US007491128B2

(12) United States Patent
Henry et al.

(10) Patent No.: US 7,491,128 B2
(45) **Date of Patent: *Feb. 17, 2009**

(54) CONVEYOR SYSTEM AND METHOD FOR WATER AMUSEMENT PARKS

(75) Inventors: Jeffery W. Henry, New Braunfels, TX (US); John Schooley, San Francisco, CA (US)

(73) Assignee: NBGS International, Inc., New Braunfels, TX (US)

( * ) Notice: Subject to any disclaimer, the term of this patent is extended or adjusted under 35 U.S.C. 154(b) by 303 days.

This patent is subject to a terminal disclaimer.

(21) Appl. No.: 10/986,720

(22) Filed: Nov. 12, 2004

(65) Prior Publication Data

US 2005/0085306 A1 Apr. 21, 2005

Related U.S. Application Data

(63) Continuation of application No. 09/952,036, filed on Sep. 11, 2001, now Pat. No. 7,285,053.

(60) Provisional application No. 60/231,801, filed on Sep. 11, 2000.

(51) Int. Cl.
*A63G 21/18* (2006.01)

(52) U.S. Cl. ..... 472/117; 472/128

(58) Field of Classification Search ..... 472/116, 472/117, 128, 129; 104/53, 69, 70
See application file for complete search history.

(56) References Cited

U.S. PATENT DOCUMENTS

| | | | |
|---|---|---|---|
| 419,860 | A | 1/1890 | Libbey |
| 435,227 | A | 8/1890 | Inglis |
| 485,624 | A | 11/1892 | Gardner |
| 536,441 | A | 3/1895 | Morris |
| 540,715 | A | 6/1895 | Butler |
| 548,256 | A | 10/1895 | Idler |

(Continued)

FOREIGN PATENT DOCUMENTS

| | | |
|---|---|---|
| BE | 543055 | 12/1955 |
| DE | 129145 | 3/1902 |
| DE | 893778 | 10/1953 |
| DE | 4243812 A1 | 6/1994 |
| EP | 1318864 | 6/2003 |

(Continued)

OTHER PUBLICATIONS

International Search Report for PCT/US01/28535 mailed Mar. 27, 2002.

(Continued)

*Primary Examiner*—Kien Nguyen
(74) *Attorney, Agent, or Firm*—Meyertons, Hood, Kivlin, Kowert & Goetzel, P.C.; Eric B. Meyertons

(57) ABSTRACT

A water transportation system and method are described, generally related to water amusement attractions and rides. Further, the disclosure generally relates to water-powered rides and to a system and method in which participants may be actively involved in a water attraction. This transportation system comprises at least two water stations and at least one water channel connecting the at least two water stations for the purpose of conveying participants between the at least two water stations. In addition, the water transportation system may include conveyor belt systems and water locks configured to convey participants from a first source of water to a second source of water which may or may not be at a different elevation.

85 Claims, 69 Drawing Sheets

U.S. PATENT DOCUMENTS

| | | | |
|---|---|---|---|
| 552,713 | A | 1/1896 | Lenox |
| 555,049 | A | 2/1896 | Ogilbe |
| 566,182 | A | 8/1896 | Jackman |
| 570,016 | A | 10/1896 | Harman |
| 572,426 | A | 12/1896 | Idler |
| 576,704 | A | 2/1897 | Urch |
| 583,121 | A | 5/1897 | Pattee |
| 604,164 | A | 5/1898 | Wilde et al. |
| 640,439 | A | 1/1900 | Boyton |
| 654,980 | A | 6/1900 | Howard |
| 664,179 | A | 12/1900 | Schofield |
| 665,765 | A | 1/1901 | Thompson |
| 689,114 | A | 12/1901 | Pape |
| 691,353 | A | 1/1902 | Carpenter et al. |
| 697,202 | A | 4/1902 | Donne |
| 697,891 | A | 4/1902 | Schrader |
| 714,717 | A | 12/1902 | LaPorte |
| 720,014 | A | 2/1903 | Folks |
| 724,040 | A | 3/1903 | Pusterla |
| 724,757 | A | 4/1903 | Symonds |
| 728,303 | A | 5/1903 | Roltair |
| 728,894 | A | 5/1903 | Folks |
| 741,964 | A | 10/1903 | Harlan |
| 743,968 | A | 11/1903 | Wilson |
| 744,880 | A | 11/1903 | Smith |
| 753,311 | A | 3/1904 | Pusterla |
| 753,449 | A | 3/1904 | Thompson |
| 754,698 | A | 3/1904 | Reed |
| 757,286 | A | 4/1904 | Du Clos |
| 760,503 | A | 5/1904 | Welsh |
| 762,566 | A | 6/1904 | Webster et al. |
| 764,675 | A | 7/1904 | Pfeiffer |
| 774,209 | A | 11/1904 | Stubbs |
| 774,274 | A | 11/1904 | Pusterla |
| 774,917 | A | 11/1904 | Maguire |
| 776,936 | A | 12/1904 | Pusterla |
| 779,464 | A | 1/1905 | Bruce |
| 783,425 | A | 2/1905 | Folks |
| 792,422 | A | 6/1905 | Kelly |
| 801,945 | A | 10/1905 | Welsh |
| 808,487 | A | 12/1905 | Stahl |
| 824,436 | A | 6/1906 | Pester |
| 828,689 | A | 8/1906 | Thompson |
| 831,149 | A | 9/1906 | Faller |
| 849,970 | A | 4/1907 | Boyton |
| 868,736 | A | 10/1907 | Washington |
| 879,283 | A | 2/1908 | Mayberry et al. |
| 883,441 | A | 3/1908 | Andrews |
| 891,388 | A | 6/1908 | Visser et al. |
| 896,940 | A | 8/1908 | Rosen |
| 904,848 | A | 11/1908 | DeVore |
| 929,972 | A | 8/1909 | M'Giehan |
| 931,863 | A | 8/1909 | Haight |
| 952,673 | A | 3/1910 | Karr |
| 1,004,174 | A | 9/1911 | Kavakos |
| 1,056,929 | A | 3/1913 | Navarro |
| 1,062,838 | A | 5/1913 | Miller |
| 1,063,949 | A | 6/1913 | Bedient |
| 1,095,965 | A | 5/1914 | Glazier |
| 1,124,950 | A | 1/1915 | Reagen et al. |
| 1,159,519 | A | 11/1915 | Menier |
| 1,167,993 | A | 1/1916 | Guzendorfer |
| 1,195,707 | A | 8/1916 | Miller |
| 1,198,749 | A | 9/1916 | Myers |
| 1,230,559 | A | 6/1917 | Burke |
| 1,249,455 | A | 12/1917 | Myers |
| 1,320,124 | A | 10/1919 | Chrul |
| 1,378,635 | A | 5/1921 | Unger |
| 1,399,469 | A | 12/1921 | Cucullu |
| 1,417,570 | A | 5/1922 | Ridgway |
| 1,440,661 | A | 1/1923 | Dickinson |
| 1,441,126 | A | 1/1923 | Sherman et al. |
| 1,448,306 | A | 3/1923 | Lezert |
| 1,497,754 | A | 6/1924 | Howard |
| 1,520,217 | A | 12/1924 | Auperl |
| 1,540,635 | A | 6/1925 | Kohl |
| 1,551,249 | A | 8/1925 | Held |
| 1,563,855 | A | 12/1925 | Held |
| 1,591,566 | A | 7/1926 | Schmidt et al. |
| 1,601,483 | A | 9/1926 | Vaszin |
| 1,606,024 | A | 11/1926 | Gorhum et al. |
| 1,606,854 | A | 11/1926 | Vaszin |
| 1,607,771 | A | 11/1926 | Miller |
| 1,609,922 | A | 12/1926 | Wiig |
| 1,648,196 | A | 11/1927 | Rohmer |
| 1,763,976 | A | 6/1930 | Lippincott |
| 1,783,268 | A | 12/1930 | Traver |
| 1,849,226 | A | 3/1932 | Erban |
| 1,859,267 | A | 5/1932 | Kurz |
| 1,893,167 | A | 1/1933 | Glagolin |
| 1,926,780 | A | 9/1933 | Lippincott |
| 2,064,035 | A | 12/1936 | Rynearson |
| 2,484,466 | A | 10/1949 | Rumler |
| 2,705,144 | A | 3/1955 | Ridgway |
| 2,738,885 | A | 3/1956 | Demaline |
| 2,888,205 | A | 5/1959 | Trucco |
| D190,127 | S | 4/1961 | Fowler |
| 2,991,726 | A | 7/1961 | Miller |
| 3,000,017 | A | 9/1961 | Skovira |
| 3,003,430 | A | 10/1961 | Hamel |
| 3,030,895 | A | 4/1962 | Hamel |
| 3,113,528 | A | 12/1963 | Morgan et al. |
| 3,114,333 | A | 12/1963 | Fowler et al. |
| 3,116,925 | A | 1/1964 | Welch |
| D204,282 | S | 4/1966 | Morgan |
| 3,390,640 | A | 7/1968 | Couttet et al. |
| 3,404,635 | A | 10/1968 | Bacon et al. |
| 3,456,943 | A | 7/1969 | Brown |
| 3,473,334 | A | 10/1969 | Dexter |
| 3,508,405 | A | 4/1970 | Koch |
| 3,534,413 | A | 10/1970 | Plasseraud |
| 3,598,402 | A | 8/1971 | Frenzl |
| 3,690,265 | A | 9/1972 | Horibata |
| D229,354 | S | 11/1973 | Morgan |
| 3,827,387 | A | 8/1974 | Morgan |
| 3,830,161 | A | 8/1974 | Bacon |
| 3,853,067 | A | 12/1974 | Bacon |
| 3,865,041 | A | 2/1975 | Bacon |
| 3,890,655 | A | 6/1975 | Mathis |
| 3,913,332 | A | 10/1975 | Forsman |
| 3,923,301 | A | 12/1975 | Myers |
| 3,930,450 | A | 1/1976 | Symons |
| 4,001,899 | A | 1/1977 | Mathis |
| 4,063,517 | A | 12/1977 | Nardozzi, Jr. |
| 4,073,722 | A | 2/1978 | Grutsch |
| 4,149,469 | A | 4/1979 | Bigler |
| 4,149,710 | A | 4/1979 | Rouchard |
| 4,175,361 | A | 11/1979 | Kumode |
| 4,194,733 | A | 3/1980 | Whitehouse, Jr. |
| 4,196,900 | A | 4/1980 | Becker et al. |
| 4,198,043 | A | 4/1980 | Timbes et al. |
| 4,205,785 | A | 6/1980 | Stanley |
| 4,221,170 | A | 9/1980 | Koudelka |
| 4,225,953 | A | 9/1980 | Simon et al. |
| 4,278,247 | A | 7/1981 | Joppe et al. |
| 4,299,171 | A | 11/1981 | Larson |
| 4,305,117 | A | 12/1981 | Evans |
| 4,337,704 | A | 7/1982 | Becker et al. |
| 4,376,404 | A | 3/1983 | Haddad |
| D269,082 | S | 5/1983 | Spieldiener |
| 4,391,201 | A | 7/1983 | Bailey |
| 4,392,434 | A | 7/1983 | Dürwald et al. |
| 4,429,867 | A | 2/1984 | Barber |
| 4,484,739 | A | 11/1984 | Kreinbihl et al. |

4,501,434 A 2/1985 Dupuis
4,516,943 A 5/1985 Spieldiener et al.
4,543,886 A 10/1985 Spieldiener et al.
4,545,574 A 10/1985 Sassak
4,545,583 A 10/1985 Pearman et al.
4,564,190 A 1/1986 Frenzl
4,683,686 A 8/1987 Ozdemir
4,696,251 A 9/1987 Spieldiener et al.
4,741,388 A 5/1988 Kuriowa
4,778,430 A 10/1988 Goldfarb et al.
4,783,861 A 11/1988 Leurent
4,792,260 A 12/1988 Sauerbier
4,797,027 A 1/1989 Combes et al.
4,805,896 A 2/1989 Moody
4,805,897 A 2/1989 Dubeta
4,817,312 A 4/1989 Fuller et al.
4,836,521 A 6/1989 Barber
4,850,896 A 7/1989 Smith et al.
4,905,987 A 3/1990 Frenzi
4,939,358 A 7/1990 Herman et al.
4,954,014 A 9/1990 Sauerbier et al.
4,960,275 A 10/1990 Magon
4,963,057 A 10/1990 Fournier
4,979,679 A 12/1990 Downs
4,984,783 A 1/1991 Fujimaki
5,011,134 A 4/1991 Langford
5,011,161 A 4/1991 Galphin
5,020,465 A 6/1991 Langford
5,022,588 A 6/1991 Haase
5,033,392 A 7/1991 Schemitsch
5,069,387 A 12/1991 Alba
5,069,443 A 12/1991 Shiratori
5,073,082 A 12/1991 Radlik
5,137,497 A 8/1992 Dubeta
5,143,107 A 9/1992 Kelley
5,152,210 A 10/1992 Chen
5,167,321 A 12/1992 Brodrick, Sr.
5,171,101 A 12/1992 Sauerbier et al.
5,183,437 A 2/1993 Millay et al.
5,194,048 A 3/1993 Briggs
5,213,547 A 5/1993 Lochtefeld
5,219,315 A 6/1993 Fuller et al.
5,224,652 A 7/1993 Kessler
5,230,662 A 7/1993 Langford
5,236,280 A 8/1993 Lochtefeld
RE34,407 E 10/1993 Frenzl
5,253,864 A 10/1993 Heege et al.
5,265,373 A 11/1993 Vollebregt
5,265,802 A 11/1993 Hobbs et al.
5,271,692 A 12/1993 Lochtefeld
5,299,964 A 4/1994 Hopkins
5,387,158 A 2/1995 Bertrand
5,393,170 A 2/1995 Lochtefeld
5,401,117 A 3/1995 Lochtefeld
5,405,294 A 4/1995 Briggs
5,421,782 A 6/1995 Lochtefeld
5,426,899 A 6/1995 Jones
5,427,574 A 6/1995 Donnelly-Weide
5,433,671 A 7/1995 Davis
5,437,463 A 8/1995 Fromm
5,439,170 A 8/1995 Dach
5,452,678 A 9/1995 Simpkins
5,453,054 A 9/1995 Langford
5,461,876 A 10/1995 Dressler
5,478,281 A 12/1995 Forton
5,482,510 A 1/1996 Ishii et al.
5,494,729 A 2/1996 Henry et al.
5,503,597 A 4/1996 Lochtefeld et al.
5,513,470 A 5/1996 Vollebregt
5,536,210 A 7/1996 Barber
5,540,622 A 7/1996 Gold et al.
5,564,859 A 10/1996 Lochtefeld
5,564,984 A 10/1996 Mirabella et al.
5,581,954 A 12/1996 Vollebregt
5,613,443 A 3/1997 Ariga et al.
5,623,986 A 4/1997 Wiggs
5,628,584 A 5/1997 Lochtefeld
5,664,910 A 9/1997 Lochtefeld et al.
5,667,445 A 9/1997 Lochtefeld
5,685,778 A 11/1997 Sheldon et al.
5,704,294 A 1/1998 Van Winkle et al.
5,716,282 A 2/1998 Ring et al.
5,732,635 A 3/1998 McKoy
5,735,748 A 4/1998 Meyers et al.
5,738,590 A 4/1998 Lochtefeld
5,761,776 A 6/1998 Vollebregt
5,766,082 A 6/1998 Lochtefeld et al.
5,779,553 A 7/1998 Langford
5,791,254 A 8/1998 Mares et al.
5,809,701 A 9/1998 Vollebregt
5,816,314 A 10/1998 Wiggs et al.
5,820,471 A 10/1998 Briggs
5,860,364 A 1/1999 McKoy
5,950,253 A 9/1999 Last
5,978,593 A 11/1999 Sexton
5,989,126 A 11/1999 Kilbert et al.
6,006,672 A 12/1999 Newfarmer et al.
6,045,449 A 4/2000 Aragona et al.
6,075,442 A 6/2000 Welch
6,115,974 A 9/2000 Milanian
6,146,282 A 11/2000 McCready et al.
6,161,771 A 12/2000 Henry
6,186,902 B1 2/2001 Briggs
6,195,851 B1 3/2001 Vollebregt et al.
6,210,287 B1 4/2001 Briggs
6,237,499 B1 5/2001 McKoy
6,261,186 B1 7/2001 Henry
6,265,977 B1 7/2001 Vega et al.
6,272,695 B1 8/2001 Brandner
6,280,342 B1 8/2001 Tod
6,336,771 B1 1/2002 Hill
6,354,955 B1 3/2002 Stuart et al.
6,362,778 B2 3/2002 Neher
6,375,578 B1 4/2002 Briggs
6,475,095 B1 11/2002 Henry
6,488,590 B2 12/2002 Katayama
6,533,191 B1 3/2003 Berger et al.
6,553,336 B1 4/2003 Johnson et al.
6,561,914 B2 5/2003 Henry
6,604,327 B1 8/2003 Reville
6,634,949 B1 10/2003 Briggs et al.
6,702,687 B1 3/2004 Henry
6,708,706 B1 3/2004 Robinson
6,758,231 B1 * 7/2004 Lochtefeld et al. ..... 137/1
6,789,608 B1 9/2004 Wiggs
6,796,908 B2 9/2004 Weston
7,004,847 B2 2/2006 Henry
7,029,400 B2 4/2006 Briggs
7,229,359 B2 6/2007 Henry et al.
7,285,053 B2 10/2007 Henry et al.
2002/0082097 A1 6/2002 Henry et al.
2003/0190967 A1 10/2003 Henry
2003/0203760 A1 10/2003 Henry et al.
2005/0034768 A1 2/2005 Henry et al.
2005/0085306 A1 4/2005 Henry et al.
2005/0090319 A1 4/2005 Henry et al.
2005/0090320 A1 4/2005 Henry et al.
2005/0090321 A1 4/2005 Henry et al.
2005/0090322 A1 4/2005 Henry et al.

FOREIGN PATENT DOCUMENTS

EP 1318864 11/2005
EP 1604712 2/2007
WO 92/03201 3/1992
WO 92/04087 3/1992

| | | |
|---|---|---|
| WO | 97/33668 | 9/1997 |
| WO | 98/45006 | 10/1998 |
| WO | 01/10184 | 2/2001 |
| WO | 02/22226 | 3/2002 |
| WO | 02/22227 | 3/2002 |
| WO | 2005/042124 | 5/2005 |
| WO | 2006/057970 | 6/2006 |
| WO | 2006/113936 | 10/2006 |
| WO | 2007/019278 | 2/2007 |
| WO | 2007/027841 | 3/2007 |
| WO | 2007/028042 | 3/2007 |
| WO | 2007/028043 | 3/2007 |
| WO | 2007/035524 | 3/2007 |
| WO | 2007/106717 | 9/2007 |

OTHER PUBLICATIONS

Written Opinion for PCT/US01/28535 mailed May 2, 2002.
Written Opinion for PCT/US01/28535 mailed Aug. 6, 2002.
International Preliminary Examination Report for PCT/US01/28535 issued Jan. 13, 2003.
Rorres, C. "The Turn of the Screw: Optimal Design of an Archimedes Screw" J. of Hydraulic Engineering, Jan. 2000, vol. 126, No. 1, pp. 72-80.
Office Action for U.S. Appl. No. 10/693,654 mailed on Dec. 7, 2004.
Office Action for U.S. Appl. No. 10/693,654 mailed on Jun. 10, 2005.
International Search Report for PCT/US01/28542 mailed Mar. 27, 2002.
Written Opinion for PCT/US01/28542 mailed May 2, 2002.
Written Opinion for PCT/US01/28542 issued Aug. 5, 2002.
International Preliminary Examination Report for PCT/US01/28542 issued Dec. 2, 2002.
Written Opinion for 01 970 881.7—2307 mailed Apr. 13, 2004.
Written Opinion for 01 970 881.7—2307 mailed Oct. 21, 2004.
Engineering drawing (as well as photographs of the finished product) for the Silver Dollar City water slide in Branson, Missouri, the date is unknown, however there is a 1986 copyright on the engineering drawing.
European Search Report for EP 05019093.3 mailed Oct. 28, 2005.
Office Action for U.S. Appl. No. 09/952,036 mailed on Feb. 9, 2006.
Co-Pending U.S. Appl. No. 10/997,791 entitled, "Rollable Carrier Ride" to Henry filed Nov. 24, 2004; available in private PAIR.
Co-Pending U.S. Appl. No. 10/997,790 entitled, "Water Amusement Park Conveyors" to Henry filed Nov. 24, 2004; available in private PAIR.
Co-Pending U.S. Appl. No. 11/244,866 entitled, "Water Amusement Park Multiple Path Conveyors" to Henry filed Oct. 6, 2005; available in private PAIR.
Co-Pending U.S. Appl. No. 11/244,869 entitled, "Water Amusement Park Conveyor Roller Belts" to Henry filed Oct. 6, 2005; available in private PAIR.
Co-Pending U.S. Appl. No. 11/215,357 entitled, "Methods and Systems for Amusement Park Conveyors" to Henry et al. filed Aug. 30, 2005; available in private PAIR.
Co-Pending U.S. Appl. No. 11/215,736 entitled, "Water Amusement Park Conveyor Barriers" to Henry et al. filed Aug. 30, 2005; available in private PAIR.
Co-Pending U.S. Appl. No. 11/215,747 entitled, "Adjusting Participant Flow Rate in Water Amusement Parks" to Henry et al. filed Aug. 30, 2005; available in private PAIR.
Co-Pending U.S. Appl. No. 11/215,795 entitled, "Modular Water Amusement Park Conveyors" to Henry et al. filed Aug. 30, 2005; available in private PAIR.
Co-Pending U.S. Appl. No. 11/215,351 entitled, "Water Amusement Park Conveyor Support Elements" to Henry et al. filed Aug.30, 2005; available in private PAIR.
Co-Pending U.S. Appl. No. 11/244,864 entitled, "Water Amusement Park Water Channel Flow System" to Henry et al. filed Oct. 6, 2005; available in private PAIR.
Co-Pending U.S. Appl. No. 11/244,872 entitled, "Water Amusement Park Water Channel and Adjustable Flow Controller" to Henry et al. filed Oct. 6, 2005; available in private PAIR.
Co-Pending U.S. Appl. No. 11/218,330 entitled, "Methods and Systems for Amusement Park Conveyor Belt Systems" to Henry et al. filed Sep. 1, 2005; available in private PAIR.
Co-Pending U.S. Appl. No. 11/283,503 entitled, "Methods and Systems for Water Amusement Conveyor" to Henry et al. filed Nov. 18, 2005; available in private PAIR.
Co-Pending U.S. Appl. No. 11/407,862 entitled, "Composite Tree" to Henry et al. filed Apr. 20, 2006; available in private PAIR.
Co-Pending U.S. Appl. No. 11/407,861 entitled, "Tree With Elevated Structure" to Henry et al. filed Apr. 20, 2006; available in private PAIR.
Co-Pending U.S. Appl. No. 11/407,875 entitled, "Water Amusement System With Elevated Structure" to Henry et al. filed Apr 20, 2006; available in private PAIR.
Co-Pending U.S. Appl. No. 11/407,874 entitled, "Thematic Tree System" to Henry et al. filed Apr. 20, 2006; available in private PAIR.
Co-Pending U.S. Appl. No. 11/407,886 entitled, "Water Amusement System With Trees" to Henry et al. filed Apr. 20, 2006; available in private PAIR.
Co-Pending U.S. Appl. No. 11/407,845 entitled, "Lift Apparatus for Base-Mounted Plant" to Henry et al. filed Apr. 20, 2006; available in private PAIR.
Co-Pending U.S. Appl. No. 11/407,885 entitled, "Tree With Covering Apparatus" to Henry et al. filed Apr. 20, 2006; available in private PAIR.
Co-Pending U.S. Appl. No. 11/512,709 entitled, "Methods and Systems for Self-Contained Floating Marine Parks" to Henry et al. filed Aug. 30, 2006; available in private PAIR.
Co-Pending U.S. Appl. No. 11/513,314 entitled, "Methods and Systems for Active Filtration of Portions of Self-Contained Floating Marine Parks" to Henry et al. filed Aug. 30, 2006; available in private PAIR.
Co-Pending U.S. Appl. No. 11/11/512,708 entitled, "Water Amusement System and Method Including a Self-Contained Floating Marine Park" to Henry et al. filed Aug. 30, 2006; available in private PAIR.
Co-Pending U.S. Appl. No. 11/513,315 entitled, "Methods and Systems for Positionable Screen for Self-Contained Floating Marine Parks" to Henry et al. filed Aug. 30, 2006; available in private PAIR.
Co-Pending U.S. Appl. No. 11/513,338 entitled, "Methods and Systems for Thermal Control Systems for Self-Contained Floating Marine Parks" to Henry et al. filed Aug. 30, 2006; available in private PAIR.
Co-Pending U.S. Appl. No. 11/512,737 entitled, "Methods and Systems for Modular Self-Contained Floating Marine Parks" to Henry et al. filed Aug. 30, 2006; available in private PAIR.
Co-Pending U.S. Appl. No. 11/512,713 entitled, "Water Circuit Interactive Games, Exercise, and Gambling" to Henry et al. filed Aug. 30, 2006; available in private PAIR.
Co-Pending U.S. Appl. No. 11/512,710 entitled, "Amusement Water Rides Involving Exercise Circuit" to Henry et al. filed Aug. 30, 2006; available in private PAIR.
Co-Pending U.S. Appl. No. 11/522,056 entitled, "Amusement Water Rides Involving Games of Chance" to Henry et al. filed Sep. 15, 2006; available in private PAIR.
Co-Pending U.S. Appl. No. 11/375,361 entitled, "Method and System of Positionable Covers for Water Amusement Parks" to Henry et al. filed Mar. 14, 2006; available in private PAIR.
Co-Pending U.S. Patent Application No. Unknown entitled, "Continuous Water Ride Method and System for Water Amusement Parks" to Henry et al. filed Dec. 8, 2006; available in private PAIR.
AA38—Exhibits related to the "Gravity Groove" slide (Sep. 1995).
AA41—Exhibits related to the "Mountain Slidewinder" ride.
AA51—International Search Report and Written Opinion for PCT/US06/15503 mailed Jul. 6, 2007.
AA52—International Search Report and Written Opinion for PCT/US06/34264 mailed Jul. 24, 2007.

* cited by examiner

CONVEYOR SYSTEM AND METHOD FOR WATER AMUSEMENT PARKS

PRIORITY CLAIM

This application is a continuation of U.S. patent application Ser. No. 09/952,036 entitled "Water Amusement System and Method" filed on Sep. 11, 2001, now U.S. Pat. No. 7,285,053 which claims priority to U.S. Provisional Patent Application Ser. No. 60/231,801 Sep. 11, 2000 entitled "Water Amusement System and Method" the disclosure of which is hereby incorporated by reference.

BACKGROUND OF THE INVENTION

1. Field of the Invention

The present disclosure generally relates to water amusement attractions and rides. More particularly, the disclosure generally relates to a system and method for a water transportation system. Further, the disclosure generally relates to water-powered rides and to a system and method in which participants may be actively involved in a water attraction.

2. Description of the Relevant Art

The 80's decade has witnessed phenomenal growth in the participatory family water recreation facility, i.e., the waterpark, and in water oriented ride attractions in the traditional themed amusement parks. The main current genre of water ride attractions, e.g., waterslides, river rapid rides, and log flumes, and others, require participants to walk or be mechanically lifted to a high point, wherein, gravity enables water, rider(s), and riding vehicle (if appropriate) to slide down a chute or incline to a lower elevation splash pool, whereafter the cycle repeats. Some rides can move riders uphill and downhill but for efficiency and performance reasons these rides also generally start on an elevated tower and generally require walking up steps to reach the start of the ride.

Generally speaking, the traditional downhill water rides are short in duration (normally measured in seconds of ride time) and have limited throughput capacity. The combination of these two factors quickly leads to a situation in which patrons of the parks typically have long queue line waits of up to two or three hours for a ride that, although exciting, lasts only a few seconds. Additional problems like hot and sunny weather, wet patrons, and other difficulties combine to create a very poor overall customer feeling of satisfaction or perceived entertainment value in the waterpark experience. Poor entertainment value in waterparks as well as other amusement parks is rated as the biggest problem of the waterpark industry and is substantially contributing to the failure of many waterparks and threatens the entire industry.

Additionally, none of the typical downhill waterpark rides is specifically designed to transport guests between rides. In large amusement parks transportation between rides or areas of the park may be provided by a train or monorail system, or guests are left to walk from ride to ride or area to area. These forms of transportation have relatively minor entertainment value and are passive in nature in that they have little if any active guest-controlled functions such as choice of pathway, speed of riders or rider activity besides sightseeing from the vehicle. They are also generally unsuitable for waterparks because of their high installation and operating costs and have poor ambience within the parks. These types of transportation are also unsuitable for waterpark guests who, because of the large amount of time spent in the water, are often wet and want to be more active because of the combination of high ambient temperatures in summertime parks and the normal heat loss due to water immersion and evaporative cooling. Water helps cool guests and encourages a higher level of physical activity. Guests also want to stay in the water for fun. Waterparks are designed around the original experience of a swimming hole combined with the new sport of river rafting or tubing. The preferred feeling is one of natural ambience and organic experience. A good river ride combines calm areas and excitement areas like rapids, whirlpools, and beaches. Mechanical transportation systems do not fit in well with these types of rides. There exists a need in waterparks for a means of transportation through the park and between the rides.

For water rides that involve the use of a floatation device (e.g., an inner tube or floating board) the walk back to the start of a ride may be particularly arduous since the rider must usually carry the floatation device from the exit of the ride back to the start of the ride. Floatation devices could be transported from the exit to the entrance of the ride using mechanical transportation devices, but these devices are expensive to purchase and operate. Both of these processes reduce guest enjoyment, cause excess wear and tear on the floatation devices, contributes to guest injuries, and makes it impossible for some guests to access the rides. Also, a park that includes many different non-integrated rides may require guests to use different floatation devices for different rides, which makes it difficult for the park operators to provide the guests with a general purpose floatation device. It is advantageous to standardize riding vehicles for rides as much as possible.

Almost all water park rides require substantial waiting periods in a queue line due to the large number of participants at the park. This waiting period is typically incorporated into the walk from the bottom of the ride back to the top, and can measure hours in length, while the ride itself lasts a few short minutes, if not less than a minute. A series of corrals are typically used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, all of which contribute to physical discomfort for the guest and lowered guest satisfaction. Additionally, these queue lines are difficult if not impossible for disabled guests to negotiate.

Typically waterparks are quite large in area. Typically guests must enter at one area and pass through a changing room area upon entering the park. Rides and picnic areas located in areas distant to the entry area are often underused in relation to rides and areas located near the entry area. More popular rides are overly filled with guests waiting in queue lines for entry onto them. This leads to conditions of overcrowding in areas of the park which leads to guest dissatisfaction and general reduction of optimal guest dispersal throughout the park. The lack of an efficient transportation system between rides accentuates this problem in waterparks.

SUMMARY OF THE INVENTION

Transportainment

For the reasons stated above and more, it is desirable to create a natural and exciting water transportation system to transport participants between rides as well as between parks that will interconnect many of the presently diverse and stand-alone water park rides. This system would greatly reduce or eliminate the disadvantages stated above. It would relieve the riders from the burden of carrying their floatation devices up to the start of a water ride. It would also allow the riders to stay in the water, thus keeping the riders cool while they are transported to the start of the ride. It would also be used to transport guests from one end of a waterpark to the other, or between rides and past rides and areas of high guest density, or between waterparks, or between guest facilities such as hotels, restaurants, and shopping centers. The transportation system would itself be a main attraction with exciting water and situational effects while seamlessly incorporating into itself other specialized or traditional water rides and events. The system, though referred to herein as a transportation system, would be an entertaining and enjoyable part of the waterpark experience.

In one embodiment, a water transportation system is provided for solving many of the problems associated with waterparks as well as amusement parks in general. The system includes and uses elements of existing water ride technology as well as new elements that provide solutions to the problems that have prevented the implementation of this kind of system in the past. This water-based ride/transportation system combines the concepts of a ride providing transportation, sport, and entertainment. Unlike presently existing amusement park internal transportation rides like trains and monorails, the invention connects the various water amusement rides to form an integrated water park ride/transportation system that will allow guests to spend a far greater amount of their time at the park in the water (or on the floatation device) than is presently possible. It will also allow guests to choose their destinations and ride experiences and allows and encourages more guest activity during the ride.

Much of the increased time in the water is due to the elimination of the necessity for guests to spend a large amount of time standing in queue lines waiting for rides, as the transportation system would be coupled with the ride so that the guest may transfer directly from the system to the ride without leaving the water. The system also allows guests to easily access remote areas of the park normally under utilized, which will act to increase park capacity; it will allow guests to self-regulate guest densities at various facilities within the system by making it easier and more enjoyable to bypass a high density area and travel to a low density area. It will also allow disabled or physically disadvantaged guests to enjoy multiple and extended rides with one floatation device and one entry to and exit from the system. It greatly reduces the amount of required walking by wet guests and reduces the likelihood of slip-and-fall type injuries caused by running guests. It reduces reliance on multiple floatation devices for separate rides and reduces wear and tear on the floatation devices by reducing or eliminating the need to drag them to and from individual rides, and allows park operators to provide guests with a single floatation device for use throughout the park.

The system may also be used to connect guest rooms of resort accommodations near the water park to the park so that guests may enter the system from a point near their rooms and be transported to and from the water park. Additionally, this configuration will serve to: entertain guests traveling to the park, increase the capacity of the park, allow gating of visitors at remote entry points, reduce parking space requirements at the park, allow increased and more convenient access to the guest rooms needed by water park guests for changing clothes, and increase the attractiveness of resort rooms to guests due to increased convenience and the novelty of the system. The system may additionally be used to transport guests to and from restaurant, shopping, and other entertainment facilities inside and outside the park.

In one embodiment, the water transportation system is composed of at least two channels. A channel is herein defined to be any water-based system for transporting participants from one point to another. The channels may be configured to convey participants by the use of water flowing through the channel. The channel may be configured to transfer the participants using a flowing stream of water. Participants may be floating in the water (with or without a floatation device) within the channel. Alternatively, the participants may be sliding along a polished surface of the channel using the inputted water to reduce the friction between the surface and the participant. The channels may be coupled to at least two stations. Each station may be a water park, water ride, lodging facility, body of water (natural or unnatural), a transportation hub (e.g., monorail, bus, train station), or amusement park. The channels may couple at least two of the stations to each other. One of the channels is configured to transport participants between the stations in a first direction. One of the other channels may be configured to transfer participants between stations in a second direction, opposite to the first direction. In this manner the participants may be transferred between stations using water rather than more conventional means.

In another embodiment, a water transportation system may be an intra-station system as opposed to the inter-station system described above. For example, a station may include two or more attractions. At least one channel may be coupled to the attractions to allow participants to be transported to the attractions within the station. The channel is configured to convey participants via water between the various attractions. One example of such a system is a water amusement park. The water amusement park may include a variety of water rides and/or water attractions. At least one channel may be coupled to some or all of the water rides and/or attractions to allow participants to be transferred to the water rides and/or attractions while remaining in water. The channel may be configured to transfer the participants using a flowing stream of water. Participants may be floating in the water (with or without a floatation device) within the channel. Alternatively, the participants may be sliding along a polished surface using the inputted water to reduce the friction between the surface and the participant. In some embodiments, the channel may be configured to convey a person from the exit point of one or more of the water rides to the entry point of one or more of the water rides.

One unit in either type of water transportation system may be a horizontal hydraulic head channel. The horizontal channel may have a first end and a second end and be configured to contain a sufficient amount of water to allow a person or floatation device to float. The channel may also include a first conduit at the first end and a second conduit at the second end. The riders may be carried (typically but not exclusively on inflatable tubes and rafts) by a current of water flowing in the channel produced by introducing input water into the channel through the first conduit at the first end and removing discharge water from the channel through the second conduit at the second end. The water (along with the rider and floatation device) flows from the first conduit at the first end into the channel and along the channel down the hydraulic gradient to the second end and out the channel through the second conduit without further addition of energy into the system by means such as elevation losses or injection of additional energized water.

The horizontal hydraulic head channels may be coupled end to end to transport riders along long distances. The channels may be coupled to downhill sloped channels. The sloped channels, in this configuration, may act as the water removal point of the preceding horizontal channel and as the water input source of the subsequent horizontal channel. In another configuration, horizontal channels of different elevations may be coupled to create a waterfall effect; a series of channels of differing elevations may be coupled to create a waterfall stairway effect. In this configuration, the removal point of one channel may function as the input source of the subsequent channel. The channels may also be coupled to mechanical lifting systems; riders may also move from section to section by exiting the discharge end of one section, entering and being transported by the mechanical lifting system to the input end of the subsequent section, and entering the input end of the subsequent section.

Along with end-to-end coupling, a channel end may be coupled anywhere along the length of another channel, or adjoining lengths may be coupled. The transfer of riders and water between channels coupled in both of these configurations may be accomplished in a similar manner as the transfer for channels coupled end to end.

The horizontal channel device may allow transportation of water and riders through relatively large distances without the need for an elevation decrease to provide motive power to the water or rider. The channel may be configured to allow the participants to traverse varying types of terrain. A floating horizontal hydraulic head channel is provided for transporting riders across bodies of water. Bodies of water include natural and unnatural bodies of water. As used herein bodies of water include lakes, rivers, creeks, oceans, seas, bays, canals, swimming pools, receiving pools positioned at the end of a water ride, other water channels, artificial rivers, etc. In one embodiment, a channel that includes floatation devices designed to keep the top of the channel above the level of the water of the body of water may be used to transport participants across a body of water. Because of the difficulties of producing an angled channel across a large body of water, the channel may be configured to use one or more horizontal hydraulic head channels. This may also allow the water disposed within the channel to be kept separate from the body of water. An enclosed channel (hereafter referred to as a tube) may be provided for transporting water and riders underground, underwater, or at some elevated height above ground. The tube will have various additional requirements depending on intended use, such as enough structural support to keep the tube from collapsing if underground or underwater, watertight construction if underwater, and a retractable or permanent cover for protection from the elements if elevated.

A thick, low velocity, sheet flow lift station comprising an adjustable gate with a sloped upstream face along with a source of input water may also be used provided to transfer riders or floatation devices from one channel section to the next. The station operates by partially or wholly withdrawing oncoming channel water and then reinjecting the water back into the same or an adjacent channel in such a way that the rider and the channel water are propelled to a higher level in a continuous floating motion on the surface of the water through the transfer from lower velocity to higher velocity. This method may be used in main channels to replace or supplement conveyor systems, lock systems, floating queue lines (all described herein), and for entry into attached water rides. In one embodiment, a nozzle to direct thick flow high volume low velocity water may be used to float riders and some of the oncoming water upward to a higher level. An included gate may be used to slow down and thicken the water for a higher level float away. Water Ferris wheels may also be used to transport riders from one channel section to the next.

In addition to transporting riders along horizontal distances, the system may be able to transport riders to locations of differing elevations, i.e., from a horizontal channel to a subsequent horizontal channel of a different elevation. Part of the present invention includes a component for maintaining the kinetic energy of riders and/or floatation devices from a lower to a higher elevation or from a higher to a lower elevation while increasing or decreasing the potential energy as needed to produce the desired elevation change. This system may include a conveyor belt system positioned to allow riders to naturally float up or swim up onto the conveyor and be carried up and deposited at a higher level.

The conveyor belt system may also be used to take riders and vehicles out of the water flow at stations requiring entry and/or exit from the channel. Riders and vehicles float to and are carried up on a moving conveyor on which riders may exit the vehicles. New riders may enter the vehicles and be transported into the channel or station at a desired location and velocity. The conveyor may extend below the surface of the water so as to more easily allow riders to naturally float or swim up onto the conveyor. Extending the conveyor below the surface of the water may allow for a smoother entry into the water when exiting the conveyor belt. Typically the conveyor belt takes riders and vehicles from a lower elevation to a higher elevation, however it may be important to first transport the riders to an elevation higher than the elevation of their final destination. Upon reaching this apex the riders then may be transported down to the elevation of their final destination on a water slide, rollers, or on a continuation of the original conveyor that transported them to the apex. This serves the purpose of using gravity to push the rider off and away from the belt, slide, or rollers into the channel or body of water. The endpoint of a conveyor may be near a first end of a horizontal hydraulic head channel wherein input water is introduced through a first conduit. This current of flowing may move the riders away from the conveyor endpoint in a quick and orderly fashion so as not to cause increase in rider density at the conveyor endpoint. Further, moving the riders quickly away from the conveyor endpoint may act as a safety feature reducing the risk of riders becoming entangled in any part of the conveyor belt or its mechanisms. A deflector plate may also extend from one or more ends of the conveyor and may extend to the bottom of the channel. When the deflector plate extends at an angle away from the conveyor it may help to guide the riders up onto the conveyor belt as well as inhibit access to the rotating rollers underneath the conveyor. These conveyors may be designed to lift riders from one level to a higher one, or may be designed to lift riders and vehicles out of the water, onto a horizontal moving platform and then return the vehicle with a new rider to the water.

The conveyor belt speed may also be adjusted in accordance with several variables. The belt speed may be adjusted depending on the rider density; for example, the speed may be increased when rider density is high to reduce rider waiting time. The speed of the belt may be varied to match the velocity of the water, reducing changes in velocity experienced by the rider moving from one medium to another (for example from a current of water to a conveyor belt). Decreasing changes in velocity is an important safety consideration due to the fact extreme changes in velocity may cause a rider to become unbalanced. Conveyor belt speed may be adjusted so riders are discharged at predetermined intervals, which may be important where riders are launched from a conveyor to a water ride that requires safety intervals between the riders.

Several safety concerns should be addressed in connection with the conveyor system. The actual belt of the system should be made of a material and designed to provide good traction to riders and vehicles without proving uncomfortable to the riders touch. The angle at which the conveyor is disposed is an important safety consideration and should be small enough so as not to cause the riders to become unbalanced or to slide in an uncontrolled manner along the conveyor belt. Detection devices or sensors for safety purposes may also be installed at various points along the conveyor belt system. These detection devices may be variously designed to determine if any rider on the conveyor is standing or otherwise violating safety parameters. Gates may also be installed at the top or bottom of a conveyor, arranged mechanically or with sensors wherein the conveyor stops when the rider collides with the gate so there is no danger of the rider being caught in and pulled under the conveyor. Runners may cover the outside edges of the conveyor belt covering the space between the conveyor and the outside wall of the conveyor so that no part of a rider may be caught in this space. All hardware (electrical, mechanical, and otherwise) should be able to withstand exposure to water, sunlight, and various chemicals associated with water treatment (including chlorine or fluorine) as well as common chemicals associated with the riders themselves (such as the various components making up sunscreen or cosmetics).

Various sensors may also be installed along the conveyor belt system to monitor the number of people using the system in addition to the their density at various points along the system. Sensors may also monitor the actual conveyor belt system itself for breakdowns or other problems. Problems include, but are not limited to, the conveyor belt not moving when it should be or sections broken or in need of repair in the belt itself. All of this information may be transferred to various central or local control stations where it may be monitored so adjustments may be made to improve efficiency of transportation of the riders. Some or all of these adjustments may be automated and controlled by a programmable logic control system.

Various embodiments of the conveyor lift station include widths allowing only one or several riders side by side to ride on the conveyor according to ride and capacity requirements. The conveyor may also include entry and exit lanes in the incoming and outgoing stream so as to better position riders onto the conveyor belt and into the outgoing stream.

Another component for transporting riders to different elevations is a water lock system. These systems may be used to increase elevation, decrease elevation, or allow riders to change channels. In one embodiment, the first body of water may be a body of water having an elevation below the second body of water. In an embodiment, the water lock system includes a chamber for holding water coupled to the first body of water and the second body of water. A chamber is herein defined as an at least partially enclosed space. The chamber includes at least one outer wall, or a series of outer walls that together define the outer perimeter of the chamber. The chamber may also be at least partially defined by natural features such as the side of a hill or mountain. The walls may be substantially watertight. The outer wall of the chamber, in one embodiment, extends below an upper surface of the first body of water and above the upper surface of the second body of water. The chamber may have a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

A first movable member may be formed in the outer wall of the chamber. The first movable member may be positioned to allow participants and water to move between the first body of water and the chamber when the first movable member is open during use. A second movable member may be formed in the wall of the chamber. The second movable member may be positioned to allow participants and water to move between the second body of water and the chamber when the second movable member is open during use. The second movable member may be formed in the wall at an elevation that differs from that of the first movable member.

In one embodiment, the first and second movable members may be configured to swing away from the chamber wall when moving from a closed position to an open position during use. In another embodiment, the first and second movable members may be configured to move vertically into a portion of the wall when moving from a closed position to an open position. In another embodiment, the first and second movable members may be configured to move horizontally along a portion of the wall when moving from a closed position to an open position.

A bottom member may also be positioned within the chamber. The bottom member may be configured to float below the upper surface of water within the chamber during use. The bottom member may be configured to rise when the water in the chamber rises during use. In one embodiment, the bottom member is substantially water permeable such that water in the chamber moves freely through the bottom member as the bottom member is moved within the chamber during use. The bottom member may be configured to remain at a substantially constant distance from the upper surface of the water in the chamber during use. The bottom member may include a wall extending from the bottom member to a position above the upper surface of the water. The wall may be configured to prevent participants from moving to a position below the bottom member. A floatation member may be positioned upon the wall at a location proximate the upper surface of the water. A ratcheted locking system may couple the bottom member to the inner surface of the chamber wall. The ratcheted locking system may be configured to inhibit the bottom member from sinking when water is suddenly released from the chamber. The ratcheted locking system may also include a motor to allow the bottom member to be moved vertically within the chamber. There may be one or more bottom members positioned within a single chamber. The bottom member may incorporate water jets to direct and/or propel participants in or out of the chamber.

The lock system may also include a substantially vertical first ladder coupled to the wall of the bottom member and a substantially vertical second ladder coupled to a wall of the chamber. The first and second ladders, in one embodiment, are positioned such that the ladders remain substantially aligned as the bottom member moves vertically within the chamber. The second ladder may extend to the top of the outer wall of the chamber. The ladders may allow participants to exit from the chamber if the lock system is not working properly.

In one embodiment, water may be transferred into and out of the water lock system via the movable members formed within the chamber wall. Opening of the movable members may allow water to flow into the chamber from the upper body of water or out of the chamber into the lower body of water.

In another embodiment, a first conduit may be coupled to the chamber for conducting water to the chamber during use. A first water control system may be positioned along the first conduit. The first water control system may be configured to control the flow of water through the first conduit during use. In one embodiment, the water control system may include a valve. The valve may be used to control the flow of water from a water source into the chamber. In one embodiment, the water source may be the first or second bodies of water. In another embodiment, the water control system includes a valve and a pump. The valve may be configured to inhibit flow of water through the conduit during use. The pump may be configured to pump water through the conduit during use.

In one embodiment, the first conduit may be coupled to the second body of water. In this embodiment, the first conduit may be configured to transfer water between the second body of water and the chamber during use. In another embodiment, the first conduit may be coupled to the first body of water. In this embodiment the first conduit may be configured to transfer water between the first body of water and the chamber during use. The first water control system may include a pump for pumping water from the first body of water to the chamber.

The lock system may also include a second conduit and a second water control system. The second conduit may be preferably coupled to the chamber for conducting water out of the chamber during use. The second water control system may be positioned along the second conduit to control flow of water through the second conduit during use.

The lock system may also include a controller for operating the system. The automatic controller may be a computer, programmable logic controller, or any other control device. The controller may be coupled to the first movable member, the second movable member, and the first water control system. The controller may allow manual, semi-automatic, or automatic control of the lock system. The automatic controller may be connected to sensors positioned to detect if people are in the lock or not, blocking the gate, or if the gate is fully opened or fully closed or the water levels within the chambers.

In one embodiment, the participants may be floating in water during the entire transfer from the lower body of water to the upper body of water. The participants may be swimming in the water or floating upon a floatation device. Preferably, the participants are floating on an inner tube, a floatation board, raft, or other floatation devices used by riders on water rides.

In another embodiment, the lock system may include multiple movable members formed within the outer wall of the chamber. These movable members may lead to multiple bodies of water coupled to the chamber. The additional movable members may be formed at the same elevational level or at different elevations.

In a further embodiment, the first and second movable members may be configured to move vertically into a portion of the wall when moving from a closed position to an open position. The members may be substantially hollow, and have holes in the bottom configured to allow fluid flow in and out of the member. In an open position, the hollow member may be substantially filled with water. To move the member to a closed position, compressed air from a compressed air source may be introduced into the top of the hollow member through a valve, forcing water out of the holes in the bottom of the member. As the water is forced out and air enters the member, the buoyancy of the member may increase and the member may float up until it reaches a closed position. In this closed position, the holes in the bottom of the member may remain submerged, thereby preventing the air from escaping through the holes. To move the member back to an open position, a valve in the top of the member may be opened, allowing the compressed air to escape and allowing water to enter through the holes in the bottom. As water enters and compressed air escapes, the gate may lose buoyancy and sink until it reaches the open position, when the air valve may be closed again.

An advantage to the pneumatic gate system may be that water may be easily transferred from a higher lock to a lower one over the top of the gate. This system greatly simplifies and reduces the cost of valves and pumping systems between lock levels. The water that progressively spills over the top of the gate as it is lowered is at low, near-surface pressures in contrast to water pouring forth at various pressures in a swinging gate lock system. This advantage makes it feasible to eliminate some of the valves and piping required to move water from a higher lock to a lower lock.

In another embodiment a pneumatic or hydraulic cylinder may be used to vertically move a gate system. An advantage to this system may be that the operator has much more control over the gate than with a gate system operating on a principle of increasing and decreasing the buoyancy. More control of the gate system may allow the gates to be operated in concert with one another, as well as increasing the safety associated with the system. The gate may be essentially hollow and filled with air or other floatation material such as Styrofoam, decreasing the power needed to move the gate.

While described as having only a single chamber coupled to two bodies of water, it should be understood that multiple chambers may be interlocked to couple two or more bodies of water. By using multiple chambers, a series of smaller chambers may be built rather than a single large chamber. In some situations it may be easier to build a series of chambers rather than a single chamber. For example, use of a series of smaller chambers may better match the slope of an existing hill. Another example is to reduce water depths and pressures operating in each chamber so as to improve safety and reduce structural considerations resulting from increased water pressure differentials. Another example is the use of multiple chambers to increase aesthetics or ride excitement. Another is the use of multiple chambers to increase overall speed and rider throughput of the lock.

The participants may be transferred from the first body of water to the second body of water by entering the chamber and altering the level of water within the chamber. The first movable member, coupled to the first body of water is opened to allow the participants to move into the chamber. The participants may propel themselves by pulling themselves along by use of rope or other accessible handles or be pushed directly with water jets or be propelled by a current moving from the lower body of water toward the chamber. The current may be generated using water jets positioned along the inner surface of the chamber. Alternatively, a current may be generated by altering the level of water in the first body of water. For example, by raising the level of water in the first body of water a flow of water from the first body of water into the chamber may occur.

After the participants have entered the chamber, the first movable member is closed and the level of water in the chamber is altered. The level may be raised or lowered, depending on the elevation level of the second body of water with respect to the first body of water. If the second body of water is higher than the first body of water, the water level is raised. If the first body of water is at a higher elevation than the second body of water, the water level is lowered. As the water level in the chamber is altered, the participants are moved to a level commensurate with the upper surface of the second body of water. While the water level is altered within the chamber, the participants remain floating proximate the surface of the water. A bottom member preferably moves with the upper surface of the water in the chamber to maintain a relatively constant and safe depth of water beneath the riders. The water level in the chamber, in one embodiment, is altered until the water level in the chamber is substantially equal the water level of the second body of water. The second movable member may now be opened, allowing the participants to move from the chamber to the second body of water. In one embodiment, a current may be generated by filling the chamber with additional water after the level of water in the chamber is substantially equal to the level of water outside the chamber. As the water is pumped in the chamber, the resulting increase in water volume within the chamber may cause a current to be formed flowing from the chamber to the body of water. When the movable member is open, the formed current may be used to propel the participants from the chamber to a body of water. Thus, the participants may be transferred from a first body of water to a second body of water without having to leave the water. The participants are thus relieved of having to walk up a hill. The participants may also be relieved from carrying any floatation devices necessary for the waterpark rides.

In one embodiment, the water lock system may be positioned adjacent to one or more water rides. The water rides carry the participants from upper bodies of water to lower bodies of water. These upper and lower bodies of water may be coupled to the centrally disposed water lock system to carry the participants from the lower bodies of water to the upper bodies of water. In this manner, the participants may be able to remain in water during their use of multiple water rides.

The water lock system concept may be adapted for use in confined areas. A limited amount of land in some parks will require that a lock system be as compact as possible. A high lift lock system with a much smaller space requirement is provided. This system may provide elevation gains of up to about 20 feet with only a single lock, as opposed to the low lift lock system that may require 4 or 5 chambers for the same elevation gain. This system may consist of a lower body of water, an upper body of water, and a vertically sliding lock tube. The lock tube may be configured to slide below the surface of the lower body of water. Participants may float over the tube. The tube may the slide upward to the upper body of water as water is pumped into the tube. The participants, located within the tube, may be lifted to the upper body of water as water is pumped into the tube.

The tube may include a cap to prevent participants from exiting the top of the tube before reaching the upper body of water. In addition, the system may be configured to pump water into the tube such that the level of the water in the tube remains several feet below the top of the tube as the tube slides upward. This configuration may also act to prevent participants from exiting the top of the tube until it has reached the upper body of water. Also, the tube may be equipped with the basket and ratchet features described above.

In another embodiment, the tube may be stationary, and extend from the lower body of water to the upper body of water. There may be a movable member in the wall of the tube at the level of the lower body of water. Participants may enter the tube through the movable member. When the participants have entered the tube, the movable member may close and water may be pumped into the tube. The participants may be lifted to the top of the tube as water is pumped into the tube. There may be another movable member in the wall of the tube at the level of the upper body of water. The participants may be able to exit the tube to the upper body of water via this movable member. The tube may be configured with the cap, basket, and ratchet features described above.

High velocity flow emitting nozzles may also be used for elevational changes, as well as conventional pool-to-pool tube chutes characterized by moderate volumes of water flowing down inclined channels and downhill tube chutes characterized by lower water lines traveling down generally fiberglass flumes, and "lazy rivers," rivers of constant water line and zero bottom slope with movement of water by injection of high energy water.

Also provided, as part of the invention, is a floating queue line system for positioning riders in an orderly fashion and delivering them to the start of a ride at a desired time. In one embodiment, this system may include a channel (horizontal or otherwise) coupled to a ride on one end and a body of water on the other end. The body of water may include receiving pools from water rides or transportation channels as previously described. It should be noted, however, that any of the previously described bodies of water may be coupled to the water ride by the floating queue line system. Alternatively, a floating queue line system may be used to control the flow of participants into the water transportation system from a dry position within a station.

In use, riders desiring to participate on a water ride may leave the body of water and enter the queue channel. The queue channel may include pump inlets and outlets similar to those in a horizontal channel but configured to operate intermittently to propel riders along the channel, or the inlet and outlet may be used solely to keep a desired amount of water in the channel. In the latter case, the channel may be configured with high velocity low volume jets that operate intermittently to deliver riders to the end of the channel at the desired time.

In one embodiment the water moves riders along the floating queue channel down a hydraulic gradient or bottom slope gradient. The hydraulic gradient may be produced by outflowing the water over a weir at one end of the queue after the rider enters the ride to which the queue line delivers them, or by out-flowing the water down a bottom slope that starts after the point that the rider enters the ride. In another embodiment the water moves through the queue channel by means of a sloping floor. The water from the outflow of the queue line channel in any method can reenter the main channel, another ride or water feature/s, or return to the system sump. Preferably the water level and width of the queue channel are minimized for water depth safety, rider control and water velocity. These factors combined deliver the riders to the ride in an orderly and safe fashion, at the preferred speed, with minimal water volume usage. The preferred water depth, channel width and velocity would be set by adjustable parameters depending on the type of riding vehicle, rider comfort and safety, and water usage. Decreased water depth may also be influenced by local ordinances that determine level of operator or lifeguard assistance, the preferred being a need for minimal operator assistance consistent with safety.

Gates may be located throughout the system and may serve multiple purposes. As stated previously, adjustable sloped face gates may be used with thick low-velocity sheet-flow lift stations to transfer riders from channel to channel or from channel to station. Adjustable gates capable of horizontal and vertical movement may be used to produce rapids effects, including standing waves, in currents of water. These adjustable gates may be wedge shaped and may be positioned in the wall or floor of a channel. Some or all of the adjustable gates may be connected to a central control system to create variable and constantly changing pattern of rapids or other riding path and water flow characteristics. These wedge-shaped gates may be constructed of padded or unpadded fiberglass or metal or other plastics balloons, or bladders. The adjustable gates may be capable of retracting into the walls, floors, or ceiling to which they are attached. These or other mechanically or pneumatically adjustable gates may be used to modify velocity and other channel flow characteristics creating, for example, artificial rapids, ride paths, and water flow current paths. They may also be used for containment purposes when the system is not in use or in a pump shutdown or other unusual operating conditions. Overflow gates may also provided for use in some larger deep flow channels, to release measured amounts of water into other channels, or to temporarily hold back all or part of the flow and then releasing it to create a flood crest effect downstream in the channel. The overflow gates allow a substantially constant overflow during changing water line heights in the main channel, and allow a way to regulate the volume of water flowing past the gate.

Another embodiment of the adjustable gates in the channel system may serve to alter the water flow characteristics to make the channel more or less severe and exciting, or may serve to modify the use of the river for different types of riding vehicles. An example of this would be to maximize the river use for kayaking either for part of the day or for the purpose of extending the season when the weather is cooler or for special events such as sports competitions. The river for example could be deferentially used at preferred times for dining vehicles, or part of entertainment skill demonstrations or other shows. Another use of gates would be to shut off portions of the channel at times of breakdowns in portions of the river, the desired use and reduced expense of operating a portion of the channel system for various reasons, or diversion of higher or lower volumes of water to various portions of the channel systems for various control or special effects reasons; for example sports events.

Throughout the system electronic signs or monitors may be positioned to notify riders or operators of various aspect of the system including, but not limited to: operational status of any part of the system described herein above; estimated waiting time for a particular ride; and possible detours around non operational rides or areas of high rider density.

The lower areas in a channel long enough to require lifting stations along the channel length may become areas where water naturally accumulates during shutdown. Containment pools at these low points in the system may be provided with enough extra freeboard to accommodate the shutdown condition of water accumulation; in practice these pools may serve additional purposes such as swimming pools or splash-down areas for water rides or features such as pool-to-pool chutes. If the containment pools are deep enough to pose a drowning threat, they may be equipped with safety baskets configured to move vertically in the pool as the water level changes to prevent riders from going below a desired depth in the pool. Water may be stored at various levels of the system by means of movable gates that hold the water at various levels within the channel, or water may be partially stored at different levels with either moveable gates or permanent weirs within the system that hold portions of water at different levels within the channels, or water may be stored either wholly or partially in exterior to the channel sumps or in combinations of the aforementioned methods and means of water storage on system shutdown.

Control System

Embodiments disclosed herein provide an interactive control system for water features. In one embodiment, the control system may include a programmable logic controller. The control system may be coupled to one or more activation points, participant detectors, and/or flow control devices. In addition, one or more other sensors may be coupled to the control system. The control system may be utilized to provide a wide variety of interactive and/or automated water features. In an embodiment, participants may apply a participant signal to one or more activation points. The activation points may send activation signals to the control system in response to the participant signals. The control system may be configured to send control signals to a water system, a light system, and/or a sound system in response to a received activation signal from an activation point. A water system may include, for example, a water effect generator, a conduit for providing water to the water effect generator, and a flow control device. The control system may send different control signals depending on which activation point sent an activation signal. The participant signal may be applied to the activation point by the application of pressure, moving a movable activating device, a gesture (e.g., waving a hand), interrupting a light beam, or by voice activation. Examples of activation points include, but are not limited to, hand wheels, push buttons, optical touch buttons, pull ropes, paddle wheel spinners, motion detectors, sound detectors, and levers.

The control system may be coupled to sensors to detect the presence of a participant proximate to the activation point. The control system may be configured to produce one or more control systems to active a water system, sound system, and/or light system in response to a detection signal indicating that a participant id proximate to an activation point. The control system may also be coupled to flow control devices, such as, but not limited to: valves, and pumps. Valves may includes air valves and water valves configured to control the flow air or water, respectively, through a water feature. The control system may also be coupled to one or more indicators located proximate to one or more activation points. The control system may be configured to generate and send indicator control signals to turn an indicator on or off. The indicators may signal a participant to apply a participant signal to an activation point associated with each indicator. An indicator may signal a participant via a visual, audible, and/or tactile signal. For example, an indicator may include an image projected onto a screen.

In some embodiments, the control system may be configured to generate and send one or more activation signals in the absence of an activation signal. For example, if no activation signal is received for a predetermined amount of time, the control system may produce one or more control signals to activate a water system, sound system, and/or light system.

Water Cannon System

A water cannon system may include a tube from which water may be ejected in response to a control signal. A control system as described above may be coupled to the water cannon to control the operation of the water cannon. A water cannon may include a first hollow member including a closed end and an opposite end having an opening therein; and a second hollow member including first and second opposing open ends. The second hollow member is of smaller cross-sectional area than the first hollow member. The first and/or second hollow members may have a substantially circular cross-section, or some other shape. During use, the second hollow member is disposed in the opening in the first hollow member to form an airtight seal within the opening. The first open end of the second hollow member is outside or coplanar with the open end of the first hollow member. The second open end of the second hollow member is inside the first hollow member. In some embodiments the second hollow member may be bent or curved so that its second open end is lower than its first open end when the water cannon is parallel to the ground. Such a configuration may ensure that the second open end is below the water level in the cannon throughout the range of motion of the water cannon. The water cannon may also include a partition member with an opening therein. During use, the partition member may be disposed inside the first hollow member with the second hollow member disposed in the opening in the partition member. The partition member may be slidable along at least of a portion of the second hollow member. One or more stops may limit the range of motion of the partition member. The partition member may substantially form a partition from the exterior surface of the second hollow member to the interior surface of the first hollow member. The water cannon may also include one or more fluid inlets connected to a fluid source and effective to release fluid into the first hollow member during use. Additionally, one or more gas inlets connected to a source of pressurized gas, and effective to release a gas into the first hollow member during use may be present. The partition member may be disposed between a gas inlet and the closed end of the first hollow member during use. The control system may be in communication with a gas inlet and one or more activation points and one or more sensors. Additionally, one or more gas release valves may be provided. The gas release valves may be opened to release gas pressure when the water cannon is spent (e.g., substantially empty of water). The gas release valves may be closed when the water cannon is loaded (e.g., at a predetermined operation fluid level). The control system may control the opening and closing of the gas release valves.

In certain embodiments, a water cannon system may include a support apparatus configured to support the water cannon during use. The support apparatus may include a base and an upright member coupling the base to the first hollow member. The water cannon may be moveably coupled to the support apparatus. For example, the upright member may be coupled to the water cannon, or the base by a semispherical ball and cup connector. A sight may be coupled to the water cannon. A seat may be coupled to the base.

The act of applying a participant signal to an activation point may cause a projectile of water to be ejected from the water cannon. The activation points may be configured to signal the control system in response to the participant signal. The activation points may be located on adjacent to the water cannon, or remote from the water cannon. The activation points may include an optical touch button.

The water cannon system may include a sensor in the vicinity of the activation points configured to signal the control system when a participant is near the activation points. The control system may be programmed to activate into an attract mode after a predetermined amount of time with no participant signal and/or no signal from the proximity sensor. This mode may include operating the cannon in a random, arbitrary, or preprogrammed fashion. This operation may serve to entice passersby to approach the activation points and participate with the water cannon system.

Interactive Water Game

An interactive water game including a control system as described above may include a water effect generator; and a water target coupled to the control system. In an embodiment, the water effect generator may include a water cannon, a nozzle, and/or a tipping bucket feature. The water effect generator may be coupled to a play structure. During use a participant may direct the water effect generator toward the water target to strike the water target with water. Upon being hit with water, the water target may send an activation signal to the control system. Upon receiving an activation signal from the water target, the control system may send one or more control signals to initiate or cease predetermined processes.

The water target may include a water retention area, and an associated liquid sensor. In an embodiment, the liquid sensor may be a capacitive liquid sensor. The water target may further include a target area and one or more drains. The water target may be coupled to a play structure.

In some embodiments, the interactive water game may include one or more additional water effect generators coupled to the control system. Upon receiving an activation signal from the water target, the control system may send one or more control signals to the additional water effect generator. The additional water effect generator may be configured to create one or more water effects upon receiving the one or more control signals from the control system. For example, the one or more water effects created by the additional water effect generator may be directed toward a participant. The additional water effect generator may include, but is not limited to: a tipping bucket feature, a water cannon, and/or a nozzle. The additional water effect generator may be coupled to a play structure.

A method of operating an interactive water game may include applying a participant signal to an activation point associated with a water system. An activation signal may be produced in response to the applied participant signal. The activation signal may be sent to a control system. A water system control signal may be produced in the control system in response to the received activation signal. The water system control signal may be sent from the control system to the water system. The water system may include a water effect generator. The water effect generator may produce a water effect in response to the water system control signal. The water effect generator may be directed toward a water target to strike the water target with water. An activation signal may be produced in the water target, if the water target is hit with water. The water target may send the activation signal to the control system. A control signal may be produced in the control system in response to the received water target activation signal. In an embodiment, the interactive water game may include an additional water effect generator. The control system may direct a control signal to the additional water effect generator if the water target is struck by water. The additional water effect generator may include, but is not limited to: a water cannon, a nozzle, or a tipping bucket feature. The additional water effect generator may produce a water effect in response to a received control signal. The water effect may be directed toward a participant.

Other components which may be incorporated into the system are disclosed in the following U.S. patents, herein incorporated by reference: an appliance for practicing aquatic sports as disclosed in U.S. Pat. No. 4,564,190; a tunnel-wave generator as disclosed in U.S. Pat. No. 4,792,260; a low rise water ride as disclosed in U.S. Pat. No. 4,805,896; a water sports apparatus as disclosed in U.S. Pat. No. 4,905,987; a surfing-wave generator as disclosed in U.S. Pat. No. 4,954,014; a waterslide with uphill run and floatation device therefore as disclosed in U.S. Pat. No. 5,011,134; a coupleable floatation apparatus forming lines and arrays as disclosed in U.S. Pat. No. 5,020,465; a surfing-wave generator as disclosed in U.S. Pat. No. 5,171,101; a method and apparatus for improved water rides by water injection and flume design as disclosed in U.S. Pat. No. 5,213,547; an endoskeletal or exoskeletal participatory water play structure whereupon participants can manipulate valves to cause controllable changes in water effects that issue from various water forming devices as disclosed in U.S. Pat. No. No. 5,194,048; a waterslide with uphill run and floatation device therefore as disclosed in U.S. Pat. No. 5,230,662; a method and apparatus for improving sheet flow water rides as disclosed in U.S. Pat. No. 5,236,280; a method and apparatus for a sheet flow water ride in a single container as disclosed in U.S. Pat. No. 5,271,692; a method and apparatus for improving sheet flow water rides as disclosed in U.S. Pat. No. 5,393,170; a method and apparatus for containerless sheet flow water rides as disclosed in U.S. Pat. No. 5,401,117; an action river water attraction as disclosed in U.S. Pat. No. 5,421,782; a controllable waterslide weir as disclosed in U.S. Pat. No. 5,453,054; a non-slip, non-abrasive coated surface as disclosed in U.S. Pat. No. 5,494,729; a method and apparatus for injected water corridor attractions as disclosed in U.S. Pat. No. 5,503,597; a method and apparatus for improving sheet flow water rides as disclosed in U.S. Pat. No. 5,564,859; a method and apparatus for containerless sheet flow water rides as disclosed in U.S. Pat. No. 5,628,584; a boat activated wave generator as disclosed in U.S. Pat. No. 5,664,910; a jet river rapids water attraction as disclosed in U.S. Pat. No. 5,667,445; a method and apparatus for a sheet flow water ride in a single container as disclosed in U.S. Pat. No. 5,738,590; a wave river water attraction as disclosed in U.S. Pat. No. 5,766,082; a water amusement ride as disclosed in U.S. Pat. No. 5,433,671; a hydraulic screw pump as disclosed in U.S. Pat. No. 5,073,082; and, a waterslide with uphill runs and progressive gravity feed as disclosed in U.S. Pat. No. 5,779,553. The system is not, however, limited to only these components.

All of the above devices may be equipped with controller mechanisms configured to be operated remotely and/or automatically. For large water transportation systems measuring miles in length, a programmable logic control system may be used to allow park owners to operate the system effectively and cope with changing conditions in the system. During normal operating conditions, the control system may coordinate various elements of the system to control water flow. A pump shutdown will have ramifications both for water handling and guest handling throughout the system and will require automated control systems to manage efficiently. The control system may have remote sensors to report problems and diagnostic programs designed to identify problems and signal various pumps, gates, or other devices to deal with the problem as needed.

BRIEF DESCRIPTION OF THE DRAWINGS

Other objects and advantages of the invention will become apparent upon reading the following detailed description and upon reference to the accompanying drawings in which.

Figure 1A:
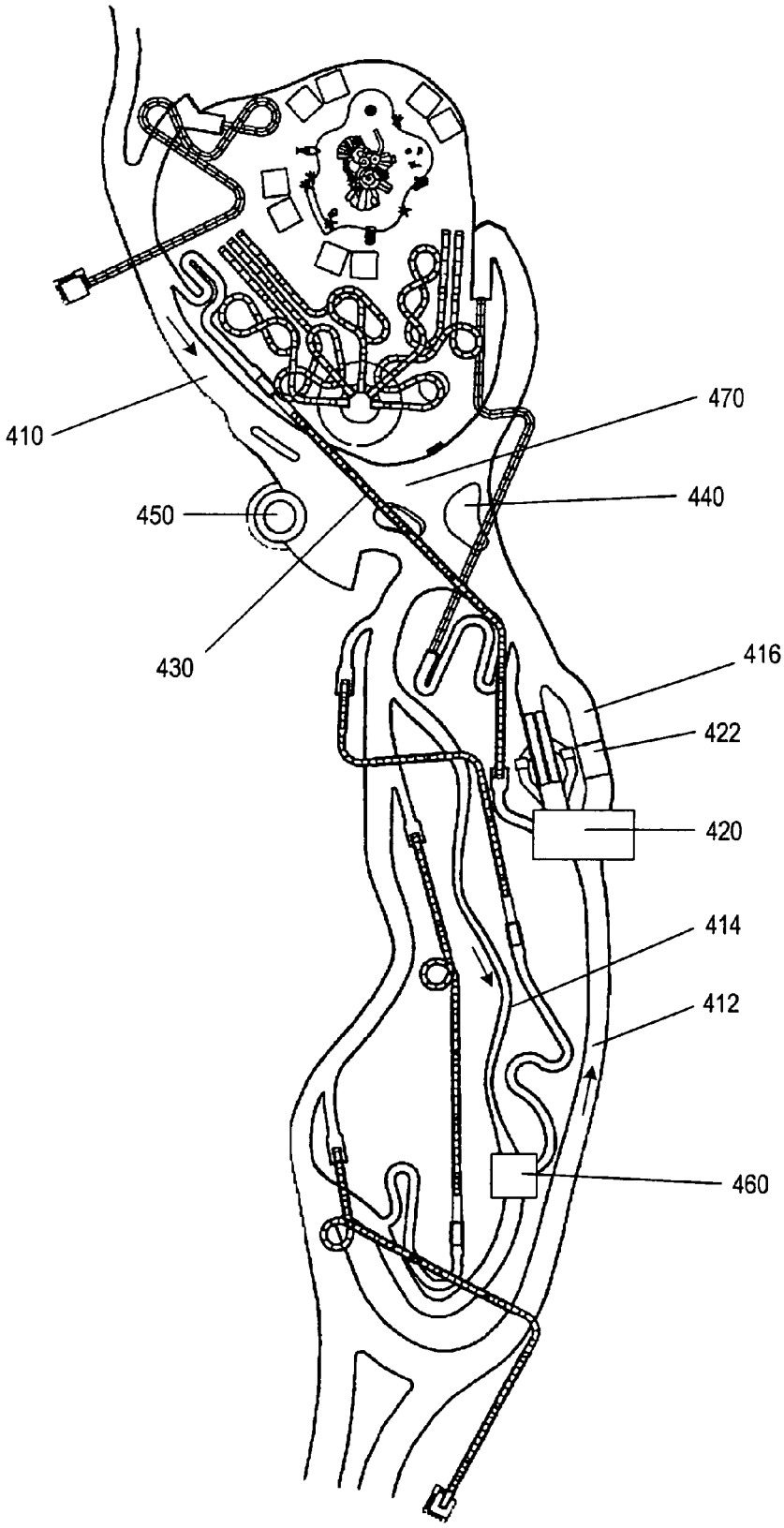
FIG. 1A depicts a schematic view of a water transportation system that includes a plurality of channels.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION OF THE INVENTION

FIG. 1A depicts an embodiment of a water transportation system. The water transportation system is a system that couples two or more stations to each other via a channel. The channels allow participants to be transferred between stations while remaining in a water environment. As used herein stations may refer to a water park, water ride, lodging facility, body of water (natural or unnatural), transportation hub (e.g., monorail, bus, train station), parking lot, restaurant, or amusement park. Channel may refer to devices that are configured to hold water and to allow people to be transferred along the channel by the flow of water. Channels as defined herein includes plastic channels, concrete channels, rivers (both artificial and natural), water rides, pools, bodies of water, combinations of these devices or any other device configured to transport a participant between one station and an another station using water.

As shown in FIG. 1A, at least two channels, 410 and 412 may be coupled to a plurality of stations 420, 430, 440, 450, 460, and 470. In the embodiment depicted in FIG. 1A, stations 420, 440, and 460 represent water parks, station 430 represents a water ride, station 450 represents a lodging facility, and station 470 represents a body of water. It should be understood that these stations are only exemplary of one particular embodiment and that the stations 420, 430, 440, 450, 460, and 470 may be any of the other types of stations described herein.

Channel 410 may extends from station 470, past station 450, and into water ride 430. As depicted in FIG. 1A, water ride 430 may serve a dual purpose. Water ride 430 may serve as a water attraction in which participants may amuse themselves. Additionally, water ride 430 may serve as a portion of the channel coupling station 450 to station 420. The participants may then remain at station 430 or may exit water ride 430 at the appropriate spot and continue on via channel 412 until they reach station 420.

Channel 412 may extend from station 420 to station 470 with stops at stations 430, 440, and 450. The direction of flow of channel 412 may be in a direction from station 420 toward station 450. Thus, channel 412 is configured to allow participants to travel in a direction opposite to the direction of flow through channel 410. This allows the participants to travel to and from any of the stations coupled together by channels 410 and 412.

Additional channels may be used to couple the stations together. In FIG. 1A, channel 414 may be used to couple station 430 to stations 450 and 460. Channel 414 may be unidirectional, as depicted in FIG. 1A, or may be bi-directional to allow travel from station 430 to 460, and back from 460 to 430. For bi-directional travel channel 414 may be composed of two substantially adjacent channels that allow travel in opposite directions along the route depicted for channel 414.

In an embodiment, channels may be composed of a series of water lock systems coupling two or more stations. Turning to FIG. 1A, channel 416 includes water lock systems 422 coupling the stations 420 and 440. Water lock systems, described in further detail herein, may be used to couple low elevation stations to higher elevation stations. For example, station 420 may be at the bottom of a hill while station 440 may be at the top of a hill. To couple station 420 and 440, participants may need to be transported from a low point of the hill to a high point of a hill over a short distance. The use of a more conventional water chute may be difficult or impossible due to the steepness of the grade. Water lock systems may be instead used to convey the passenger up to the top of the hill. The water lock system may be coupled to plastic or concrete waterways, as depicted in FIG. 1A to convey the participants between the stations.

The channels typically have a length that is suitable to transport the channels from station to station. For example the channels depicted in FIG. 1A may be less than a mile if the stations are close together. Alternatively, the channels may be miles in length if the stations are spaced from each other by more than a mile. In one embodiment, the flow rate through channels is less than 5 mph, preferably less than 3 mph. For a typical transportation system, rides of more than one hour may make the participants bored or anxious. Thus, in some embodiments, the distance between stations may be less than 3 miles to keep the travel time to a minimum.

Channels may be configured in a variety of widths as well as lengths. Channels may be configured to allow a single participant to pass through a portion of the channel at a time, or may have a width that allows multiple participants to pass through any given point at a time. Generally, the wider the channel the more water may be required to transport the participants through the channel. Thus, channels may be configured to maximize throughput of participants while minimizing water usage. The width of the channel may be varied along the length of the channel. Some portions of the channel may be infrequently used, and may be narrower than more frequently used portions of the channel.

The channels depicted in FIG. 1A may be configured to allow single or bi-directional passage of the participants. For example, channel 410 may be configured to allow one way travel only. Thus, 410 may be a single channel. Alternatively, the channels may be bi-directional in configuration. Thus each of the depicted channels in FIG. 1A, may actually include two separate channels, each channel configured to convey participants in opposite directions from each other. Thus any shown pathway may be available for the participants to choose from.

Figure 1B:
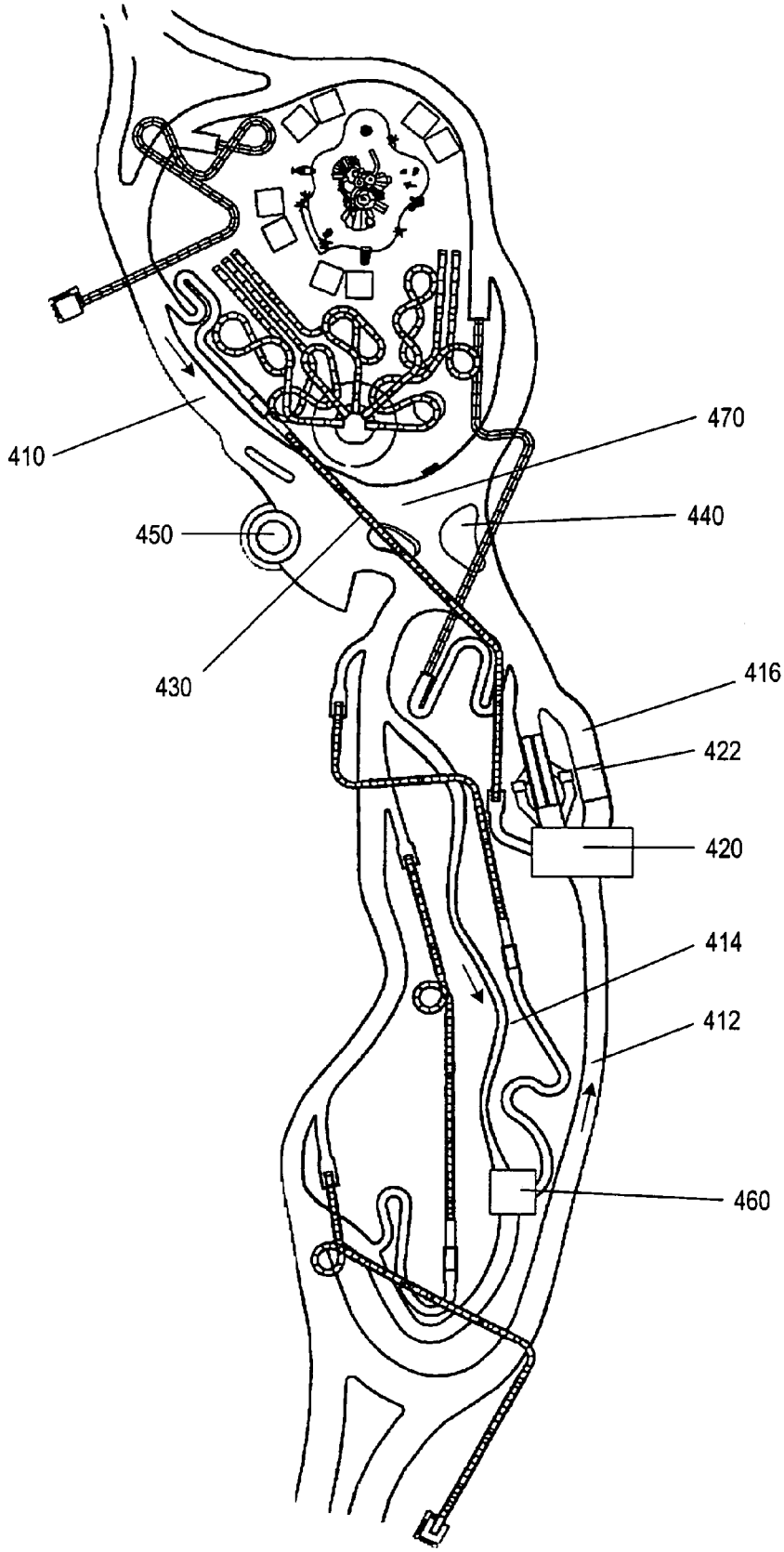
FIG. 1B depicts a schematic view of a water transportation system that includes a continuous channel coupling stations.

FIG. 1B depicts another embodiment of a water transportation system. The water transportation system is a system that couples two or more stations to each other via a channel. The channels allow participants to be transferred between stations while remaining in a water environment. As shown in FIG. 1B, at least one continuous channel 410 may be couple a plurality of stations 420, 430, 440, 450, 460, and 470. In the embodiment depicted in FIG. 1B, stations 420, 440, and 460 represent water parks, station 430 represents a water ride, station 450 represents a lodging facility, and station 470 represents a body of water. It should be understood that these stations are only exemplary of one particular embodiment and that the stations 420, 430 440, 450, 460, and 470 may be any of the other types of stations described herein.

Channel 410 may extends from station 470, past station 450, and into water ride 430. As depicted in FIG. 1B, water ride 430 may serve a dual purpose. Water ride 430 may serve as a water attraction in which participants may amuse themselves. Additionally, water ride 430 may serve as a portion of the channel coupling station 450 to station 420. In use, participants leaving station 450 may travel along channel 410 until they reach water ride 430. The participants may then remain at station 430 or may exit water ride 430 at the appropriate spot and continue on via channel 410 until they reach station 420.

Channel 410 may continue from station 420 to station 470 with stops at stations 430, 440, and 450. The direction of flow of channel 412 may be in a direction from station 420 toward station 450. Thus, channel 412 is configured to allow participants to travel in a direction opposite to the direction of flow through channel 410. This allows the participants to travel to and from any of the stations coupled together by channels 410 and 412.

Additional channels may be used to couple the stations together. In FIG. 1B, channel 414 may be used to couple station 430 to stations 450 and 460. Channel 414 may be unidirectional, as depicted in FIG. 1A, or may be bidirectional to allow travel from station 430 to 460, and back from 460 to 430. For bidirectional travel channel 414 may be composed of two substantially adjacent channels that allow travel in opposite directions along the route depicted for channel 414.

In an embodiment, channels may be composed of a series of water lock systems coupling two or more stations. Turning to FIG. 1B, channel 416 includes water lock systems 422 coupling the stations 420 and 440. Water lock systems, described in further detail herein, may be used to couple low elevation stations to higher elevation stations. For example, station 420 may be at the bottom of a hill while station 440 may be at the top of a hill. To couple station 420 and 440, participants may need to be transported from a low point of the hill to a high point of a hill over a short distance. The use of a more conventional water chute may be difficult or impossible due to the steepness of the grade. Water lock systems may be instead used to convey the passenger up to the top of the hill. The water lock system may be coupled to plastic or concrete waterways, as depicted in FIG. 1B to convey the participants between the stations.

The channels typically have a length that is suitable to transport the channels from station to station. For example the channels depicted in FIG. 1B may be less than a mile if the stations are close together. Alternatively, the channels may be miles in length if the stations are spaced from each other by more than a mile. In one embodiment, the flow rate through channels is less than 5 mph, preferably less than 3 mph. For a typical transportation system, rides of more than one hour may make the participants bored or anxious. Thus, in some embodiments, the distance between stations may be less than 3 miles to keep the travel time to a minimum.

The channels depicted in FIG. 1B may be configured to allow single or bi-directional passage of the participants. For example, channel 410 may be configured to allow one way travel only. Thus, 410 may be a single channel. Alternatively, the channels may be bidirectional in configuration. Thus each of the depicted channels in FIG. 1B, may actually include two separate channels, each channel configured to convey participants in opposite directions from each other. Thus any shown pathway may be available for the participants to choose from.

Figure 1C:
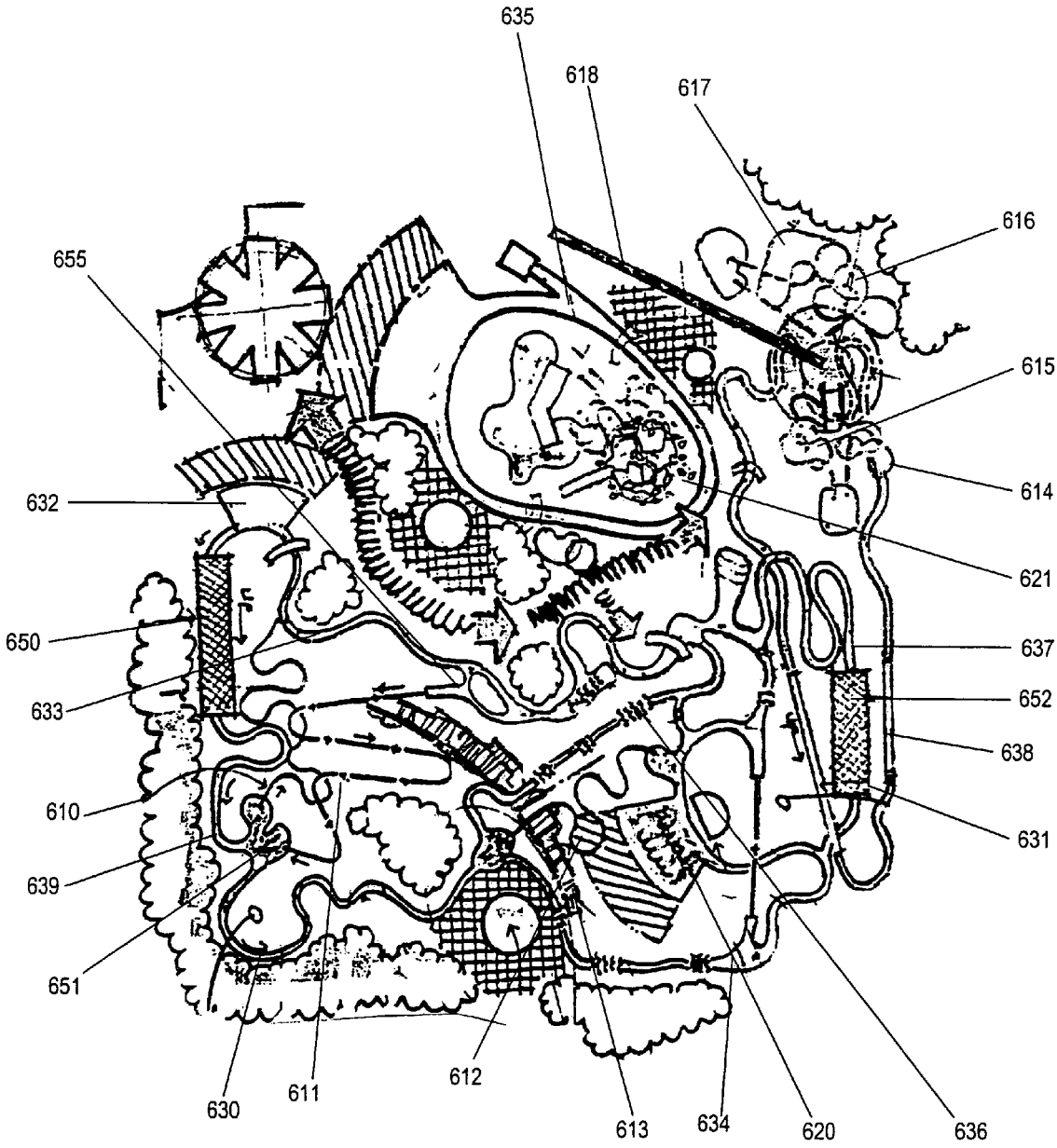
FIG. 1C depicts a schematic view of a water transportation system for a water amusement park.

FIGS. 1A and 1B depict a water transportation system that is used to couple a variety of different stations together. Thus, the water transportation system described in FIGS. 1A and 1B is an interstation water transportation system. The system depicted in FIG. 1C is an intrastation water transportation system that is configured to transport participants within a station. It should be understood that the intrastation water transportation system may also be coupled to an interstation water transportation system (not shown in FIG. 1C).

The embodiment depicted in FIG. 1C is directed to a water amusement park that includes a plurality of water rides interconnected by a channel. While specifically depicted for a water amusement park, it should be understood that the intrastation water transportation system may be set up in any of the previously listed types of stations. The water amusement park includes a variety of water rides 610-618 and water play areas 620 and 621. The water play areas and water rides may be interconnect by a series of channels 630-638. In one embodiment, channels 630 to 638 combine together to make a continuous channel linking the water rides and water play areas together.

The channels 630-638 may include a variety of different features for conducting participants about the water park in an entertaining method. In one embodiment, rapids may be produced within a channel, as depicted for channel 636. The rapids may be produced by placing obstructions or bump-like distortions along the bottom or sides of the channel and varying the width and/or depth and/or bottom slope of the channel as is known in the art.

In another embodiment rapids may be produced by varying the velocity of the water through bottom slope changes or introduction of higher velocity water jets such that the water is accelerated to supercritical velocities and then rapidly transitioned back to sub-critical velocities thereby producing various types of hydraulic jumps in the water without need of obstructions or underwater bump-like distortions of the channel bottom or sides. This allows rapids with sudden changes in water surface heights and sudden water velocity changes to be created with much less energy loss than those made with obstructions or bump-like distortions of the bottom and thereby allows more rapids to be produced for a given fall in river bottom elevation. This also allows for greater safety for the rider in hydraulic jump rapids as no bump-like distortions of the channel are needed which the rider may impact at the higher velocities of travel in rapids areas. Some of the types of hydraulic jumps that can be produced in this fashion are as described in the art as Undular jumps, Weak jumps, Oscillating jumps, Steady jumps and Strong jumps. The hydraulic profile of the river in a hydraulic jump area remains relatively stable in location, size and characteristics when the conditions that produce them are held relatively constant.

In one embodiment the hydraulic profile of the rapids portion of the river produced with hydraulic jumps is variously changed by intermittent disruption by use of moveable gates within the rapids area so as to change the hydraulic profile. Such disruption can cause the hydraulic jumps to variously change from one type to another as described above, or from one size to another, or from one location to another. Changing locations may have the effect of sending slowly moving standing waves upriver or down river or both. Intermittent application of moveable gates or various combinations of moveable gates as obstructions to the water flow in the hydraulic jump type of rapids areas can result in a wide range of river surface and ride characteristics. This can make the river experienced different in these areas virtually every time a rider traverses it.

Most water rides are based on gravity providing the force to propel a participant from an upper elevation point to a lower elevation point. The channels may, in some embodiments, be configured to transport participants from a exit point of a water ride back to the entry point of the water ride. For example, as depicted in FIG. 1C, participants that ride water rides 610 and 611 from an entry pool 651 to a collection pool 655, may wish to return to the entry pool without having to leave the water. The collection pool 655 may be coupled to a channel 633. The participants may enter channel 633 and be transported to portion 650 of channel 633. Portion 650 may be configured to elevate the participants from a low elevation point to a high elevation point. Portion 650 may use a variety of different methods to elevate the participants. In one embodiment, portion 650 may include a conveyor system, as described herein. Alternatively, portion 650 may include a water lock system, as described herein. Other methods may include the use of an uphill water slide as described herein. Once the participant is transported to the top of portion 650, the participant may be conveyed along channel 639 back to the entry pool. Other portions of the system, e.g., section 652 may also be used to elevate the participants.

The channels, for either interstation or intrastation use are configured to transport a person along the length of the channel by the use of water. The channels may be configured to hold a sufficient amount of water such that the participants float within the channel. A current of water may be produced in the channel to move the participants through the channel in the direction of the current. Alternatively, the channel may be formed of a low friction material such as a plastic, fiberglass, or coated cement. The participant sits upon the low friction surface (or a low friction device) and is pushed along the surface of the channel. Water is flowed through the channel to reduce the friction between the participant and the surface of the channel. Streams of water or air may be used to impart the force causing the participant to move along the channel. Alternatively, the channel may include inclined sections. The inclined section may be formed from a low friction material. The participants may be propelled down an inclined surface by gravitational forces, with water on the channel reducing the friction between the channel and the participant. It should be understood that channels may include different sections. Some of the sections may be configured to hold a sufficient amount of water to allow a participant to float, while other portions may be relatively shallow such that the participant slides across the surfaces of the channel.

In another embodiment, the channel may include a substantially angled section to transport a participant from a high elevation portion of the channel to a lower elevation portion of the channel. In one embodiment, the channel may be configured such that the participant is floating within the channel. To ensure that a sufficient amount of water is present in the channel, a water inlet may be positioned proximate the higher elevation portion of the channel. To keep the volume at a sufficient level throughout the inclined portion of the channel, a stream of water may be pumped into the channel. Such a channel is described in more detail in U.S. Pat. No. 4,805,896 to Moody, which is incorporated herein by reference.

When a portion of the channel is coupled to a water park or water ride station, the channel may be coupled directly to a water ride. In this manner participants may exit the water ride and enter the channel without having to get out of the water. The channel may be configured to return the participants to the top of the water ride. Typically, a water ride includes a receiving pool positioned at the exit of the ride. The receiving pool may be configured to "catch" the participants as they exit the water ride. This receiving pool may be coupled to the channel to participants to move from the water ride to the channel without exiting the water.

In some embodiments, the water ride may feed directly into the channel without the use of a receiving pool. The participants will exit the water ride and enter the channel. The channel may transport the participants to the entrance to the water ride and/or to other water rides or stations. In one embodiment, the channel may be coupled to the water ride such that the water flowing from the water ride enters the channel and produces a flow of water within a portion of the channel. The water ride, in effect, serves as a water input source for the channel. A similar system is described in U.S. Pat. No. 5,421,782 which is incorporated herein by reference.

In another embodiment, participants may be moved through a channel by sliding along the surface of the channel. For downwardly inclined section of the channel, the participants will move down the incline by gravitational forces. For horizontal surfaces or vertically inclined surfaces, a force may be applied to the participant to move the participant along the surface. In one embodiment, a plurality of tangentially oriented water jets may be oriented along a channel. The water jets may produce streams of water that cause the participant to move along the channel. The water jets may be used to control the passage of the participants through a channel regardless of whether the channel is downwardly inclined, horizontal, or upwardly inclined. A similar system is described, for example, in U.S. Pat. No. 5,213,547 which is incorporated herein by reference.

In some embodiments, the channels may be coupled to a station using walkways. The walkways may allow participants arriving at the station to move from the station into the water transportation system. The participants may enter the water transportation system by a variety of different methods. In one embodiment, a stairway may couple a walkway to a channel of the water transportation system. The walkway may allow a participant to gradually enter the channel via the stairway. This may also allow the participant to more easily mount a floatation device as the participant enters the channel. Alternatively, the walkway may gradually slope into the channel, like a beach, such that the participant walks into the channel.

In some embodiments, the participants may be disposed on a floatation device. Floatation devices include an inner tube, a floatation board, raft, boat or other floatation devices used by riders on water rides. To allow easy access to and from the channel and the stations, docking stations may be coupled to the channels. The docking station may be configured to receive a participant riding a floatation device, or floatation devices without participants. The docking station may be configured to inhibit the movement of the floatation devices through the channel. Once the floatation device is stopped, entry onto the floatation device and exit from the floatation device may be more readily accomplished.

To create entertaining effects in the channel, obstructions may be placed in the channel to create various water patterns. In one embodiment, the obstructions may be placed in the conduits such that a standing wave pattern is produced. Water hitting the obstruction may be slowed and cause a portion of the flowing water to move upward creating a wave like effect. The use of obstructions to create standing wave effects is described in U.S. Pat. No. 5,421,782 which is incorporated herein by reference.

Along with entertainment effects obstructions may be used to control the flow of participants and water through the water transportation system. In one embodiment, movable obstructions may be used to control the flow of water and participants through the channels. Movable obstructions may be moved in a substantially vertical direction between a raised position and a lowered position. In the raised position, the movable obstruction may substantially inhibit the flow of participants and/or water through the channel. In the lowered position, the movable obstruction may allow substantially uninhibited movement of the participants and/or water through the channel. The movable obstructions may be positionable in the raised position, the lowered position or any position between the raised or lowered position. The movable obstruction may be mechanically operated or pneumatically operated. An example of a pneumatically operated obstruction is described in U.S. Pat. No. 5,453,054 which is incorporated herein by reference.

In one embodiment, a wave generator may be coupled to the channel to produce a wave of water that propagates through the channel. The wave of water may help to propel the participants through the channel in a more enjoyable manner. Methods of generating a wave of water in a channel are described in U.S. Pat. No. 5,766,082 which is incorporated herein by reference. In another embodiment, the channel may include a wave generator and be coupled to a beach area. In use, the wave generator may produce a wave that propagates through the channel. When the wave encounters the beach area, the wave may move from the channel toward the beach area to create a tidal effect.

Figure 2A:
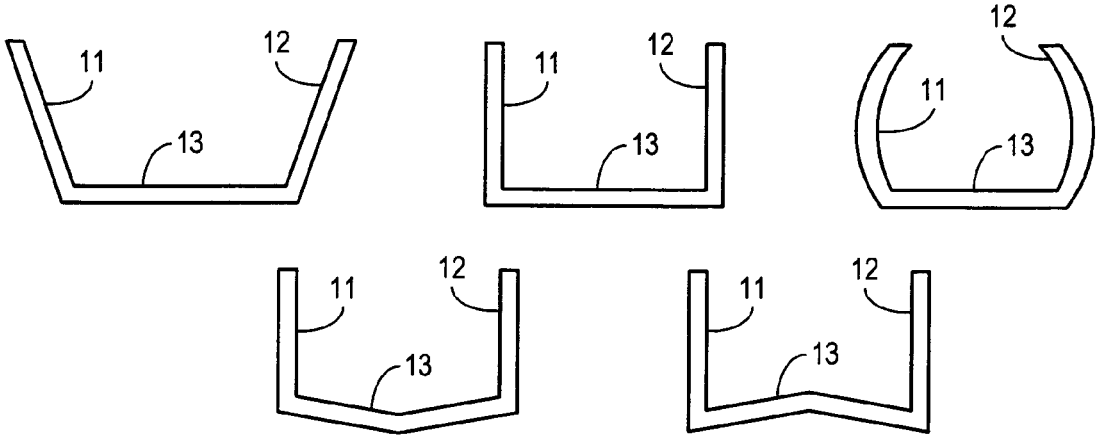
FIG. 2A depicts a cross section of a horizontal hydraulic head channel.

In another embodiment, a substantially horizontal hydraulic head channel section may be used to generate a flow of water through a portion of the channel. FIG. 2A shows a cross section of a horizontal hydraulic head channel section 10. These channel sections 10 may be characterized as having a negligible bottom slope as measured by the total change in elevation from the beginning to the end of the channel divided by the length of the channel. The channel 10 includes channel walls 11, 12 and a channel bottom 13. The channel bottom 13 may be sloped up or down from the walls 11, 12 to the middle of the channel 10 to facilitate draining during shutdown.

Figure 2B:
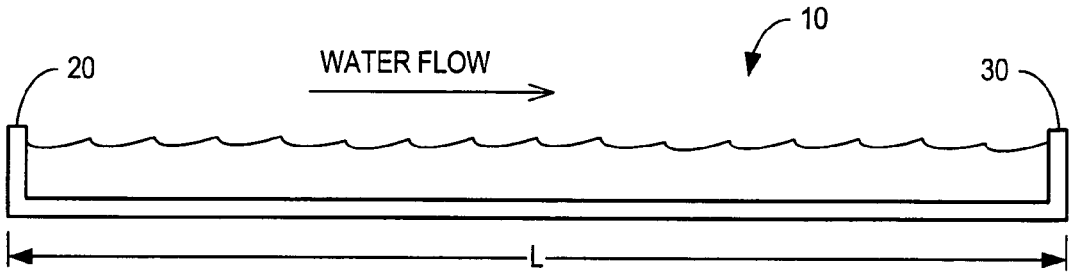
FIG. 2B depicts a side elevational view of a horizontal hydraulic head channel.
Figure 3:
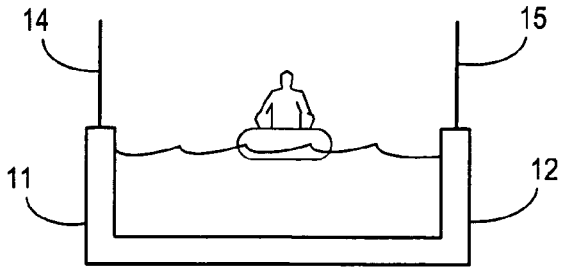
FIG. 3 depicts a cross-sectional view of a horizontal hydraulic head channel with a retaining barrier.

The length L of the channel 10, shown in FIG. 2B, may range from less than 50 feet to more than 1000 feet from the input end 20 to the discharge end 30. The length L of the channel 10 may be a function of the water volume in the channel 10 and the velocity of the water traveling through the channel 10. Slower velocity water may allow longer channel sections 10. The channel 10 may be made of a variety of materials known to those skilled in the art including but not limited to surface-treated concrete or fiberglass. Retaining walls may be formed on the sides of the channel. For instance, in an embodiment, (FIG. 3) a substantially transparent retaining wall 14, 15 may be mounted on the channel wall 11, 12. As the participants move through the channel, the participants may be able to ride along in the concrete channel 10 while viewing the surroundings through the plastic wall 14, 15. The plastic wall 14, 15 may also serve to inhibit participants from intentionally or unintentionally exiting the channel 10 along its length, except at desired locations.

Figure 4:
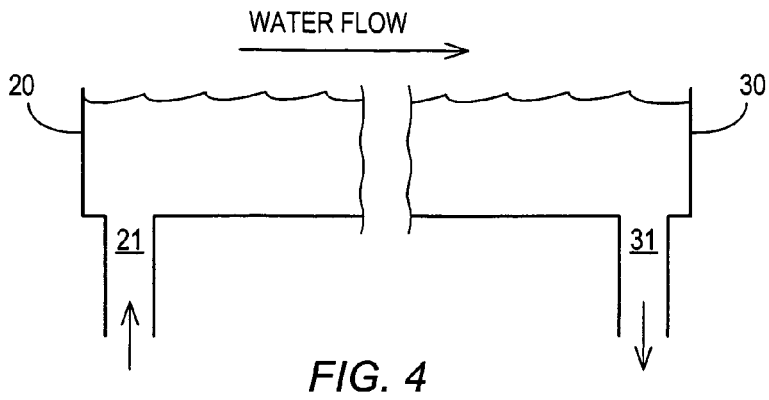
FIG. 4 depicts a side elevational view of a horizontal hydraulic head channel showing inlet and outlet conduits.

FIG. 4 shows the input end 20 and the output end 30 of a horizontal hydraulic head channel section 10. In the embodiment shown, the input end 20 includes an input conduit 21 which may be coupled to a pump outlet for introducing water into the channel 10. The input source 21 is configured to allow attachment of various size and shape pipes and nozzles configured to discharge water from a plurality of locations at the input end 20. The output end 30 includes an output conduit 31 which may be coupled to a pump inlet for removing water from the channel 10.

The participants may be carried on the current of water produced by these devices. The input conduit 21 supplies potential or kinetic energy or combinations of both to the input end 20 of the channel system 10 in the form of high velocity water, and the output source 31, located downstream of the input source 21, removes water from the channel 10 such that the water will flow from the input area 20 to the discharge area 30 down a hydraulic energy gradient.

Note that while the output source 31 is described as "downstream" of the input source 21, this designation refers to a lower hydraulic energy level of the water rather than an elevation loss. The hydraulic gradient acts in lieu of an elevation gradient to produce the current. The water flows from the input source 21 at the input end 20 into the channel 10 and along the channel 10 down the hydraulic gradient to the output end 30 and out the channel 10 through the output source 31 without further addition of energy into the system by means such as elevation losses or injection of energized water.

Figure 5:
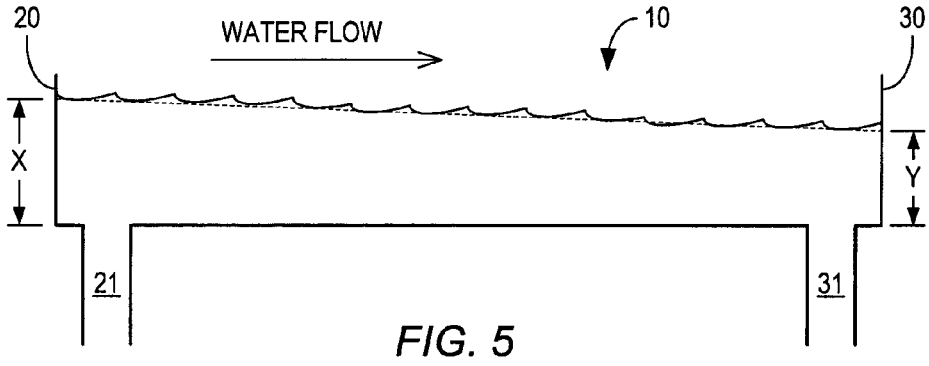
FIG. 5 depicts a side elevational view of a horizontal hydraulic head channel showing differences in hydraulic head between input end and discharge end.

FIG. 5 demonstrates the principle that the horizontal hydraulic head channels 10 use to propel riders. The input source 21 of the channel section 10 introduces water into the channel 10, and this input water may have more energy than the rest of the water in the channel 10. This water starts flowing in the direction of decreased energy, in this case toward the output end 30 of the channel 10 which is removing water from the channel 10. As the water flows from the input end 20 to the output end 30, it may gradually lose energy due to friction and turbulence, until it reaches the output end 30 and is removed from the channel 10. This energy difference is what provides the motive force for water and rider movement. As shown, the head height of the water at the input end 20 of the channel 10 is X, and the head height at the output end 30 is Y. When the height X is greater than the height Y a hydraulic gradient is produced. Note that although the water height is different at the input and output ends of the channel, the bottom of the channel is substantially horizontal.

Figure 6:
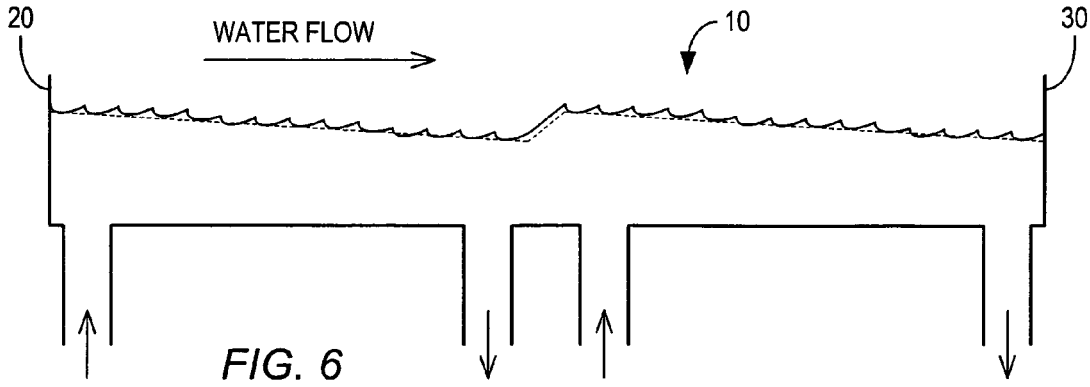
FIG. 6 depicts two adjoining horizontal hydraulic head channels, coupled end-to-end, showing differences in hydraulic head at the junction.
Figure 7A:
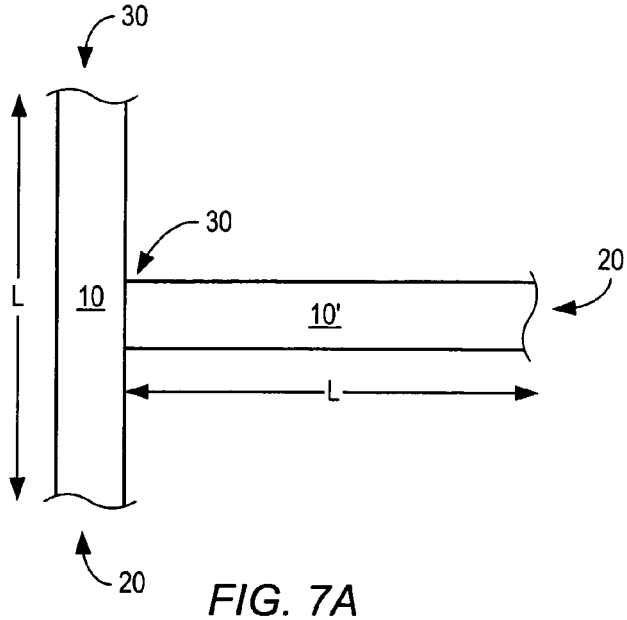
FIG. 7A depicts two adjoining horizontal hydraulic head channels, coupled end-to-length.
Figure 7B:
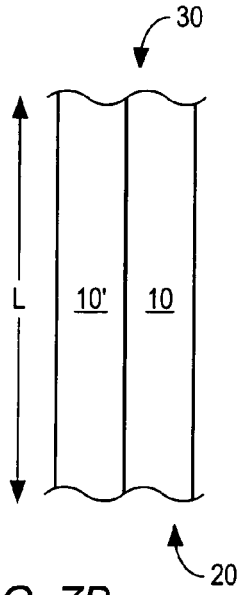
FIG. 7B depicts two adjoining horizontal hydraulic head channels, coupled length-to-length.
Figure 8:
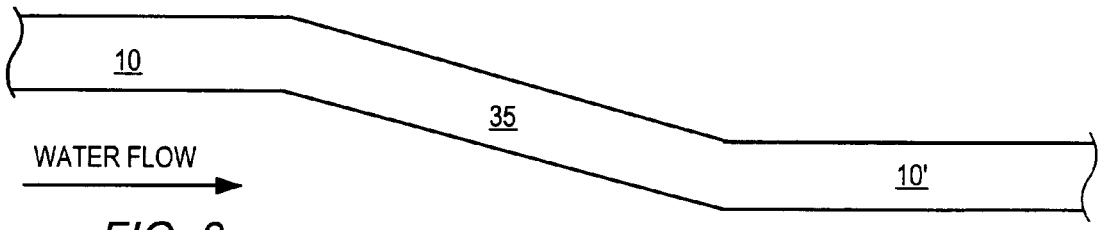
FIG. 8 depicts a horizontal hydraulic head channels coupled along a downhill slope.
Figure 9:
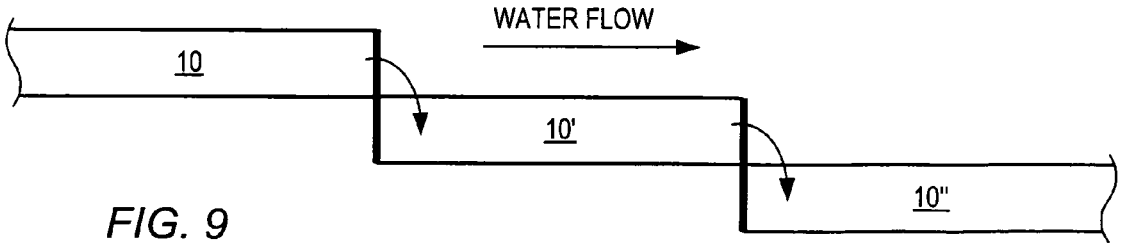
FIG. 9 depicts a series of horizontal hydraulic head channels coupled along a downhill slope.
Figure 10:
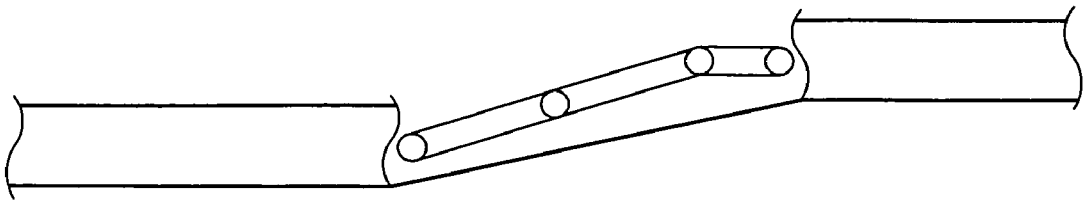
FIG. 10 depicts a horizontal hydraulic head channel coupled to conveyor.

The horizontal hydraulic head channels 10 may be coupled end to end to transport riders along long distances (FIG. 6). Along with end-to-end coupling, a channel end 20, 30 may be coupled anywhere along the length L of another channel 10' (FIG. 7A), or adjoining lengths may be coupled (FIG. 7B). Often the channels 10 will be coupled to downhill sloped channels 35 (FIG. 8). The sloped channels 35, in this configuration, may act as the output source 31 of the preceding horizontal channel 10 and as the input source 21 of the subsequent horizontal channel 10'. In another configuration, horizontal channels 10, 10' of different elevations may be coupled to create a waterfall effect; a series of channels 10, 10', 10" of differing elevations may be coupled to create a waterfall stairway effect (FIG. 9). In this configuration, the output source 31 of one channel 10 may function as the input source 21 of the subsequent channel 10. The channels 10 may also be coupled to mechanical lifting systems, such as a conveyor system (FIG. 10). Participants may move from a preceding section 10 to a subsequent section 10 at a higher elevation by exiting the discharge end 30 of the preceding section 10 to the input end of the mechanical lifting system, and entering the input end 20 of the subsequent section 10 from the discharge end of the mechanical lifting system.

Figure 11:
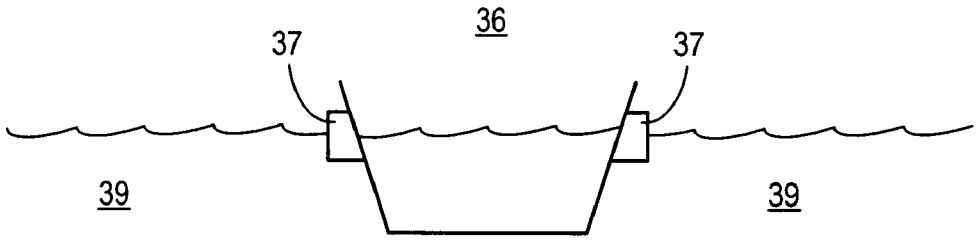
FIG. 11 depicts a floating horizontal hydraulic head channel.

The horizontal channel 10 may allow transportation of water and riders through large distances without the need for an elevation decrease to provide motive power to the water or rider. In order to be put into practice, the channel 10 may be configured to traverse varying types of terrain. A floating horizontal hydraulic head channel 36 may be used for transporting riders across bodies of water 39, as depicted in FIG. 11. The channel 36 includes floatation devices 37 designed to keep the top of the channel 36 above the level of the water of the body of water. In this way, the treated channel water may be kept separate from the untreated water of the body of water 39.

Figure 12:
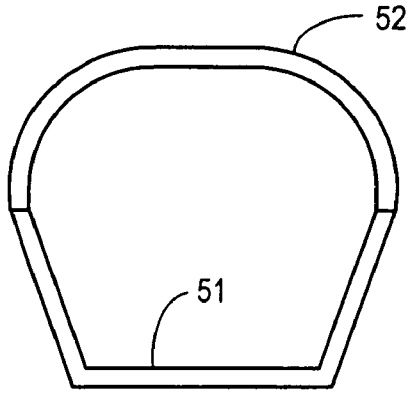
FIG. 12 depicts an enclosed horizontal hydraulic head tube.
Figure 13:
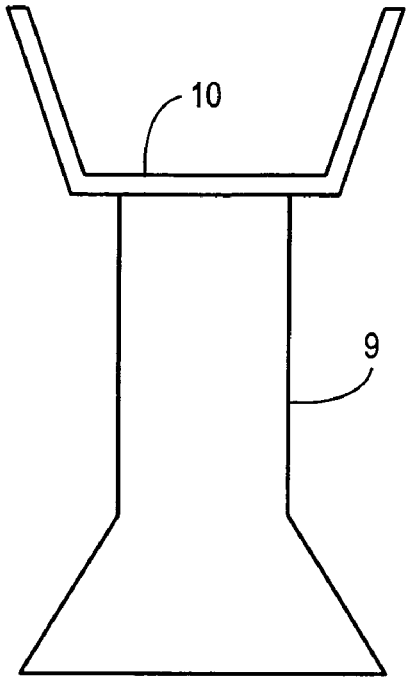
FIG. 13 depicts an elevated horizontal hydraulic head channel.
Figure 14:
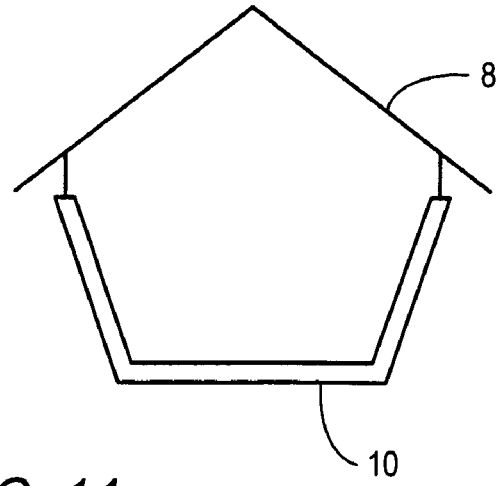
FIG. 14 depicts a covered horizontal hydraulic head channel.

A tube may be used for transporting water and riders underground, underwater, or at some elevated height above ground, as depicted in FIG. 12. The tube 51 may have various additional requirements depending on intended use, such as enough structural support to keep the tube 51 from collapsing if underground or underwater, watertight construction if underwater, and a retractable or permanent cover for protection from the elements if elevated. The tube top 52 may be configured to provide a surface to project lighting effects, to shield a rider from the elements, or may be configured to be waterproof such that the tube 51 may be completely submerged. FIG. 13 shows an elevated horizontal hydraulic head channel 10. The supports 9 in this embodiment may be configured to hold a reservoir of water for use in the channel 10. Finally, FIG. 14 shows a horizontal channel 10 with a cover 8. The cover 8 may be permanent or retractable, depending on its desired function.

The tube may additionally be configured to produce effects for riders in the channel. These effects may be sound, lighting, water, or wind effects, or a combination of effects. In an embodiment, an opaque darkened tube may be configured to project images of high-speed watercraft onto a projection surface inside the tube. Additionally, the tube may be configured with pneumatically or mechanically operated movable gates to produce dynamically changeable rapids effects by varying the position and shape of the gates, and submerged gates at the bottom of sloped portions of channel to produce standing wave effects via high volumes of water. Additional sound, lighting, water and wind effects may created to simulate rider travel at a much higher speed through the tube than the actual rider speed. In another embodiment, a transparent channel, elevated such that a rider may see a view of the water park, is configured to provide information about the view or information about the water park in general. In a further embodiment, a transparent tube submerged in an aquarium or other body of water may be configured to provide information on the animals or exhibits contained in the body of water.

As FIG. 6 illustrates, the water at the output end 30 of the channel 10 is at a lower energy level than water at the input end 20. When two adjacent channel sections 10, 10' are coupled, the system may include a way to provide a rider with additional energy to propel the rider from the low energy output end 30 of one section 10 to the high energy input end 20 of the adjacent section 10'. To accomplish this task, a thick low velocity sheet flow lift station may be used. The lift station may operate by partially or wholly withdrawing oncoming channel water and then reinjecting the water back into the same or an adjacent channel in such a way that the rider and the channel water are propelled to a higher level in a continuous floating motion on the surface of the water through the transfer from lower energy to higher energy water. This method may be used in main channels to replace or supplement conveyor systems, lock systems, floating queue lines (all described herein), and for entry into attached rides.

Figure 15:
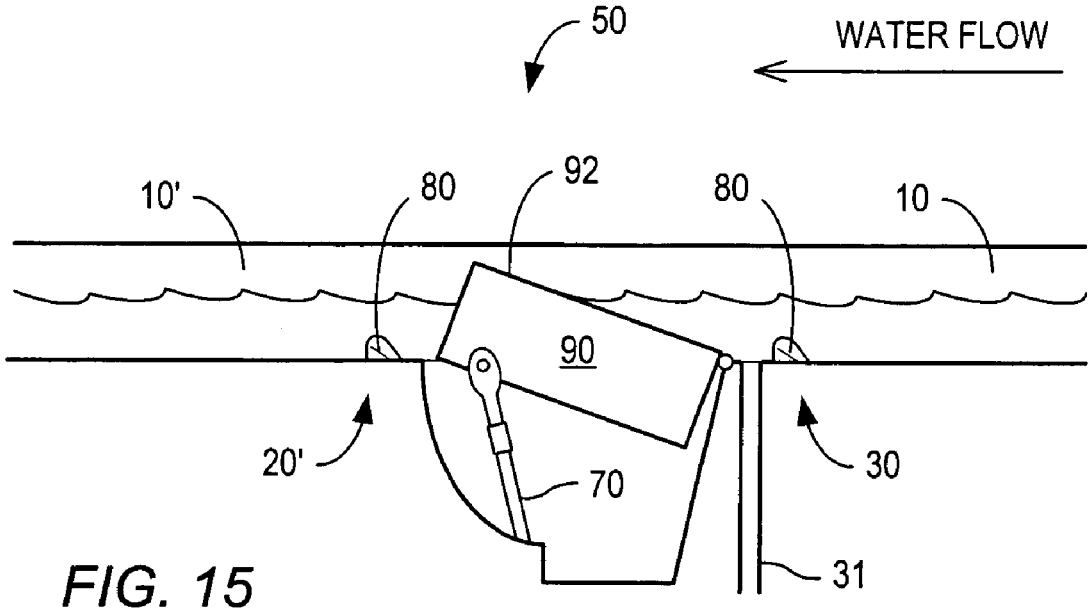
FIG. 15 depicts a thick low velocity sheet flow lift station located at the junction of two adjoining horizontal hydraulic head channels.

The station 50, as shown in FIG. 15, comprises one or more nozzles 80, and an adjustable gate 90. These components are located at the juncture of adjacent channel sections 10, 10' for transfer from the output end 30 of one section 10 to the input end 20' of the next section 10', or may be positioned anywhere along the length L of a section 10 for transfer to an adjoining section 10' or water feature (not shown).

The higher velocity injection water is introduced into the channel 10 from the nozzle 80 (connected to a water source, not shown) at an angle that will allow a rider to be smoothly transferred from the slower incoming stream of water onto the greater velocity injected water and then up and over the upstream face 92 of the gate 90 and into the subsequent channel section 10'. As the water travels up and over the gate 90, its velocity decreases as it exchanges kinetic energy for potential energy. This produces an increase in the thickness of the water in the channel 10 in inverse proportion to the decrease in water velocity. The shape of the gate 90 may prevent backflow of the higher elevation water at the input end 20' of the subsequent channel 10' to the output end 30 of the channel 10. The end result is a continuous flow of water from one channel 10 to the next channel 10'. The input end 20' of the subsequent section 10' will have water of a substantially higher potential energy level than the water at the output end 30 of the preceding section 10 and the water will have enough total energy to transport the rider to the output end 30' of the subsequent section 10'.

Figure 16:
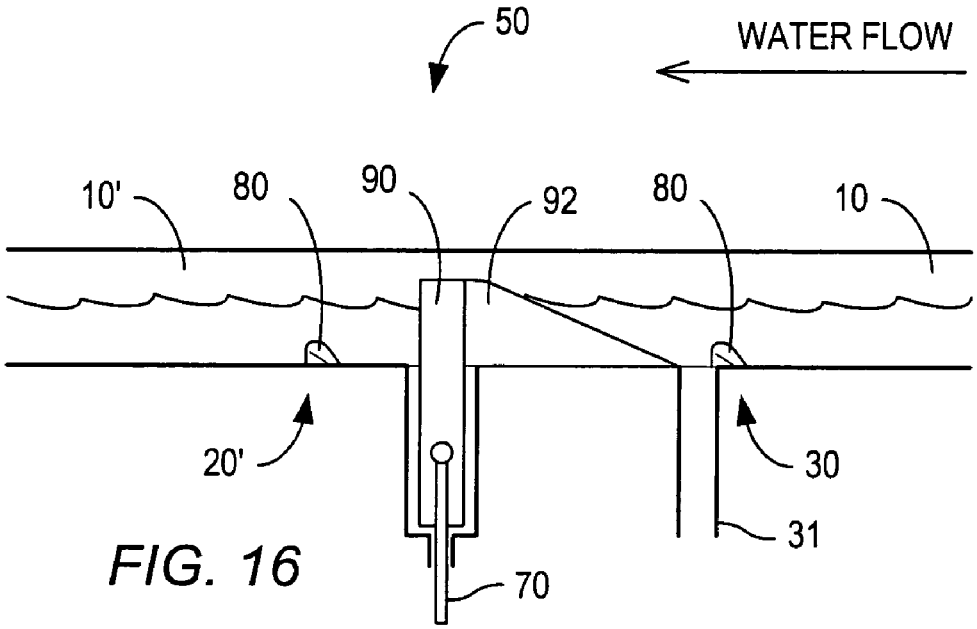
FIG. 16 depicts a movable gate positioned within a channel.

The gate 90 may be used to slow down and thicken the water for a higher level float away. In an embodiment, the gate 90 is placed downstream of the output source 31 and the nozzle 80. The gate 90 may be immovable, or may be adjustable when attached to a pivot arm 70. The arm 70 may be mechanically or pneumatically actuated. FIG. 16 is a view of an alternate embodiment of an adjustable gate 90. It includes a sloped upstream face 92.

Another way to prevent water from flowing upstream from a higher surface elevation is to energize the water sufficiently by increasing its velocity and then causing, through various methods, an acute resistance event that will create a hydraulic jump in which the water is substantially reduced in velocity (kinetic energy) and therefore increased in depth (potential energy) downstream of the hydraulic jump. The higher velocity onrushing water immediately upstream from the hydraulic jump must be of sufficient velocity and momentum to prevent the higher elevation water from moving upstream. This hydraulic jump method requires more energy input than the lift station described above due to additional energy loss of the water from turbulence at the hydraulic jump.

The transfer of riders and water between channels 10, 10' coupled length-to-length and length-to-end may be accomplished in the same way as the transfer for channels 10, 10' coupled end-to-end. The difficulties associated with these end-to-length and length-to-length transfers are not as great as the difficulties in the end-to-end configuration because the energy difference between the incoming stream and the outgoing stream is smaller and the discharge point 31 is not located as close to the input point 21 as with the end-to-end configuration.

In addition to transporting riders along horizontal distances, the water transportation system may be able to transport riders to locations of differing elevations, i.e., from a horizontal channel to a subsequent horizontal channel of a different elevation. Part of the present invention includes a component for maintaining the kinetic energy of riders and/or floatation devices from a lower to a higher elevation or from a higher to a lower elevation while increasing or decreasing the potential energy as needed to produce the desired elevation change. This system comprises a conveyor belt device positioned to allow riders to naturally float up or swim up onto the conveyor and be carried up and deposited at a higher level.

Figure 17:
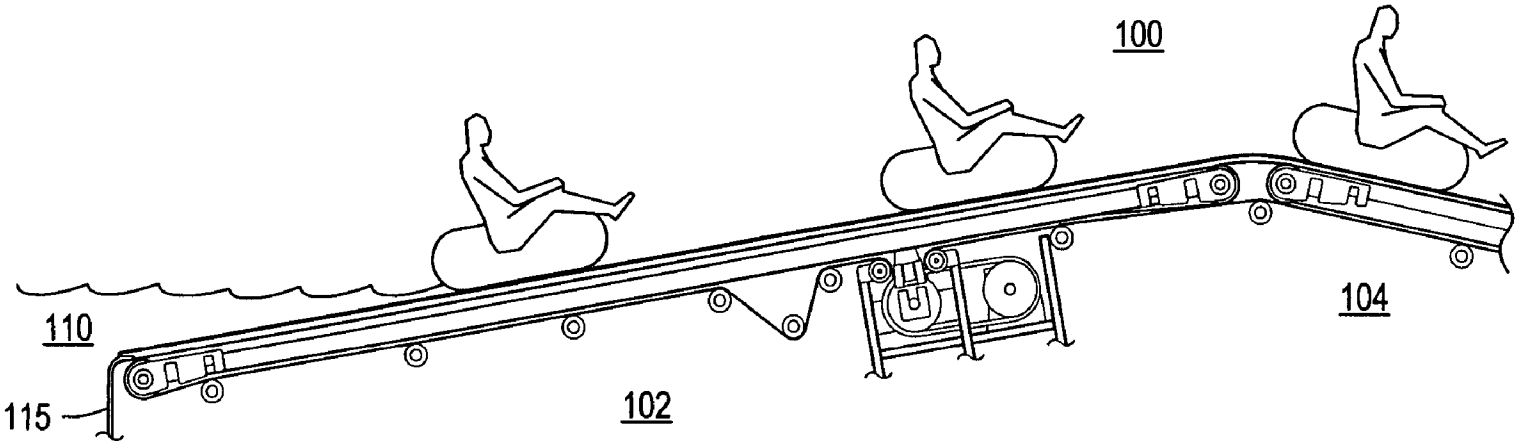
FIG. 17 depicts a side view of a conveyor lift station.
Figure 18:
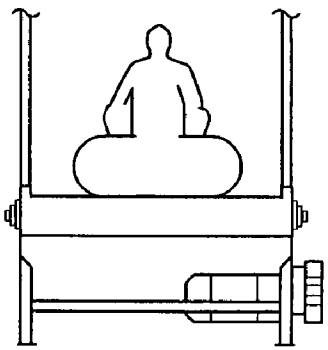
FIG. 18 depicts an end view of a conveyor lift station.

An embodiment of the conveyor lift station 100 is depicted in FIG. 17, and includes an inclined conveyor 102 and a launch conveyor 104. The infeed end 110 of the inclined conveyor 102 may extend below the surface of the incoming water. The infeed end 110 includes a deflector plate 115 located over the terminal wheel 120 to protect against access to the rotating terminal roller 125. The deflector plate 115 may extend from the top of the terminal wheel 120 to the channel bed at an angle so that it will guide riders up onto the conveyor belt 130. As used herein, a "belt" may generally refer to a continuous band of flexible material for transmitting motion and power or conveying materials. The conveyor belt 130 tension may be maintained by counterbalanced primary and secondary rollers. The rollers may be coupled to a drive unit 145. The drive unit may be configured to provide a rotational force to the rollers. Running the full length on the top surface of the belt 130 at either side is a wear strip (not shown) that may act as nip protection between the running and static surfaces.

At the interface 152 of the inclined conveyor 102 and the launch conveyor 104 is a rotating anti-nip unit (not shown) that rotates away from the point of nip in the event that an object tries to pass through the interface 152. In the event of rotation of the unit, a limit switch (not shown) may operate the emergency stop circuit (not shown) to activate the brake (not shown) on the drive unit 145 to stop the belt 130.

A launch conveyor 104 comprises rollers coupled to a timing belt which is in turn coupled to a drive motor. The top of the discharge end of the conveyor 104 extends below the surface of the outgoing stream of water for smoother entry into the water.

Figure 19:
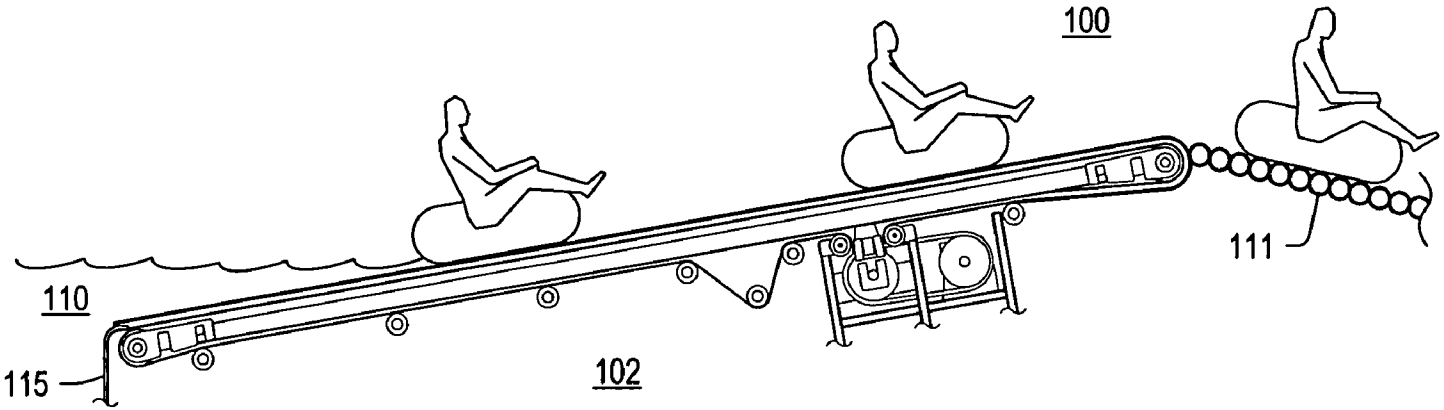
FIG. 19 depicts a two person conveyor lift station.
Figure 20:
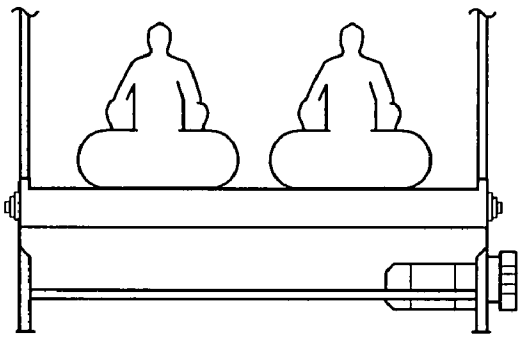
FIG. 20 depicts an end view of a two person conveyor lift station.

Another embodiment of the conveyor 100 is shown in FIGS. 19 and 20. This embodiment includes only an inclined conveyor 102, and a system of rollers 111 which act to launch the participant. The depicted conveyor is designed to receive two riders and floatation devices at the time at the infeed end 110. The infeed end 110 of the inclined conveyor 102 extends below the surface of the incoming water. The infeed end 110 includes a deflector plate 115 located over the terminal wheel 120 to protect against access to the rotating terminal roller 125. The deflector plate 115 extends straight down from the top of the terminal wheel 120 to the channel bed. Conveyor belt 130 tension is maintained by counterbalanced primary and secondary rollers, with the drive unit 145 mounted inline and fitted with a force vent cooler (not shown) and fast action brake (not shown). The belt 130 speed may be adjusted between 0.5 feet per minute and 5.0 feet per minute. Running the full length on the top surface of the belt 130 at either side is a wear strip (not shown) that may act as nip protection between the running and static surfaces.

Figure 21:
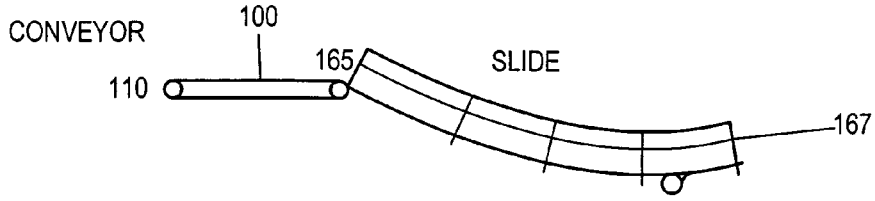
FIG. 21 depicts a side view of a conveyor lift station coupled to a water ride.
Figure 22:
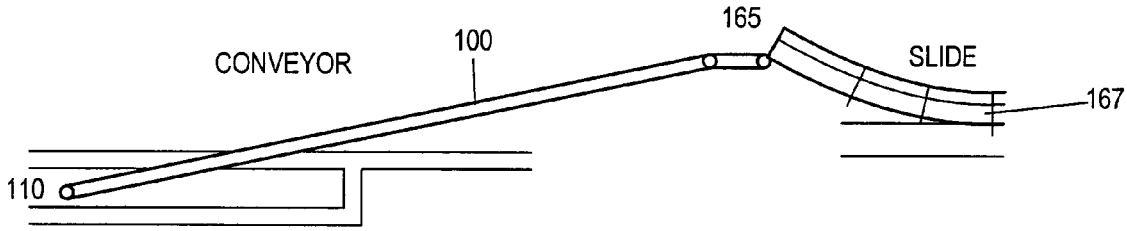
FIG. 22 depicts a side view of a conveyor lift station with an entry conveyor coupled to a water slide.
Figure 23:
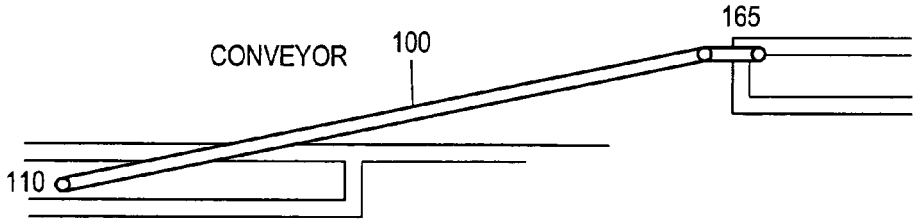
FIG. 23 depicts a side view of a conveyor lift station coupled to an upper channel.

More embodiments of conveyor systems are shown in FIGS. 21, 22, and 23. FIG. 21 shows a dry conveyor for transporting riders entering the system into a channel. It includes a conveyor belt portion ending at the top of a slide 167 which riders slide down on into the water. FIG. 22 shows a wet conveyor for transporting riders from a lower channel to a higher one with a slide 167 substituted for the launch conveyor. FIG. 23 shows a river conveyor for transporting riders from a channel to a lazy river. This embodiment does not have a descending portion.

Figure 24:
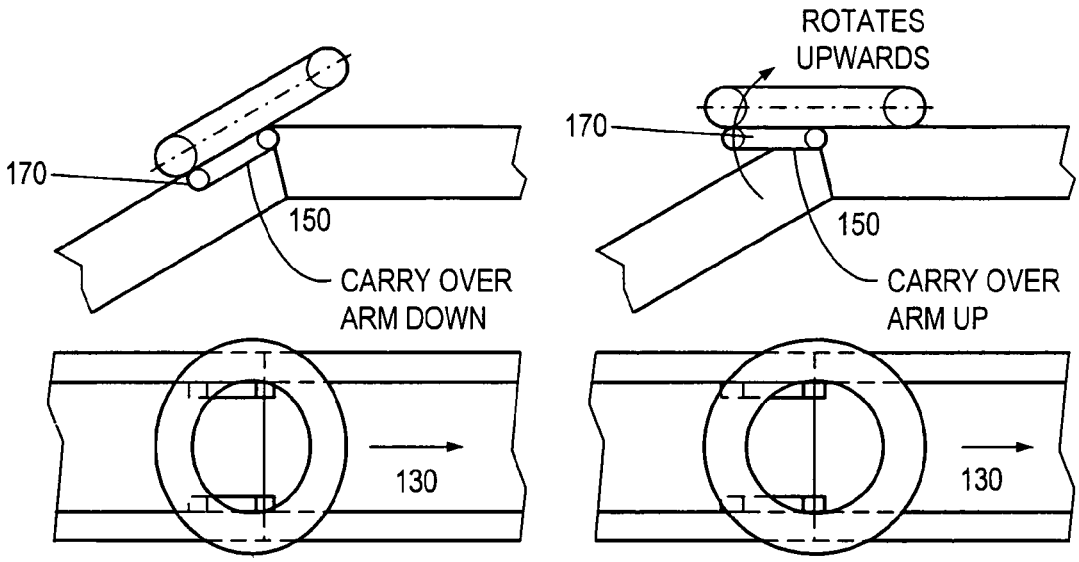
FIG. 24 depicts a side view of the apex of a conveyor lift station showing carry over arms.

In some situations, it may be desirable to include carryover arms 170 (depicted in FIG. 24) to facilitate transfer of riders over the apex 150 of a conveyor 100. Additionally, the conveyor 100 with slide 167 configuration may allow riders to move away from the discharge end 165 in response to contact from subsequent riders. This configuration is useful when the required exit velocity of the conveyor system 100 is larger than the velocity of the conveyor belt 130. The conveyor 100 may also include entry lanes in the incoming stream so as to better position riders onto the conveyor belt 130.

The speed of the conveyor belt 130 may normally be between 1 foot per second and 5 feet per second. These speeds may vary (through the use of a variable speed drive mechanism) in accordance with several factors. The rider density (and therefore ride demand) in the park may dictate changing the conveyor belt 130 speeds to control the rate of rider introduction to and discharge from a ride or channel to match the demand. The speed of the conveyor 130 may be varied to match water velocities and rider speeds entering and leaving the conveyor 100. This will reduce acceleration changes experienced by a rider (possible causing the rider to become unbalanced) moving from a current of water onto the conveyor belt 130. Conveying the riders from the incoming stream at the same rate they arrive at the conveyor 100 will prevent rider buildup at the infeed end 110 to the conveyor 100. The riders must also move from the discharge end 165 of the conveyor 100 at the same rate as riders enter the infeed end 110 to prevent rider buildup at the discharge end 165 of the conveyor 100. This may be accomplished by setting the conveyor belt 130 speed slightly lower than the arrival and exit speeds of the riders. In situations where there is an input time requirement for the ride in which the conveyor 100 discharges, the conveyor belt 130 speed can be set so that riders are discharged at a set minimum rate into the ride when the riders are stacked upon the conveyor 100 at the maximum design density. This may be important in instances where the conveyor 100 launches riders onto a water ride that requires safety intervals between the riders.

Figure 25:
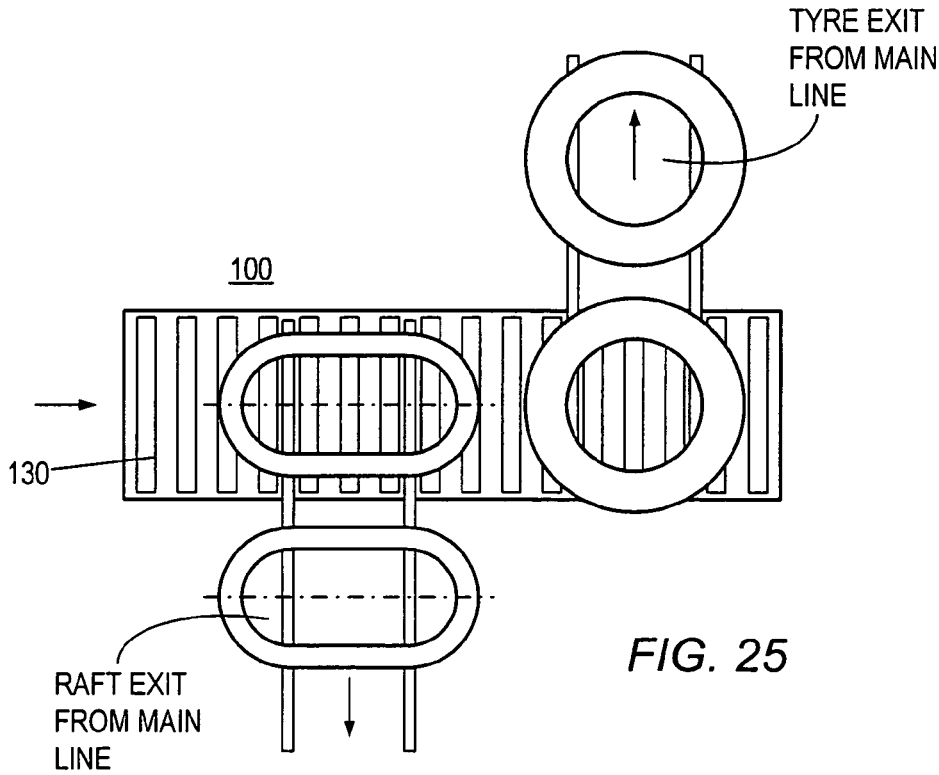
FIG. 25 depicts a overhead view of a system for transporting floatation devices to a conveyor system.

The conveyor belt system 100 may also be used to take riders and vehicles out of the water flow at stations requiring entry and/or exit from the channel (depicted in FIG. 25). Riders and vehicles float to and are carried up on a moving conveyor belt 130 on which riders may exit the vehicles and new riders enter the vehicles and be transported into the channel or station at a desired location and velocity. These conveyors 100 would not be designed to lift riders from one level to a higher one but to lift riders and vehicles out of the water, onto a horizontal moving platform and then return the vehicle with a new rider to the water.

There are several safety concerns to address in connection with the conveyor system 100. The belt 130 should be made of a material and with physical surface design to provide good traction to riders and vehicles on the slope in wet conditions while not being unpleasant to the touch of wet, sun-sensitized skin which may contact the belt 105 or causing undue wear on vehicles; the belt 130 must also be designed to withstand alternating exposure to chlorinated water and sunlight. Electrical and motor works should be designed to operate in an aqueous environment containing wet riders and to resist exposure to chlorinated water and sunlight. The conveyor 100 angle of ascent must be small enough to safely transfer riders up the slope in a manner that will not cause them to tip over backwards or otherwise roll or slide back down the conveyor belt 130. The indicated maximum safe angle is now considered to be less than about 18%.

Additional safety features include safety relay detection cells designed to scan a defined height above the moving conveyor belt to detect if any rider on the conveyor is standing up. Rotation detection devices mounted to idler wheels will monitor belt movement and notify the conveyor control system that the belt is moving when the drive is running. Brake devices will be mounted along the length of the conveyor and will be activated in the event that rotation is not detected while the drive is running. There may also be a local remote station for the operator which will allow remote starting, stopping, and emergency stopping. It may also include a fault light indication with a flashing beacon and a programmable key lock pad for control of the drive unit, and a mimic indication for which the emergency stop is activated. Located around the site of the conveyor may be additional emergency stop buttons. Finally, electrical interlocks may allow the conveyor to operate only when the main control system is functioning.

Figure 26:
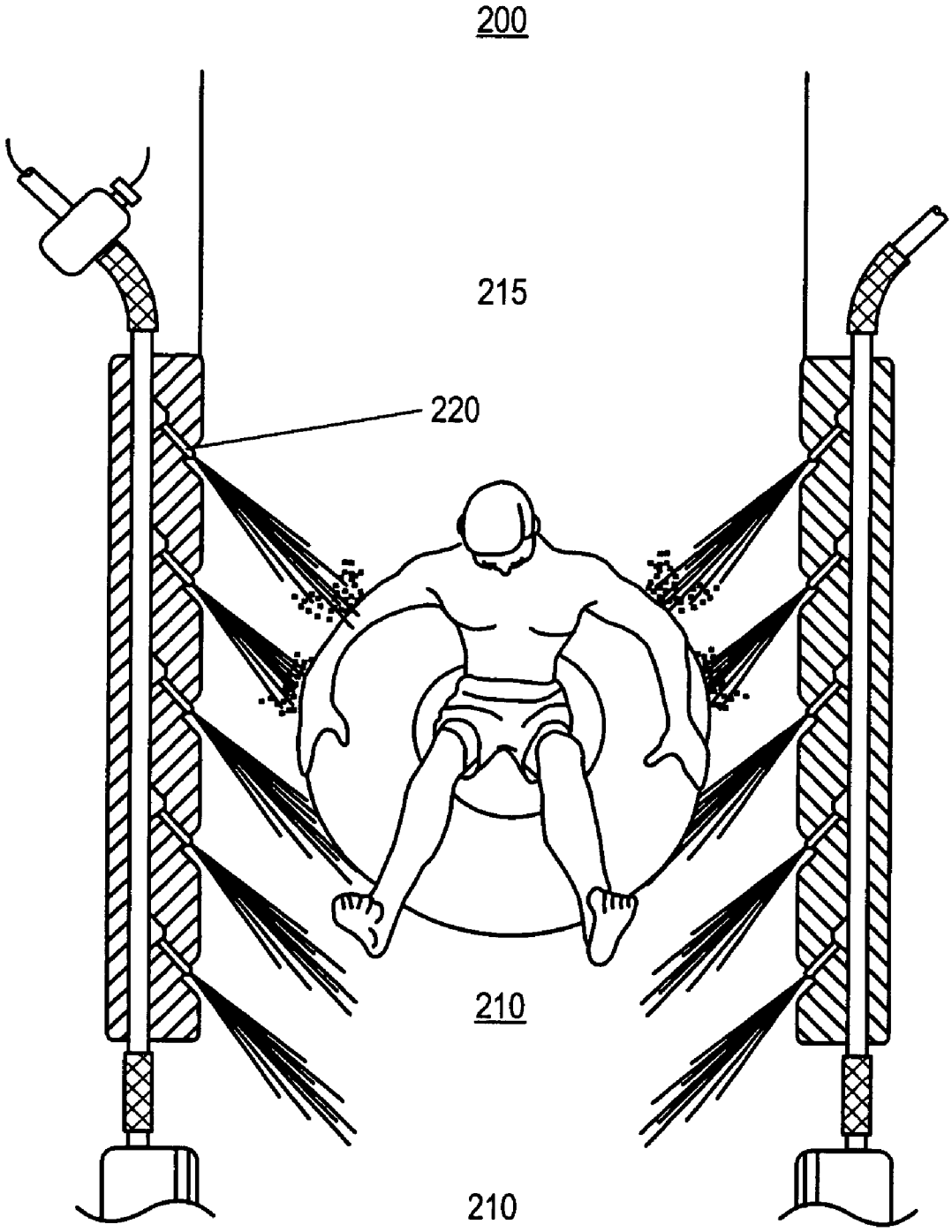
FIG. 26 depicts a floating queue line with jets.

In some embodiments, a floating queue line system for positioning riders in an orderly fashion and delivering them to the start of a ride at the desired time may be coupled to the channels of a water transportation system. In one embodiment (depicted in FIG. 26), the system 200 includes a queue channel 205 coupled to a water ride at a discharge end 210 and coupled to a transportation channel on the input end 215. The channel 205 contains enough water to allow riders to float in the channel 205. The channel 205 additionally comprises high velocity low volume jets 220 located along the length of the channel 205. The jets are coupled to a source of pressurized water (not shown). Riders enter the input end 215 of the queue channel 205 from the coupled transportation channel, and the jets 220 are operated intermittently to propel the rider along the channel at a desired rate to the discharge end 210. This rate may be chosen to match the minimum safe entry interval into the ride, or to prevent buildup of riders in the queue channel 205. The riders are then transferred from the queue channel 205 to the water ride, either by a sheet flow lift station (as described previously) or by a conveyor system (also described previously) without the need for the riders to leave the water and/or walk to the ride. Alternatively, propulsion of the riders along the channel 205 may be by the same method as with horizontal hydraulic head channels; that is, by introducing water into the input end 215 of the channel 205 and removing water from the discharge end 210 of the channel 205 to create a hydraulic gradient in the channel 205 that the riders float down. In this case, the introduction and removal of water from the channel 205 may also be intermittent, depending on the desired rider speed.

Gates may be located throughout the system and may serve multiple purposes. As stated previously, adjustable sloped face gates will be used with thick low velocity sheet flow lift stations to transfer riders from channel to channel or from channel to station. Adjustable gates capable of horizontal and/or vertical movement may be used in conjunction with nozzles and pumps to produce rapids effects, including standing waves, in currents of water. These or other mechanically or pneumatically adjustable gates may be used to modify velocity and other channel flow characteristics. They may also be used for containment purposes when the system is not in use or in a pump shutdown or other unusual operating condition. Overflow gates are also provided for use in some larger deep flow channels, to release measured amounts of water into other channels. The floating gates allow a substantially constant overflow during changing water line heights in the larger channel.

Figure 27:
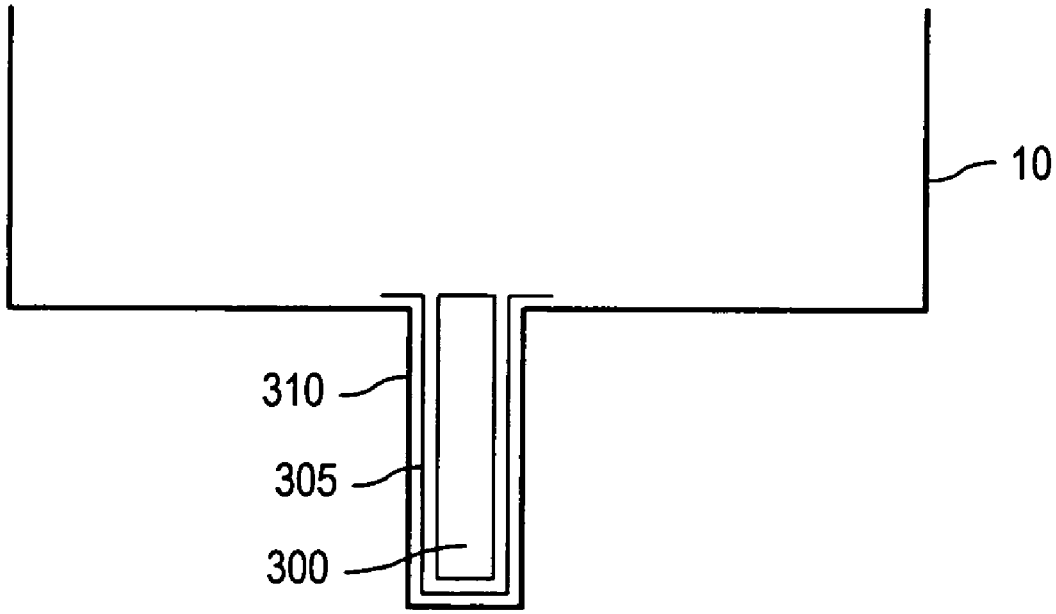
FIG. 27 depicts a movable gate disposed within a channel.

FIG. 27 shows a vertically movable gate 300 within a sleeve 305 housed in a gate well 310 in a channel section 10. The gate well 310 is configured to receive the sleeve 305. The depth of the well 310 must be great enough to accept the total desired vertical displacement of the gate 300. Additionally, if the upstream face of the gate 300 is sloped or otherwise contoured (to produce water effects or for use in thick low velocity sheet flow lift stations), the well 310 must be shaped accordingly to house the gate 300 in a retracted position.

Figure 28:
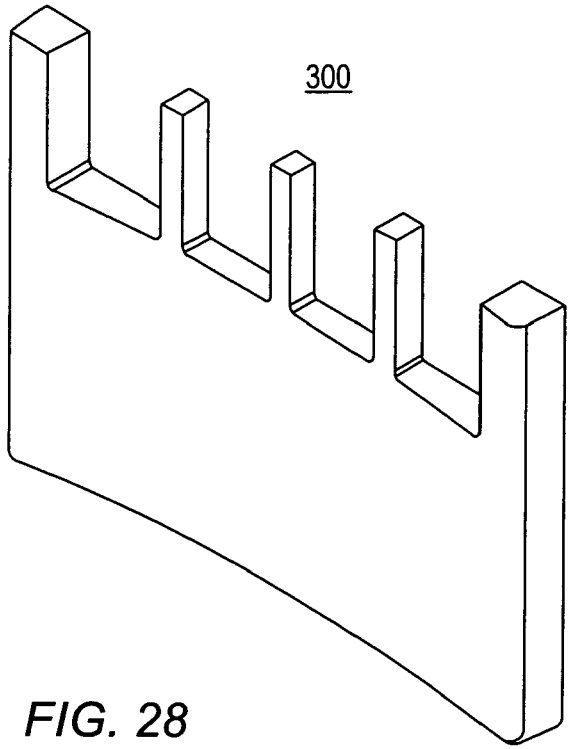
FIG. 28 depicts an embodiment of a gate.
Figure 29:
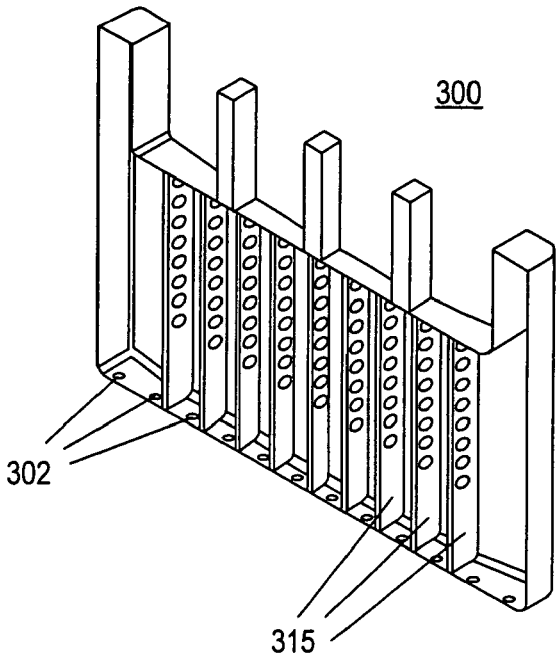
FIG. 29 depicts a cross-sectional view of a movable gate.

The sleeve 305 serves to house the gate 300 and provide a low friction sliding surface for the gate 300 along the downstream inner surface of the sleeve 305. The gate 300 is shown in FIGS. 28 and 29. In this embodiment, the gate 300 is substantially hollow and pneumatically operated; it may contain one or more stiffening webs 315 or foam inserts for structural support. The gate 300 defines one or more water ports 302 to allow water to flow in and out of the gate 300. The gate 300 defines one or more valves (not shown) configured to be coupled to a compressed air source (not shown). During use, compressed air may be introduced into the gate 300 via the valve, which will force water out of the ports 302, causing the buoyancy of the gate 300 to increase and the gate 300 to float upward. When the gate 300 is lowered, air is released from the valve, allowing water to enter the port 302 and fill the gate 300, decreasing the buoyancy of the gate 300 and causing it to sink downward.

Figure 30:
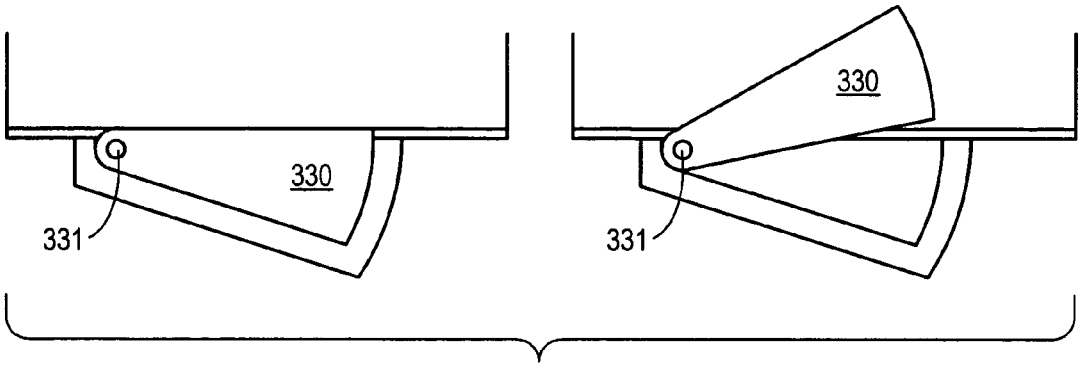
FIG. 30 depicts a cross-sectional side view of a movable obstruction.
Figure 31:
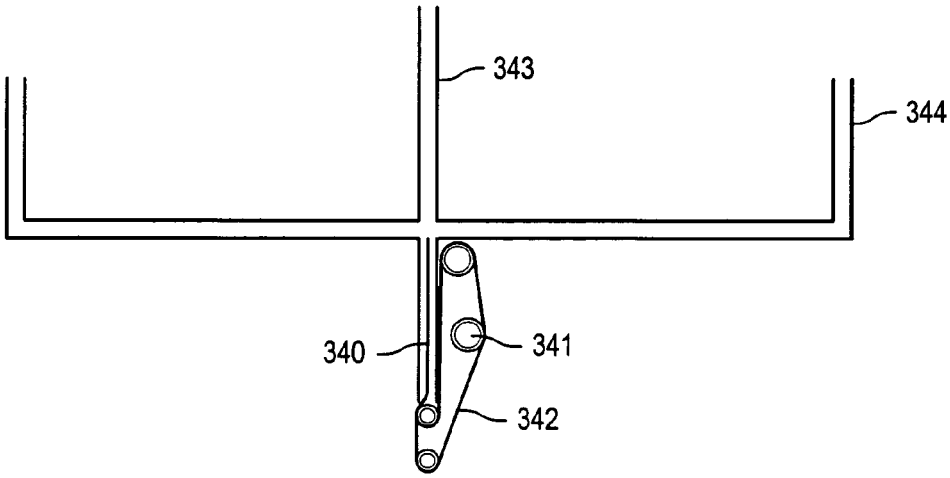
FIG. 31 depicts a cross-sectional side view of a movable obstruction.

Further embodiments are shown in FIGS. 30 and 31. The gate 330 of FIG. 30 rotates up or down around the pivot 331. The gate 330 may be mechanically or pneumatically operated. The gate 340 in FIG. 31 is operated by a motor 341 and pulley system 342. The gate 340 moves vertically in the slide channel 343 in the wall of the transportation channel 344.

The lower areas in a channel long enough to require lifting stations along the channel length may become areas where water naturally accumulates during shutdown. Containment pools at these low points in the system may be provided with enough extra freeboard to accommodate the shutdown condition of water accumulation. In practice these pools may serve additional purposes such as swimming pools or splashdown areas for water rides. If the containment pools are deep enough to pose a drowning threat, they may be equipped with safety baskets configured to move vertically in the pool as the water level changes to prevent riders from going below a desired depth in the pool.

Figure 32:
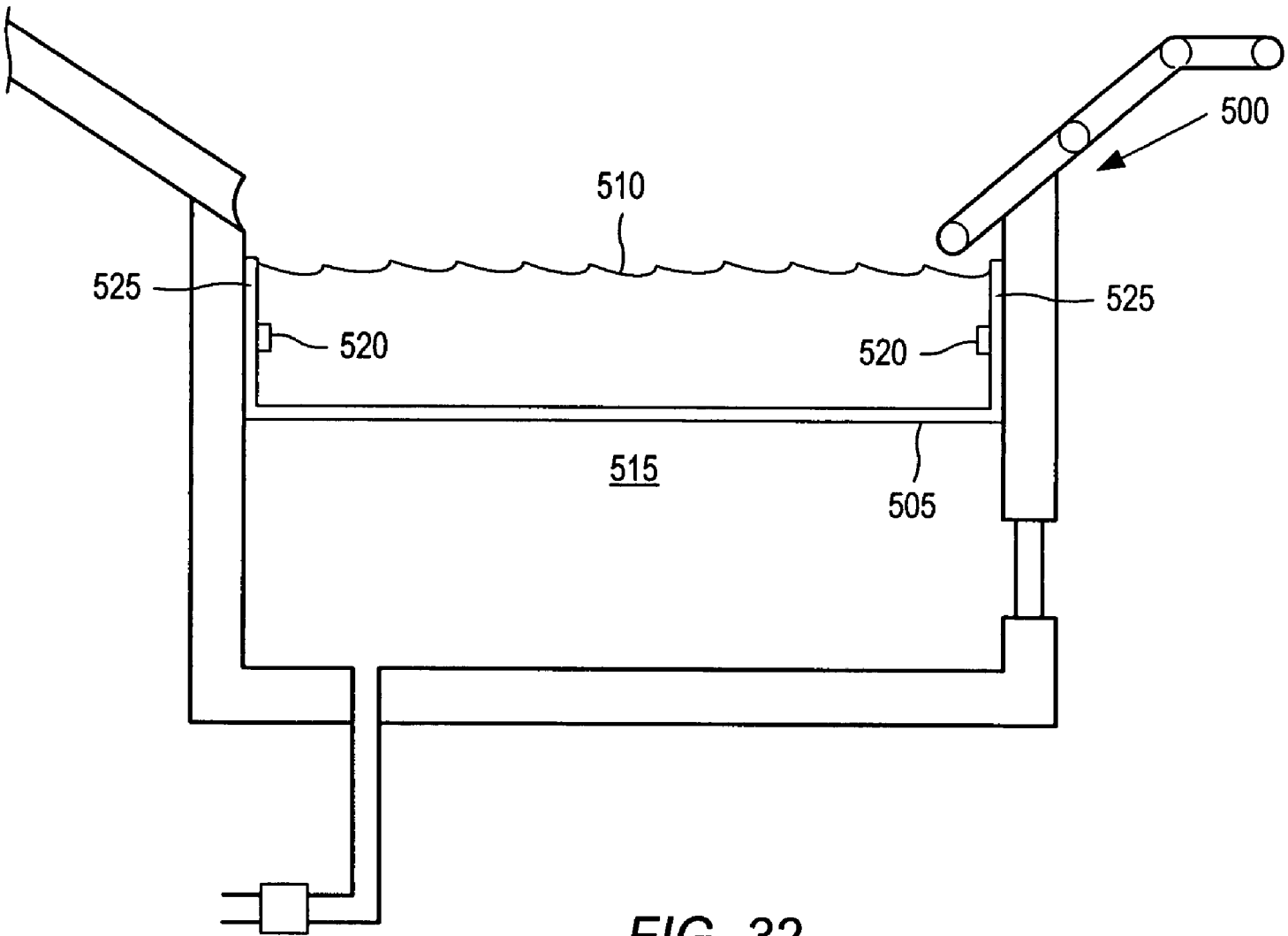
FIG. 32 depicts a cross sectional side view of a containment pool.

FIG. 32 shows one embodiment of a containment pool 500 at a low point in the system. Bottom member 505 may be configured to remain at a substantially constant distance from the upper surface 510 of the water 515 in the pool 500 as the water level in the pool 500 changes. Floatation members 520 may be placed on wall 525 to provide buoyancy to bottom member 505. By placing floatation members 520 at a location between the bottom member 505 and the top of wall 525 the level at which the bottom member 505 remains below the surface 510 may be maintained. For example, by placing floatation members 520 at a position approximately three feet from the bottom of wall 525, bottom member 505 may be maintained at a position of at least about 3 feet below the surface 510 of the water 515. In one embodiment, floatation members 520 are placed on wall 525 at a position such that the bottom member remains about 3 feet below the upper surface 510 of the water 515 and such that wall 525 extends about 3 feet above the surface 510 of the water 515.

Figure 33:
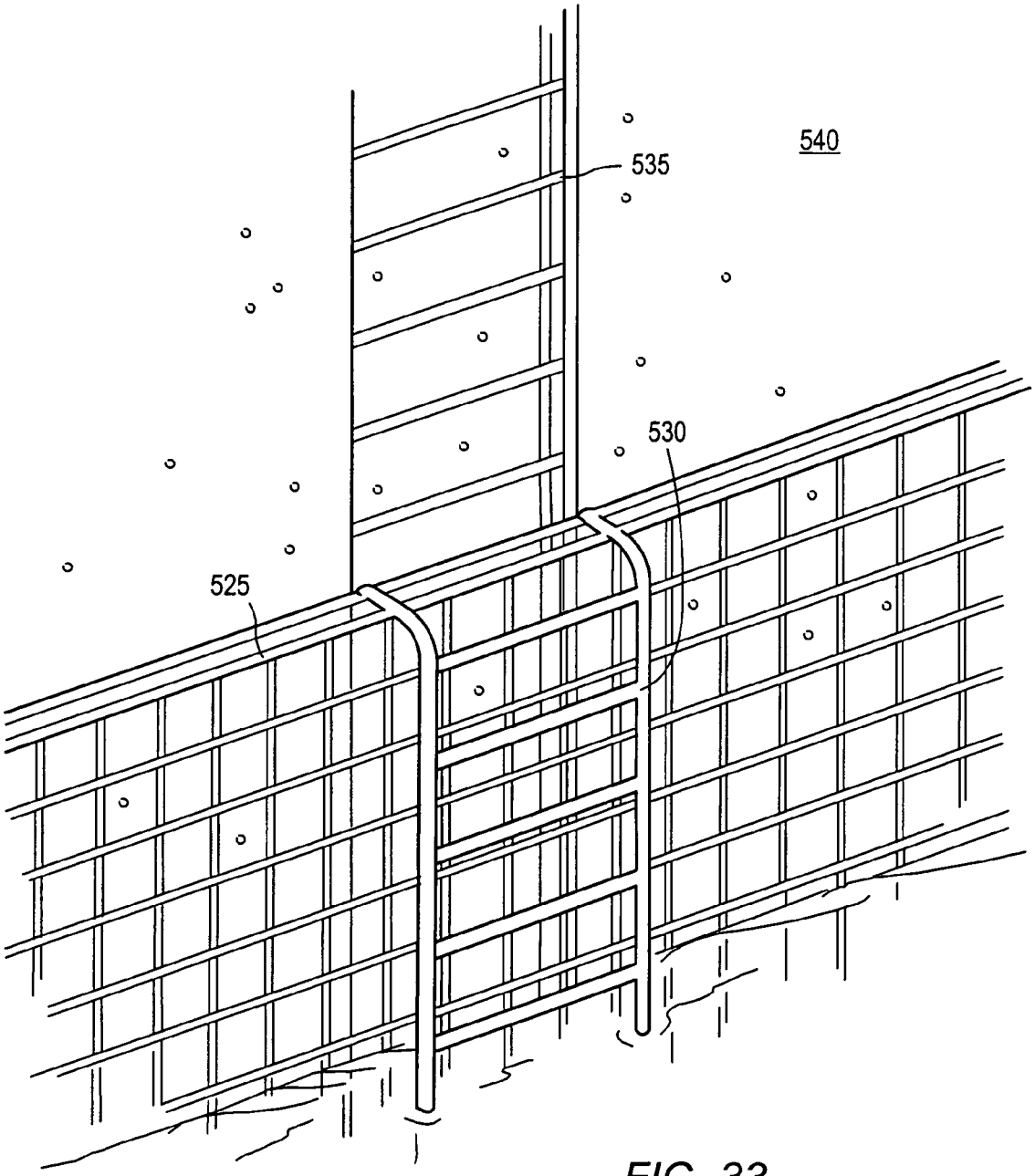
FIG. 33 depicts a perspective view of a ladder coupled to the wall and the bottom member.

FIG. 33 shows an embodiment of a containment pool 500 with bottom member 505 additionally including a ladder 530 extending along a vertical portion of wall 525 of the bottom member 505. Ladder 530 may extend from the bottom member (not shown) to the top of wall 525. A complimentary ladder 535 may be formed in an inner surface of the outer wall 540 of the pool 500. The complementary ladder 535 may extend the entire vertical height of the pool 500 and is substantially aligned with the ladder 530 of the bottom member 505. As the bottom member 505 is raised or lowered, ladder 530 and ladder 535 may remain substantially aligned such that at any given time participants may exit the pool 500 by climbing up the ladders 530, 535. In the event that the pool 500 cannot be filled to a height allowing participants to exit the pool 500, the ladders 535, 530 may allow participants to exit the pool 500. Thus, the ladder system may help to prevent participants from becoming trapped in the pool 500 in the event of unusual operating conditions in the system.

Figure 34:
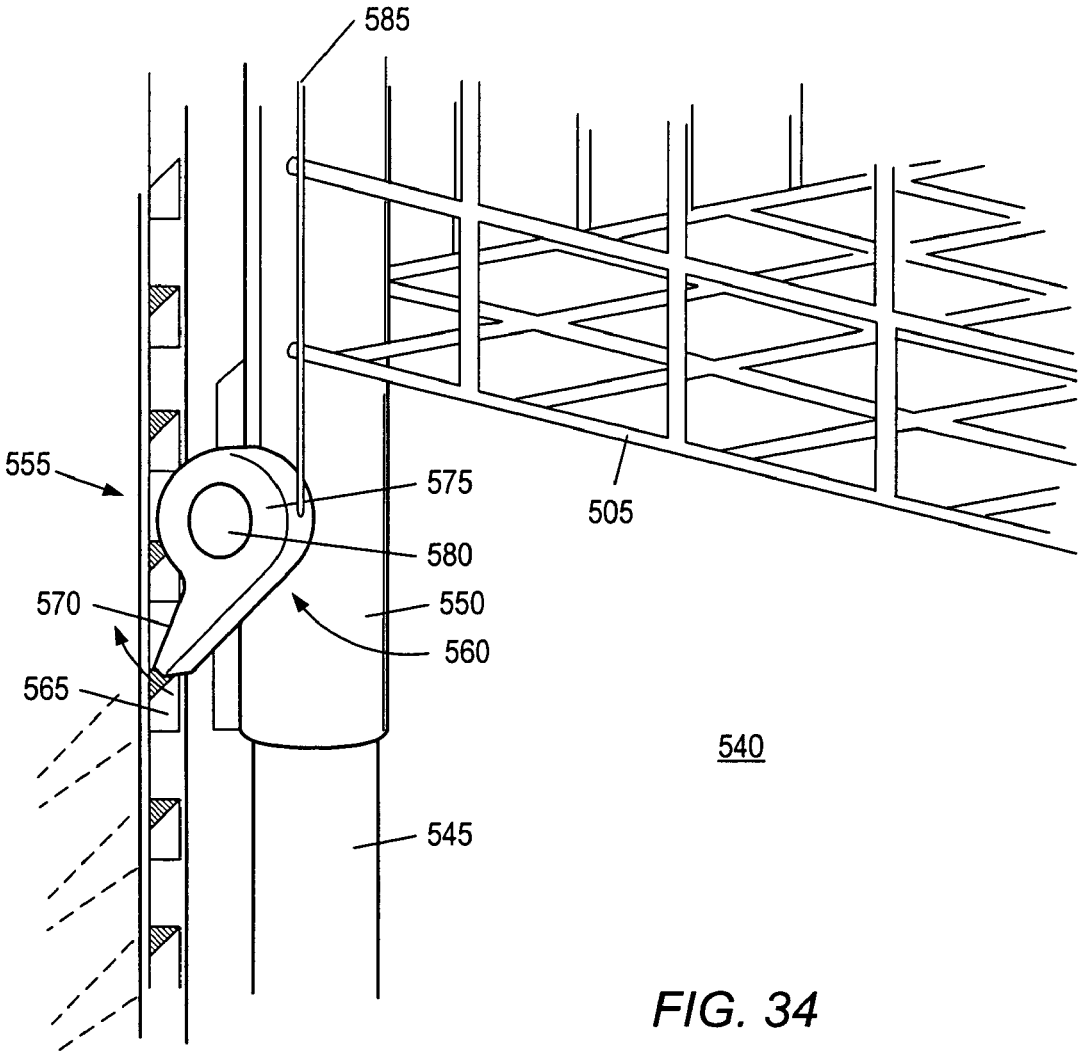
FIG. 34 depicts a perspective view of a ratcheted locking mechanism.

In an embodiment, bottom member 505 is preferably coupled to outer wall 540 by at least one guide rail 545 formed on the inner surface of the outer wall 540, as depicted in FIG. 34. An engaging member 550 may couple bottom member 505 to guide rail 545. Engaging member 550 may substantially surround a portion of guide rail 545 such that the engaging member 550 is free to move vertically along the guide rail 545, but is substantially inhibited from becoming detached from the guide rail 545. The coupling of bottom member 505 to guide rail 545 may reduce the bobbing movement of the bottom member 505 while the bottom member 505 is floating within the pool 500. The engaging member 550 may also include a motor configured to move the bottom member 505 vertically within the pool 500. The use of a motor to move the bottom member 505 allows the bottom member 505 to be moved without floating the bottom member 505.

A ratcheted locking system 555 may also be incorporated onto bottom member 505. Ratchet locking system 555 includes a locking member 560 which is configured to fit into grooves 565 formed in the inner surface of outer wall 540. Locking member 560 may include a protrusion 570 extending from the main body 575 configured to fit into grooves 565. The main body 575 may include a ratchet system 580 which forces protrusions 570 against outer wall 540. A ratchet system may allow locking member 560 to rotate relatively freely in one direction, while allowing only a constrained rotation in the opposite direction. As depicted in FIG. 34, the locking member 560 may be configured such that rotation in a clockwise direction is constrained. As bottom member 505 moves up the wall 540 the protrusion 570 may be forced into one of the grooves 565 when aligned with a groove 565. As the bottom member 505 is forced up by the rising water, protrusion 570 may slide out of one groove 565 and into another groove. Protrusion 570 may extend from main body 575 of locking member 560 at an angle to facilitate removal of the protrusion from a groove 565 as bottom member 505 moves upward.

When bottom member 505 moves in a downward direction, locking system 555 may inhibit the downward movement of the bottom member 505. As bottom member 505 moves downward, protrusion 570 may extend into one of grooves 565. The locking member 560, as described above, may only rotate for a limited distance in a clockwise direction. Thus, once protrusion 570 is extended into a groove 565, the protrusion 570 may lock bottom member 505 at that position, preventing further movement of the bottom member 505 in a downward direction. The bottom member 505 may be unlocked by raising the bottom member 505 or via a release mechanism which is incorporated into the ratchet system 580.

In response to changing conditions in the transportation system, the water level of the pool 500, along with the bottom member 505, may be lowered. To lower the bottom member 505, a release system may be incorporated into the ratchet system 580. The release system may be configured to allow the locking system 555 to be moved into a position such that protrusion 570 no longer makes contact with the grooves 565. This may allow the bottom member 505 to be moved in a downward direction. In one embodiment, a flexible member 585 (e.g., a chain, rope, wire, etc.) may be attached to locking member 560. To allow bottom member 505 to be lowered, flexible member 585 may be pulled such that the protrusion 570 is moved away from grooves 565 (i.e., the locking member 560 is rotated in a counterclockwise direction, as depicted in FIG. 34). Flexible member 585 may be manually or automatically operated.

Figure 35:
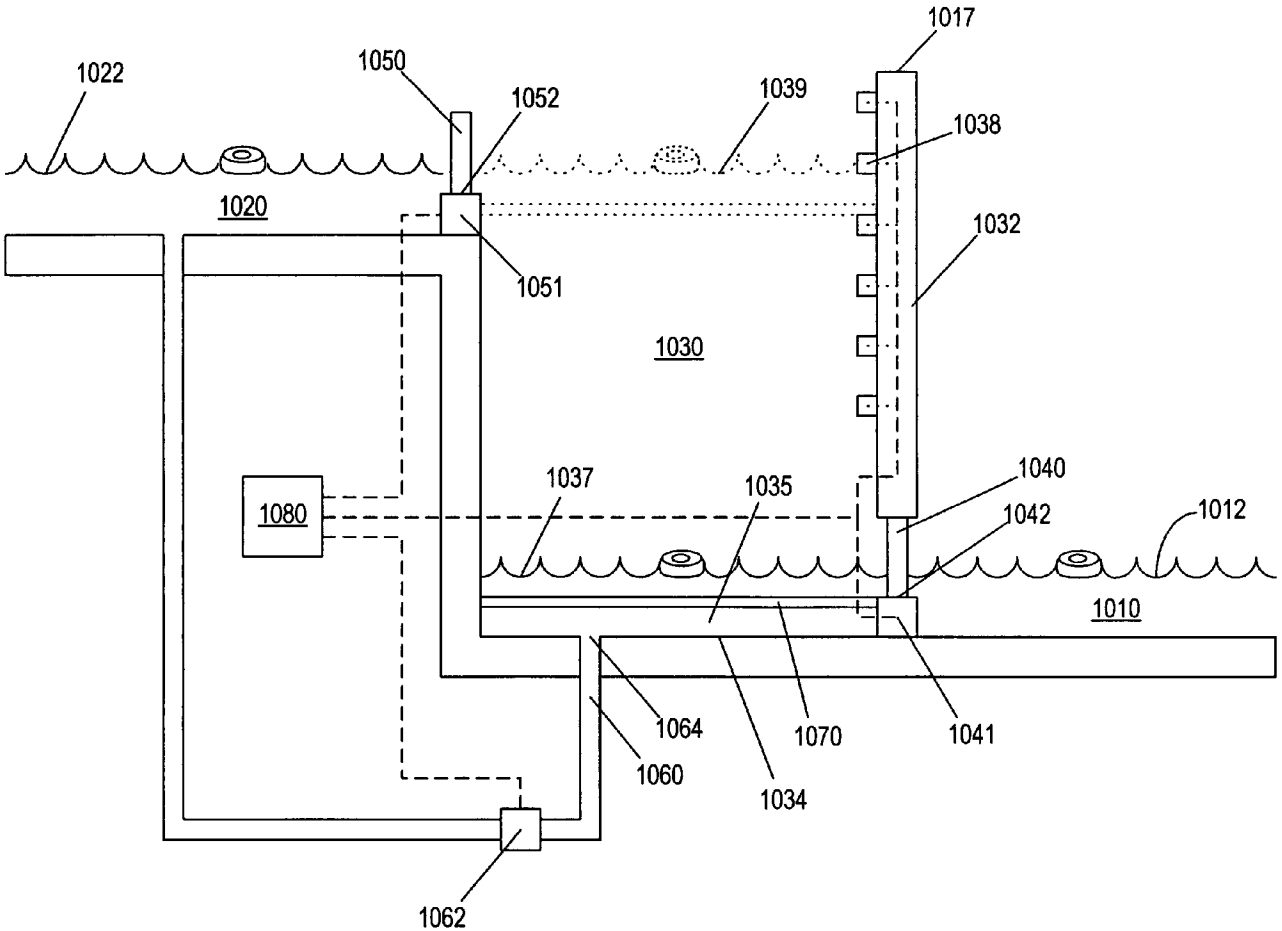
FIG. 35 depicts a cross-sectional side view of a water lock system with one chamber and a conduit coupling the upper body of water to the chamber.
Figure 36:
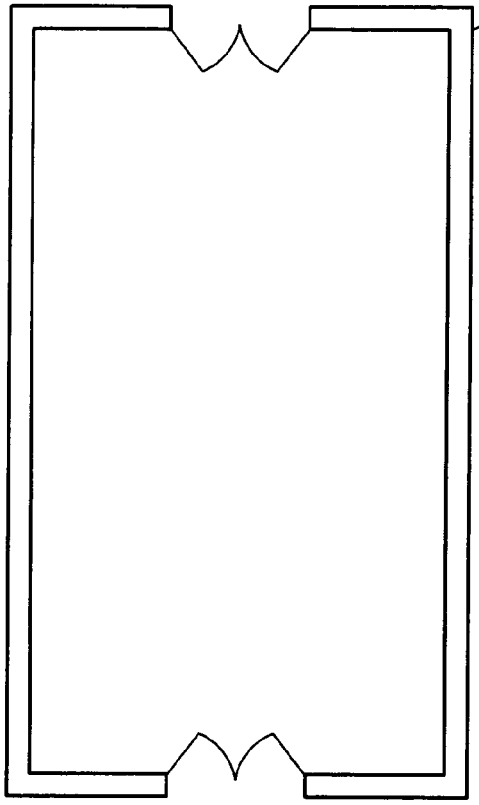
FIG. 36 depicts an overhead view of a rectangular lock system.

In another embodiment a water lock system may be used to transport participants from a low elevation point to an upper elevation point. A water lock system may be used to allow participants to remain in water while being transported from a first body of water to a second body of water, the bodies of water being at different elevation levels. In one embodiment, the first body of water may be a body of water having an elevation below the second body of water. FIG. 35 depicts a water lock system for conveying a person or a group of people (i.e., the participants) from a lower body of water 1010 to an upper body of water 1020. It should be understood that while a system and method of transferring the participants from the lower body of water to the upper body of water is herein described, the lock system may also be used to transfer participants from an upper body to a lower body, by reversing the operation of the lock system. The upper and lower bodies of water may be receiving pools (i.e., pools positioned at the end of a water ride), entry pools (i.e., pools positioned to at the entrance of a water ride), another chamber of a water lock system, or a natural body of water (e.g., a lake, river, reservoir, pond, etc.). The water lock system, in one embodiment, includes at least one chamber 1030 coupled to the upper and lower bodies of water. First movable member 1040 and second movable member 1050 may be formed in an outer wall 1032 of the chamber. First movable member 1040 may be coupled to lower body of water 1010 such that the participants may enter chamber 1030 from the lower body of water while the water 1035 in the chamber is at level 1037 substantially equal to upper surface 1012 of the lower body of water. After the participants have entered chamber 1030, the level of water within the chamber may be raised to a height 1039 substantially equal to upper surface 1022 of upper body of water 1020. Second movable member 1050 may be coupled to upper body of water 1020 such that the participants may move from chamber 1030 to the upper body of water after the level of water in the chamber is raised to the appropriate height.

Outer wall 1032 of chamber 1030 may be coupled to both lower body of water 1010 and upper body of water 1020. Outer wall 1032 may extend from a point below upper surface 1012 of lower body of water 1010 to a point above upper surface 1022 of upper body of water 1020. Outer wall 1032 may be formed in a number of different shapes, as depicted in FIGS. 36-39. Outer wall 1032 of the chamber may, when seen from an overhead view, be in a rectangular shape (FIG. 36), a U-shape (FIG. 37), a circle (FIG. 38), an L-shape (FIG. 39), as well as a number of other shapes not depicted, including, but not limited to, a square, a star, other regular polygons (e.g., a pentagon, hexagon, octagon, etc.), a trapezoid, an ellipse, a Y-shape, a T-shape, or a figure eight.

Returning to FIG. 35, first movable member 1040 may be in contact with lower body of water 1010. First movable member 1040 may extend from a position below upper surface 1012 of lower body of water 1010 to a point above upper surface 1012. First movable member 1040 may extend from a position below the upper surface of lower body of water 1010 to the top 1017 of outer wall 1032. First movable member 1040 may be formed in a portion of outer wall 1032 which is substantially shorter then the vertical length of the wall. In one embodiment, first movable member 1040 extends to a depth below upper surface 1012 such that participants may easily enter the chamber without contacting the lower surface 1042 of the first movable member. If participants are to be able to walk into the chamber, first movable member 1040 may extend to the bottom 1034 of chamber 1030. Thus, participants may enter the chamber without tripping over a portion of outer wall 1032. In one embodiment, the participants will enter the chamber while floating at or proximate the upper surface 1012 of the water. The lower surface 1042 of first movable member 1040 may be positioned at a depth of between about 1 foot to about 10 feet below upper surface 1012 of lower body of water 1010, more preferably at a depth of between about 2 feet to about 6 feet from upper surface 1012, and more preferably still at a depth of between about 3 feet to about 4 feet from upper surface 1012. As the participants float from lower body of water 1010 into chamber 1030, they may pass over lower surface 1042 of first movable member 1040 with little or no contact with the lower surface of the movable member.

Second movable member 1050 may be in contact with upper body of water 1020. Second movable member 1050 may extend from a position below upper surface 1022 of upper body of water 1020 to a point above upper surface 1022. Second movable member 1050 may extend from a position above upper surface 1022 of lower body of water 1020 to the bottom 1034 of chamber 1030. Second movable member 1050 may be formed in a portion of outer wall 1032 which is substantially shorter then the vertical length of the wall. Second movable member 1050 may be formed at a position in outer wall 1032 such that participants may move from chamber 1030 to upper body of water 1020, when water 1035 within the chamber is at the appropriate level. In one embodiment, second movable member 1050 extends to a depth below upper surface 1022 of upper body of water 1020 to allow participants to enter the upper body of water without contacting lower surface 1052 of the second movable member. The participants may enter the upper body of water while floating at or proximate the upper surface 1039 of the water within the chamber 1030. The lower surface 1052 of second movable member 1050 may be positioned at a depth of between about 1 foot to about 10 feet from upper surface 1022 of upper body of water 1020, more preferably at a depth of between about 2 feet to about 6 feet from upper surface 1022, and more preferably still at a depth of between about 3 feet to about 4 feet from upper surface 1022. As the participants float from chamber 1030 to upper body of water 1020, they may pass over lower surface 1052 of second movable member 1050 with little or no contact.

In one embodiment, water may be transferred into and out of chamber 1030 via movable members 1040 and 1050 formed within outer wall 1032. Opening of the movable members 1040 and 1050 may allow water to flow into chamber 1030 from the upper body of water 1020 or out of the chamber into lower body of water 1010. Control of the movable members 1040 and 1050 may allow chamber 1030 to be filled and lowered as needed.

In another embodiment, a conduit 1060 may be coupled to chamber 1030. Conduit 1060 may be configured to introduce water from a water source into chamber 1030. A water control system 1062 may be positioned along conduit 1060 to control flow of water through the conduit. Water control system 1062 may be a valve which is configured to control the flow of water from a pressurized water source to chamber 1030 during use. Water control system 1062 may also include a pump, as described later, for increasing the flow rate of water flowing through conduit 1060.

In one embodiment, conduit 1060 may be coupled to upper body of water 1020. Conduit 1060 may be configured to allow water from upper body of water 1020 to be transferred to chamber 1030. Water control system 1062 may be used to control the transfer of water from upper body of water 1020 to chamber 1030. In one embodiment, conduit 1060 is positioned such that an outlet 1064 of the conduit enters chamber 1030 at a position below upper body of water 1020. In this manner, upper body of water 1020 may act as a pressurized water source for the supplying water to chamber 1030. In this embodiment, the water control system 1062 may be a simple two way valve. To fill chamber 1030, the valve may be adjusted to an open position, allowing water from upper body of water 1020 to enter the chamber. When a desired amount of water has entered chamber 1030, the valve may be closed to inhibit further passage of water from upper body of water 1020 to the chamber.

A bottom member 1070 may be positioned within chamber 1030. Bottom member 1070 may be configured to float at a position below upper surface 1037 of water 1035 in chamber 1030. As chamber 1030 is filled with water, bottom member 1070 will rise toward the top of the chamber. In one embodiment, bottom member 1070 remains at a substantially constant distance from upper surface 1037 of water 1035 as the water rises within chamber 1030. Bottom member 1070 may remain at a distance of less than about 6 feet from upper surface 1037 of water 1035, preferably at a distance of less than about 4 feet from upper surface 1037, and more preferably at a distance of less than about 3 feet from upper surface 1037.

During operation, chamber 1030 is filled with water to elevate the participants to a level commensurate with the level of water in upper body of water 1020. As the level of water 1035 in chamber 1030 increases, some participants may become apprehensive or upset once the level of water passes a depth which is over the participants' heads. This may especially be true for younger or less experienced swimmers. To assuage the fears of these participants, bottom member 1070 may be positioned at a depth below the surface of the water such that most or all of the participants may easily stand upon the bottom member as the water begins to rise. In this manner, the participants will be lifted by the incoming water, while feeling confident that if they should tire or fall off a floatation device they may rest upon bottom member 1070. Bottom member 1070 may also reduce the risk of participants drowning. If a participant becomes fatigued or separated from their floatation device, the position of bottom member 1070 will ensure that the participant will always be able to stand with their head above or near upper surface 1037 of water 1035 if desired.

Figure 78:
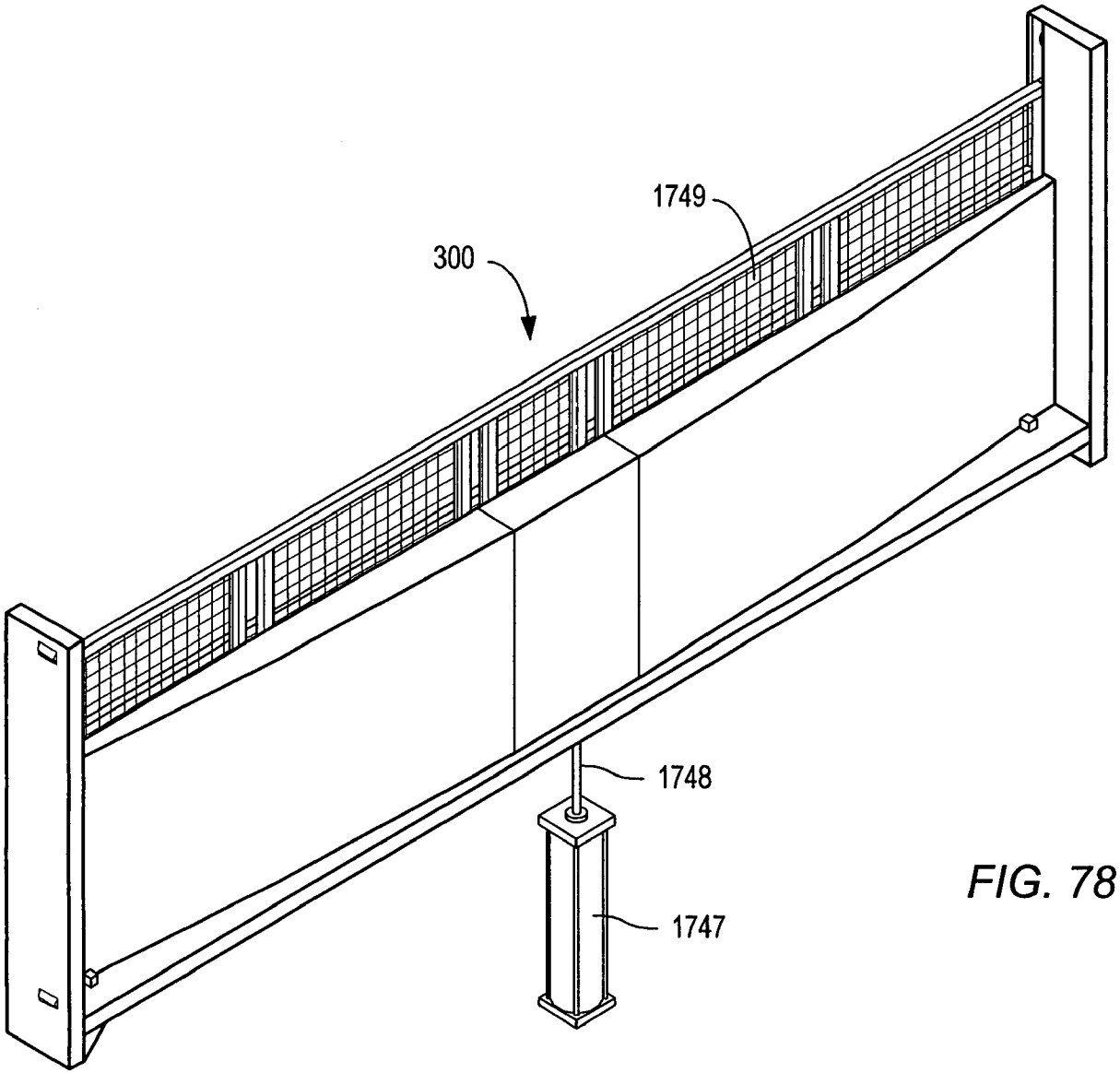
FIG. 78 is an alternate embodiment of a side elevational view of a gate of the lock assembly of FIG. 69.
Figure 79:
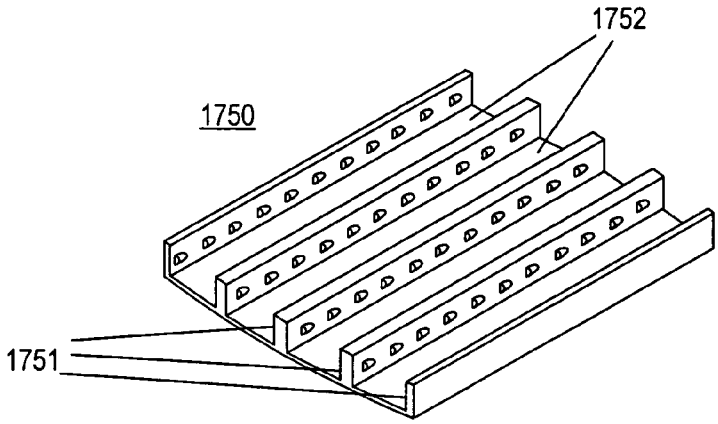
FIG. 79 is a side elevational view of the basket of the lock assembly of FIG. 69.
Figure 80:
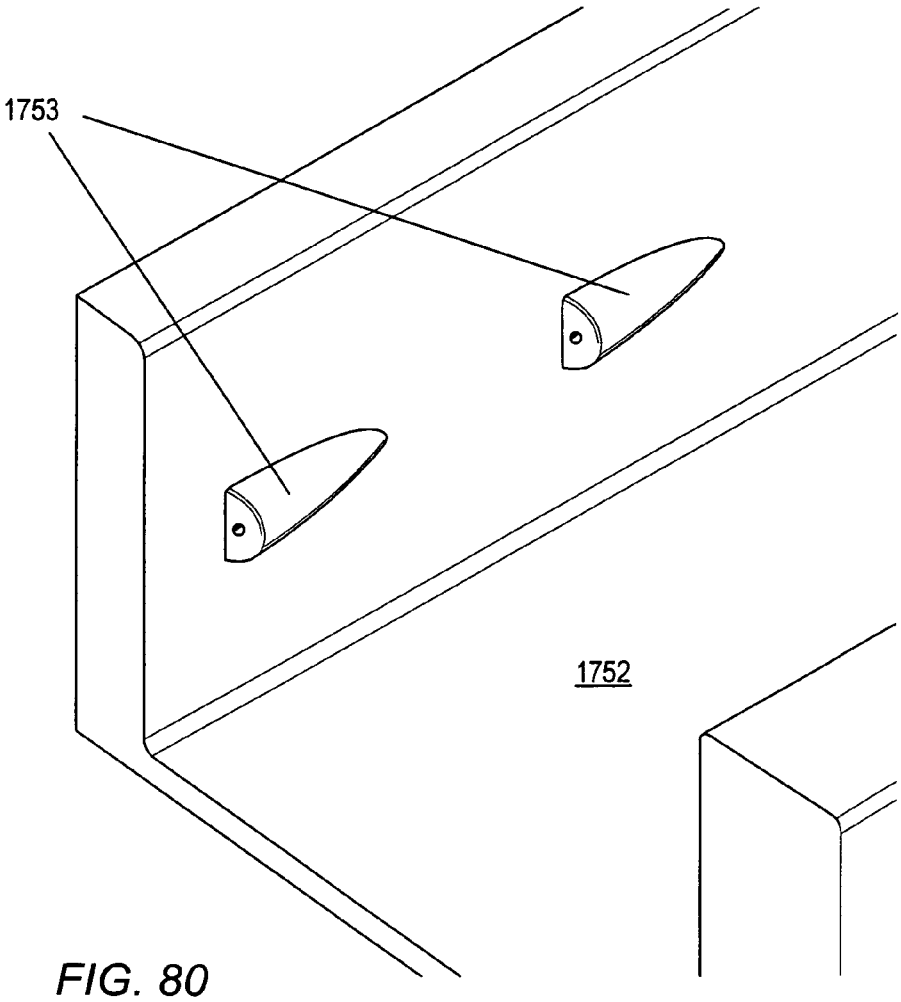
FIG. 80 is a side elevational view of the nozzles of the basket of the lock assembly of FIG. 69.

An automatic control system 1080 may be coupled to the water lock system. The controller 1080 may be a computer, programmable logic controller, or any of other known controller systems known in the art. The controller may be coupled to water control system 1062, first movable member 1040, and second movable member 1050. The controller may control the operation of the first and second movable members and the operation of the water control system. A first movable member operating mechanism 1041 may be coupled to first movable member 1040 to allow automatic opening and closing of the first movable member. Operating mechanism 1041 may be hydraulically or pneumatically operated, examples of this mechanism are depicted in FIGS. 15, 16, and 78. The controller may send signals to first movable member operating mechanism 1041 to open first movable member 1040, while maintaining second movable member 1050 and water control system 1062 in closed positions. After the participants have entered the chamber, the controller may signal first movable member operating mechanism 1041 to close first movable member 1040 and signal water control system 1062 to allow water to enter chamber 1030. The controller may be configured to allow the water to flow into chamber 1030 for a predetermined amount of time. Alternatively, sensors 1038 for determining the level of the water 1035 within chamber 1030 may be positioned on an inner surface of outer wall 1032. In one embodiment, sensors 1038 are positioned at various heights along outer wall 1032. When water 1035 within chamber 1030 reaches sensors 1038, the sensors may produce a signal to automatic controller 1080 which indicate the current height of the water within the chamber. A second movable member operating mechanism 1051 may be coupled to second movable member 1050 to allow automatic opening and closing of the second movable member. After the water has reached the desired level, automatic controller 1080 may be configured to signal water control system 1062 to stop the flow of water to chamber 1030 and second movable member operating mechanism 1051 to open second movable member 1050 allowing the participants to move to upper body of water 1020.

Figure 40:
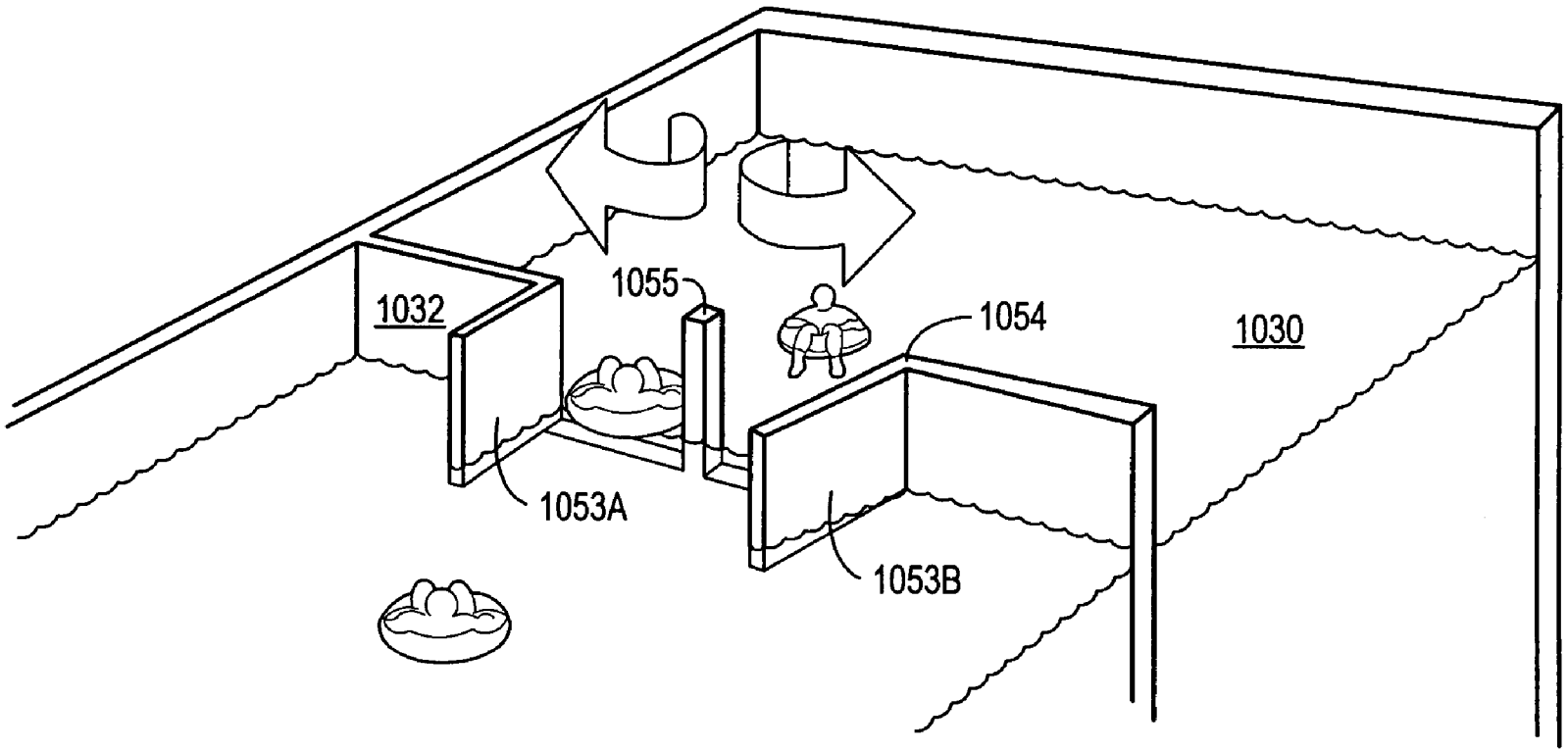
FIG. 40 depicts a perspective view of a lock system which includes swinging door movable member.

First movable member 1040 and/or second movable member 1050 may be a swinging door, as depicted in FIG. 40. The movable members may include a single door, or, preferably a pair of doors 1053*a* and 1053*b*. The doors may be coupled to outer wall 1032 by a hinge 1054. Hinge 1054 allows the doors to swing away from outer wall 1032 when moving from a closed to an open position. An "open position" is a position which allows water and/or participants to be transferred through the movable member. A "closed position" is a position which inhibits passage of water and/or participants through the movable member. The doors 1053*a/b* may swing into chamber 1030 or away from chamber 1030. If two doors are used a divider 1055 may be positioned between the two doors 1053*a/b*. Divider 1055 may serve as a support to help maintain doors 1053*a/b* in a closed position. A hydraulic or pneumatic movable member operating system 1041 (see FIG. 35) may be coupled to doors 1053*a/b* to facilitate opening and closing of the doors during use. Doors 1053*a/b* may have a length which is substantially equal to the vertical length of outer walls 1032. Doors 1053*a/b* may have a vertical length of between about 3 to about 6 feet, preferably a vertical length of between about 3 feet to about 4 feet.

Figure 41:
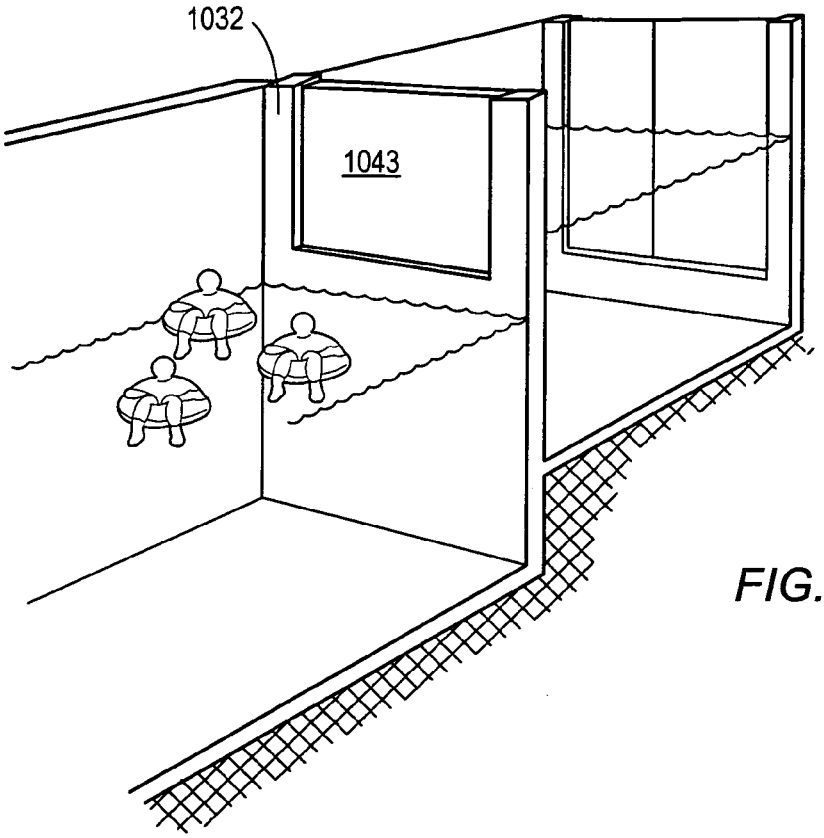
FIG. 41 depicts a perspective view of a lock system which includes a vertically movable member with the movable member in a closed position.
Figure 42:
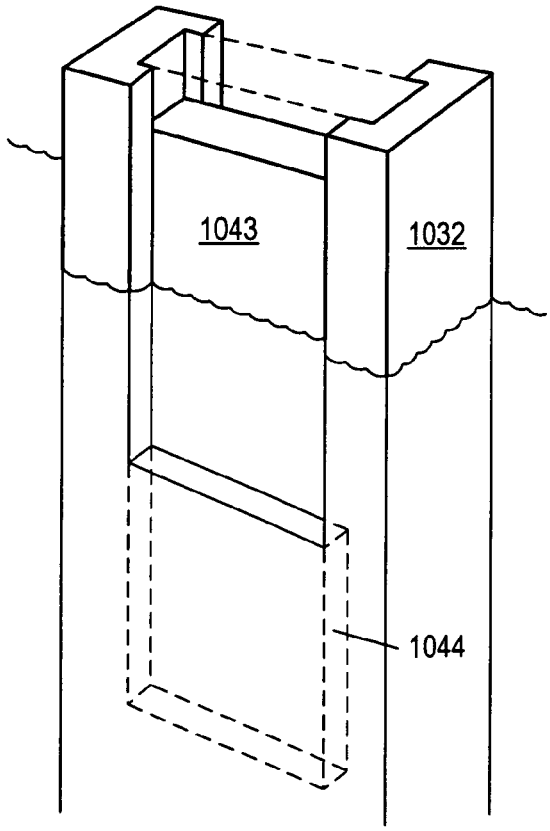
FIG. 42 depicts a perspective view of a vertically movable member moving to an open position.
Figure 43:
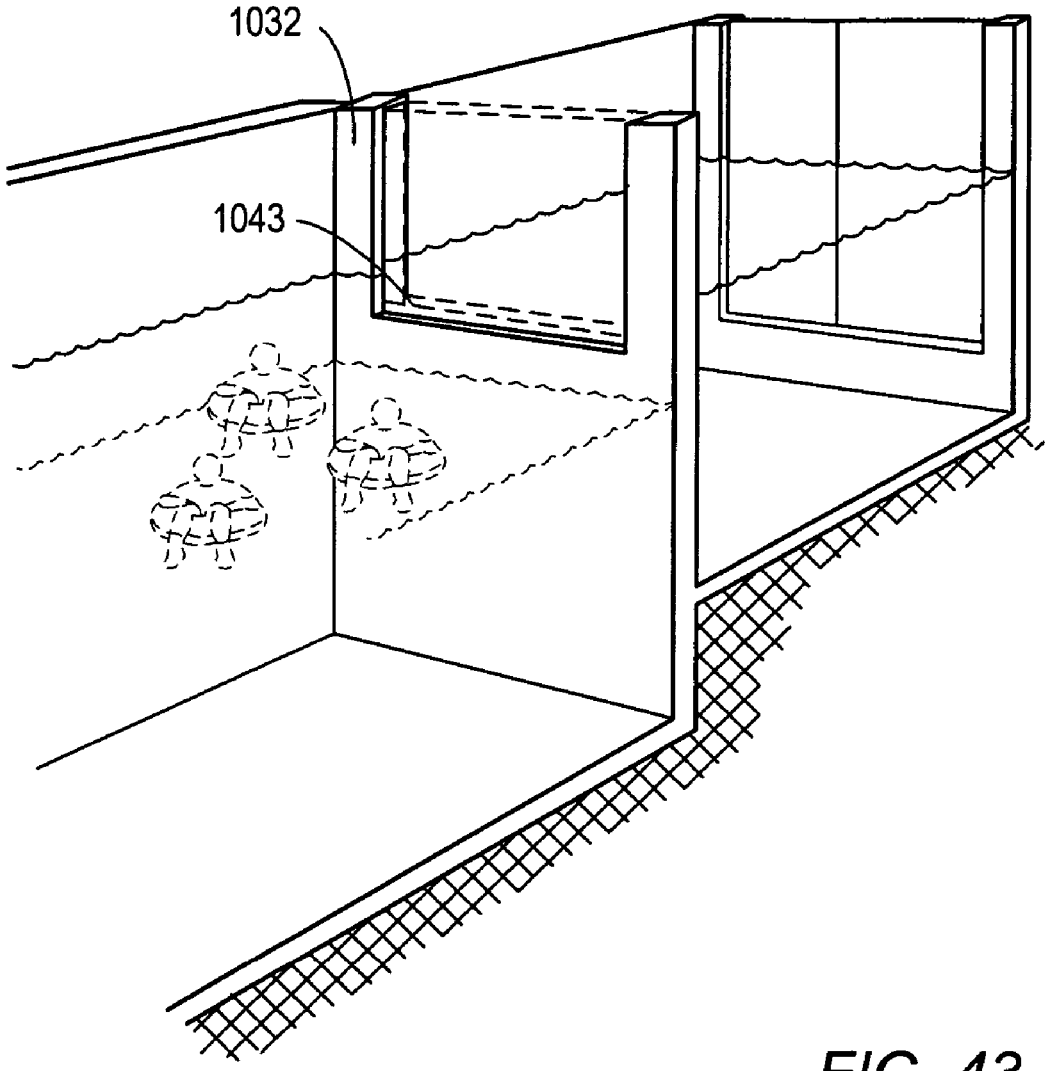
FIG. 43 depicts a perspective view of a lock system which includes a vertically movable member with the movable member in an open position.

In another embodiment, depicted in FIGS. 41-43, first movable member 1040 and/or second movable member 1050 may be a door 1043 configured to move vertically into a portion of outer wall 1032. As depicted in FIG. 42, when door 1043 moves from a closed position (See FIG. 41) to an open position (see FIG. 43) the door may be moved into a cavity 1044 formed in outer wall 1032. In FIG. 42, door 1043 is configured to move down into cavity 1044 when moving into an open position. A hydraulic movable. member operating system 1041 (see FIG. 35), or similar devices, may be positioned within outer wall 1032 to move the door up or down. The door preferably has a vertical length of between about 3 feet to about 6 feet, more preferably a vertical length of between about 3 feet to about 5 feet.

When a movable member, is positioned near an upper body of water, the movable member may be lowered into the wall (as depicted in FIGS. 41-43). When a movable member is positioned near a lower body of water the door of the movable member may be formed in the middle of the wall, or near the bottom of the wall. In this case, the movable member may be moved from a closed position to an open position by moving the movable member in an upward or downward direction.

Figure 44:
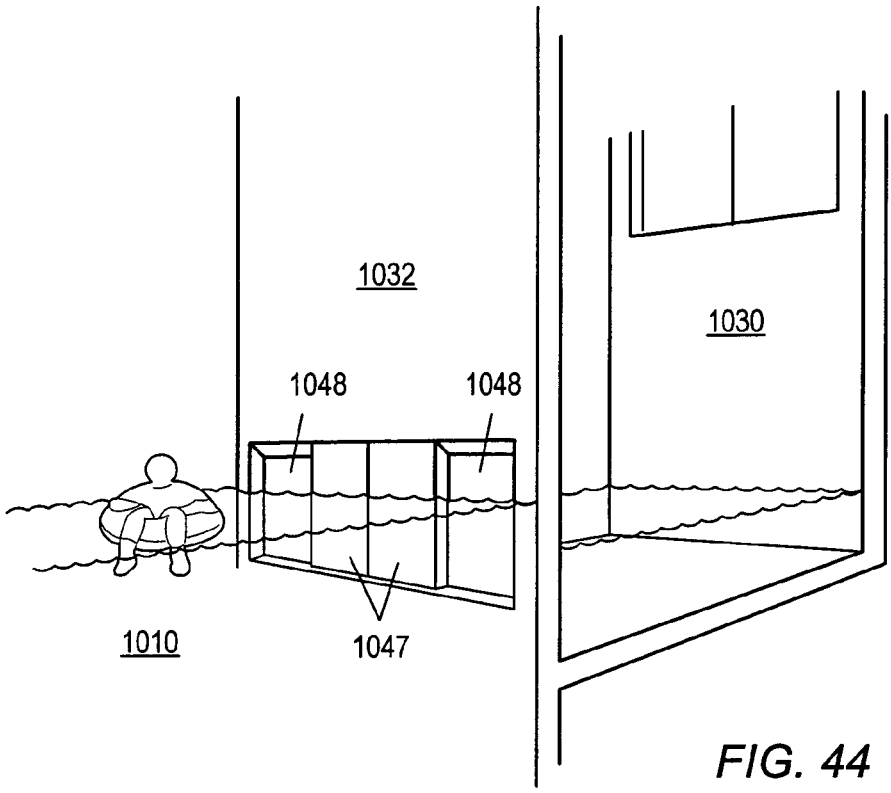
FIG. 44 depicts a perspective view of a lock system which includes a horizontally movable member with the movable member in a closed position.
Figure 45:
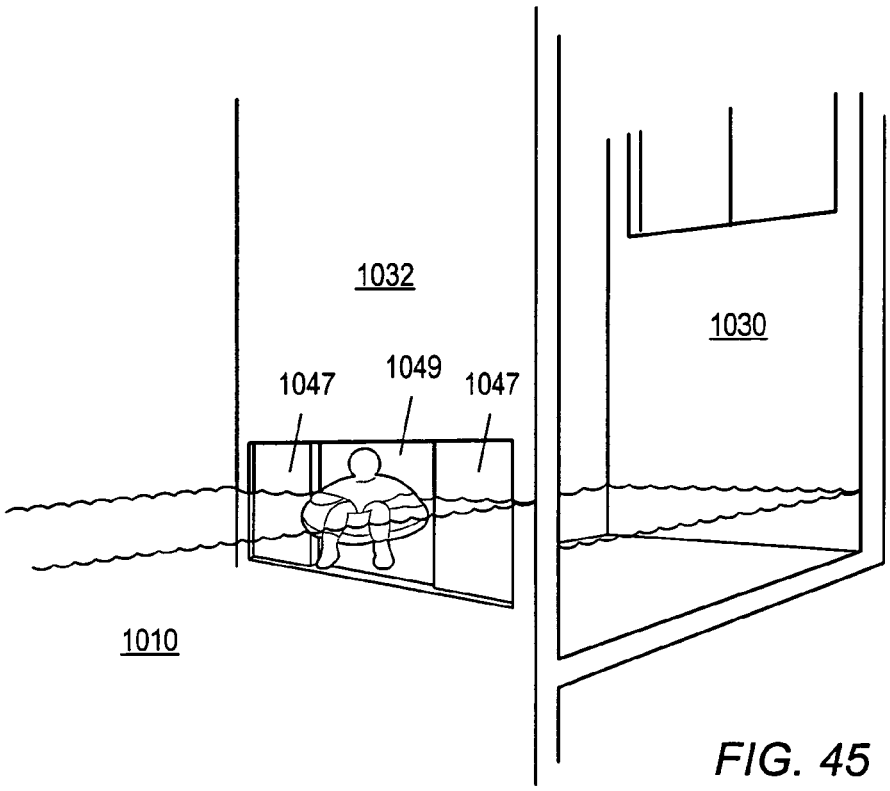
FIG. 45 depicts a perspective view of a lock system which includes a horizontally movable member with the movable member in an open position.

In another embodiment, depicted in FIGS. 44-45, the movable members may be a single door, or, as depicted, a pair of doors 1047, configured to move horizontally into a cavity 1048 formed in outer wall 1032. When doors 1047 move from a closed position (depicted in FIG. 44) to an open position (depicted in FIG. 45) the doors may be moved into cavity 1048. As depicted in FIG. 45, the doors may be configured to move away from a central portion of the movable member along outer wall 1032, when moving into an open position. A hydraulic or pneumatic system, or similar system, may be positioned within cavity 1048 or upon outer wall 1032 to move the door. The door may have a vertical length of between about 3 feet to about 6 feet, more preferably a vertical length of between about 3 feet to about 5 feet.

Referring to FIG. 45, the horizontally movable doors 1047 are depicted near the lower body of water. Doors 1047 are depicted in an open position. While in this position, the doors may reside in cavity 1048, leaving opening 1049 through which the participants may pass from lower body of water 1010 to chamber 1030 or from chamber 1030 to lower body of water 1010. When the participants are to be moved to an upper body of water, doors 1047 may be moved into a closed position, as depicted in FIG. 44 and the chamber may be filled with water.

The movable members may be any combination of sliding or swinging doors. For example, all of the movable members may be vertically sliding doors. Alternatively, the lower movable member may be horizontally sliding doors while the upper movable member may be vertically sliding doors. An advantage to using sliding doors or small hinged doors is that the amount of power necessary to move such doors may be minimized. In a typical lock system, such as those used to move ships, the entire wall of the lock system is typically used as the movable member. Thus, a hydraulic system which is capable of opening a massive movable member may be required. Such systems tend to be relatively slow and may require large amounts of power to operate. For the purposes of moving people, the doors only need to be large enough to comfortably move a person from one body of water to the next. Thus, much smaller doors may be used. A further advantage of sliding doors is that the movement of the doors (either horizontally or vertically) is not significantly inhibited by water resistance. The sliding doors may also be safer than swinging doors, since a swinging door may swing into a participant during the opening or closing of the movable member.

Figure 46:
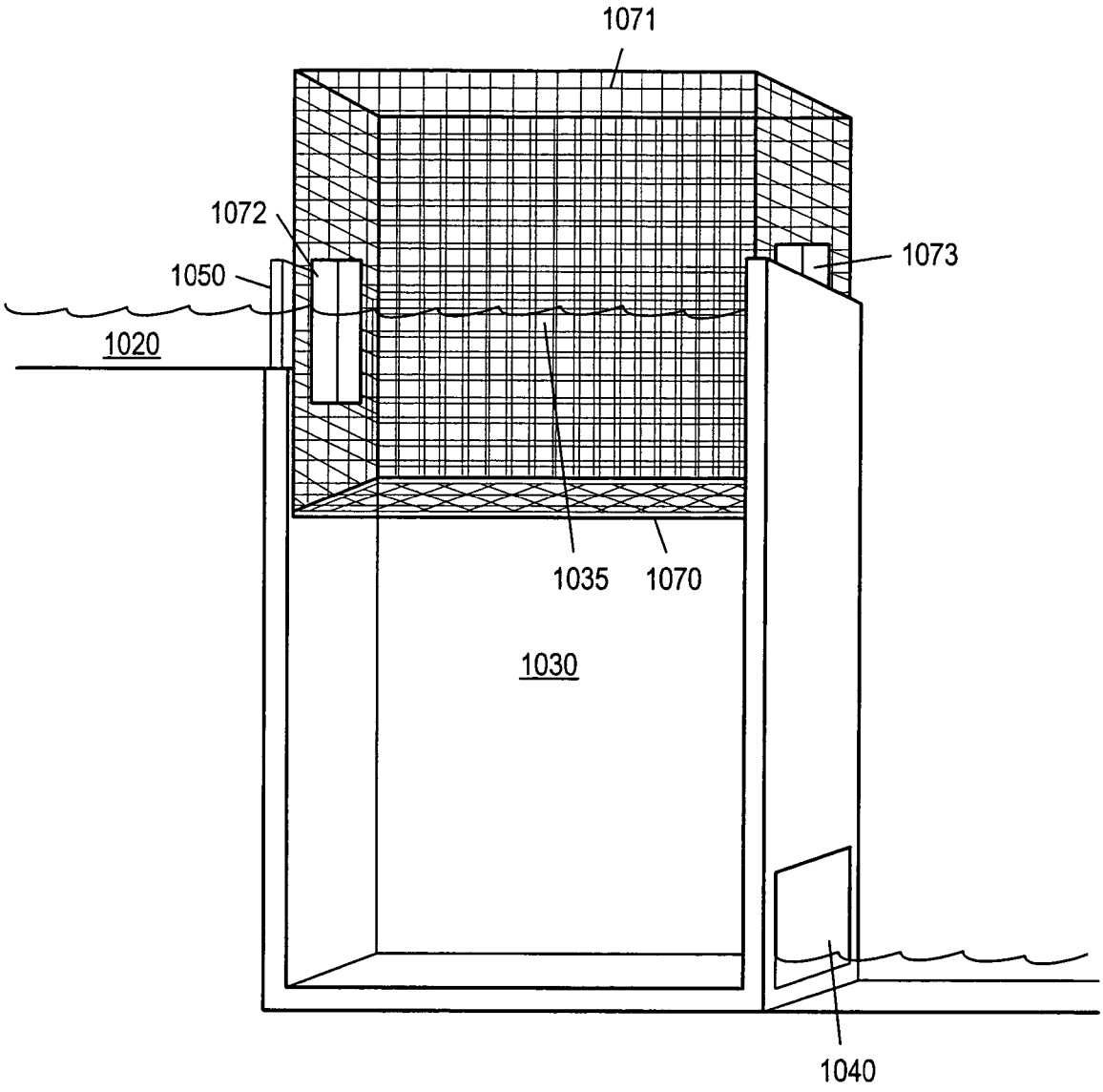
FIG. 46 depicts a perspective view of a lock system which includes a bottom member.

Turning to FIG. 46, a substantially water permeable bottom member 1070 is depicted. By making bottom member 1070 water permeable, water may flow through the bottom member with little resistance, thus allowing the bottom member to easily move through the water in chamber 1030. In one embodiment, a number of openings are formed in bottom member 1070 to allow water to pass through the bottom member. The openings may be in any shape, including, but not limited to a square, circular, rectangular, regular polygon, star, or an oval. In one embodiment, the openings have a shape and size that allows water to freely move through the openings, while inhibiting the participants from moving through the openings.

In one embodiment, bottom member 1070 is composed of a grid of elongated members as depicted in FIG. 46. The spacing of the elongated members is such that participants, as well as the arms, legs, hands, feet, heads, etc. of the participants, are inhibited from passing through any of the openings formed by the grid.

Bottom member 1070, in one embodiment, includes a wall 1071 formed along the perimeter of the bottom member. Wall 1071 may extend from the bottom member toward the top of chamber 1030. Wall 1071 may extend above the surface of the water 1035 in the chamber during use. The wall may be configured to extend to a height such that the participants are inhibited from moving to a position below bottom member 1070. In this configuration, bottom member 1070 may act as a "basket" which ensures that the participants remain at or near the upper surface of the water 1035 in chamber 1030 at all times. Wall 1071 may extend above the surface of the water by a distance of between about 2 to about 6 feet, preferably by a distance of between about 2½ to about 5 feet, and more preferably by a distance of between about 3 to 4 feet.

Movable members 1072 and 1073 may be formed in wall 1071 of bottom member 1070. Movable members 1072 and 1073 may be formed at a location in wall 1071 such that they correspond with the position of the first movable member 1040 and the second movable member 1050 formed in outer wall 1032 of the chamber, when the bottom member is at a level proximate one of the first or second movable members. For example, as depicted in FIG. 46, movable member 1072 of the bottom member is positioned in wall 1071 of the bottom member at a level approximately equal to the second movable member 1050, when water 1035 in chamber 1030 is substantially equal to the water level in upper body of water 1020. This may allow participants to easily exit through wall 1071, via movable member 1072 and through second movable member 1050 when moving from chamber 1030 to upper body of water 1020. In a similar manner, movable member 1073 may be positioned at a level approximately equal to first movable member 1040, when water 1035 in the chamber is lowered. Movable members 1072/1073 may extend over the entire vertical length of wall 1071 of the bottom member. In one embodiment, movable members 1072/1073 extend from about 1 to 3 feet below the surface of the water to 1 to 3 feet above the surface of the water, preferably from about 1½ to about 2 feet above and below the upper surface of the water.

Figure 47:
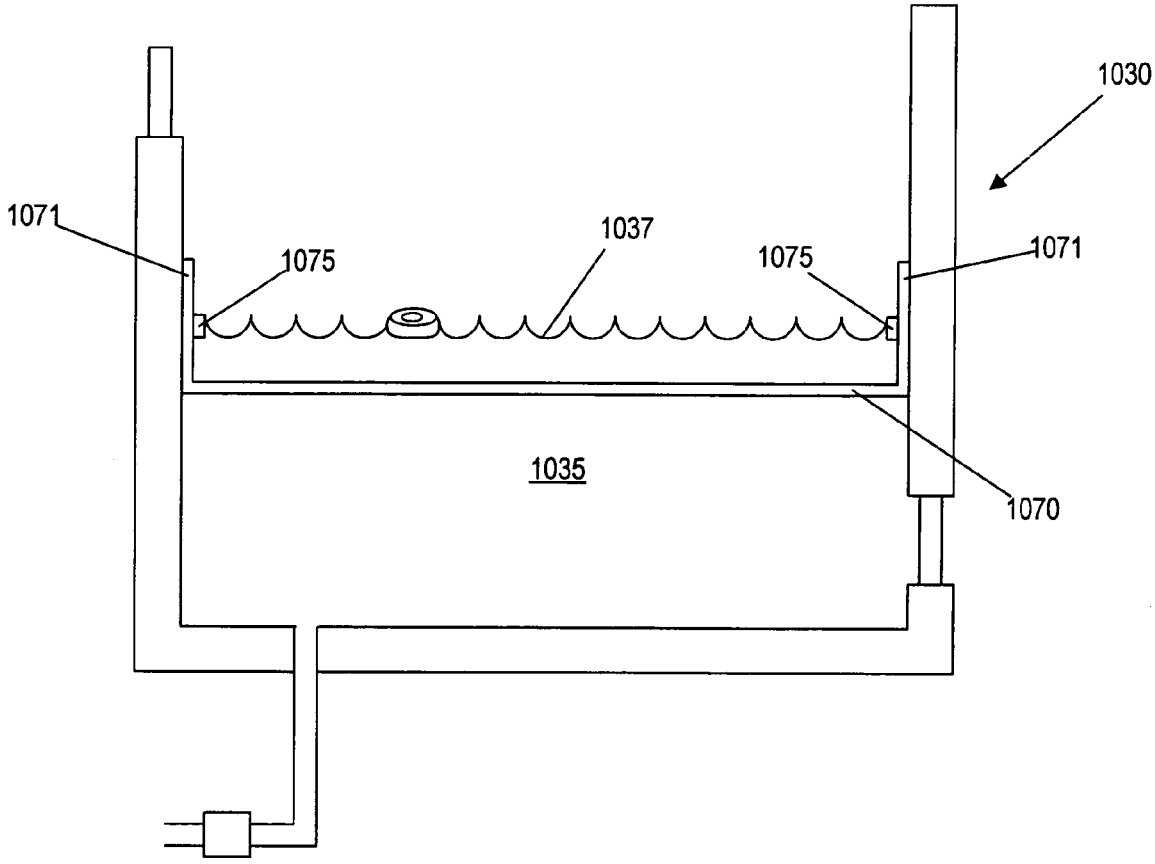
FIG. 47 depicts a cross sectional side view of a bottom member disposed within a chamber of a lock system.

Bottom member 1070 may be configured to remain at a substantially constant distance from the upper surface 1037 of the water in chamber 1030 as the water level is adjusted within the chamber. In one embodiment, depicted in FIG. 47, floatation members 1075 may be placed on wall 1071 to provide buoyancy to bottom member 1070. By placing floatation members 1075 at a location between the bottom member 1070 and the top of wall 1071 the level at which the bottom member remains below the surface may be maintained. For example, by placing floatation members 1075 at a position approximately three feet from the bottom of wall 1071, bottom member 1070 may be maintained at a position of at least about 3 feet below the surface of the water 1035. In one embodiment, floatation members 1075 are placed on wall 1071 at a position such that the bottom member remains about 3 feet below the upper surface of the water and such that wall 1071 extends about 3 feet above the surface of the water. Though not shown, all the water lock embodiments may additionally comprise the ladder and ratchet features described previously herein for the containment pool comprising a water permeable bottom member safety system.

Figure 48:
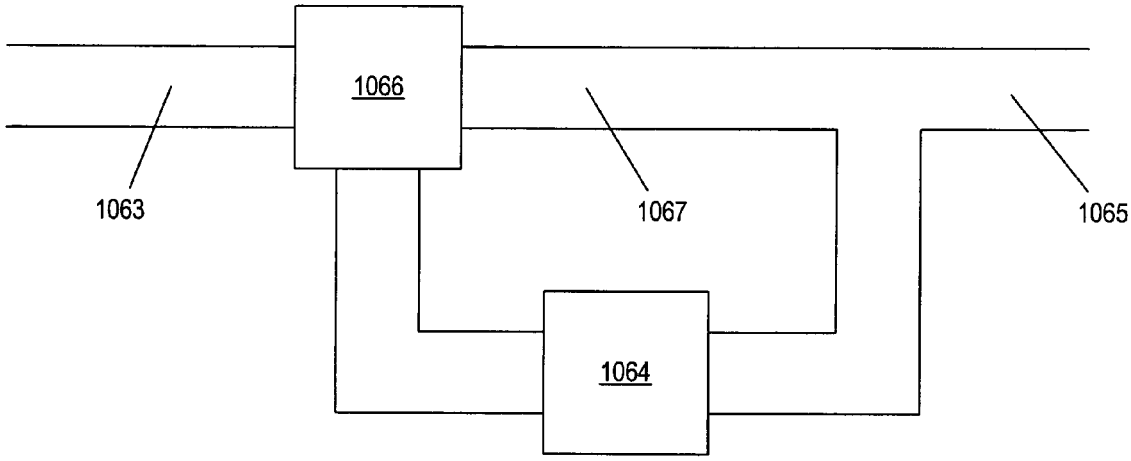
FIG. 48 depicts a cross sectional side view of a water control system.

A number of configurations may be used to control the input of water to the chamber, and the output of water from the chamber. Referring back to FIG. 35, a conduit 1060 may be coupled to upper body of water 1020 such that water from the upper body of water may be transferred into chamber 1030. The water may be removed by opening the first movable member 1020 (either partially or fully) to remove the water from the chamber. Alternatively, water control system 1062 may include a pump for pumping the water back to upper body of water 1020. As depicted in FIG. 48, a water control system may include a pump 1064 and a diverter valve 1066. Conduit 1063 may be coupled to the upper body of water, while conduit 1065 may be coupled to the chamber. Diverter valve 1066 may be a three way valve which allows water to pass through pump 1064 or a bypass conduit 1067. When the chamber is to be filled diverter valve 1066 may be set to allow water to pass through bypass conduit 1067 and into the chamber. Alternatively, the valve may be switched to allow the pump 1064 to increase the rate of water flow into the chamber. The water may be flowed through the conduit until the upper level of the water in the chamber is substantially equal to the upper level of the water in the upper body of water.

To lower the water level in the chamber, the diverter valve 1066 may be switched to allow water to flow to pump 1064. The water may be pumped from the chamber back to the upper body of water until the level of the water in the chamber and the lower body of water are substantially equal. In the case when pump 1064 is used to increase flow of water to the chamber and also to pump water back to the upper body of water, pump 1064 may be a reversible pump. Alternatively, two separate pumps may be used to pump water in each direction. In this manner, water may be transferred from the chamber to the upper body of water and from the upper body of water to the chamber using the same conduit. In this embodiment, the amount of water transferred from the upper body of water to the lower body of water during multiple cycles of the lock system may be negligible.

Figure 49:
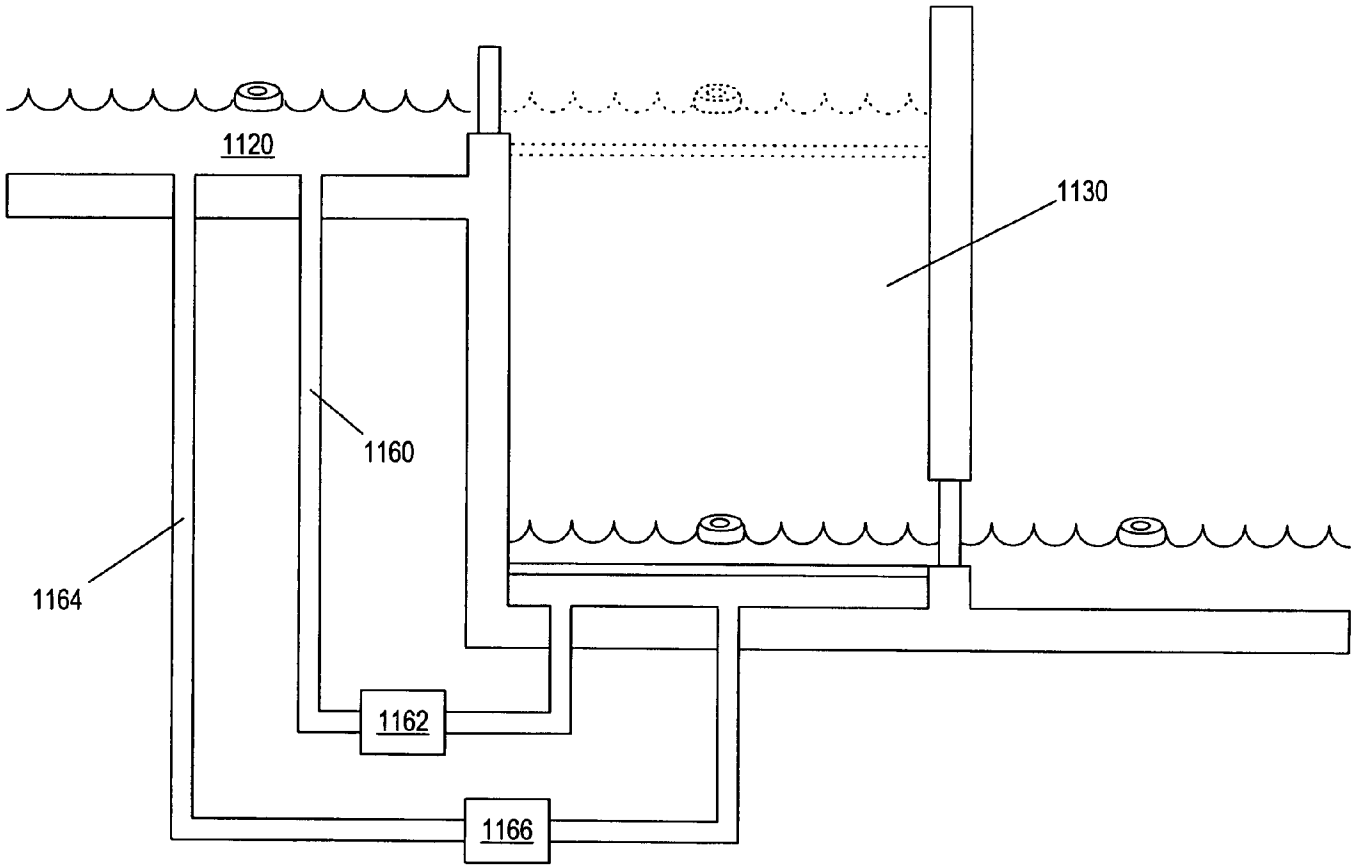
FIG. 49 depicts a cross sectional side view of a water lock system which includes one chamber and two conduits coupling an upper body of water to the chamber.

Alternatively, two conduits may be used to transfer the water to and from the chamber, as depicted in FIG. 49. A first conduit 1160 may be coupled to an upper body of water 1120 and a chamber 1130. First conduit 1160 may include a first water control system 1162. The first water control system 1162 may be a two-way valve. A second conduit 1164 may also be coupled to upper body of water 1120 and chamber 1130. The second conduit may include a second water control system 1166. The second water control system 1166 may include a pump and a valve. To fill chamber 1130 with water, the first water control system 1162 may be set to allow water to flow from upper body of water 1120 to chamber 1130. To lower the water level in chamber 1130, second water control system 1166 may be opened, while closing first water control system 1162, such that the pump of the second water control system pumps water from the chamber back to upper body of water 1120.

These embodiments, where the water is transferred from and to the upper body of water may have an advantage when the upper and lower body of water require a preset amount of water to be maintained within the bodies of water during use. If excess water is transferred from the upper body of water to the lower body of water, the upper body of water may become depleted of water while the lower body of water may become overfilled. The transfer of the water from the upper body of water to the chamber and then back to the upper body of water from the chamber may alleviate this problem by maintaining both the upper and lower bodies of water at a substantially constant level over multiple cycles of the lock system.

Figure 50:
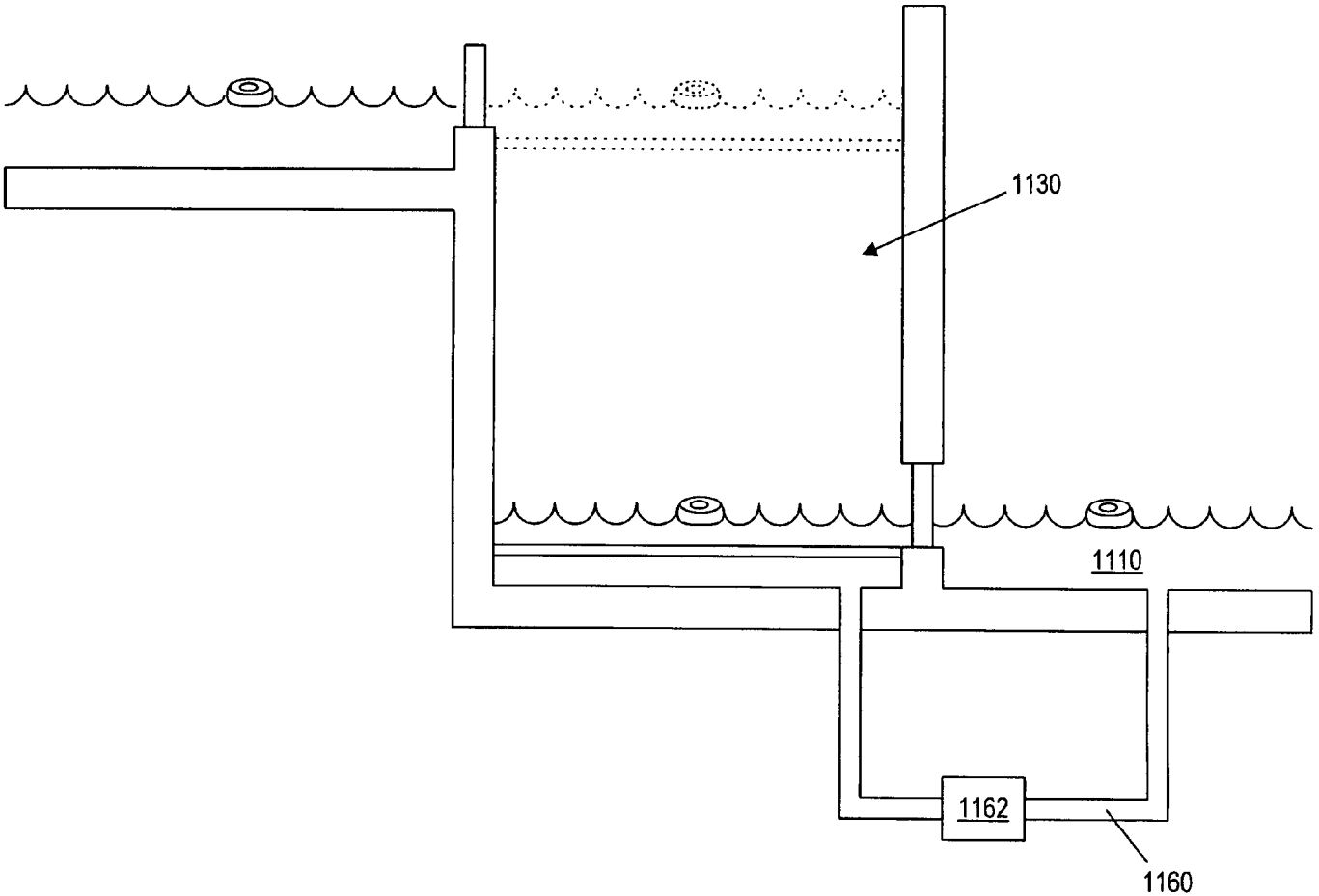
FIG. 50 depicts a cross sectional side view of a water lock system which includes one chamber and a conduit coupling a lower body of water to the chamber.

In another embodiment, depicted in FIG. 50, the lower body of water 1110 may be used to supply water into the chamber. A conduit 1160 may be coupled to chamber 1130 such that water from lower body of water 1110 may be introduced into chamber 1130. A water control system 1162 may be positioned along conduit 1160. Water control system 1162 may include a diverter valve and a pump (e.g., as depicted in FIG. 48). When chamber 1130 is to be filled, the diverter valve of water control system 1162 may be adjusted to allow water to be pulled through the pump and into chamber 1130. The pump may fill chamber 1130 with water by transferring water from lower body of water 1110 to the chamber. To lower the water level in chamber 1130, the diverter valve may be coupled to a bypass conduit (see FIG. 48). The water is then forced through the bypass conduit by the water pressure differential between the chamber water and the lower body of water, until the level of water in chamber 1130 is substantially equal to the level of water in lower body of water 1110.

Figure 51:
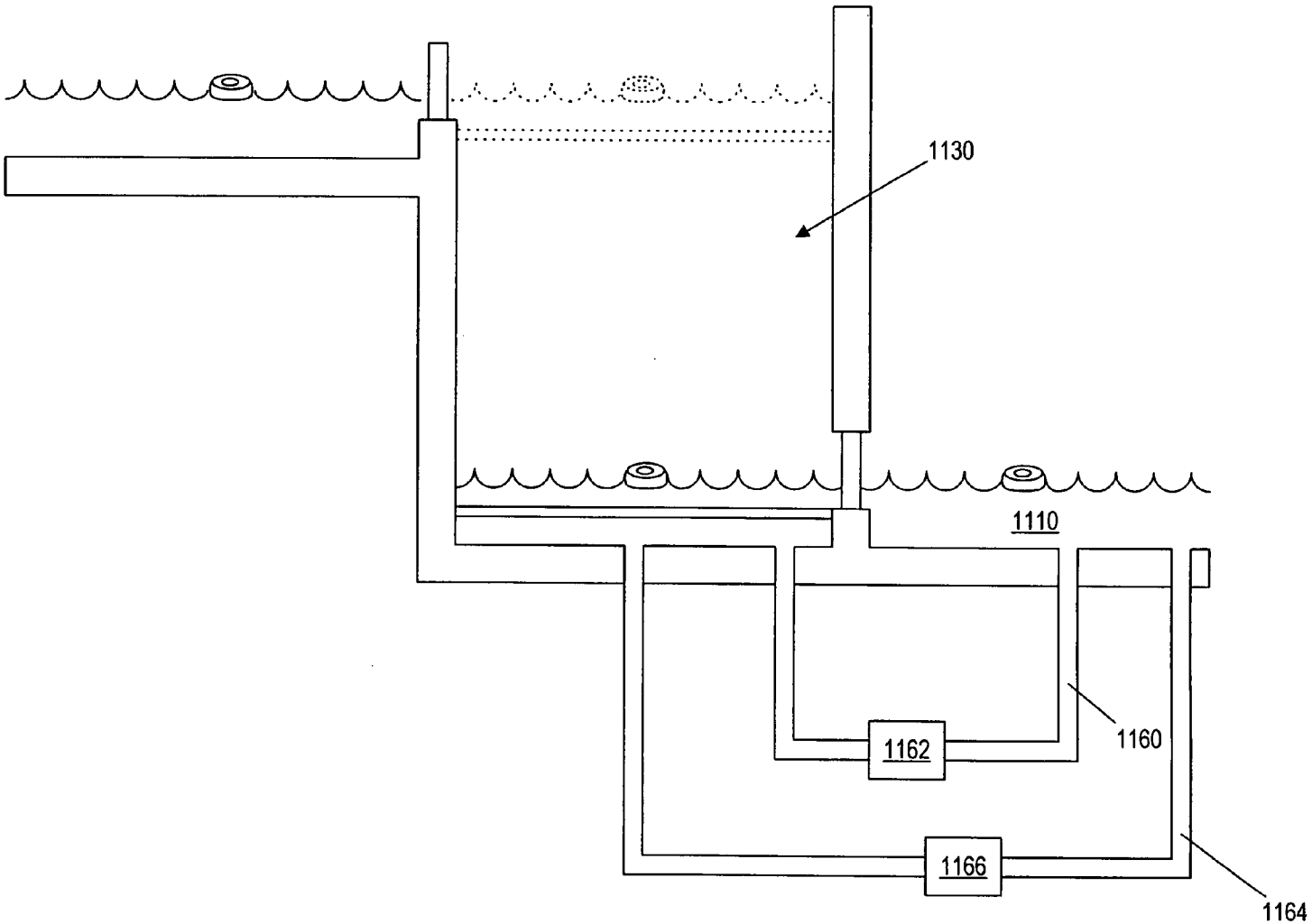
FIG. 51 depicts a cross sectional side view of a water lock system which includes one chamber and two conduits coupling a lower body of water to the chamber.

Alternatively, two conduits may be used to transfer the water between the chamber 1130 and the lower body of water 1110, as depicted in FIG. 51. A first conduit 1160 may be coupled to lower body of water 1110 and chamber 1130. A first water control system 1162 may be positioned along the first conduit 1160. First water control system 1162 may include a pump and a valve (e.g., as depicted in FIG. 48). A second conduit 1164 may also be coupled to the lower body of water 1110 and the chamber 1130. A second water control system 1166 may be positioned along the second conduit 1164. Second water control system 1166 may include a valve.

To fill chamber 1130, first water control system 1162 may be adjusted to allow water to be pumped from lower body of water 1110 into chamber 1130, while second water control system 1166 is in a closed position. To lower the water level in chamber 1130, second water control system 1166 may be opened, while closing first water control system 1162, such that the water from chamber 1130 is transferred to the lower body of water 1110.

Figure 52:
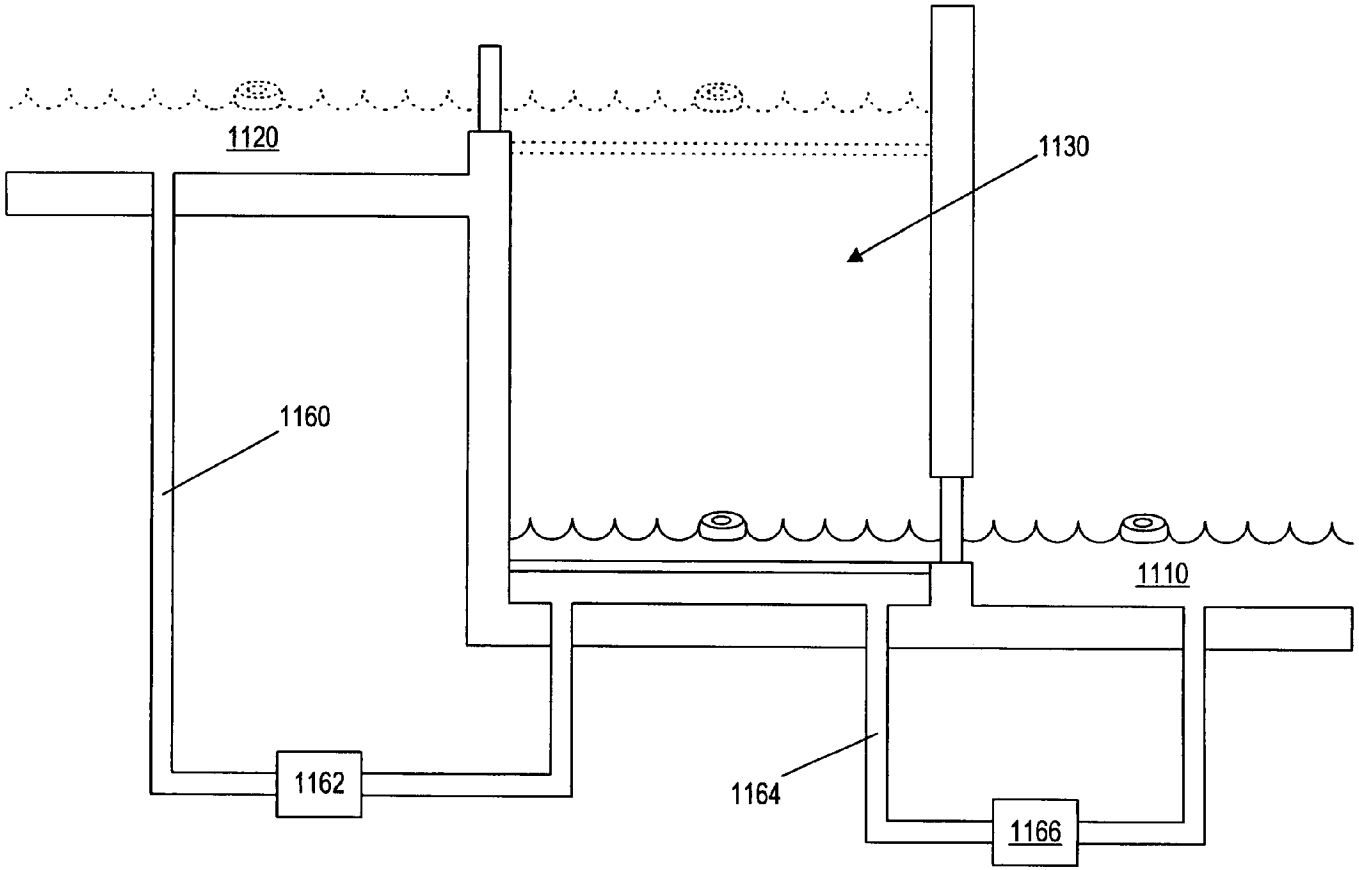
FIG. 52 depicts a cross sectional side view of a water lock system which includes a chamber, a first conduit coupling an upper body of water to the chamber, and a second conduit coupling a lower body of water to the chamber.

In another embodiment, two conduits may be used to fill and empty the chamber, as depicted in FIG. 52. A first conduit 1160 may be coupled to upper body of water 1120 and chamber 1130. A second conduit 1164 may be coupled to lower body of water 1110 and chamber 1130. A first water control system 1162 may be positioned along first conduit 1160. A second water control system 1166 may be positioned along second conduit 1164. First water control system 1162 may be a valve or a valve/pump system (see FIG. 48). To fill chamber 1130, first water control system 1162 may be opened such that water flows from upper body of water 1120 to chamber 1130. Second water control system 1166 may be adjusted such that water is inhibited from flowing from chamber 1130 to lower body of water 1110. In one embodiment, the water pressure differential between upper body of water 1120 and the water in chamber 1130 may be used to force water from the upper body of water into the chamber. When the level of the water in chamber 1130 is substantially equal to the level of water in upper body of water 1120, the water pressure differential will become nearly zero. Thus, the water may stop flowing into chamber 1130 without having to close or adjust water control system 1162. Alternatively, a pump may be incorporated into water control system 1162 and water may be pumped from upper body of water 1120 to chamber 1130.

To empty chamber 1130, first water control system 1162 may be adjusted such that water flow from upper body of water 1120 to the chamber is inhibited. Second water control system 1166 may be adjusted so that water in chamber 1130 now flows through second conduit 1164 and into lower body of water 1110. By relying on a water pressure differential, the water may automatically stop flowing into lower body of water 1110 when the water level in chamber 1130 is substantially equal to the water level in the lower body of water. Alternatively, water control system 1166 may include a pump to increase the rate of water transfer from chamber 1130 to lower body of water 1110.

An advantage of using two conduits in this manner to transfer water to and from the chamber is that there may be no need to use water level monitoring devices. Since the flow of water will automatically stop when the water level is at the desired level, no water monitoring devices may be necessary. This may allow a much simpler system to be built. Such a system may include water control devices which are simply two way valves to allow or inhibit the flow of water thorough the conduits. Such a system may be easily run manually, semi-automatically, or automatically. Semi-automatically is defined to mean when a human operator informs the automatic control devices when to open/close the valves.

Figure 53:
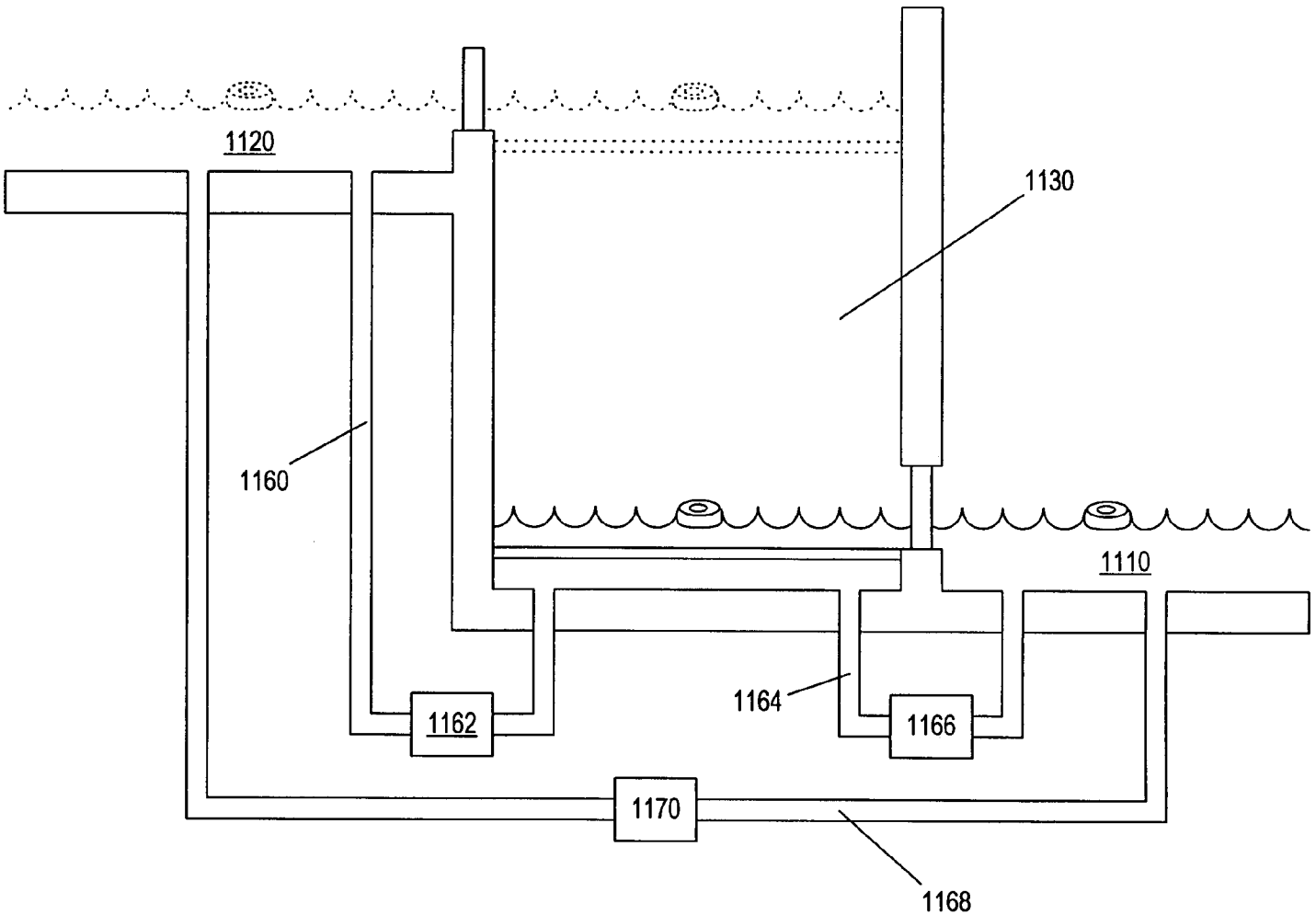
FIG. 53 depicts a cross sectional side view of a water lock system which includes a chamber, a first conduit coupling an upper body of water to the chamber, a second conduit coupling a lower body of water to the chamber, and a third conduit coupling the lower body of water to the upper body of water.

A disadvantage of this two conduit system is that water is being transferred from upper body of water 1120 to lower body of water 1110. After repeated cycles, the lower body of water may become overfilled with water while the upper body of water may become depleted of water. To prevent this from occurring a third conduit may be added to the system. As depicted in FIG. 53, a lock system may include a first conduit 1160 for transferring water from an upper body of water 1120 to a chamber 1130, a second conduit 1164 for transferring water from the chamber to a lower body of water 1110, and a third conduit 1168 for transferring water from the lower body of water to the upper body of water. The first, second and third conduits may include first, second, and third water control systems 1162, 1166, and 1170. First and second water control systems may be similar in function to the water control systems described above. Third water control system 1170 may include a pump for pumping water from lower body of water 1110 to upper body of water 120. During use first conduit 1160 may be used to transfer water from upper body of water 1120 to chamber 1130. To lower the level of the water in chamber 1130, water may be transferred from chamber 1130 to lower body of water 1110 via second conduit 1164. As described above, such a system may alter the level of water in the two bodies of water after repeated cycles. Once this situation occurs, the third conduit may be used to transfer water from lower body of water 1110 to upper body of water 1120. The transfer of water from the lower to the upper body of water may occur at anytime during the cycle. In one embodiment, the transfer occurs as the water from chamber 1130 is being transferred to lower body of water 1110. Thus, the level of water in both the upper and lower bodies of water may remain substantially constant over repeated cycles of the lock system.

The lock systems described above may be used to transfer participants from a lower body of water to an upper body of water while the participants remain in the water. The participants may be swimming in the water or may be floating upon the surface of the water with a floatation device. Examples of floatation devices include, but are not limited to inner tubes, floating boards, life jackets, life preservers, water mattresses, rafts and small boats.

Figure 54:
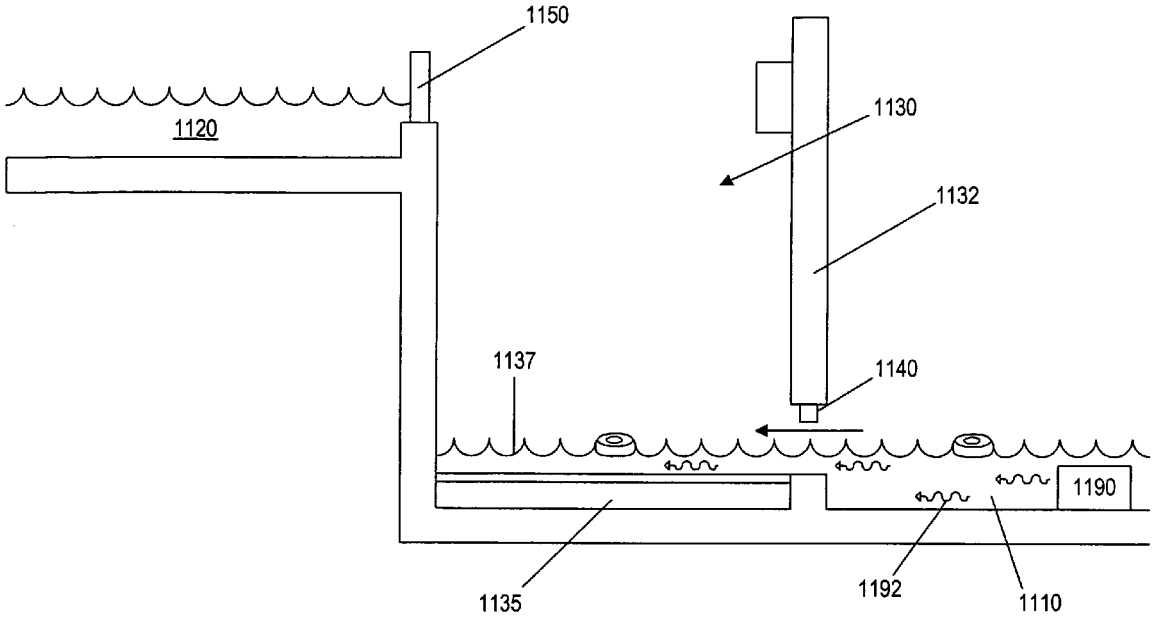
FIG. 54 depicts a cross sectional side view of a water lock system in which participants are being transferred from a lower body of water to a chamber.

As depicted in FIG. 54, a lock system, in one embodiment, includes a chamber 1130 which is coupled to a lower body of water 1110 and an upper body of water 1120. The level of water in chamber 1130 is initially set to be substantially equal to the level of water in lower body of water 1110. A first movable member 1140 may be positioned in outer wall 1132 of chamber 1130 proximate the upper surface of water 1137 in the lower body of water. First movable member 1140 is initially in an open position to allow participants to move from lower body of water 1110 into chamber 1130. The participants may swim or propel their floatation device into chamber 1130 via first movable member. In another embodiment, a water propulsion system 1190 may be set up within lower body of water 1110 to cause a current (denoted by the curved lines 1192) to be produced in the water 1135. The current may propel the participants toward movable member 1140 from lower body of water 1110.

Figure 55:
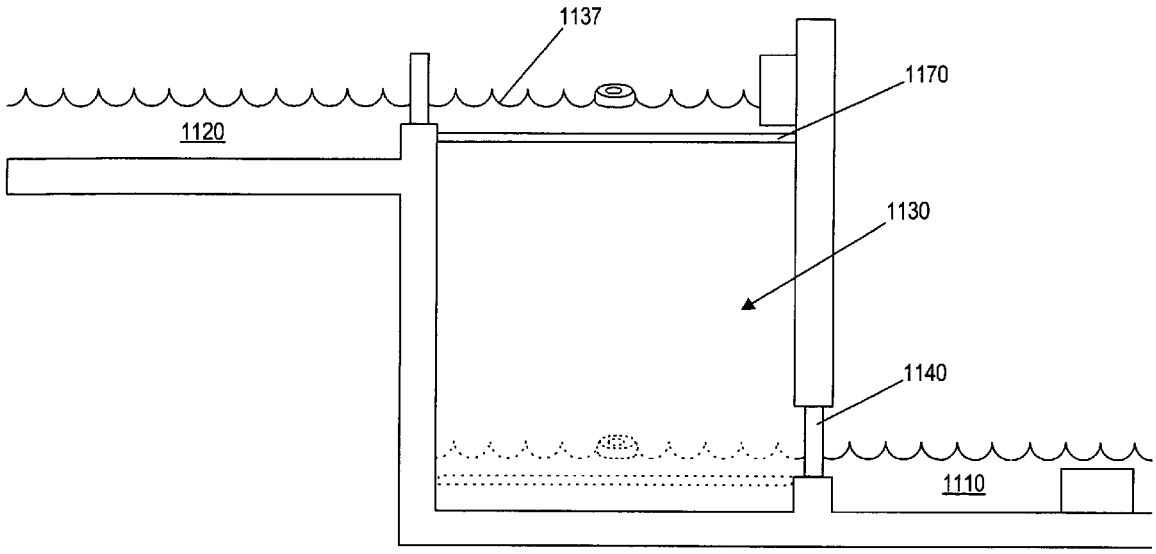
FIG. 55 depicts a cross sectional side view of a water lock system in which the chamber is filled with water.

After the participants have entered chamber 1130, first movable member 1140 may be closed, as depicted in FIG. 55. Water may be transferred from a water source into chamber 1130 causing the water level within the chamber to rise. The water source may be lower body of water 1110, upper body of water 1120, and/or an alternate water supply source (e.g., a nearby water reservoir, river, lake, ocean, etc.). The water, in one embodiment, may be transferred into chamber 1130 until the upper surface 1137 of the water in the chamber is substantially equal to the upper surface of the water in upper body of water 1120. Thus, the participants may be raised from a lower level to an upper level as water is transferred into the chamber. A bottom member 1170, as described above, may also be raised as the water enters the chamber.

Figure 56:
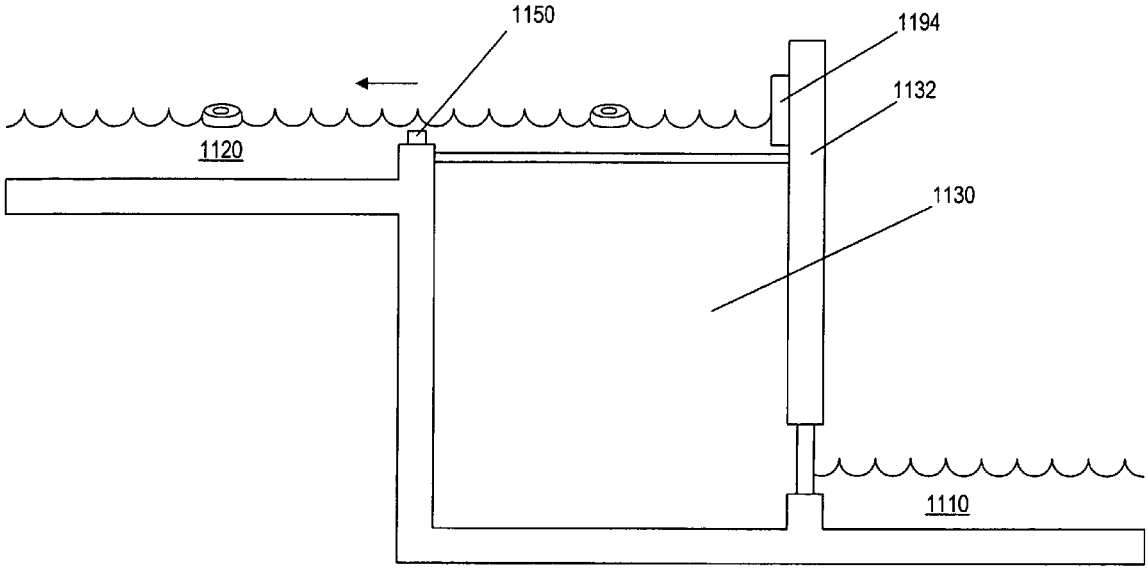
FIG. 56 depicts a cross sectional side view of a water lock system in which participants are being transferred from the chamber to an upper body of water.

After the water in the chamber has reached a level substantially equal to the level of water in upper body of water 1120, the second movable member 1150 may be opened as depicted in FIG. 56. Participants may then move from chamber 1120 into upper body of water 1130. The participants may move using their own power or be propelled by a water propulsion system 1194 incorporated on outer wall 1132.

In another embodiment, a current may be generated by continuing to fill chamber 1130 with water after the level of water in the chamber is substantially equal to the level of water in upper body of water 1120. In an embodiment, second movable member 1150 is opened when the level of water between the chamber 1130 and the upper body of water 1120 are substantially equal. Additional water may be introduced into the chamber 1130 such that the level of water in the chamber begins to rise above the level of water in the upper body of water 1120. As the water is pumped into the chamber 120, the resulting increase in water volume may cause a water current to be formed flowing from the chamber to the upper body of water. The formed current may be used to propel the participants from the chamber to the upper body of water.

Overall, the participants may be moved from lower body of water 1110 to upper body of water 1120 while remaining in water during the entire transfer period. An advantage of this method of transfer is that the participants do not have to leave the water, thus allowing the participants to remain cool on hot days. The participants will no longer have to carry their floatation devices. Inner tubes and boards may be difficult for some younger riders to carry. By transferring people with a lock system, the need to carry floatation devices to the start of a water ride may be eliminated.

After the participants have been transferred to the upper body of water, the water level may be lowered by removing water from the chamber. The water may be removed until the water level is substantially equal to the water in the lower body of water. The first movable member may then be reopened to allow more participants to be transferred to the upper body of water. It should be understood that after a group of participants have been transferred to the upper body of water, another group may enter the lock system and be transferred to the lower body as the water within the chamber is lowered. It should also be understood that any of the previously described embodiments of the water lock system may be used to transfer participants between any number of bodies of water having different elevations.

Figure 57:
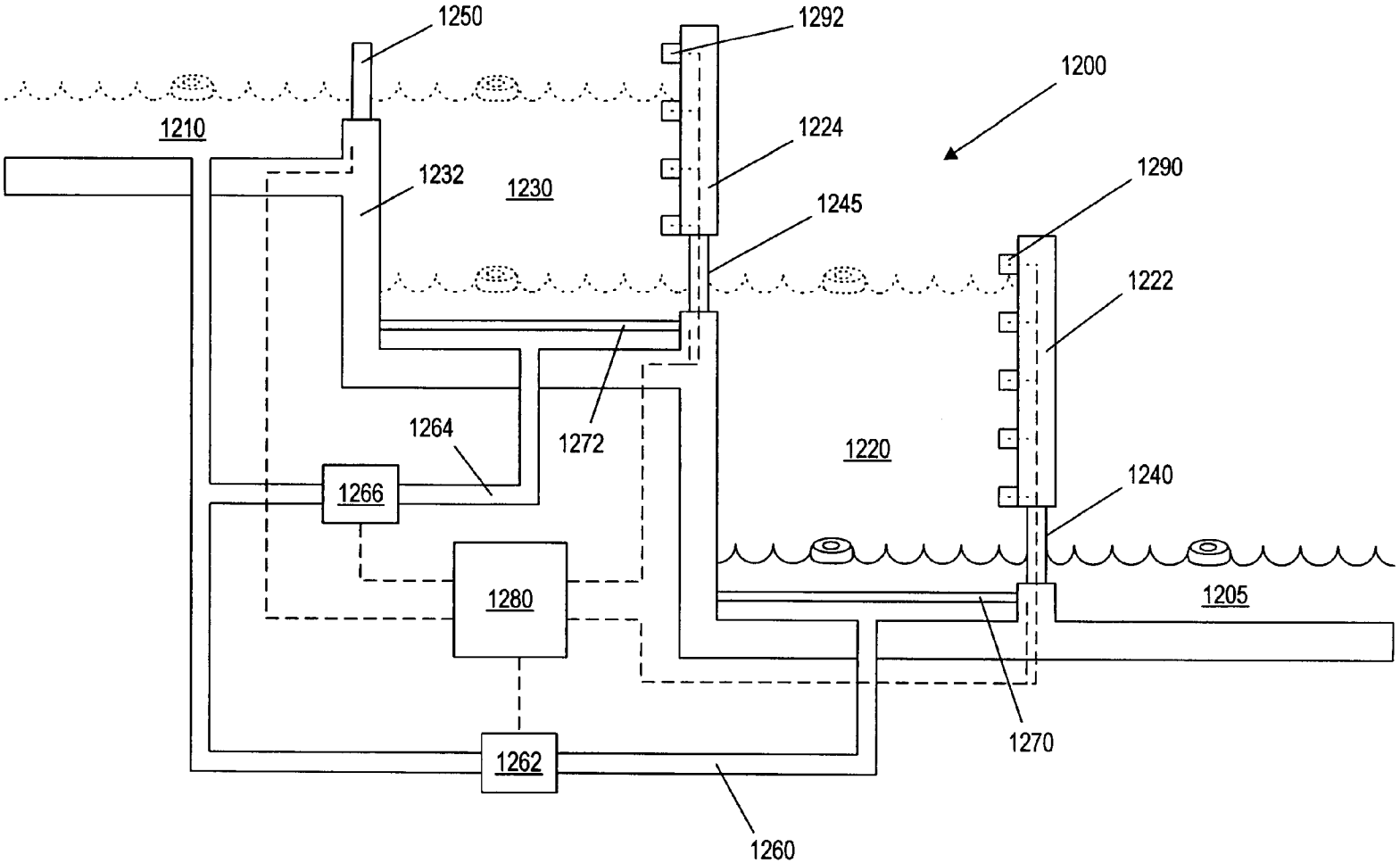
FIG. 57 depicts a cross sectional side view of a water lock system which includes two chambers, a first conduit coupling an upper body of water to the first chamber, and a second conduit coupling the upper body of water to the second chamber.

In another embodiment, multiple chambers may be linked together to transfer participants from a lower body of water to an upper body of water. FIG. 57 depicts a water lock system 1200 that, in one embodiment, includes two chambers for transferring participants from a lower body of water 1205 to an upper body of water 1210. It should be understood that while only two chambers are depicted, additional chambers may be positioned between the bodies of water and the following description would be applicable to such systems. A first chamber 1220 may be coupled to lower body of water 1205. A portion of first chamber 1220 may extend below the upper surface of lower body of water 1205. A second chamber 1230 may be coupled to first chamber 1220 and upper body of water 1210. A portion of outer wall 1222 of first chamber 1220 may also form a portion of the outer wall of second chamber 1230. Bottom members 1270 and 1272, as previously described, may be positioned within the first and second chambers respectively.

A first movable member 1240 may be formed adjacent to lower body of water 1205. First movable member 1240 may extend from a position below the upper surface of lower body of water 1205 to a point above the upper surface of the lower body of water. First movable member 1240 may extend over the entire vertical length of the outer wall 1222 of first chamber 1220. In one embodiment, first movable member 1240 is formed in a portion of outer wall 1222 that is substantially shorter than the vertical length of the outer wall. The first movable member may be a swinging-movable member or a sliding movable member as previously described.

A second movable member 1245 may be formed in outer wall 1224 of first chamber 1220 adjacent to second chamber 1230. Second movable member 1220 may extend from a point above the bottom member of second chamber 1230 toward the top of first chamber wall 1224. Second movable member 1245 may be positioned to allow participants to enter second chamber 1230 from first chamber 1220, while the water level is elevated within the first chamber. Second movable member 1245 may be a swinging movable member or a sliding movable member as previously described.

A third movable member 1250 may be formed adjacent upper body of water 1210. Third movable member 1250 may extend from a position below the upper surface of upper body of water 1210 to a point above the upper surface. Third movable member 1250 may be formed in a portion of outer wall 1232 which is substantially shorter then the vertical length of the wall. Third movable member 1250 may be formed at a position in outer wall 1232 such that participants may move from second chamber 1230 to upper body of water 1210 when the water within the second chamber is substantially level with the water in the upper body of water. Third movable member 1250 may extend to a depth below the upper surface of upper body of water 1210 to allow participants to easily enter the upper body of water without contacting the lower surface of the third movable member.

Conduits 1260 and 1264 may be positioned to introduce water into first chamber 1220 and second chamber 1230, respectively. Water control systems 1262 and 1266 may be positioned along conduits 1260 and 1264, respectively, to control flow of water through the conduits. Water control systems 1262 and 1266 may include a valve which is configured to control the flow of water from a pressurized water source to the chamber. Water control systems 1262 and 1266 may also include a pump for increasing the flow rate of water through the conduits.

An automatic controller 1280 may be coupled to the lock system. The controller may be a computer, programmable logic controller, or any other known controller system. The controller may be coupled to water control systems 1262 and 1266 and movable members 1240, 1245, and 1250. The operation of the movable members and the water control systems may be coordinated by the controller such that the proper timing of events occurs. Sensors 1290 and 1292 may be positioned on the inner surface of the first chamber 1220 and the second chamber 1230, respectively, to relay the level of water within the chambers back to control system 1280.

In one embodiment, first conduit 1260 and second conduit 1264 may be coupled to upper body of water 1210. The first and second conduits, 1260 and 1264 may be configured to allow water from upper body of water 1210 to be transferred to first chamber 1220 and second chamber 1230 respectively. First water control system 1262 may be used to control the transfer of water from upper body of water 1210 to first chamber 1220. Second water control system 1266 may be used to control flow of water from upper body of water 1210 to second chamber 1230. The water control systems 1262 and 1266 may include a pump, a valve and a bypass conduit, as depicted in FIG. 48. The operation of this type of water control system has been previously described.

To lower the water level in either of the chambers, the water control systems 1262 and 1266 may include a pump for pumping water from the first chamber 1220 and the second chamber 1230 respectively. The water may be pumped from the chambers back to upper body of water 1210 during use. In this manner, each of conduits 1260 and 1264 may allow the water to be transferred from upper body of water 1210 to the chambers 1220 and 1230, respectively, and from the chambers back to the upper body of water. An advantage of these embodiments is that the water level in both the upper and lower bodies of water remains substantially constant over multiple cycles of the water lock system.

Figure 58:
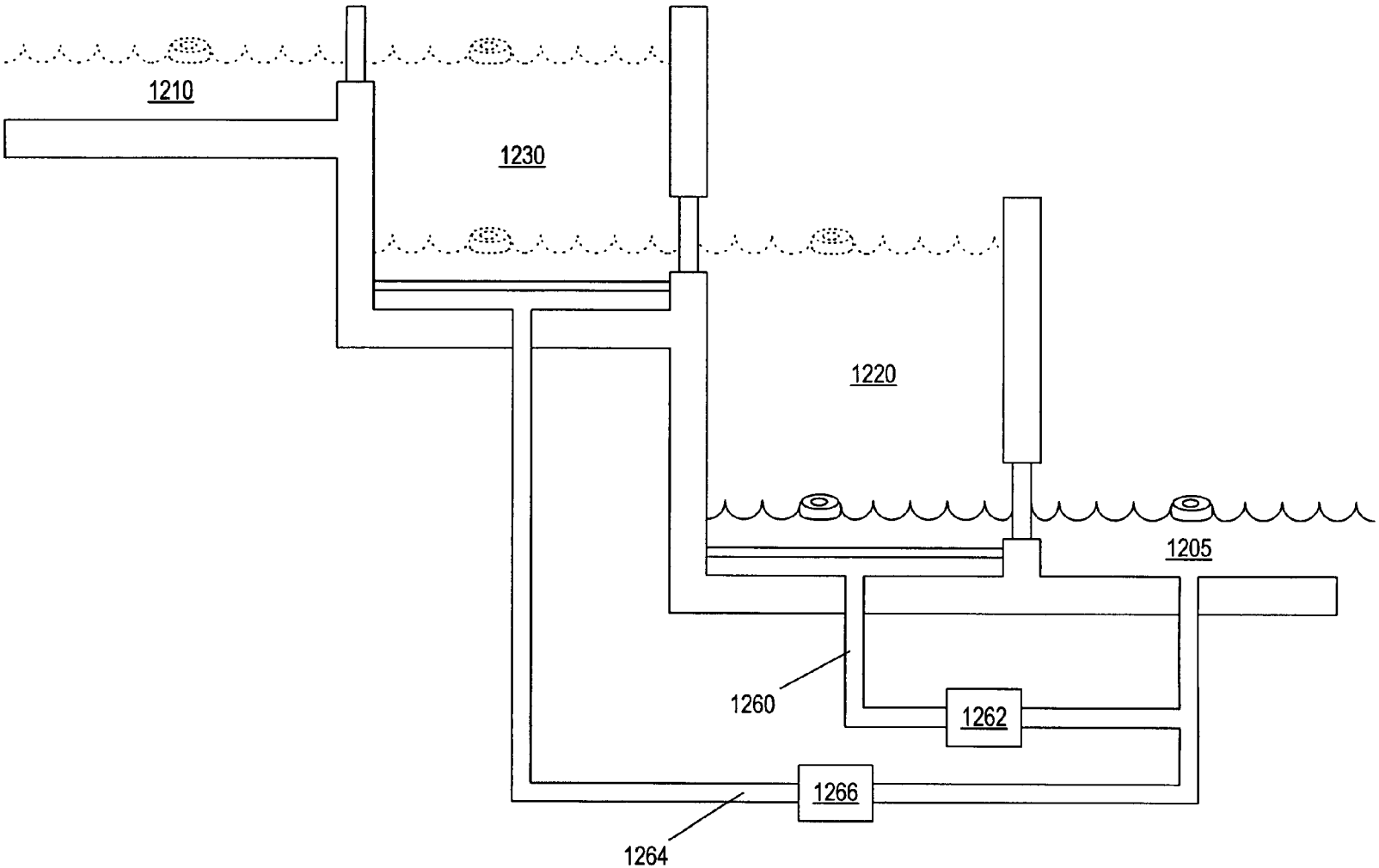
FIG. 58 depicts a cross sectional side view of a water lock system which includes two chambers, a first conduit coupling a lower body of water to the first chamber, and a second conduit coupling the lower body of water to the second chamber.

In another embodiment, depicted in FIG. 58, lower body of water 1205 may be used to supply water into the first and second chambers 1220 and 1230. The first conduit 1260 and second conduit 1264 may be coupled to chambers 1220 and 1230 such that water from lower body of water 1205 may be introduced into the chambers. Water control systems 1262 and 1266 (e.g., as depicted in FIG. 48), are positioned along conduits 1260 and 1264, respectively. Each of water control systems 1262 and 1266 may include a pump. When a chamber is to be filled, the appropriate water control system may direct water from lower body of water 1205 to a pump. The pump may fill the chamber with water by pumping water from lower body of water 1205 to the chamber. To lower the water level in a chamber, the water control system may be adjusted to allow water to flow back into the lower body of water.

Figure 59:
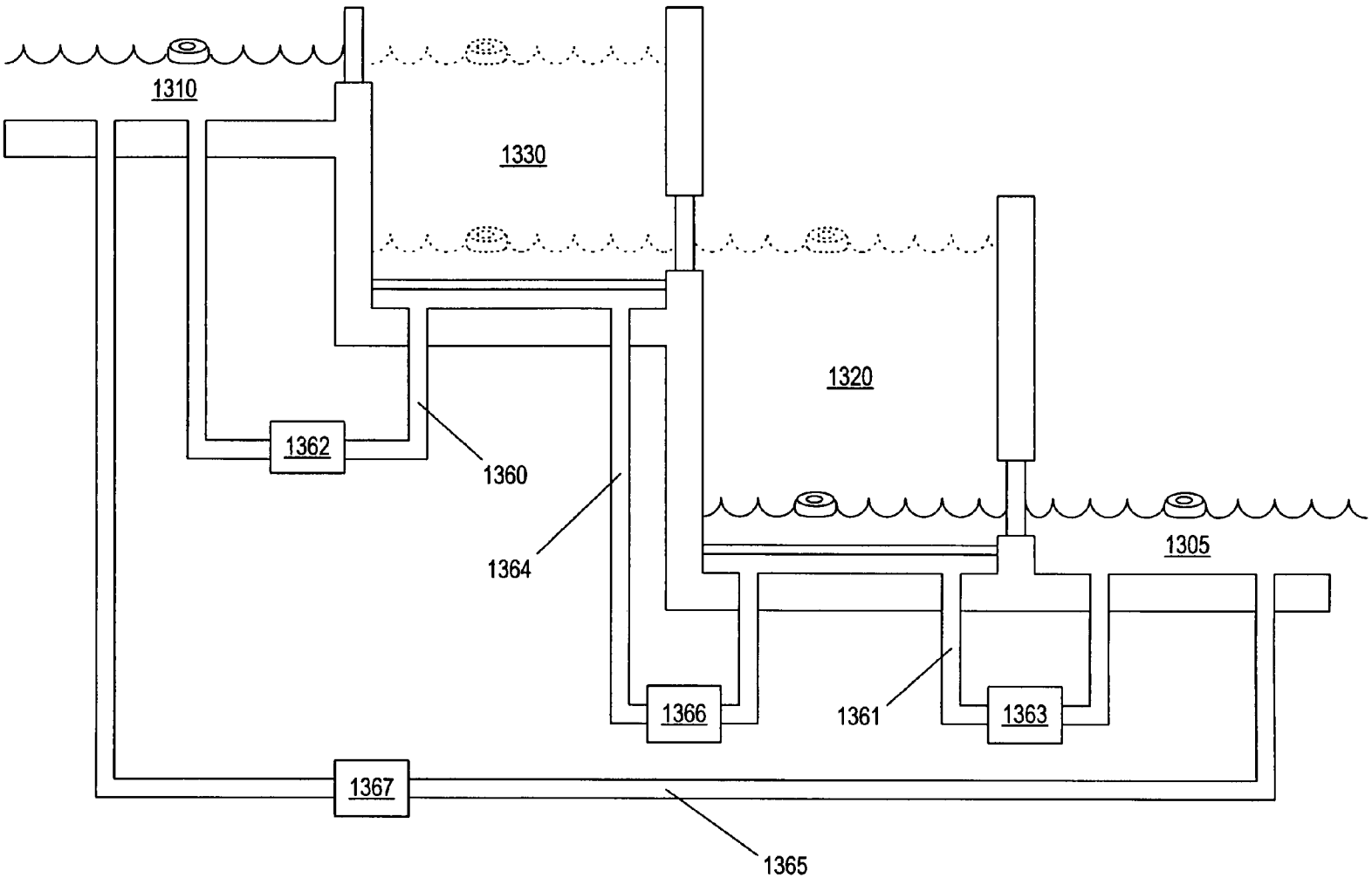
FIG. 59 depicts a cross sectional side view of a water lock system which includes two chambers, a first conduit coupling an upper body of water to the second chamber, a second conduit coupling the second chamber to the first chamber, a third conduit coupling the second chamber to a lower body of water, and a fourth conduit coupling the lower body of water to the upper body of water.

In another embodiment, three conduits may be used to transfer water between the upper body of water 1310, the chambers 1320 and 1330, and the lower body of water 1305, as depicted in FIG. 59. A first conduit 1364 may be coupled to first chamber 1320 and second chamber 1330. A first water control system 1366 may be positioned along first conduit 1364. First conduit 1364 may be configured to transfer water from second chamber 1330 to first chamber 1320. A second conduit 1360 may be coupled to upper body of water 1310 and second chamber 1330. Second conduit 1360 may include a second water control system 1362. Second conduit 1360 may be configured to transfer water from upper body of water 1310 to second chamber 1330. A third conduit 1361 may be coupled to first chamber 1320 and lower body of water 1305. Third conduit 1361 may include a third water control system 1363. Third conduit 1361 may be configured to transfer water from first chamber 1320 to lower body of water 1305. The first, second, and thirds water control systems may include a valve or a pump/valve system (e.g., the system of FIG. 48).

As noted before, a disadvantage of this type of lock system is that water is being transferred from the upper body of water to the lower body of water. After repeated cycles the lower body of water may become overfilled while the upper body of water may become depleted. In an embodiment, a fourth conduit may be added to the system to transfer water from the lower body of water back to the upper body of water. Fourth conduit 1365 may include a fourth water control system 1367. Fourth water control system 1367 may include a pump for pumping water from lower body of water 1305 to upper body of water 1310. The transfer of water from lower body of water 1305 to upper body of water 1310 may occur at anytime during the cycle. The transfer of water from the lower body of water to the upper body of water may occur as water from first chamber 1320 is being transferred to lower body of water 1305. Thus, the level of water in both the upper and lower bodies of water may remain substantially constant over repeated cycles of the lock system.

Figure 60:
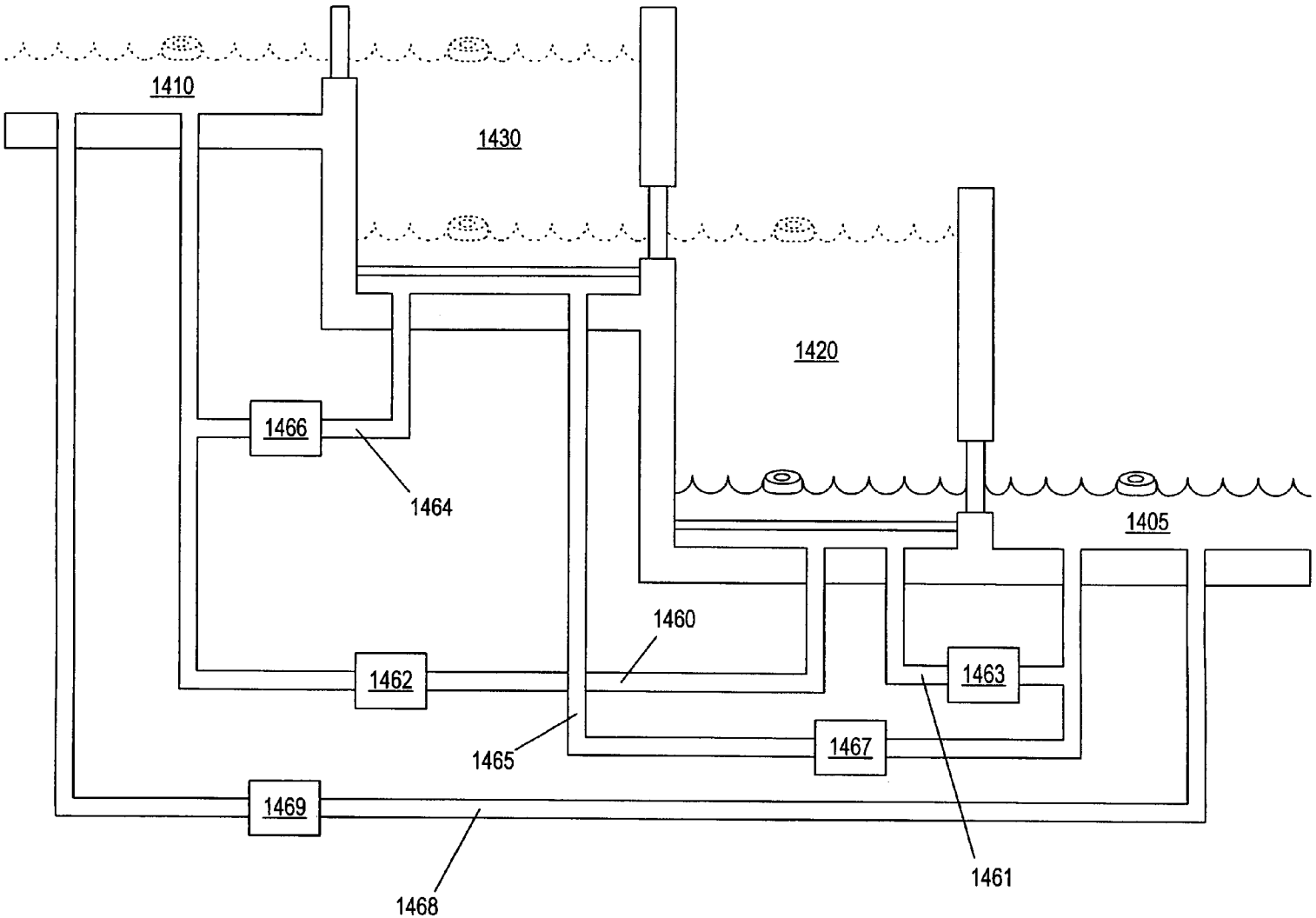
FIG. 60 depicts a cross sectional side view of a water lock system which includes two chambers, a first conduit coupling an upper body of water to the first chamber, a second conduit coupling the upper body of water to the second chamber, a third conduit coupling a lower body of water to the first chamber, a fourth conduit coupling a lower body of water to the second chamber, and a fifth conduit coupling the lower body of water to the upper body of water.

In another embodiment, four conduits may be used to fill and empty the chambers, as depicted in FIG. 60. A first conduit 1460 may be coupled to upper body of water 1410 and to first chamber 1420. A second conduit 1464 may be coupled to upper body of water 1410 and second chamber 1430. The first and second conduits may be configured to allow transfer of water from upper body of water 1410 to the first and second chambers, respectively. First and second water control system 1462 and 1466 may be positioned along the first and second conduits, respectively. A third conduit 1461 may be coupled to first chamber 1420 and lower body of water 1405. A fourth conduit 1465 may be coupled to lower body of water 1405 and second chamber 1430. The third and fourth conduits may be configured to allow the transfer of water from the first and second chambers respectively to the lower body of water. Third and fourth water control systems 1463 and 1467 may be positioned along the third and fourth conduits respectively. The water control systems may include a valve or a valve/pump system (e.g., as depicted in FIG. 48). An advantage of this type of system is that the first and second chambers may be independently emptied or filled.

A fifth conduit 1468 may be added to the system. Fifth conduit 1468 may include a fifth water control system 1469. Fifth water control system 1469 may include a pump for pumping water from lower body of water 1405 to upper body of water 1410. The transfer of water from lower body of water 1405 to upper body of water 1410 may occur at anytime during the cycle. The transfer of water from the lower body of water to the upper body of water may occur as water from first chamber 1420 is being transferred to lower body of water 1405. Thus, the level of water in both the upper and lower bodies of water may remain substantially constant over repeated cycles of the lock system.

The multiple lock systems described above may be used to transfer participants from a lower body of water to an upper body of water in stages while the participants remain in the water. The participants may be swimming in the water or may be floating upon the surface of the water with a floatation device. Examples of floatation devices include, but are not limited to inner tubes, floating boards, life jackets, life preservers, and air mattresses and small boats. By using multiple chambers, a series of smaller chambers may be built rather than a single large chamber. For example, if an elevation change of 100 feet is required a single 100 foot chamber may be built or four coupled 25 foot chambers may be built. In some situations it may be easier to build a series of chambers rather than a single chamber. For example, use of a series of smaller chambers may better match the slope of an existing hill than a large single chamber. Additionally, the chambers may be formed independently of each other. For example, a series of chambers may be used, with a channel or canal connecting each of the chambers, rather than the chambers being integrally formed as depicted in the embodiments above.

Figure 61:
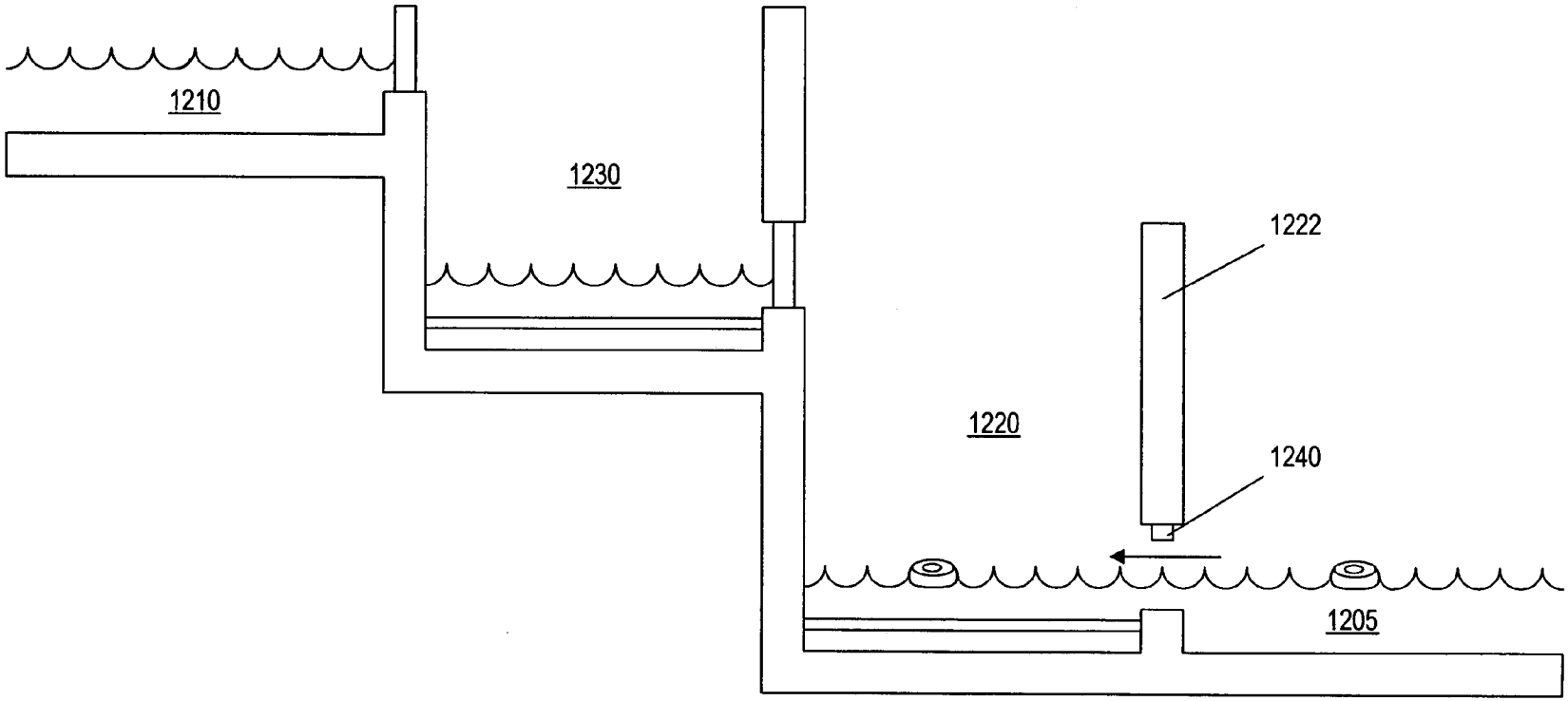
FIG. 61 depicts a cross sectional side view of a water lock system in which participants are being transferred from a lower body of water to a first chamber.

A method of using a multiple chamber system is described below. As depicted in FIG. 61, a lock system may include a first chamber 1220 which is coupled to a lower body of water 1205 and a second chamber 1230 coupled to the first chamber and an upper body of water 1210. While only two chambers are shown it should be understood that additional chambers may be positioned between the first and second chambers and that the below described method would be applicable to such multiple chamber systems. The level of water in first chamber 1220 may be initially set to be substantially equal to the level of water in lower body of water 1205. A first movable member 1240 may be formed in outer wall 1222 of first chamber 1220 proximate the upper surface of lower body of water 1205. First movable member 1240 may, initially, be in an open position to allow participants to move from lower body of water 1205 into the first chamber. The participants may swim or propel their floatation device into the chamber via the first movable member. Alternatively, a water current, as previously described, may be produced to push the participants toward the first chamber from the lower body of water.

Figure 62:
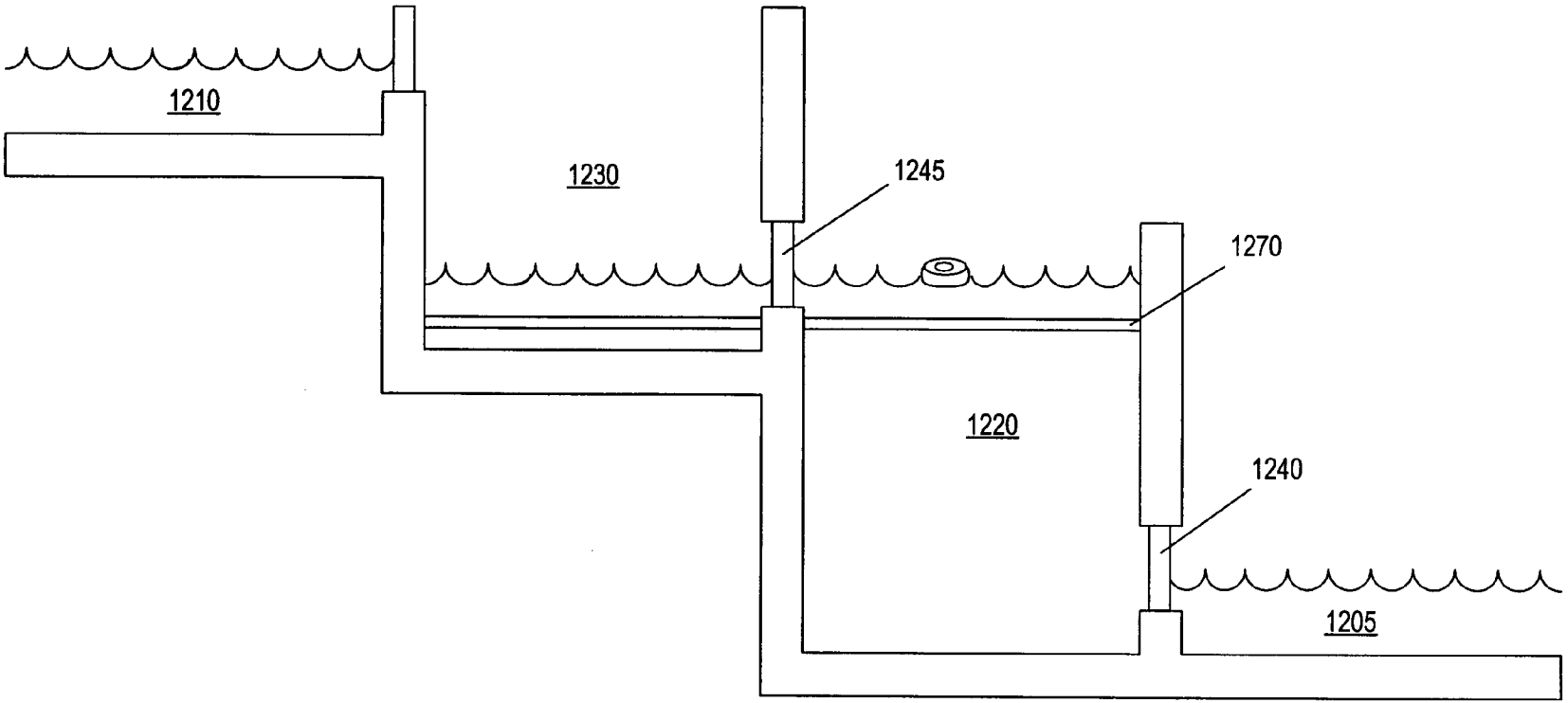
FIG. 62 depicts a cross sectional side view of a water lock system in which the first chamber is filled with water.

After the participants have entered first chamber 1220, first movable member 1240 may be closed, as depicted in FIG. 62.

Water may be transferred from a water source into first chamber 1220 causing the water level within the first chamber to rise. The water source may be the lower body of water 1205, the upper body of water 1210, and/or an alternate water supply source (e.g., a nearby water reservoir, river, lake, ocean, etc.). The water may be transferred into first chamber 1220 until the water level in the chamber is substantially equal to the level of water in second chamber 1230. Second movable member 1245 may be positioned at a level above the bottom of second chamber 1230. Second chamber 1230 may be filled with water to a level equal to a portion of second movable member 1245. Thus, the participants may be raised from lower body of water 1205 to an intermediate level as water is transferred into the first chamber. A bottom member 1270, as described above, may also be raised as the water enters the chamber.

Figure 63:
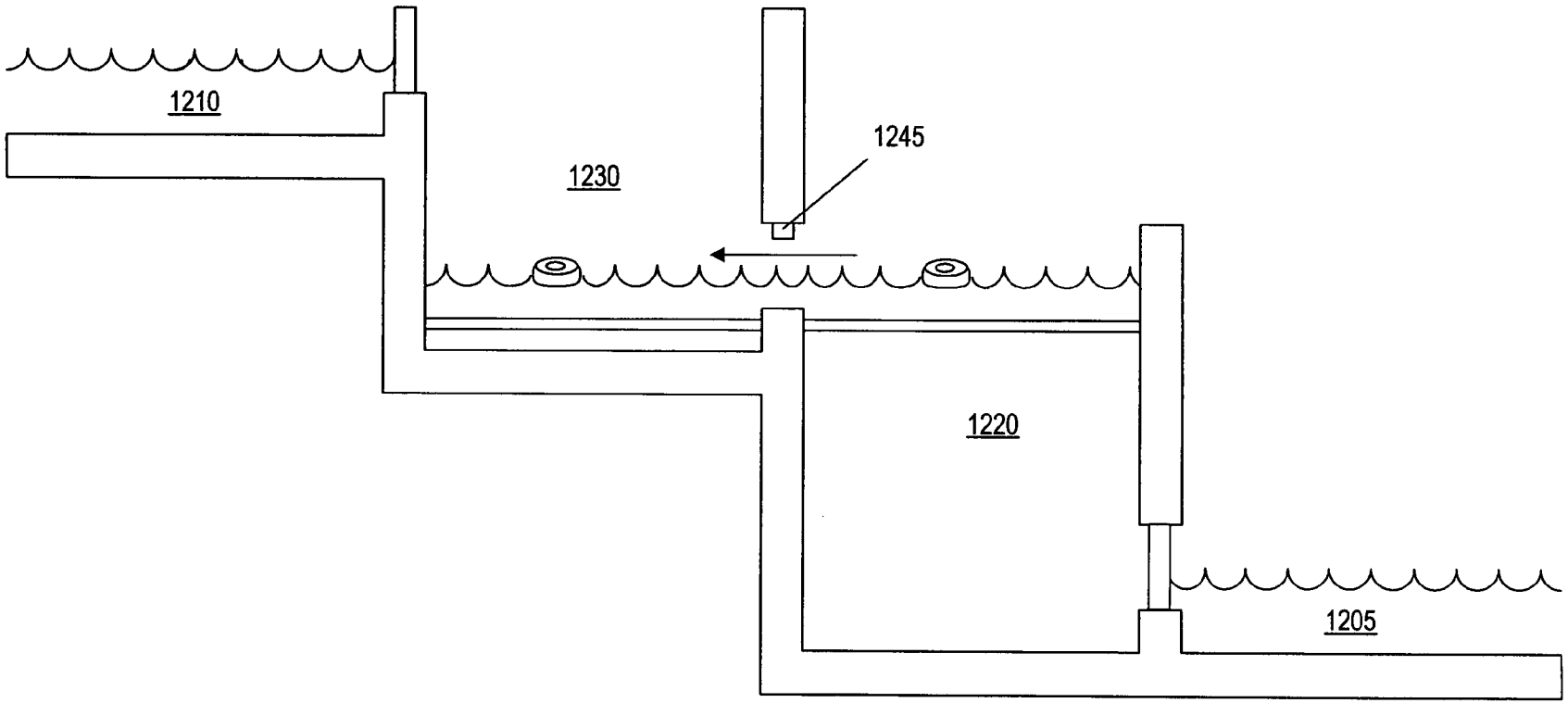
FIG. 63 depicts a cross sectional side view of a water lock system in which participants are being transferred from the first chamber to a second chamber.

After the water in first chamber 1220 has reached a level substantially equal to the water in second chamber 1230, second movable member 1245 may be opened as depicted in FIG. 63. Participants may move from first chamber 1220 into second chamber 1230. The participants may move into second chamber 1230 using their own power or be propelled by a water current.

Figure 64:
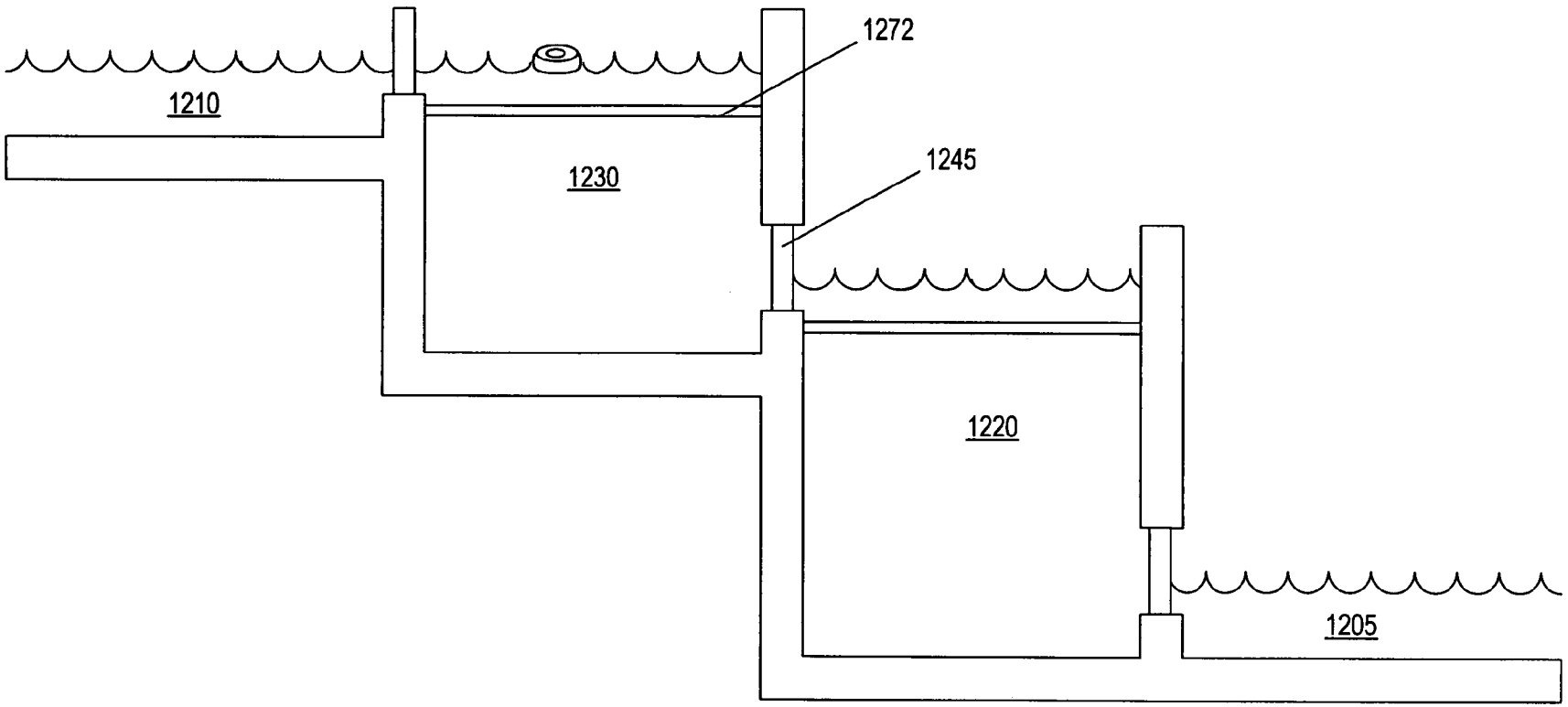
FIG. 64 depicts a cross sectional side view of a water lock system in which the second chamber is filled with water.

After the participants have entered second chamber 1230, second movable member 1245 may be closed, as depicted in FIG. 64. Water may be transferred from a water source into second chamber 1230 causing the water level within the second chamber to rise. The water may be transferred into the chamber until the water level in second chamber 1230 is substantially equal to the level of water in upper body of water 1210. Thus, the participants may be further raised from an intermediate level to upper body of water 1210 as water is transferred into second chamber 1230. A bottom member 1272, as described above, may also be raised as the water enters the second chamber.

Figure 65:
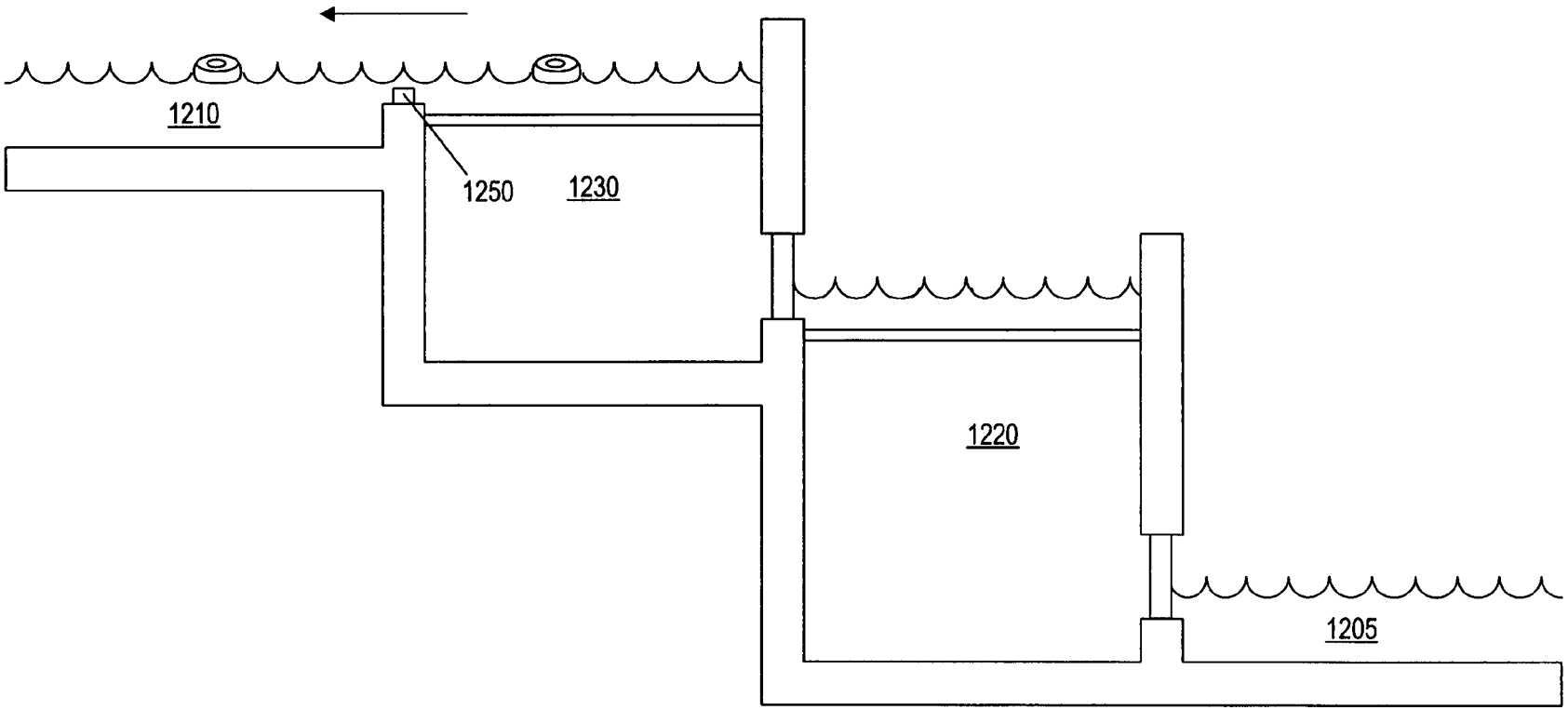
FIG. 65 depicts a cross sectional side view of a water lock system in which participants are being transferred from the second chamber to the upper body of water.

After the water in second chamber 1230 has reached a level substantially equal to the water in upper body of water 1210, third movable member 1250 may be opened as depicted in FIG. 65. Participants may then move from second chamber 1230 into upper body of water 1210. The participants may move using their own power or be propelled by a water current into upper body of water 1210. Overall, the participants may be moved from a lower body of water to an upper body of water while remaining in water during the entire transfer period.

After the participants are transferred to upper body of water 1210, the water level in the both chambers may be lowered. In one embodiment, the water in both chambers may be lowered at the same time. This allows both chambers to be reset to the original starting water levels (e.g., as depicted in FIG. 61). The water within first chamber 1220 may be set at a level about equal to lower body of water 1205. The water within second chamber 1230 may be set at a level proximate second movable member 1245. After the water level is reduced, first movable member 1240 may be reopened to allow more participants to be transferred into the lock system.

Figure 66:
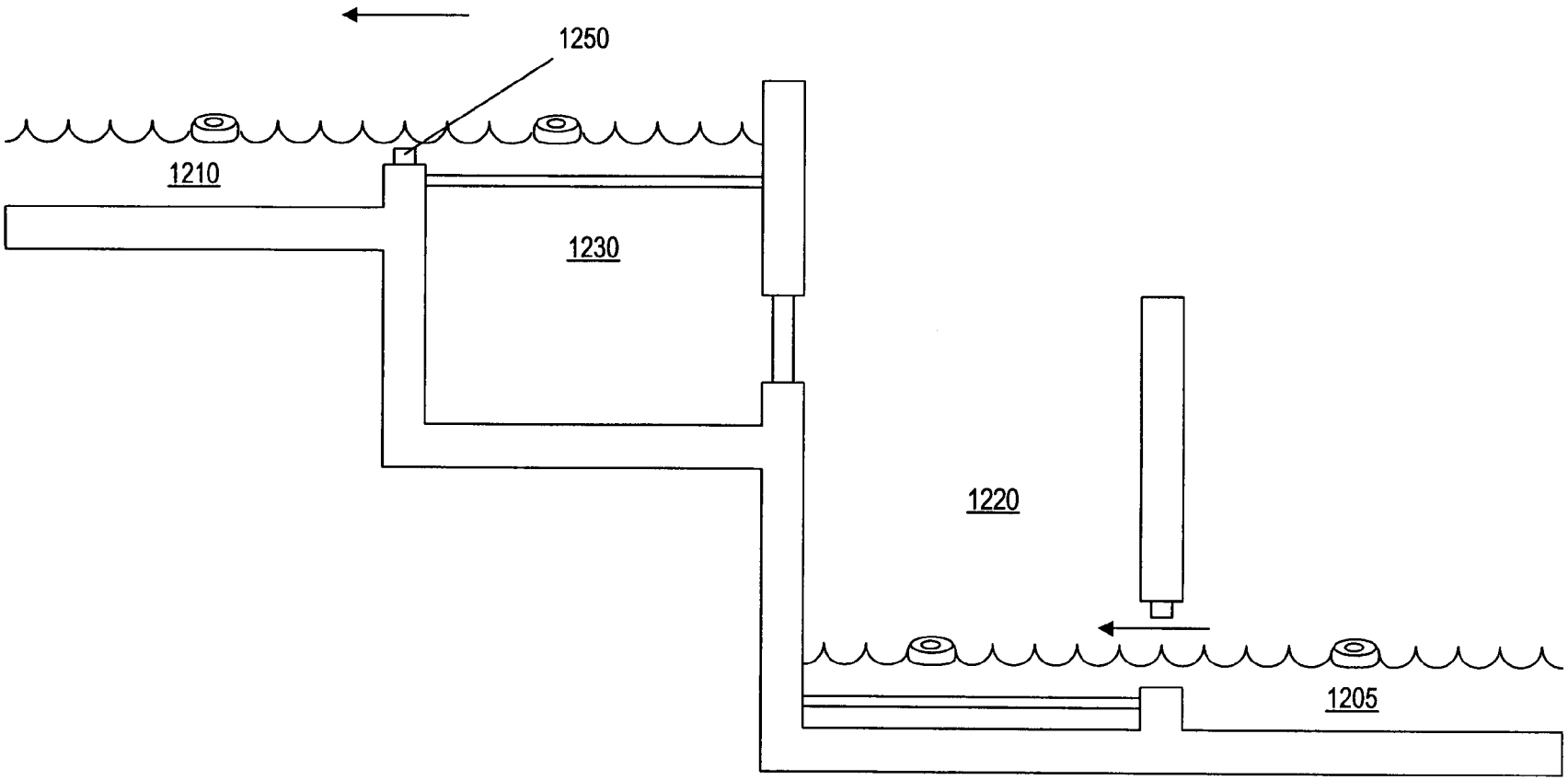
FIG. 66 depicts a cross sectional side view of a water lock system in which participants are being transferred from the second chamber to the upper body of water and from the lower body of water to the first chamber.

Alternatively, the filling and emptying of the chambers may be offset to allow a more efficient usage of a multiple chamber system. After participants have moved from first chamber 1220 to second chamber 1230, the first chamber may be emptied while the second chamber is filled, as depicted in FIG. 66. After second chamber 1230 is filled, third movable member 1250 is opened and the participants may move into upper body of water 1210. While the participants are being transferred to upper body of water 1210, additional participants may enter first chamber 1220. Once the participants have entered first chamber 1220 and left second chamber 1230, the water level in the first chamber may be raised while the water in the second chamber is lowered (see FIG. 63). The system may thereafter be cycled between the states depicted in FIGS. 63 and 66 to continually transfer participants from the lower body of water to the upper body of water. It should be understood that while a method of transferring the participants from the lower body of water to the upper body of water is described, the lock system may also be used to transfer participants from an upper body to a lower body. Thus, after a group of participants have been transferred to the upper body, another group may enter the lock system and be transferred to the lower body as the water within the chambers is lowered.

Figure 37:
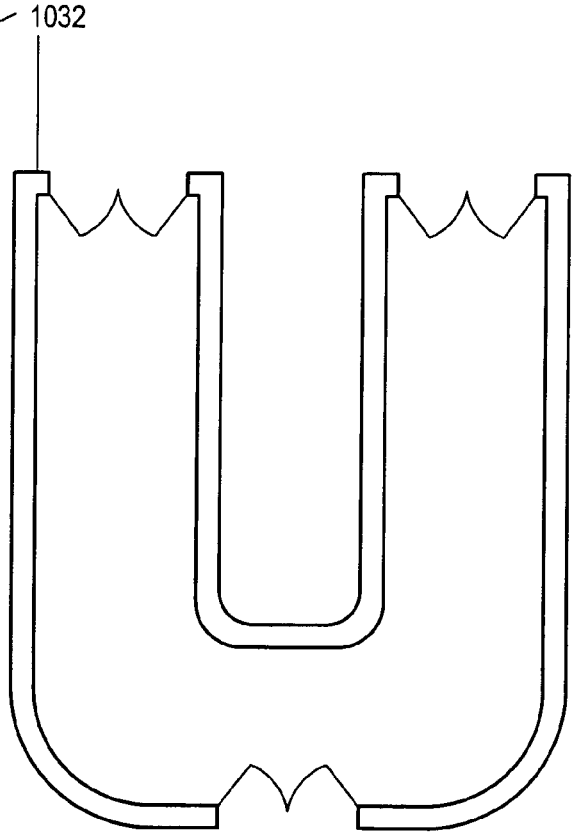
FIG. 37 depicts an overhead view of a U-shaped lock system.
Figure 39:
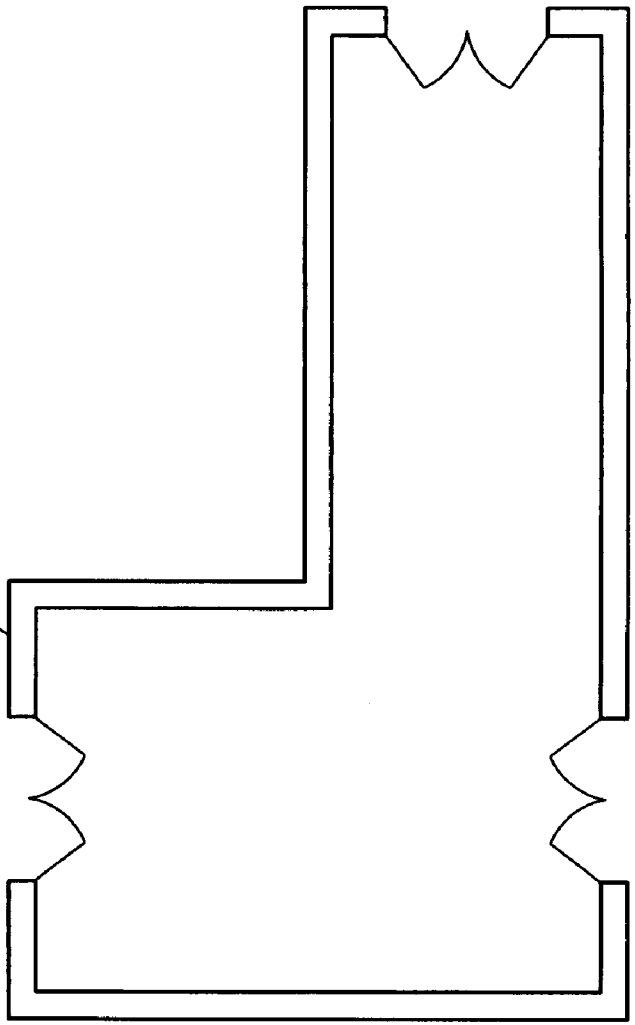
FIG. 39 depicts an overhead view of an L-shaped lock system.
Figure 38:
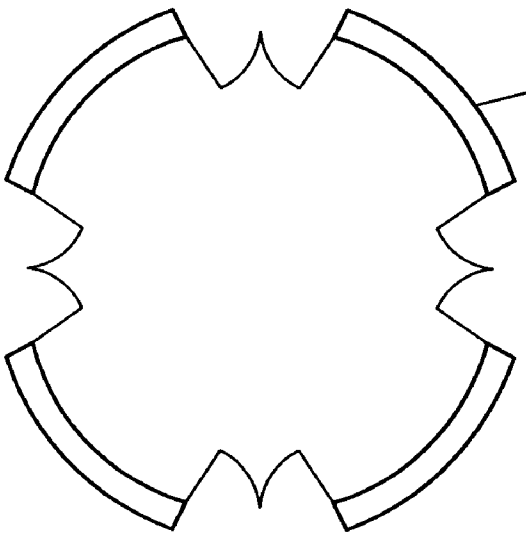
FIG. 38 depicts an overhead view of a circular lock system.

Referring back to FIGS. 37-39 it should be appreciated that multiple movable members may be formed in the chamber. FIG. 37, for example, depicts a U-shaped chamber which includes three movable members. The movable members may lead to three separate bodies of water or three locations of the same upper body of water. FIGS. 38 and 39 also depict chambers having multiple movable members. In this manner, the chamber may be used to transfer participants from a receiving pool to multiple water rides.

Figure 67:
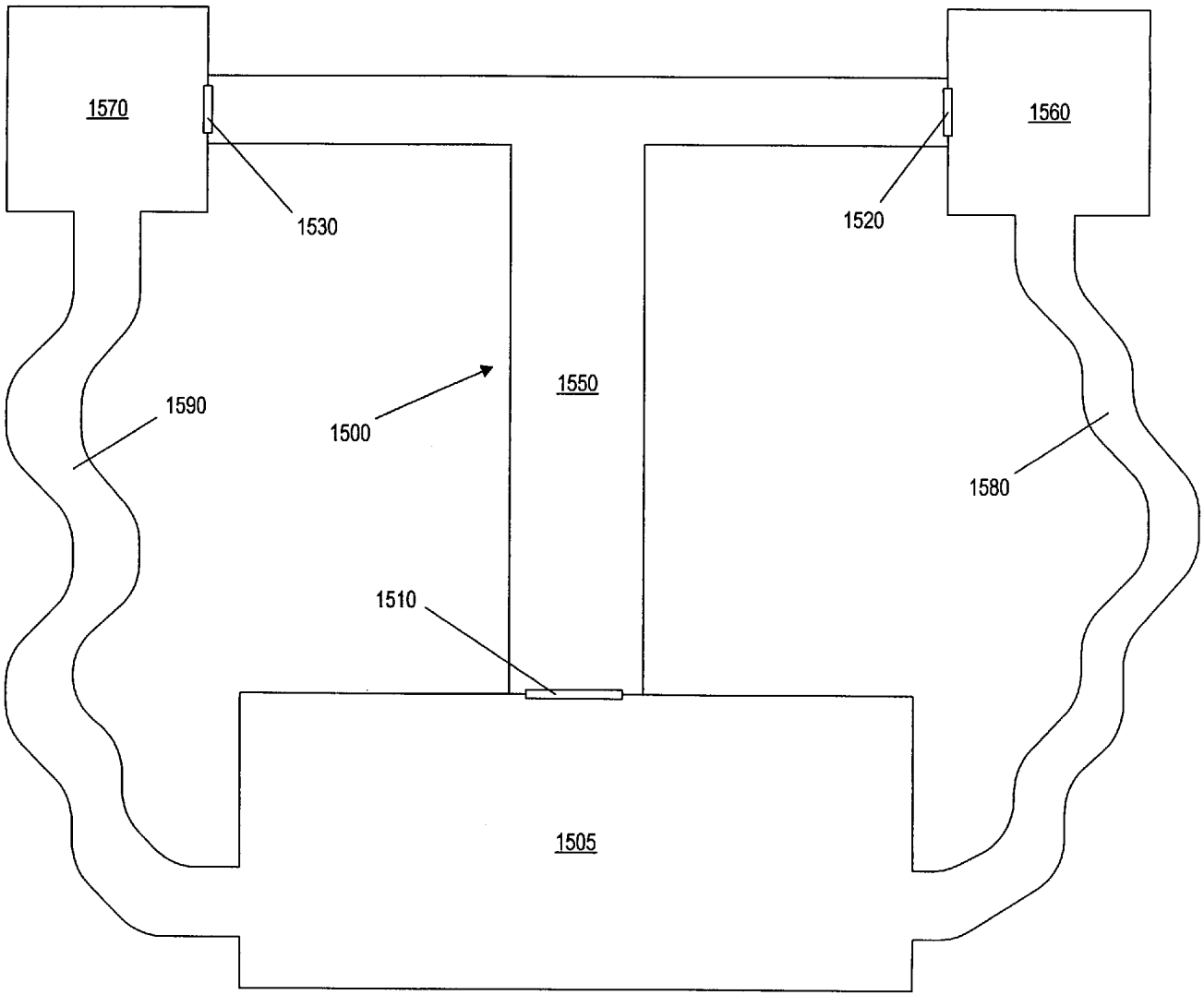
FIG. 67 depicts an overhead view of a water park system which includes a lock system.

FIG. 67 depicts an overhead view of a water park, in which two water rides are depicted which start at different locations. A first water ride 1590 is configured to convey participants from a first upper body of water 1570 to a receiving pool 1505. A second water ride 1580 is configured to convey participants from a second upper body of water 1560 to receiving pool 1505. Receiving pool 1505 may be positioned at an elevation below the first and second upper bodies of water. A water lock system 1500 preferably couples receiving pool 1505 to first and second upper bodies of water 1560 and 1570. Participants exiting either water ride will preferably enter receiving pool 1505. The participants may propel themselves, or be propelled, through the water of the receiving pool over to movable member 1510. When movable member 1510 is open, participants may enter chamber 1550 of water lock system 1500. After entering chamber 1550, the chamber may be filled with water to a level which is substantially equal to the upper bodies of water. As the chamber is filled participants may propel themselves, or be propelled to either of the two upper movable members 1520 and 1530. After the chamber is filled, movable members 1520 and 1530 may be opened allowing the participants to move to the start of either water ride. Thus, a centrally disposed water lock system 1500 may allow the participants to enjoy a variety of water rides without having to leave the water. Any of the previously described water lock systems may be incorporated into the water park system.

Figure 68:
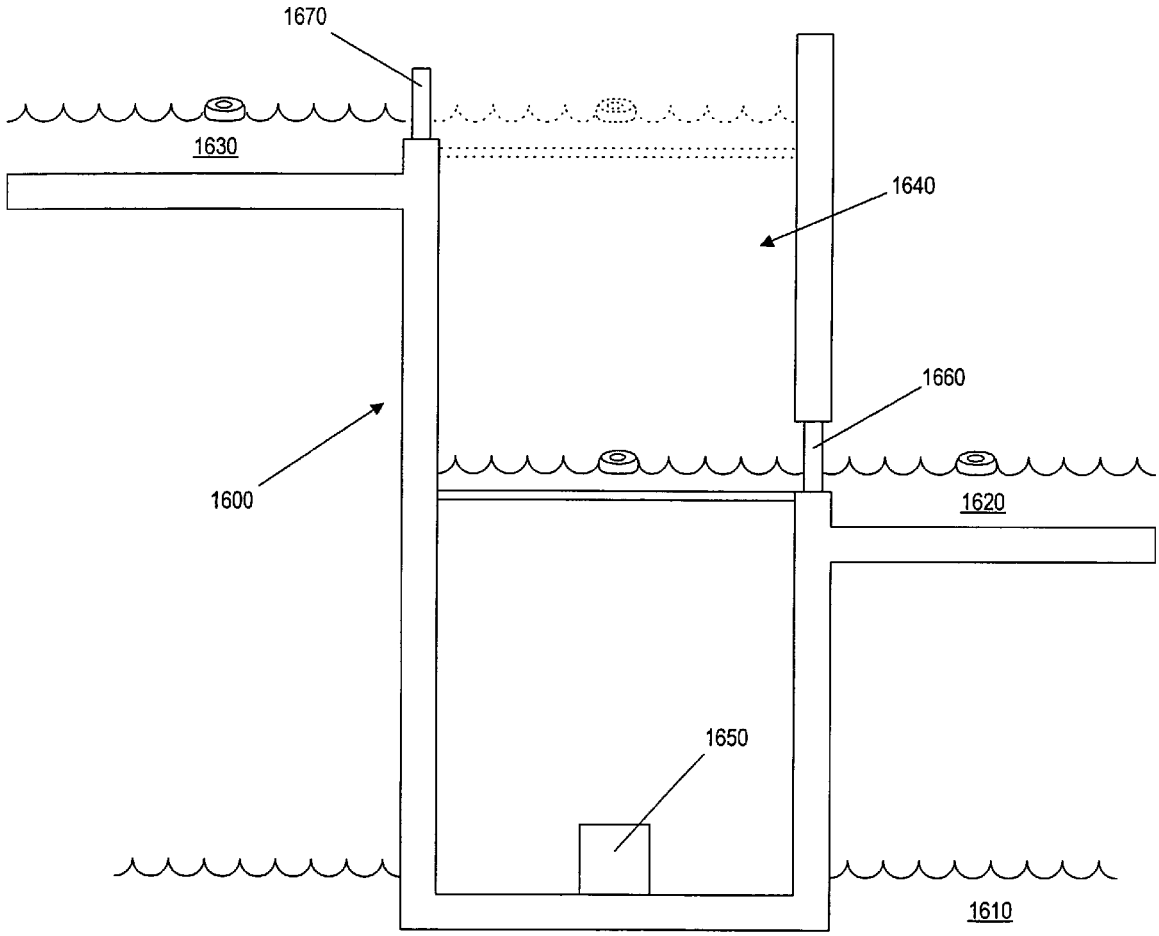
FIG. 68 depicts a cross sectional side view of a water lock system in which includes a chamber and three movable members, each movable member being at a different elevation.

It should be understood that the additional movable members do not need to be at the same vertical height along the chamber wall. As depicted in FIG. 68 some water rides may have starting points at different elevations. To accommodate these different elevations, movable members may be formed at different heights within the chamber, each elevation corresponding to a ride or series of rides which have starting points at about that elevational height. As depicted in FIG. 68, three bodies of water may be coupled by a water lock system 1600. A receiving pool 1610 is formed at the base of the water lock system 1600. Receiving pool 1610 may be positioned to receive participants exiting from various water rides. A first movable member 1650 may be formed proximate receiving pool 1610 to allow participants from the receiving pool to enter chamber 1640. After the participants enter chamber 1640, the chamber may be filled with water. The water level may be raised until the water level is at a level substantially equal to the water level of a first upper body of water 1620.

Participants which desire to ride water rides which are coupled to first upper body of water 1620 may now leave chamber 1640 via movable member 1660. Other riders who wish to ride water rides coupled to a second, higher elevation body of water 1630 may remain in chamber 1640. After some of the participants have been transferred to first upper body of water 1620, the water level of the chamber may be further raised to a level substantially equal to the water level of second upper body of water 1630. The remaining participants may now enter second upper body of water 1630 via movable member 1670. In this way the water lock system may accommodate water rides starting at different elevational levels. While only two upper bodies of water are depicted, it should be understood that additional movable members at additional heights may be disposed in the walls of the chamber to allow additional water rides to be coupled to a centrally disposed water lock system.

While described as having only a single chamber coupled to two bodies of water, it should be understood that multiple chambers may be interlocked to couple two or more bodies of water. By using multiple chambers, a series of smaller chambers may be built rather than a single large chamber. In some situations it may be easier to build a series of chambers rather than a single chamber. For example, use of a series of smaller chambers may better match the slope of an existing hill.

Lock System with Pneumatically Operated Gate

Figure 69:
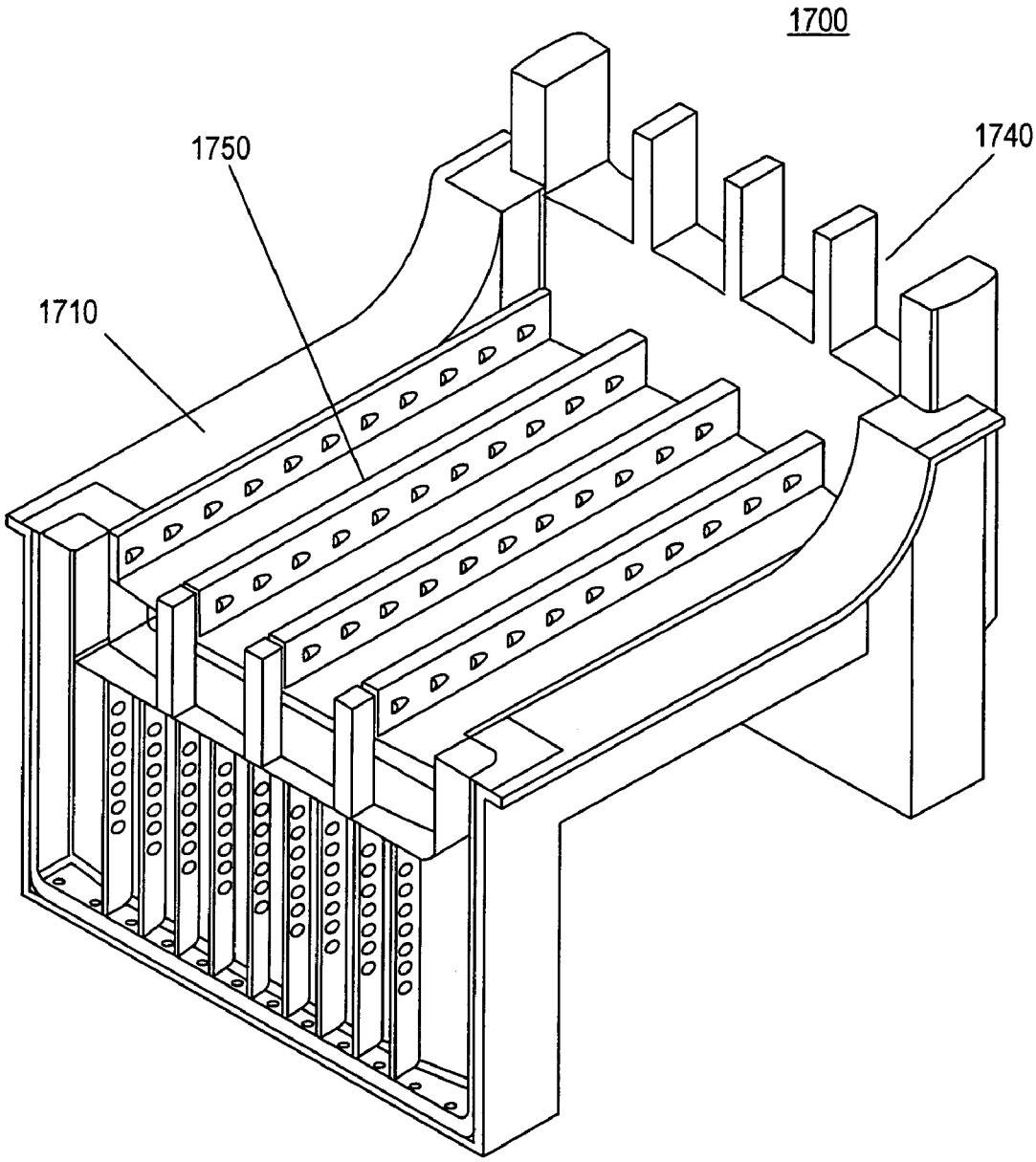
FIG. 69 depicts a side elevational view of a lock assembly in a water lock system.
Figure 70:
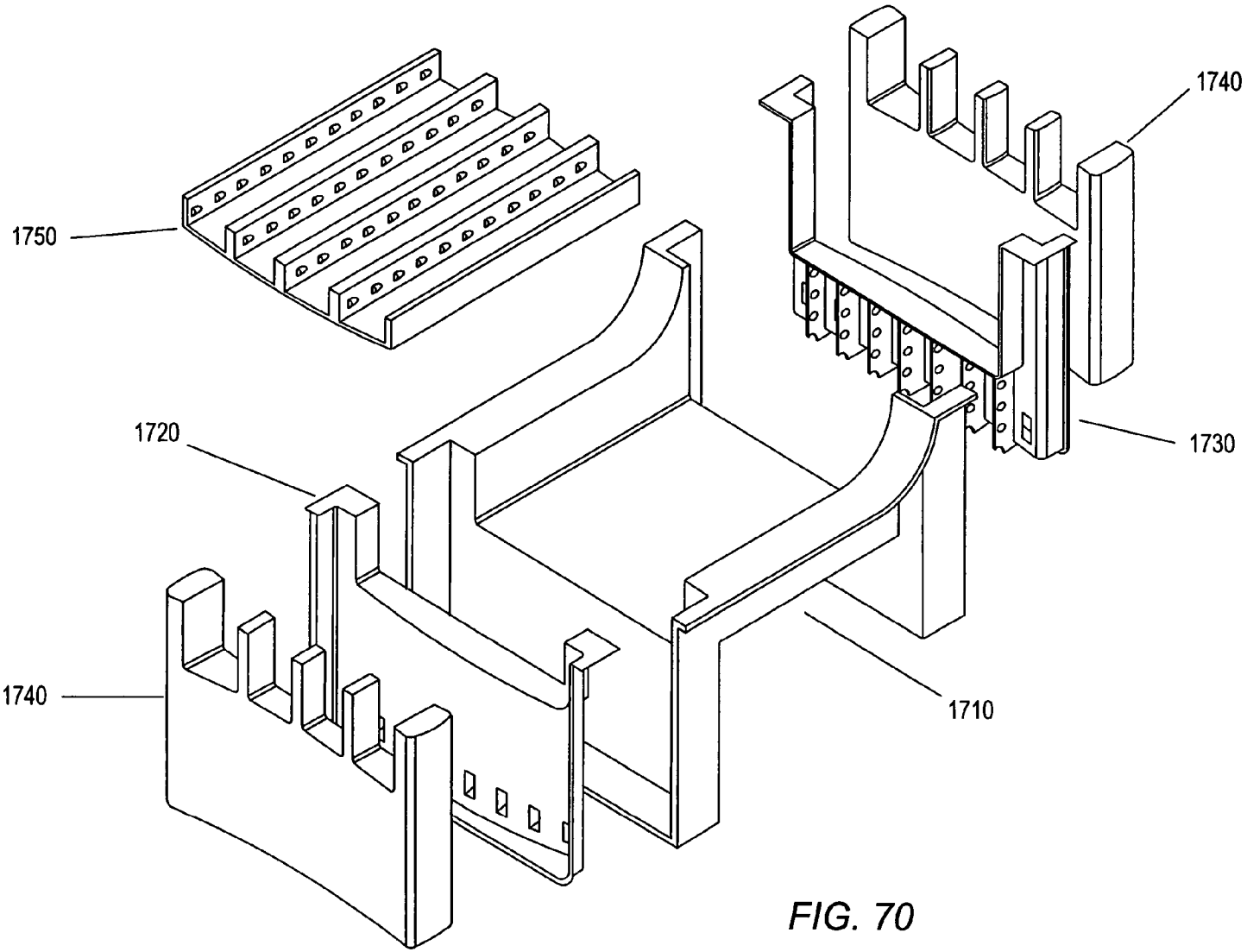
FIG. 70 depicts an exploded view of the elements of the lock assembly of FIG. 69.

FIGS. 69-82 depict one embodiment of an individual lock for use in any of the above mentioned systems. Referring to FIGS. 69 and 70, the lock assembly generally is noted as 1700. It further comprises a lock 1710, a high 1720 and a low 1730 sleeve for receiving a gate 300, a bottom member 1750, a compressed air source 1760, a pump 1770, a controller 1780, an entry pool 1790, and an exit pool 1800.

Figure 71:
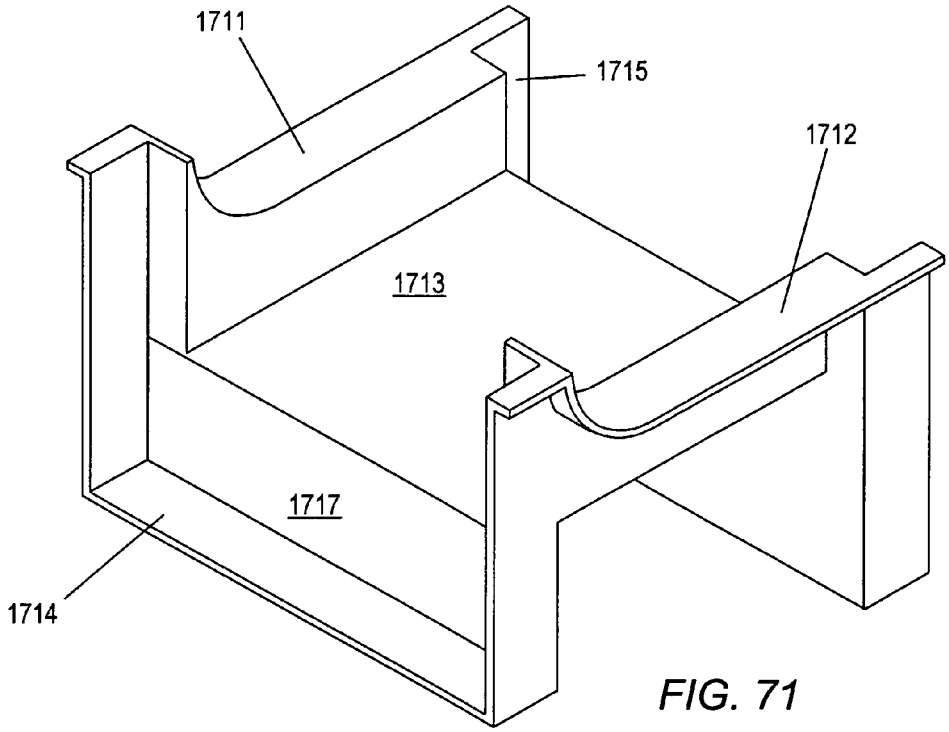
FIG. 71 depicts a side elevational view of the lock of the lock assembly of FIG. 69, as viewed from the upstream side.
Figure 72:
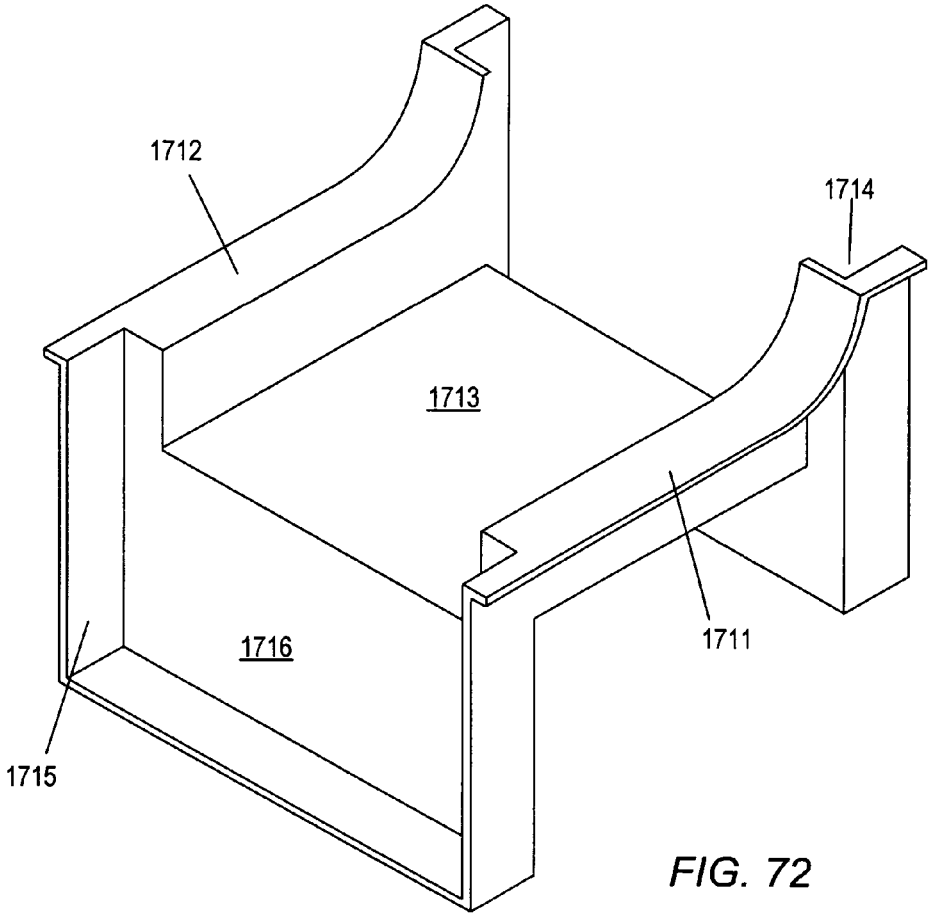
FIG. 72 depicts a side elevational view of the lock of the lock assembly of FIG. 69, as viewed from the downstream side.

The lock 1710, shown in FIGS. 71 and 72, further defines perimeter aprons 1711, 1712, a lifting bay 1713 with an upstream end 1716 and a downstream end 1717, and upper and lower lock gate wells 1714, 1715. The perimeter aprons 1711, 1712 may be of varying dimensions depending on the surroundings, but should be wide enough to provide a buffer to keep foreign materials from entering the system 11700. Structurally, the aprons 1711, 1712 should be wide enough to stiffen the top of the lifting bay 1713 and wells 1714, 1715. The lifting bay 1713 dimensions will depend on the desired elevation gain and capacity of the system. The upper and lower lock gate wells 1714, 1715 should be configured to receive the low and high sleeves 1730, 1720, respectively. The well feature 1714, 1715 of the lock 1710 is the only critical portion in terms of accuracy of concrete forming. This accuracy should be within ±⅛ inch to insure minimal distortion to the sleeve 1720, 1730 and gate 300 elements while they are loaded.

Figure 73:
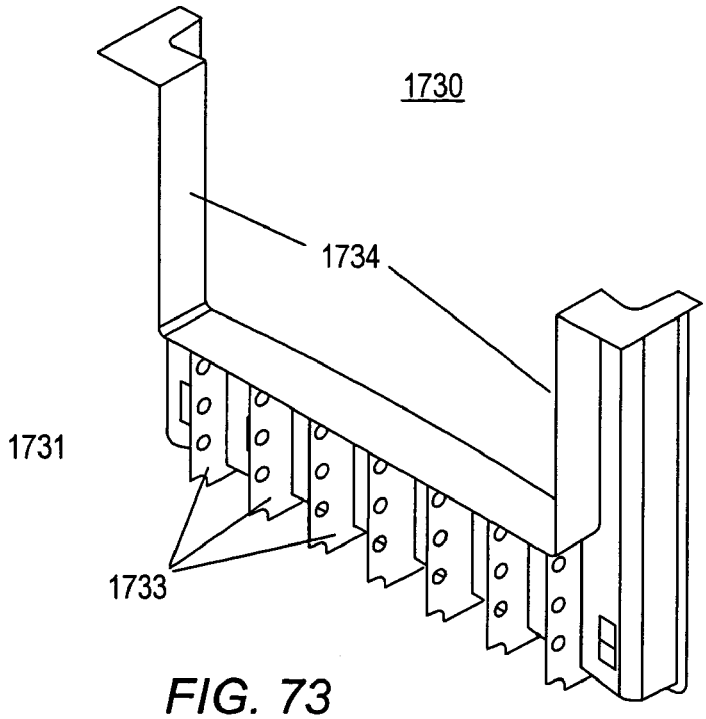
FIG. 73 is a side elevational view of the low sleeve of the lock assembly of FIG. 69, as viewed from the back of the sleeve.
Figure 74:
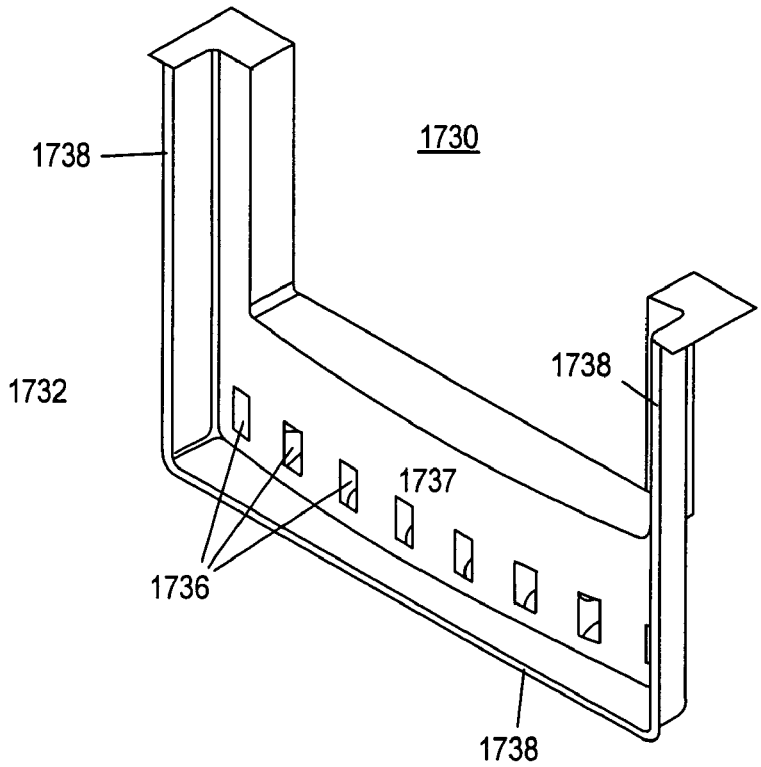
FIG. 74 is a side elevational view of the low sleeve of the lock assembly of FIG. 69, as viewed from the front of the sleeve.

The sleeves 1720 and 1730 (FIGS. 73-77) serve to house the gates 300 and provide a low friction surface for the gates 300. FIGS. 73 and 74 show the back 1731 and front 1732, respectively, of the low sleeve 1730. The back 1731 of the sleeve 1730 further defines one or more stiffening webs 1733 and a support flange 1734. The front 1732 of the low sleeve 1730 defines the low friction surfaces along which the gate 300 will slide vertically during use. The front 1732 also defines a front face 1737 and a support flange 1738. There are also one or more water ports 1736 through the sleeve 1730, to allow circulation of water.

Figure 75:
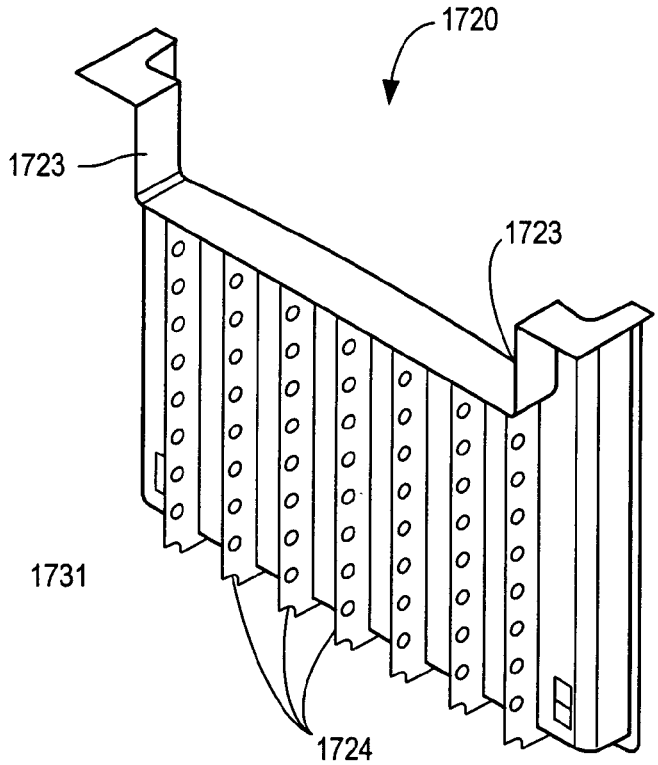
FIG. 75 is a side elevational view of the high sleeve of the lock assembly of FIG. 69, as viewed from the back of the sleeve.
Figure 76:
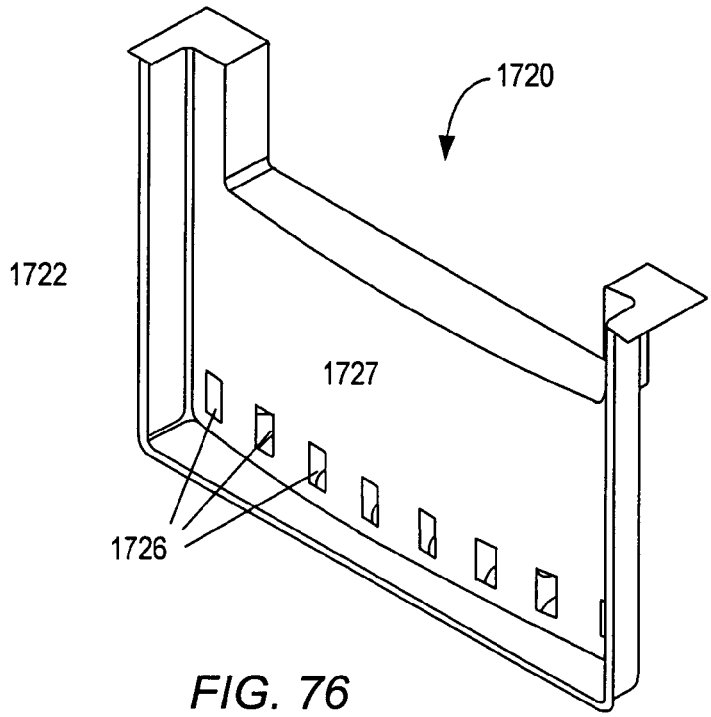
FIG. 76 is a side elevational view of the high sleeve of the lock assembly of FIG. 69, as viewed from the front of the sleeve.

The high sleeve 1720 is depicted in FIGS. 75 and 76. This assembly 1720 also defines a support flange 1723 and one or more stiffening webs 1724 on the back 1731. The front 1722 defines a larger front face 1727 than the front face 1737 of the low sleeve 1730 to conform to the shape of the portion of the lock 1710 that will support it. This sleeve 1720 also defines one or more water ports 1726.

Figure 77:
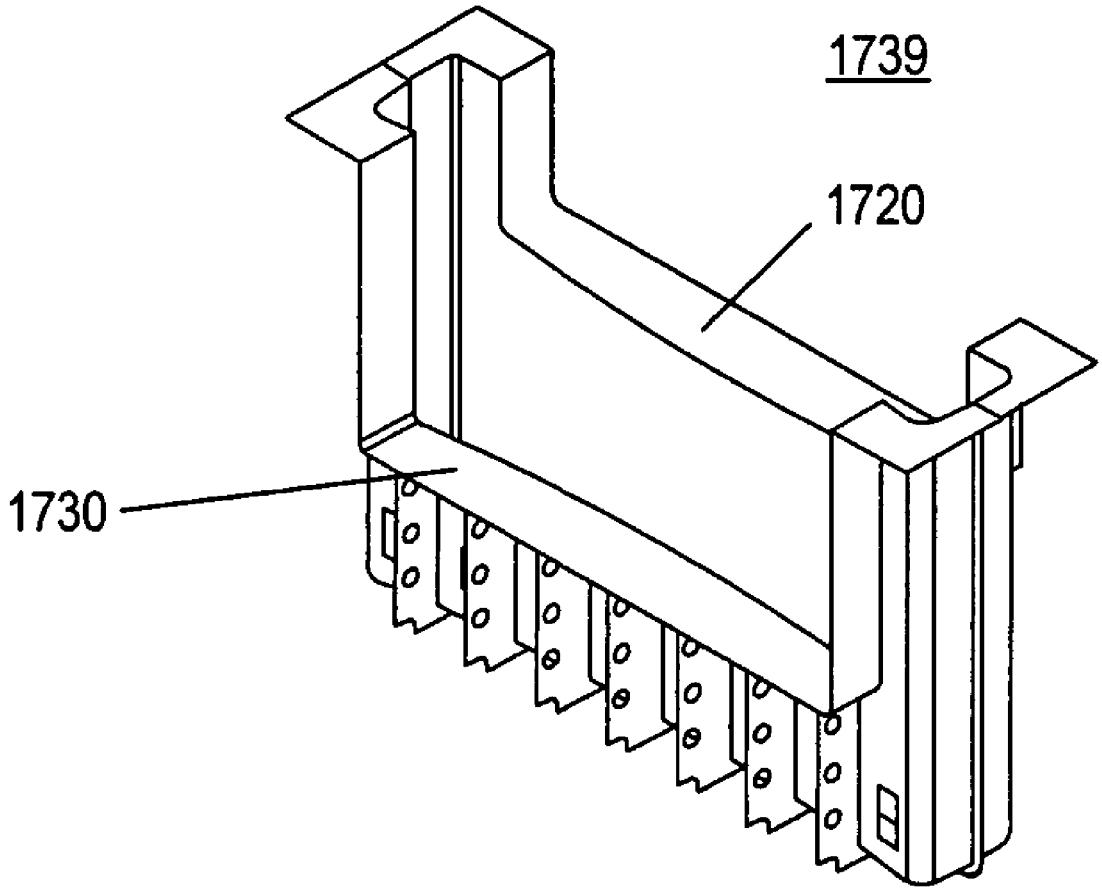
FIG. 77 is a side elevational view of a sleeve assembly of the lock assembly of FIG. 69.

While the high and low sleeves 1720, 1730 have been described separately for clarity and to describe one complete lock assembly 1700 of a lock system, it should be understood that in use, the high sleeve 1720 of one lock assembly 1700 of a lock system will be coupled with the low sleeve 1730 of the adjacent downstream lock assembly 1700 to comprise a single sleeve assembly 1739, as depicted in FIG. 77. Similarly, the low sleeve 1730 of the lock assembly 1700 will be coupled with the high sleeve 1720 of the adjacent upstream lock assembly 1700.

FIGS. 28 and 29 show the gate 300. The gate 300 is substantially hollow, but may contain one or more stiffening webs 315. The gate defines one or more ports 302 to allow water to flow in and out of the gate 300. The gate further defines one or more valves (not shown) configured to be coupled to a compressed air source (not shown). During use, compressed air may be introduced into the gate 300 via the valve, which will force water out of the ports 302 in the bottom 1742, causing the buoyancy of the gate 300 to increase and the gate 300 to float upward. In an embodiment, the upstream face 1746 of the gate may be curved as shown in FIG. 28 to better withstand the force of the water bearing on the gate 300 in a closed position.

An alternate embodiment of the gate 300 does not comprise ports 302. In this embodiment, the one or more valves are coupled to a water source. Water is pumped into the gate 300 through the valve to decrease the buoyancy and move the gate 300 to a open position, and water is pumped out of the gate 300 through the valve to increase the buoyancy and move the gate to a closed position. In this way, no source of compressed air is needed to operate the gate 300.

A further embodiment of the gate 300 additionally comprises pneumatic or hydraulic cylinders 1747 with attached pistons 1748, as shown in FIG. 78. When the gate 300 is in a closed position, the cylinders 1747 may be actuated to extend the pistons 1748 into receptacles in the sleeve (not shown). The cylinders 1747 may be actuated to retract the pistons 1748 to allow the gate to move back to an open position. The piston 1748 and cylinder 1747 arrangement may serve as a safety device to ensure that the gate remains in a closed position in the event of equipment failure. Gate 300 may further comprise a water permeable section 1749 which may serve to control water overflow when gate 300 is in closed position. In addition water permeable section 1749 may inhibit participants from prematurely exiting water lock 1710. Water permeable section 1749 may retract within gate 300 when gate 300 is in an open position and extend out of gate 300 when gate 300 is in a closed position. The at least one guide rail 545 and ratcheted locking system 555 depicted in FIG. 34 may also be incorporated into the gate 300 and sleeve 1720, 1730 design to perform the same function.

Several considerations should be taken into account when designing the gate 300 and sleeve 1720, 1730 assembly. The depth of the well 1714, 1715 must be great enough to accept the total desired vertical displacement of the gate 300. The width of the gate 300 should be proportioned to include enough volume to float the gate 300 when approximately one-third is filled with air. The one-third figure is approximate and is chosen to ensure that enough upward pressure may be applied to the gate 300 to overcome resistance to gate movement.

Another consideration in the design of the system is the overlap of the lock gate 300 and the sleeve 1720, 1730 when the gate 300 is in a closed position. In this position the gate 300 is subjected to substantial pressure as the upstream lock is filled with water. The gate 300 must be designed to withstand these loads. It also must be designed to minimize friction to allow movement of the gate 300 to be driven by buoyancy changes or pneumatic or hydraulic cylinder and piston pressure. Further, in the closed position, the gate 300 and sleeve 1720, 1730 assembly may use the upstream water pressure to aid in creating an effective seal between the gate 300 and sleeve 1720, 1730; the upstream pressure will help force the gate 300 securely against the sleeve 1720, 1730. The tolerance (or gap) between the outside of the gate 300 and the inside of the sleeve 1720, 1730 should be designed with this small lateral movement of the gate 300 in mind. The tolerance should also allow for a freely sliding gate 300. Therefore the tolerance between the gate 300 and sleeve 1720, 1730 must be minimized for sealing purposes but balanced against the increased friction between the gate 300 and sleeve 1720, 1730 as the tolerance gets smaller and smaller. The preferred tolerance between the sleeve 1720, 1730 and the gate 300 can be less than 0.375 inches, and a tolerance of 0.1875 inches would be even more effective for sealing and actuation purposes.

The bottom member 1750 (FIGS. 79 and 80) may comprise one or more lane walls 1751 defining one or more lanes 1752. The bottom member 1750 is configured to float about 3 feet below the surface of the water in the lifting bay 1713. Each lane wall 1751 may further comprise one or more nozzles 1753, each of which may be connected to the pump 1770 and configured to direct a stream of water upstream. The lane 1752 and nozzle 1753 configuration will help ensure a faster and more orderly progression of participants through the lock system 1710. Though not shown, a further embodiment would include the at least one guide rail 545 and ratcheted locking system 555 depicted in FIG. 34.

Figure 81:
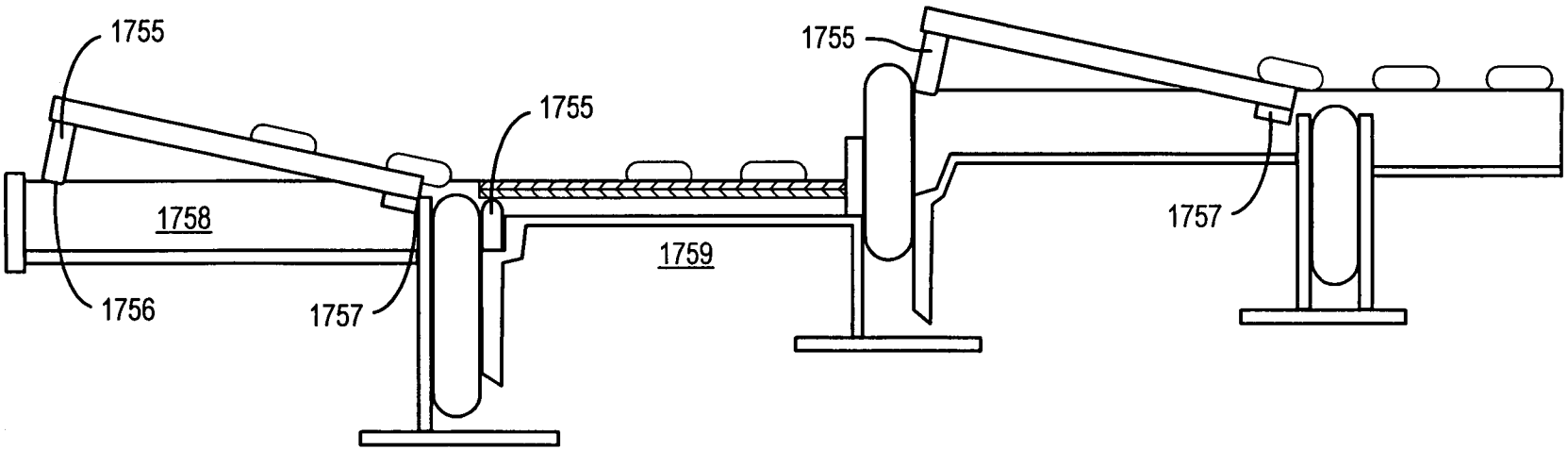
FIG. 81 is a side elevational view of a lock system with adjustable basket.
Figure 82:
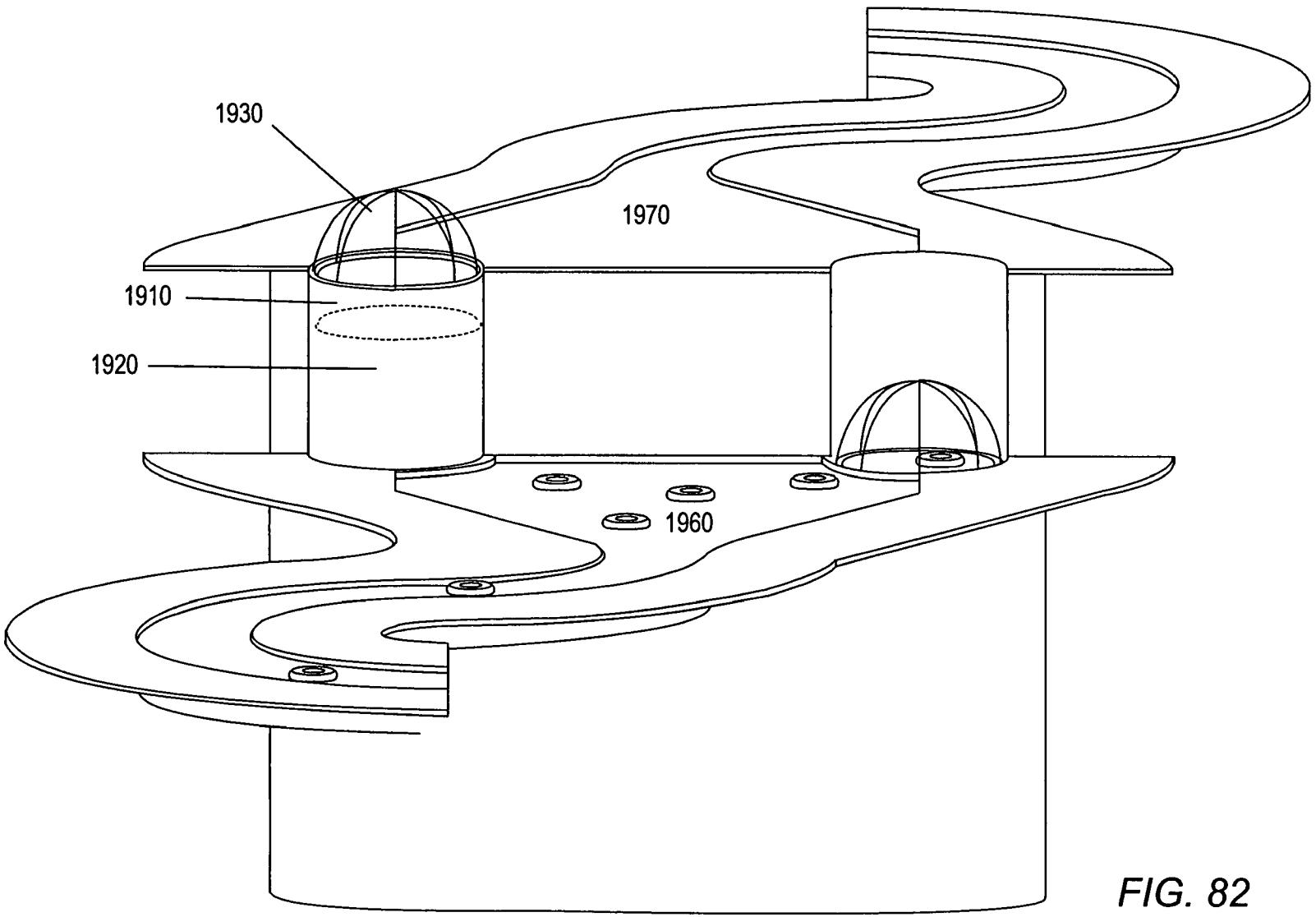
FIG. 82 is an embodiment of a high lift lock system.
Figure 83:
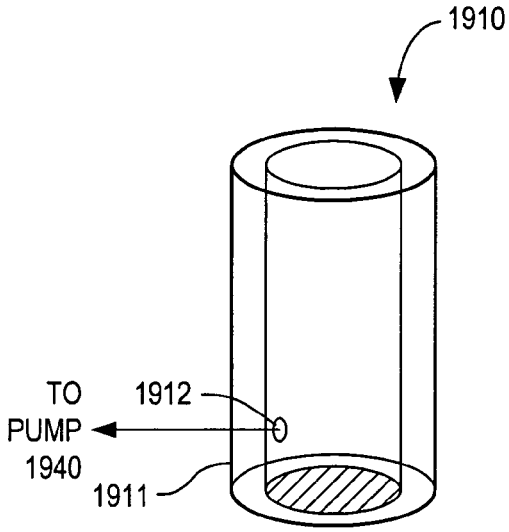
FIG. 83 is a lock tube of a high lift lock system.
Figure 84:
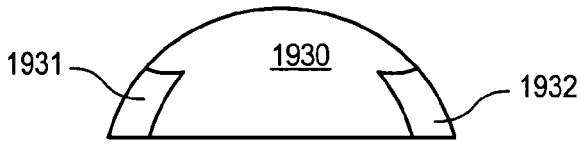
FIG. 84 is a cap of a high lift lock system.

Another embodiment of the bottom member 1750 which may facilitate progression of participants through the lock system 1710 is shown in FIG. 81. In this embodiment, the bottom member 1750 comprises at least one floatation member 1755 coupled to the downstream end of the bottom member 1750. The floatation member 1755 comprises a valve 1756 coupled to a water source (not shown). A volume of water in the floatation member 1755 may be varied to change the buoyancy of the bottom member 1750. The upstream end of the bottom member 1750 may be coupled 1757 to a wall of the lock 1758 such that it may move vertically and pivot in the lock 1710. In an embodiment, the bottom member 1750 is coupled to a wall of the lock 1758 via the ratchet locking system previously described. When the water level in a downstream lock 1758 is at a level of the water in an upstream lock 1759, the buoyancy of the floatation member 1755 is increased such that the downstream end of the bottom member 1750 is lifted out of the water and the upstream end of the bottom member 1750 pivots around the couple 1757. Thus, the bottom member 1750 slopes toward the upstream lock 1759, and participants may slide down the slope to the upstream lock 1759.

The compressed air source (not shown), as mentioned above, may be configured to be coupled to one or more gates 300 and to be able so supply a sufficient amount of air at the pressure required to force air out of the gate 300 at the desired speed. The compressed air source may have the capacity to lift two gates 300 simultaneously in a four lock system.

In an embodiment, the estimated volume of a gate 300 may be approximately 500 cubic feet. The displacement of a gate 300 in the closed position may be approximately 80 cubic feet. The volume above water level in the closed position may be approximately 190 cubic feet. This leaves 230 cubic feet considered to be the adjustable ballast volume. The weight of the complete gate 300 may be approximately 500 pounds. At zero pounds per square inch (psi), therefore, it may require about nine cubic feet of displacement to float the gate 300. The 221 cubic foot difference between the 230 cubic foot adjustable ballast and the nine cubic feet needed to float the gate 300 is the margin of error available to adjust the gate weight for frictional forces and the actual construction weight of the gate 300. This large margin of error ensures effective adjustments to overcome frictional forces and the gate weight.

The above figures are based on an air pressure of zero psi within the gate 300. The cross-sectional area of the interior of the gate 300 may be approximately 5000 square inches. An air pressure of 1 psi, therefore, should be able to lift 5000 pounds. The maximum estimated air pressure held internally by the gate 300 may be approximately 10 psi, which would result in a lifting capacity of 50,000 pounds. This capacity is about 100 times more than needed to lift a 500 pound gate 300, which indicates that sufficient pressure will be available to overcome friction and water pressure.

In a four gate system, two gates 300 will be actuated simultaneously. Using a 230 cubic foot adjustable volume per gate 300, 460 cubic feet per minute at 10 psi will be needed from a compressed air source. If 0.033 horsepower (HP)is needed to compress 1 cubic foot of air to 10 psi, then a 15 HP compressor will be required to operate the system. The inclusion of compressed air storage capacity of approximately 50 cubic feet at 100 psi will allow the compressed air source 1760 to run intermittently. Even larger storage capacity is recommended to ensure minimal maintenance and long life for the compressed air source 1760.

The pump intake (not shown) may be located in a variety of positions, but preferably toward the upstream end 1716 of the lifting bay 1713 to ensure the smoothest water flow to the nozzles (not shown). The pump (not shown) may be configured to supply enough water to the nozzles to provide enough force to propel one or more participants on floatation devices to the upstream end 1716 of the lifting bay 1713.

The pump must have enough capacity to return the amount of water used per lift within the same time frame as the cycle time of each lock. In an embodiment, 1600 cubic feet, or approximately 12,000 gallons per lift may be required. The cycle time may be 3 minutes. These figures indicate that the pump must have a capacity of at least 4,000 gallons per minute to keep up with the system.

The controller (not shown) may be manual or automatic. In an embodiment, the controller comprises a programmable logic controller. It may be configured to control the valves (not shown) in the gates 300 and the pump, so that the valves and pump 1770 turn on and off at the appropriate time during use to facilitate the transportation of users from the downstream end 1717 of the lifting bay 1713 to the upstream end 1716. Though each lock assembly 1700 has been described as comprising its own controller, it should be understood that one controller may be configured to operate all the devices in each lock assembly 1700 of a lock system 1710.

High Lift Lock System

FIGS. 82-85 show embodiments of a high lift lock system, noted generally as 1900. The system 1900 further comprises a vertically slidable lock tube 1910, a lock tube sleeve 1920, a cap 1930, a pump 1940, a controller 1950, an entry pool 1960, and an exit pool 1970.

The tube 1910 may be closed at the bottom end 1911 and configured to fit within the sleeve 1920. The tube 1910 may additionally comprise one or more valves 1912 coupled to the pump 1940. The cap 1930 may be configured to fit the top of the tube 1910. The cap 1930 may additionally comprise at least one movable member 931, and preferably an additional movable member 1932. The pump 1940 may be configured to pump water into the tube 1910. The controller 1950 may be coupled to the pump 1940, the tube 1910, and the movable members 1931, 1932 and configured to control and coordinate the movement of these devices.

Participants in the entry pool 1960 enter the retracted tube 1910 through a movable member 1931 in the cap 1930. After the participants enter the tube 910, the movable member 1931 is closed, and the tube 1910 slides upward in the sleeve 1920 to the exit pool 1970. While the tube 1910 slides upward, the pump 1940 pumps water into the tube through the valve 1912. As the water level in the tube 1910 rises, the participants are carried up on the water surface. When the tube 1910 slides up to the level of the exit pool 1970, and the water level in the tube 1910 reaches the water level in the exit pool 1970, the movable member 1932 opens and the participants exit the tube 1910 through the member 1932 to the exit pool 1970. After the participants exit, the tube 1910 slides back down in the sleeve 1920 to the entry pool 1960 while water exits the tube 1910 through the valve 1912 to the entry pool 1960.

In an embodiment, there are no valves in the bottom end 1911 of the tube 1910. The water in the tube 1910 is confined to the tube 1910. The method of operation is the same as above, except that the pump 1940 is not needed to pump water into the tube 1910. After the participants enter the tube 1910 through the movable member. 1931 in the cap 1930, the tube 1910, participants, and water are all lifted to the level of the exit pool 1970, where the participants exit as described above. The volume of water that may exit the tube 1910 with the participants at the exit pool 1970 may be replenished when the tube 1910 slides below the surface of the entry pool 1960 to allow additional participants to enter.

Figure 85:
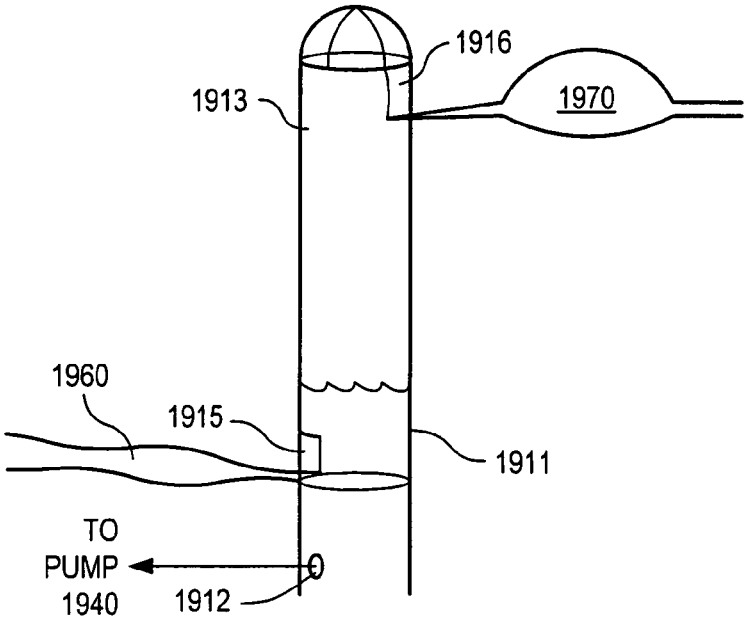
FIG. 85 is an alternate embodiment of a high lift lock system.

In another embodiment, the tube 1910 is immovable, extends from the entry pool 1960 to the exit pool 1970, and additionally comprises movable members 1915, 1916 in the bottom 1911 and the top 1913 of the tube (FIG. 85). Participants enter the bottom 1911 of the tube 1910 through the movable member 1915. The movable member 1915 then closes, and the pump 1940 pumps water into the tube 1910. As the water level in the tube 1910 rises, the participants are carried along until the water level reaches the level of the exit pool 1970. The participants exit the tube 1910 through the second movable member 1916 to the exit pool 1970. The water level in the tube 1910 is then lowered by letting water exit the tube 1910 via the valve 1912 until the water in the tube 1910 reaches the level of the water in the entry pool 1960 again.

Though not shown, all the high lift embodiments may additionally comprise the basket and ratchet features described previously. There also may be multiple high lift systems between the same upper and lower bodies of water.

All of the above devices may be equipped with controller mechanisms configured to be operated remotely and/or automatically. For large water transportation systems measuring miles in length, a programmable logic control system may be a necessity to allow park owners to operate the system effectively and cope with changing conditions in the system. A pump shutdown will have ramifications both for water handling and guest handling throughout the system and will require automated control systems to manage efficiently. The control system may have remote sensors to report problems and diagnostic programs designed to identify problems and signal various pumps, gate, or other devices to deal with the problem as needed.

In one embodiment, a water input source may be coupled to a channel of the water transportation system. The water input source may be configured to provide a variable flow rate of water through the channel. A water flow sensor may also be coupled to the channel. The water flow sensor may monitor the flow rate of water as the water passes through the channel. The water input source and the water flow sensor may be coupled to a controller. While the channel is being used, the water flow rate through the channel may vary. The controller may be configured to monitor the flow rate of the water through the channel and send control signals to the water input sensor to vary the flow off water into the channel in response to the monitored flow rate.

In another embodiment, a controllable obstruction may be positioned within a channel. The controllable obstruction may be moved from a lowered position to a raised position, and to positions in between the lowered and raised positions. The controllable obstruction may be moved in response to control signals. When in the raised position the controllable obstruction may substantially inhibit the flow of water and/or participants through the channel. When the controllable obstruction is in a lowered position, the flow of water and/or participants through the channel may be substantially inhibited. A water flow sensor may also be coupled to the channel. The water flow sensor may monitor a flow rate of water passing through the channel. The controllable obstruction and the water flow sensor may be coupled to a controller. While the channel is being used, the water flow rate through the channel may vary. The controller may be configured to monitor the flow rate of the water through the channel and send control signals to the controllable obstruction to vary the position of the controllable obstruction.

Control System

Figure 86:
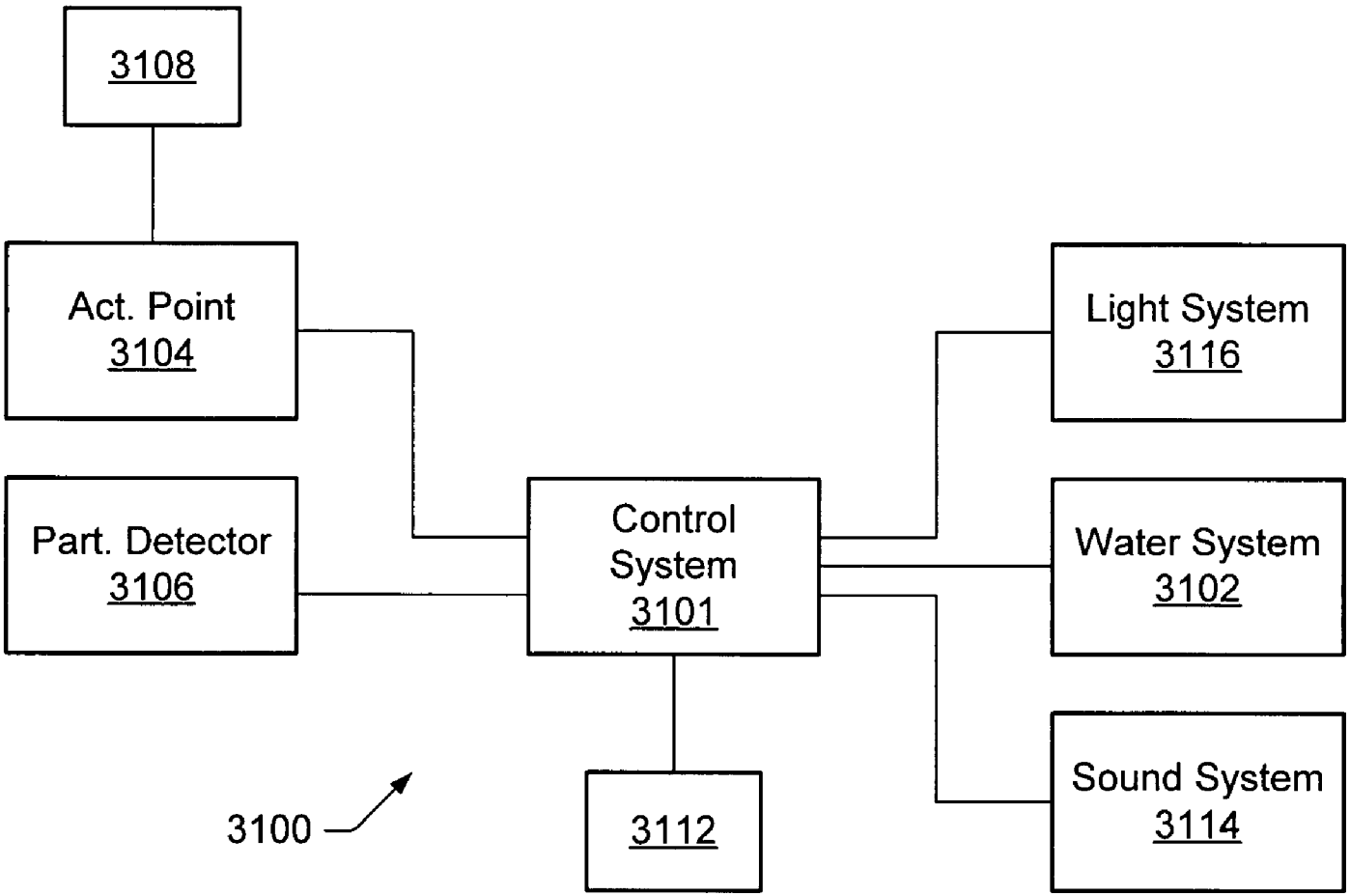
FIG. 86 depicts a schematic of a control system for a water system, a sound system and a light system.

FIG. 86 depicts a schematic of one embodiment of a water amusement system 3100. Water amusement system 3100 may include a water system 3102. Water system 3102 may be configured to produce one or more water effects. A control system 3101 may be coupled to water system 3102. Control system 3101 may be configured to generate water system control signals and send the water system control signals to water system 3102. Water system 3102 may be configured to generate a water effect in response to receiving a water system control signal. Control system 3101 may be configured to generate a plurality of different water system control signals. Water system 3102 may be configured to generate different water effects in response to different water system control signals.

In some embodiments, water amusement system 3100 may also include a light system 3116. Light system 3116 may be configured to produce one or more light effects. Control system 3101 may be coupled to light system 3116. Control system 3101 may be configured to generate light system control signals and send the light system control signals to light system 3116. Light system 3116 may be configured to generate a light effect in response to receiving a light system control signal. Control system 3101 may be configured to generate a plurality of different light system control signals. Light system 3116 may be configured to generate different light effects in response to different light system control signals.

In some embodiments, water amusement system 3100 may include a sound system 3114. Sound system 3114 may be configured to produce one or more sound effects. Examples of sound effects are described below in more detail. In some embodiments, sound system 3114 and water system 3102 may be integrated together such that the sounds appear to be emanating from the water effects during use. Control system 3101 may be coupled to sound system 3114. Control system 3101 may be configured to generate sound system control signals and send the sound system control signals to sound system 3114. Sound system 3114 may be configured to generate a sound effect in response to receiving a sound system control signal. Control system 3101 may be configured to generate a plurality of different sound system control signals. Sound system 3114 may be configured to generate different sound effects in response to different sound system control signals.

Collectively, water system 3102, light system 3116, and sound system 3114 may be referred to as "water amusement features." Water amusement system 3100 may include one or more water amusement features as described above.

In an embodiment, water amusement system 3100 may include one or more activation points 3104 coupled to control system 3101. Activation point 3104 may be configured to receive a participant signal. A participant signal may be applied to activation point 3104 by a participant who desires to activate the water amusement system. As used herein, a "participant" may refer to an individual interacting with the water amusement system primarily for entertainment, as distinguished from a system operator. As used herein, an "operator" may generally refer to an individual interacting with the water amusement system primarily as an agent of the owner of the water amusement system to coordinate the function of the water amusement system. In response to the participant signal, activation point 3104 may generate one or more activation signals. Activation signals may be sent to control system 3101. The activation signals may indicate that a participant has signaled the activation point. In response to the activation signal, control system 3101 may generate one or more water amusement feature control signals. In some embodiments, activation point 3104 may include a one or more of input devices 3108. Input device 3108 may be configured to receive a participant signal and transfer that signal to activation point 3104. For example, input device 3108 may include a hand wheel movably mounted in proximity to activation point 3104. The wheel may not be directly coupled to activation point 3104. Rather a sensor of activation point 3104 may sense rotation of the wheel. For example, activation point 3104 may include a capacitive proximity detector. The proximity detector may detect movement of one or more spokes of the wheel, or of a flat area, or flap coupled to an axle of the wheel. Movement of a sensed feature past the sensor may correspond to a participant signal. Activation point 3104 may be configured to generate a plurality of activation signals in response to a plurality of participant signals. Control system 3101 may also be configured to generate a plurality of control signals in response to the activation signals.

A participant detector 3106 may be coupled to control system 3101. Participant detector 3106 may be configured to generate a detection signal when a participant is within a detection range of participant detector 3106. The detection signal may be sent to control system 3101. In response to a received detection signal, control system 3101 may generate one or more water amusement feature control signals. This "attract" mode may entice participants that are in the proximity of water amusement system 3100 to approach the system and interact with the system via activation point 3104.

In an embodiment, control system 3101 may be configured to stop the production of water amusement feature control signals in the absence of an activation and/or detection signal. In this manner, water amusement system 3100 may be "turned off" in the absence of participants.

In an embodiment, control system 3101 may be configured to produce random, arbitrary or predetermined water amusement feature control signals in the absence of a detection signal and/or activation signal. Thus, when no participants are present at activation point 3104, control system 3101 may revert to an attract mode, producing water amusement feature control signals to activate one or more of the water amusement features such that participants may be attracted to water amusement system 3100. Control system 3101 may be configured to generate water amusement feature control signals in the absence of an activation signal and/or a detection signal after a predetermined amount of time. When a participant begins to interact with activation point 3104, control system 3101 may resume generating water amusement feature control signals in response to the participant's input.

Application point 3104 may be configured to receive a participant signal by sensing pressure, motion, proximity, sound, or position of a movable activating device (e.g., a switch or trigger). Activation point 3104 may be configured to respond to the participant signal. In one embodiment, activation point 3104 may be configured to respond to a participant's touching of the activation point. In such an embodiment, activation point 3104 may respond to varying amounts of pressure, from a very light touch to a strong application of pressure.

Optical Touch Button

Figure 87:
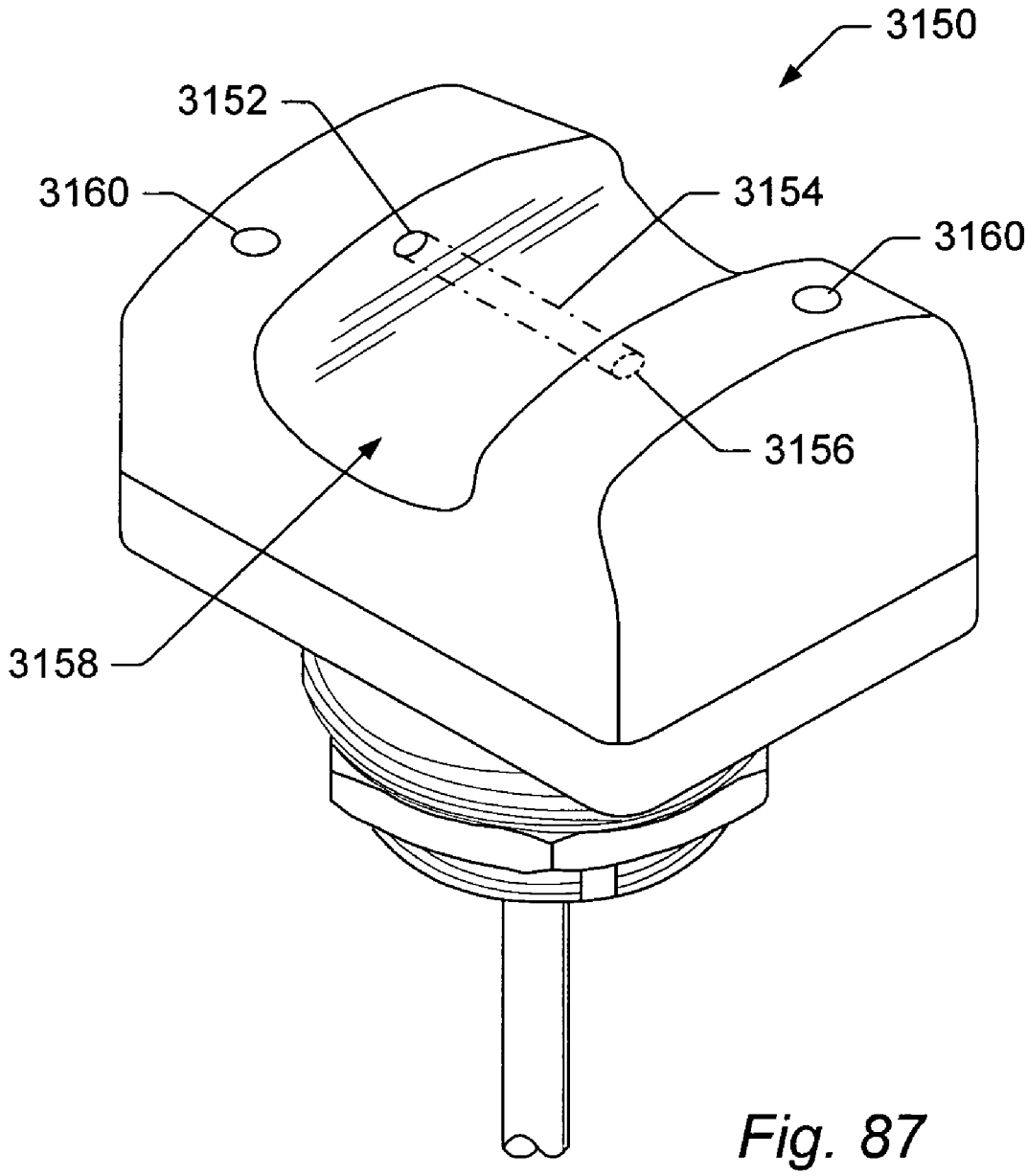
FIG. 87 depicts an embodiment of an optical touch button.

FIG. 87 depicts an embodiment of an optical touch button, suitable for use as an activation point. In the embodiment depicted in FIG. 87, optical touch button 3150 may detect a participant's touch or proximity by use of an light detector 3152. A light beam 3154 may be directed from a light source 3156 on one side of a recess 3158, to light detector 3152 on the other side of recess 3158. To provide a participant signal, a participant may place a finger, thumb, or other object in recess 3158, thereby blocking light beam 3154. Upon interruption of light beam 3154, optical touch button 3150 may send an activation signal to a control system. An advantage of such an optical touch button may be that it may have no moving parts. Additionally, optical touch button 3150 may include one or more indicators 3160, such as light emitting diodes. Depending on the configuration of the optical touch button, each indicator 3160 may indicate different information. For example, in an embodiment, a first indicator may indicate that the optical touch button is on (e.g., receiving power), while a second indicator may indicate when a participant signal has been received by optical touch button 3150. In another embodiment, one or more of indicators 3160 may be configured to provide indication to a participant to provide a participant signal. A water amusement system may be used very frequently, as such, a device with no moving parts may provide both increased safety (e.g., by reduction in the number of pinch points) and increased reliability and up-time (e.g., by reduced mechanical wear). An optical proximity detector is further described in U.S. Pat. No. 4,939,358, which is incorporated by reference as though full set forth herein. A suitable optical proximity detector may be purchased from Banner Engineering Corp. of Minneapolis, Minn., under the name Optical Touch Buttons.

In another embodiment, activation point 3104 may include a button that may be depressed by the participant to signal the activation point. In another embodiment, activation point 3104 may include another type of movable activation device. For example, the activation point may be a lever or a rotatable wheel. In such embodiments, the participant may signal the activation point by moving the lever (e.g., reciprocating the lever) or rotating the wheel. In another embodiment, the activation point may respond to a gesture. For example, the activation point may be a motion detector. The participant may signal the activation point by creating movement within a detection area of the motion detector. The movement may be created by passing an object (e.g., an elongated member) or a body part (e.g., waving a hand) in front of the motion detector. In another embodiment, activation point 3104 may be sound activated. The participant may signal the sound-activated activation point by creating a sound. For example, by speaking, shouting or singing into a sound sensitive activation point (e.g., a microphone), the activation point may become activated.

In another embodiment, activation point 3104 may include a hand wheel. A hand wheel may be a rotary activated input device. In one embodiment, the hand wheel may include at least one sensor to determine the direction and number of times the hand wheel is rotated. In one embodiment, the hand wheel may produce a signal to turn "on" a feature or turn "off" a feature based on the number of turns of the wheel detected by the sensor. The signal to turn "on" and/or "off" may be sent based on a predetermined number of turns of the wheel. The signal to turn "on" or "off" may be produced by the same number of turns for each signal, or by a different number of turns. In another embodiment, the signal to turn "on" or "off" may be determined by the direction of rotation. The use of multiple sensors coupled to a hand wheel may allow the direction of rotation of the hand wheel to be determined. For example, a clockwise rotation of the wheel may produce an "on" signal, while a counterclockwise rotation of the wheel may produce an "off" signal. In another embodiment, the programmable control system may be configured to turn "on" successive features with each turn of the wheel (e.g., in a clockwise direction), and turn "off" the successive features in a reverse sequence with each turn of the wheel in the opposite direction (e.g., in a counterclockwise direction. Alternatively, the wheel may produce a signal to turn "on" features in a random or arbitrary manner with each turn of the wheel (e.g., in a clockwise direction), and turn "off" the features in a random or arbitrary sequence with each turn of the wheel in the opposite direction (e.g., in a counterclockwise direction).

Water system 3102 may include one or more flow control devices coupled to one or more water effect generators. The flow control devices may allow control over the operation of the water effect. For example, flow control devices may include valves, such as solenoid-actuated valves. In some embodiments, a flow control device may include a pump. A valve used in a flow control device may be an air valve or a water valve. A water valve may allow the flow of water to a water effect generator to be altered. An air valve may allow the flow of air to a water effect generator to be altered. Generally, a flow control device may be capable of receiving a water system control signal from control system 3101 and performing some action in response to the water system control signal to initiate, cease, and/or otherwise alter a fluid flow.

In one embodiment, a water valve may be opened, releasing a stream of water or closed, cutting off a stream of water based on the type of water system control signal received from control system 3101. In addition to turning the flow of water on or off, a water valve may be configured to vary the volume, pressure, and/or direction of the water stream in response to a water system control signal from control system 3101.

In one embodiment, a valve may be a diaphragm valve that may be actuated by a solenoid. Such valves may be used to control the flow of water or air through water system 3102. The size of the valve may vary depending on the design of the water feature. For example, valve sizes may vary from about ½ in. to about 2 in. depending on the design of the feature.

A variety of water effect generators may be included in water system 3102. Examples of water effect generators may include, but are not limited to: nozzles, water falls, water cannons, water fountains, water geysers, etc. Water effect generators are described in U.S. Pat. Nos. 6,261,186 and 6,161,771 both of which are incorporated herein by reference. Nozzles may be used to create a spray pattern. Spray patterns may include, but are not limited to, fan sprays, cone sprays, streams, or spirals. One or more water valves may also be coupled to a system of nozzles for producing a waterfall effect. The valves may be used to control the flow of water to the waterfall. A rain curtain effect may be produced by the system of nozzles. The nozzles may create streams of falling droplets that appear as a "curtain" of water. Combinations of valves activated in sequence may be used to produce an "explosion" of water in certain water effect generators. For example, geysers or cannons may use valves to control both air and water flow to produce a "pulse" of water. Another type of water effect generator may be a water container. For example, a water feature may include a rotatable water container. The water feature may be configured to at least partially fill the water container. At a predetermined time or level of water, the water container may be tilted such that some or all of the water in the container is poured out. Moving water features, such as the spinning roof water features described in more detail below, may also include flow control devices and water effect generators. For example, the direction of rotation of a spinning roof water feature may be determined by which of the nozzles are activated. A paddlewheel water feature may operate in a similar manner.

Flow control devices in water system 3102 may be activated in sequence to control the flow of water and air to a water feature. In some embodiments, a plurality of flow control devices may be controlled by a single actuator. For example, in a geyser or cannon an actuator may control two or more valves in response to a single water system control signal to generate the pulse of water. In another example, a rotatable water contain may include one or more actuators coupled to pneumatic or hydraulic cylinders and to water valves. The water valves may control filling of the container, while the pneumatic or hydraulic cylinders may control rotating the container.

Participant detector 3106 may include any device capable of detecting a change in the surroundings and sending a signal to control system 3101 in response. For example, participant detector 3106 may include a photoelectric eye, an inductive proximity sensor, a motion sensor, a microphone, a flow sensor, a water level sensor, or any of many other sensors well known to one skilled in the art. In an embodiment, the participant detector 3106 is a photoelectric eye. In such an embodiment, the photoelectric eye may send a signal to control system 3101 in response to an object intersecting a projected beam of light. Participant detector 3106 may produce a signal when a participant passes into the detection range of the detector. Control system 3101 may send one or more control signals to water system 3102, light system 3116, and/or sound system 3114 in response to a signal from participant detector 3106. For example, control system 3101 may direct the water amusement features to produce a variety of effects to attract the attention of the participant in the detection range of participant detector 3106.

A control system input device 3112 may be coupled to control system 3101. Control system input device 3112 may include, but is not limited to: a keyboard, an electronic display screen, a touch pad, a touch screen, any combination of these devices, or any other input device known in the art. Generally, control system input device 3112 may include one or more devices capable of transmitting signals to and receiving signals from control system 3101. In one embodiment, control system input device 3112 may be a touch screen capable of displaying information to an operator and receiving input from the operator in the form of contact with the screen. For example, the screen may display a series of menus with different programming options for control system 3101. The operator may choose a desired option by touching the appropriate area of the screen. Control system input device 3112 may then transmit a signal to control system 3101 corresponding to input provided by the operator. In this manner, the actions of control system 3101 may be configured by the operator of water amusement system 3100.

Control system 3101 may include a processing unit capable of receiving one or more input signals, processing the signals, and sending one or more output signals in response. Control system 3101 may be capable of being programmed, that is, configured by an operator to perform a variety of tasks. For example, tasks may include, controlling one or more features based on predetermine and/or random control parameters, and generating reports for an operator. Controlling one or more features may include, but is not limited to: receiving activation and/or detection signals, sending feature control signals to features based on received input signals, randomly, or according to a predetermined schedule. Additionally, controlling one or more features may include inhibiting a feature from performing one or more actions. For example, control system 3101 may be configured to determine if a requested action would conflict with a. preprogrammed control parameter. If such a conflict exists, control system 3101 may inhibit the action from being performed. For example, a water feature may be inhibited from activating if a participant is detected too close to the water feature. Controlling features may also include monitor feature control parameters. Data from monitoring control parameters may be used to generate an automatic notification to an operator if maintenance of a feature is required and/or to track feature use or performance.

Control system 3101 may be programmed to turn on and/or turn off a feature after a determined period of time. For example, control system 3101 may be programmed to open and close a fountain valve every 60 seconds. Control system 3101 may also be programmed to turn on and/or turn off a feature after a determined period of time with no input from any activation point and/or participant detector. For example, if an activation point and/or participant detector has not been signaled for 5 minutes, control system 3101 may be programmed to open one or more water valves and turn on one or more lights to display the capabilities of water amusement system 3100. Programming control system 3101 in this manner may serve to attract participants to interact with water amusement system 3100. Control system 3101 may also be configured to turn one or more features off if left on for a predetermined amount of time. In one embodiment, a variety of "on" and "off" time limits may be programmed into control system 3101 such that water amusement system 3100 may become an automated system in the absence of activation and/or detection signals. Other actions and combinations of actions, which are well known to one skilled in the art, may be programmed into control system 3101.

Control system 3101 may also be configured to generate and send indicator control signals. Indicator control signals may be sent to one or more indicators associated with one or more activation points (as described with referenced to FIG. 20). Indicator control signals may direct the one or more indicators to turn on or off, thereby providing or ceasing to provide an indication signal to a participant.

Control system 3101 may include a logic controller. For example, the logic controller may include, but is not limited to: a programmable logic controller (PLC), an application specific integrated circuit, a general purpose computer configured to perform control system functions, and/or a facility control system (define terms adequately). A logic controller may be used to monitor input signals from a variety of input points (e.g., sensors), which report various events and/or conditions. In response to input signals provided by input sensors, the logic controller may derive and generate output signals which may be transmitted via output points to various output devices (e.g., actuators, relays, etc.) to control the water amusement system. A logic controller may control a plurality of output devices.

Logic controllers may be configured in a plurality of ways with regard to voltage input and output, memory availability and programmability. For example, a logic controller may be configured to utilize input power of 120 VAC. In such a case, one or more actuators associated with the logic controller may be configured to utilize input power of 12 or 24 VDC. However, these power values should not be considered limiting. In an embodiment, a logic control may include a plurality of PLCs combined in an Input/Output (I/O) chassis. In such an embodiment, each PLC may communicate with a supervisory processor or other PLCs while communicating with its own local I/O devices. The logic controller may be remotely programmed and/or controlled from a central computer system. For example, PLCs with the aforementioned capabilities may be obtained commercially from a plurality of vendors. Further information on PLCs may be found in U.S. Pat. No. 5,978,593 to Sexton, which is incorporated herein by reference.

Water Cannon System

Figure 88:
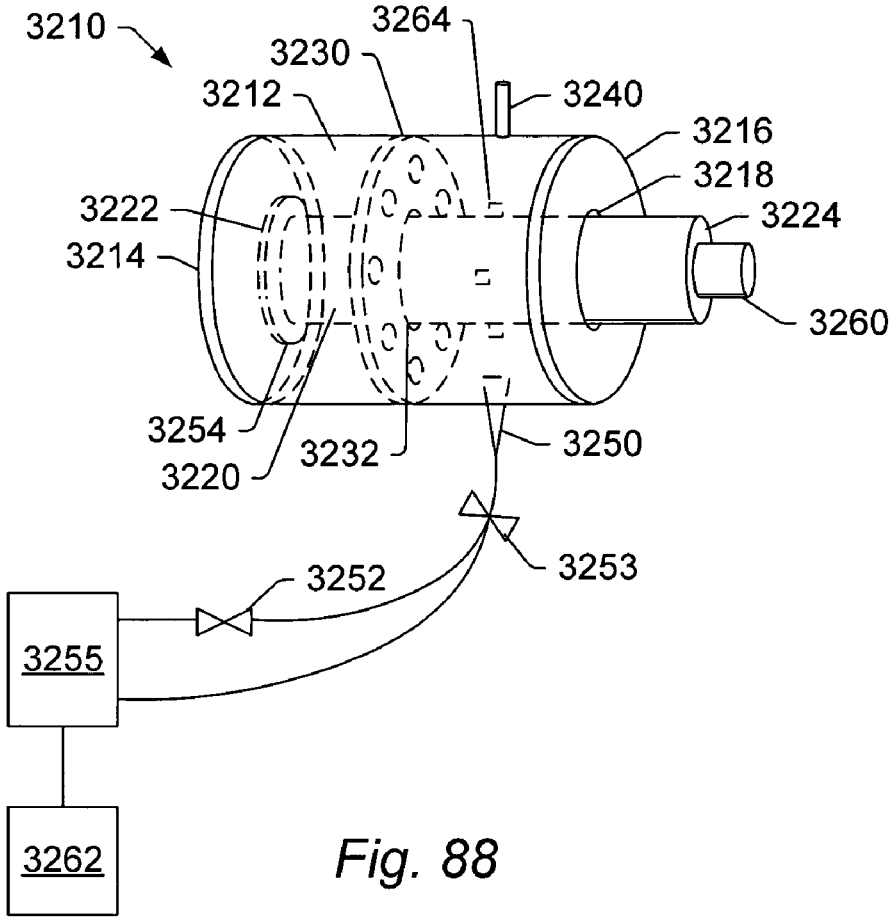
FIG. 88 is a side view of an embodiment of a water cannon.

Turning to FIG. 88, a perspective view of an embodiment of a water cannon 3210 is shown. The water cannon may include a first hollow member or reservoir 3212, having a closed end 3214 and an opposing end 3216. Opposing end 3216 provides an opening 3218 through which a second hollow member or channel 3220 may be disposed. Second hollow member 3220 may have opposing open ends 3222 and 3224, such that, during use, open end 3222 may be disposed inside first hollow member 3212, and open end 3224 may be disposed outside of first hollow member 3212. Open end 3224, in certain embodiments, may include a hollow projection or nose 3260, in open communication with the second open end 3222, such that a fluid flowing into the second open end 3222 may flow out the projection or nose 3260. Alternatively, open end 3224 may include a flat end with an opening therein. The opening in open end 3224 may be the same size as and contiguous with the hollow interior channel of hollow member 3220, or the opening may be narrower, or larger. It is understood that a narrowing structure may project into the hollow member 3222. In certain embodiments, an opening in second hollow member 3220 may be at least partially covered by a screen.

When member 3220 is disposed within opening 3218, an airtight and watertight seal may be formed between member 3220 and member 3212 at opening 3218. The members may be rigidly and/or permanently sealed, as with a weld or other permanent joint, or they may be sealed with the use of a gasket and/or sealant such as silicone or glue.

In an embodiment, water cannon 3210 may further include a planar or disc shaped member, partition member 3230. Partition member 3230 may provide an opening 3232 such that the second hollow member 3220 is able to fit within the opening 3232. In such a configuration, partition member 3230 may be freely slidable along second hollow member 3220. The device may also include a stop 3254 to prevent the partition member 3230 from sliding off the second hollow member 3220 during use. Stop 3254 may be coupled to second hollow member 3220, to first hollow member 3212, or to partition member 3230. Stop 3254 may be a ridge, bump, projection or a series of projections formed to prevent the partition member 3230 from sliding off the second hollow member 3220 during use. In certain embodiments, the stop 3254 may be attached to or formed as a combination of attachments to, or projections in, the first and second hollow members 3212, 3220. In certain embodiments, open end 3222 may be positioned so close to end 3214 that a partition member 3230 may be too large to slip off second hollow member 3220. In such embodiments, a stop may not be present. In some embodiments, a second stop 3264 may be present. Second stop 3264 may prevent partition member 3230 from sliding beyond an operational limit. For example, for proper function of water cannon 3210, gas inlet 3250 may be positioned such that gas entering via gas inlet 3250 pushes partition member 3230 toward open end 3222. Second stop 3264 may prevent partition member 3230 from sliding beyond gas inlet 3250. In some embodiments, gas inlet 3250 may be attached to end 3216. In such embodiments, a stop 3264 may not be present.

The first hollow member 3212 may also include one or more inlets 3240 for a liquid, such as water. Inlet 3240 may include a valve (not shown) to control the flow of liquid into the first hollow member 3212. The valve may be passively operational such that the valve automatically closes when the fluid level in the reservoir reaches a predetermined level. The valve may open when the fluid level falls below the predetermined level. In other embodiments, the valve may be operated by a participant using the water cannon, or may be operated by a timer or control system. Inlet 3240 may be in fluid communication with a fluid source, such as a water source. The fluid source may, in certain embodiments, include a pump for moving fluid from the source into the inlet.

As previously mentioned, reservoir 3212 may include one or more gas inlets 3250 disposed between end 3216 of reservoir 3212 and partition member 3230. In some embodiments, gas inlets 3250 may be connected to a control system or to a valve 3252. A source of compressed gas or compressed air may be coupled to gas inlets 3250. Valve 3252 may be activated by a participant to cause reservoir 3212 to become filled with gas. During use, opening valve 3252 may allow gas to flow into the chamber, causing an increase in gas pressure to be produced within the chamber. This increase in gas pressure may cause partition 3230 to move causing the ejection of a projectile of water. After the projectile has been ejected, additional gas may be inhibited from entering reservoir 3212.

In an embodiment, a valve 3253 may be positioned between valve 3252 and gas inlet 3250. Valve 3253 may be configured to allow the gas pressure to build up between valves 3252 and 3253 such that the gas is pressurized to an appropriate pressure. To produce a burst of gas, valve 3253 may be opened allowing the pressurized gas to enter reservoir 3212. After a burst of gas is released, valve 3253 may be closed and the air pressure allowed to increase. In this manner, an air line coupled to valve 3253 may supply air for only the time required to eject the projectile of water. Valve 3252 may serve as a main cutoff valve. During use, valve 3252 may remain open to allow flow of air to reservoir 3212. Valve 3252 may be closed to prevent the water cannon from being used, e.g., during routine maintenance. The use of a dual valve system may allow gas from the gas supply system to be conserved and energy use of the device to be reduced.

Valve 3252 and/or valve 3253 may be connected to a control system 3255. Control system 3255 may be configured to accept remote signals from an activation point 3262. Activation point 3262 may be an activation point that generates an activation signal in response to a participant signal, as described with reference to FIG. 86. For example, in an embodiment, activation point 3262 may include an optical proximity detector as was previously described with reference to FIG. 87. Valves 3252 and/or 3253 may be coupled to activation point 3262 via control system 3255. A participant signal delivered to activation point 3262 may cause an activation signal to be sent to control system 3255. Control system 3255, upon receiving an activation signal from activation point 3262, may send a control signal to at least one of valves 3252 and 3253 such that the valve is opened. Opening of the valve may initiate a sequence of events which ultimately produces a water projectile. Signals sent between activation point 262, control system 3255, and valves 3252 and/or 3253 may be electrical, pneumatic, or hydraulic signals. In an embodiment, activation point 3262 may be located on or in the vicinity of water cannon 3210. Alternatively, activation point 3262 may be located at a remote location from water cannon 3210. By placing activation point 3262 at a remote location, a participant may operate one or more water cannons which may be located in an inaccessible location (e.g., on top of a play structure or building).

In an embodiment, control system 3255 may be configured to operate at least one of valves 3252 and 3253 without any participant input. Control system 3255 may be programmed to produce water projectiles at random, or at predetermined intervals. Control system 3255 may also be programmed to produce water projectiles based on one or more predetermined triggering events. For example, a water projectile may be triggered by a detection signal from a participant detector, as described with reference to FIG. 86. Based on the programming of control system 3255, the control system may send a signal to valve 3252 and/or valve 3253 to initiate the production of a water projectile. Control system 3255 may be configured to continuously operate the water cannon (e.g., whether a participant is present or not). Alternatively, control system 3255 may be configured to operate the water cannon system only when activation point 3262 is in an idle state (e.g., when no participants are present).

During operation of water cannon 3210, fluid may flow into reservoir 3212 to at least partially fill reservoir 3212 via fluid inlet 3240. In an embodiment, the fluid may fill reservoir 3212 at least until the fluid level completely covers open end 3222. As the fluid level reaches a predetermined level, a valve in fluid inlet 3240 may be closed or the fluid flow may be stopped by some other means. When reservoir 3212 is full of fluid (e.g., the predetermined level has been reached), partition member 3230 may be disposed near open end 3224, and may rest against one or more stops 3264. This may be described as the "loaded" cannon configuration. When the cannon is in the loaded configuration, valve 3252 and/or valve 3253 may be activated to release compressed gas or air into gas inlet 3250. The compressed or pressurized gas may force partition member 3230 to slide down second hollow member 3220. As partition member 3230 slides down second hollow member 3220, the liquid in reservoir 3212 may be forced into open end 3222, through second hollow member 3220 and out open end 3224. In an embodiment, water cannon 3210 may be configured such that the radius of the second hollow member 3220 is no more than about one-third the radius of the first hollow member 3212. It is believed that such a configuration may allow an "explosive" movement of partition member 3230 upon entry of the compressed gas into first hollow member 3212 resulting in a mass of water being forcefully ejected in a single spurt from second hollow member 3220. In some embodiments, first hollow member 3212 and second hollow member 3220 may not have a circular cross-section. In such embodiments, first hollow member 3212 and second hollow member 3220 may be sized such that the cross-sectional area of first hollow member 3212 is about 9 times the cross-sectional area of second hollow member 3220. Alternately, the hollow members may be sized such that the hydraulic radius of second hollow member 3220 is about one third the hydraulic radius of first hollow member 3212. As used herein, "hydraulic radius" may generally refer to the cross-sectional area of a member divided by the length of the wetted perimeter of the member.

Figure 89A:
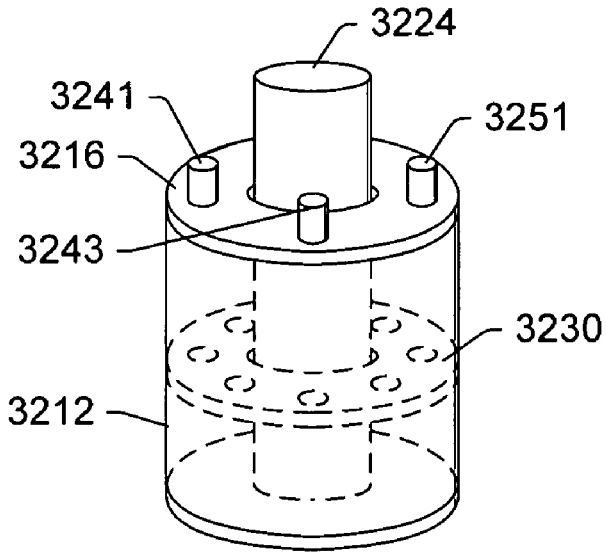
FIG. 89A is a perspective view of an embodiment of a water cannon in a loaded configuration.
Figure 89B:
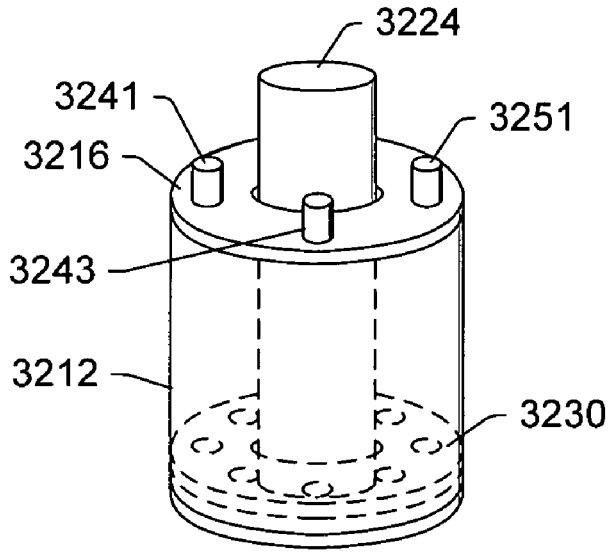
FIG. 89B is a perspective view of an embodiment of a water cannon in a spent configuration.

FIG. 89A depicts a perspective view of an embodiment of a water cannon 3210 in a "loaded" configuration. Partition member 3230 may be disposed at least partially up second hollow member 3220. In the embodiment shown, end 3216 of the first hollow member 3212 includes an adapter 3241 coupled to fluid inlet 3240 (depicted in FIG. 88), an adapter 3251 coupled to gas inlet 3250 (depicted in FIG. 88), and a gas release valve 3243. FIG. 89B depicts a perspective view of the embodiment shown in FIG. 89A in a "spent" configuration (i.e., after firing). In FIG. 89B, partition member 3230 has been forced down second hollow member 3220 by an influx of pressurized gas and has caused ejection of a fluid "projectile." In an embodiment, gas release valve 3243 may be coupled to a control system. Gas release valve 3243 may be configured to open when fluid level in reservoir 3212 reaches a first predetermined level (e.g., when the water cannon is spent, as depicted in FIG. 89B). By opening gas release valve 3243, gas pressure may be released from reservoir 3212. Gas release valve 3243 may be configured to be closed when fluid level in reservoir 3212 reaches a second predetermined level (e.g., when the water cannon is loaded, as depicted in FIG. 89A). Closing gas release valve 3243 may prevent gas from escaping from reservoir 3212; thereby permitting rapid pressurization of the reservoir upon firing of water cannon 3210.

As used herein, a "projectile" may generally refer to a discrete volume or mass of water ejected from a water cannon due to a single release of gas into the first hollow member. A projectile may travel through its trajectory as a discrete, or substantially continuous mass of water. It is understood that the projectile will break into smaller portions during the course of its trajectory. Nevertheless, the projectile may provide a sudden, large impact of short duration when it hits a target. A projectile is differentiated in this way from a continuous or semi-continuous stream of water, as in previous water gun type devices. A device as described herein, therefore, may provide a different and more fin sensation for a "target" person who hit with the projectile as compared to a continuous stream. A water cannon as described herein may provide the target or recipient with a sensation more akin to being hit with a water balloon or a bucket of water. This may be contrasted with a stream of water where the sensation may be similar to being sprayed with a water gun or water hose. In an embodiment, a projectile produced by water cannon 3210 may have a volume of between about 8 oz. to about 60 gallons. For example, a projectile may have a volume of between 1 gallon to about 20 gallons or between 2 gallons and 10 gallons depending on the size of the water cannon.

By adjusting the pressure of the gas burst, the shape of the projectile may also be varied. For example, a high pressure, short burst of gas may cause a more diffuse projectile, while a low pressure, longer burst of gas may cause a more dense projectile. The type of projectile produced may be determined by the gas pressure, the flow rate of the gas, and the dimensions of the first and second hollow members.

Figure 90:
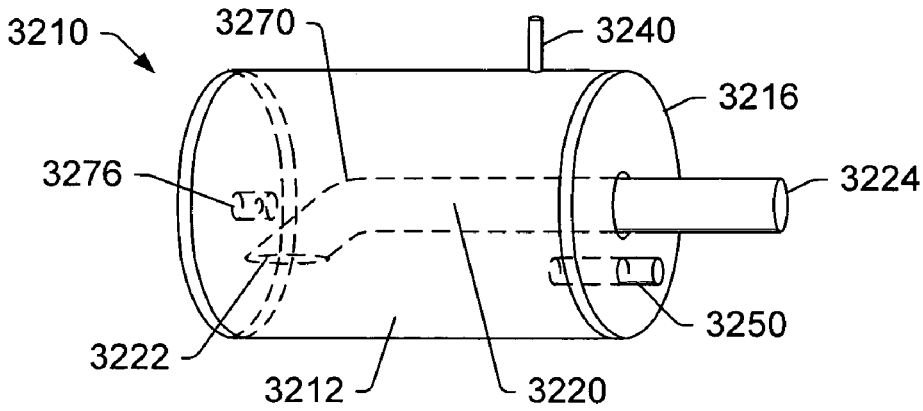
FIG. 90 is a side view of an embodiment of a water cannon.

FIG. 90 depicts an embodiment of water cannon 3210 in which second hollow member 3220 includes a curve or angle 3270. Angle 3270 may have any suitable angle. For example, angle 3270 may be a large or small obtuse angle, a right angle, or an acute angle so long as a partition member may be configured to force liquid into and through second hollow member 3220. It is contemplated that in order to place the open end 3222 further beneath the liquid surface level of reservoir 3212, it may be advantageous to point second open end 3222 in a downward direction relative to first open end 3224. In this arrangement, second hollow member 3220 may be configured such that, during use, when first open end 3224 of the second hollow member 3220 is pointed parallel to the ground, second open end 3222 of the second hollow member 3220 may be positioned lower than the first open end.

In some embodiments, water cannon 3210 may be equipped with a secondary water effect generator 3276 (e.g., a nozzle, or valve) providing a water passage through closed end 3214 of reservoir 3212. Secondary water effect generator 3276 may be used to create a "back-fire" effect, wherein a participant interacting with water cannon 3210 may be soaked rather than an intended target. For example, as described in further detail with reference to FIGS. 93 and 94, a first participant's water cannon may back-fire if a second participant strikes a target associated with the first participant's water cannon. In such a case, the control system may initiate secondary water effect generator 3276 to direct water onto the first participant from the first participant's water cannon.

Figure 91:
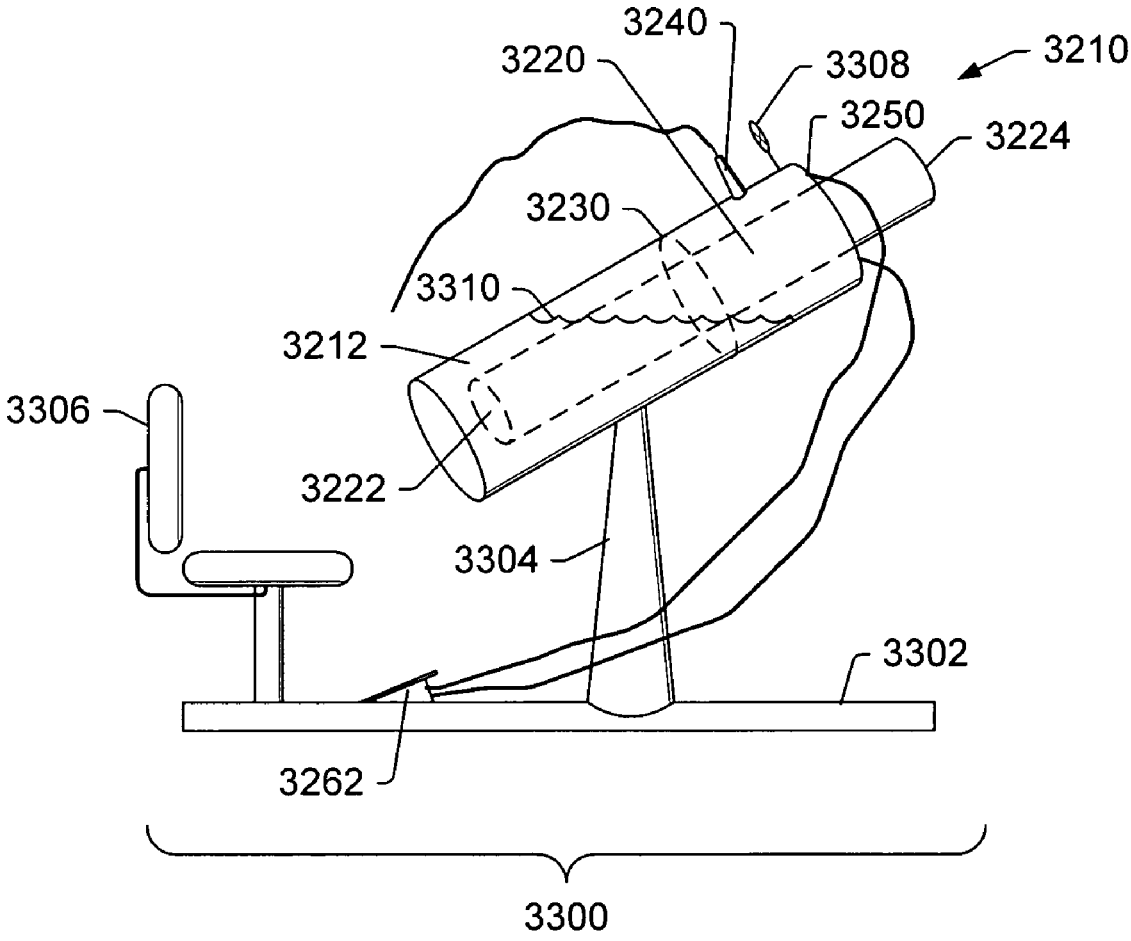
FIG. 91 is a side view of a water cannon that includes a support apparatus.

Turning to FIG. 91, an embodiment of a mounted water cannon station 3300 is depicted. The mounting configuration may include a base 3302. Base 3302 may be attached to or resting on the ground, or in a pool of water, for example. An upright member 3304 may extend from base 3302 to water cannon 3210. Upright member 3304 may support water cannon 3210. In some embodiments, upright member 304 may be moveably coupled to water cannon 3210 such that a participant or an automatic positioning device may aim water cannon 3210 at a target. For example, in certain embodiments, upright member 3304 may include a semispherical attachment that mates with a cup-like structure in the base 3302 such that water cannon 3210 may be raised or lowered and/or swiveled simultaneously. In alternative embodiments, the top of upright member 3304 may include a vertically adjustable connection to water cannon 3210 effective to raise or lower the cannon during use. In certain embodiments, the upper connection of upright member 3304 to water cannon 3210 may be a semispherical ball, and cup connection as described above. In addition, mounted water cannon station 3300 may be include a seat 3306 for a participant to occupy while operating water cannon 3210.

As shown in FIG. 91, an activation point 3262 may be coupled to water cannon 3210. Activation point 3262 may be a foot pedal positioned for easy access by a participant seated in seat 3306. In other embodiments, activation point 3262 may be an electronic switch, a manual switch, a lever, a handle, a wheel, a pressure pad, a button, or a trigger. For example, activation point 3262 may include an optical proximity detector as discussed with reference to FIG. 87. Water cannon 3210 may further include a sight 3308. Sight 3308 may, for example, be positioned on an upper or side surface of water cannon 3210. It is contemplated that water cannon 3210 may be most effective at producing a projectile or mass of water or other fluid when cannon 3210 is tilted such that open end 3224 is pointed at a somewhat upward angle, as shown in FIG. 91. As depicted, fluid level 3310 may be above the open end 3222 in a loaded configuration in this orientation.

A plurality of water cannons, as described herein, may be used in combination to form an array of water cannons in various configurations. For example, two or more water cannons may be set up as opposing sides, such that the participants of one set of cannons may fire at the participants of an opposing set, and vice versa. In certain embodiments, the water cannons of opposing sides may fire water or other fluid of different colors so that non-adjacent cannons can be designated or recognized as being on a particular side. In other embodiments, a single water cannon station may include multiple barrels or multiple cannons operated by a single participant or a single control mechanism so that a rapid-fire effect may be achieved. Alternatively, a single water cannon may be configured to produce multiple projectiles of water. In such an embodiment, when the control mechanism is activated by a participant, the water cannon may produce multiple water projectiles, either one after another or all at once. When multiple projectiles are produced one after another, the water cannon may continue producing water projectiles until the control mechanism is no longer activated.

In an embodiment, a water cannon system, which includes one or more water cannons, may include a sound system and/or light system as discussed with reference to FIG. 1. For example, the water cannon system may be incorporated into a musical water fountain system. In such an embodiment, the sound system, water cannon system, and/or lighting system may be activated by a participant. The timing of the light, water and sound effects may be coordinated to create a unified effect dependent upon physical acts of the participant(s). For example, an explosive sound and/or flash of light may be initiated in response to a participant's firing of a water cannon.

Figure 92:
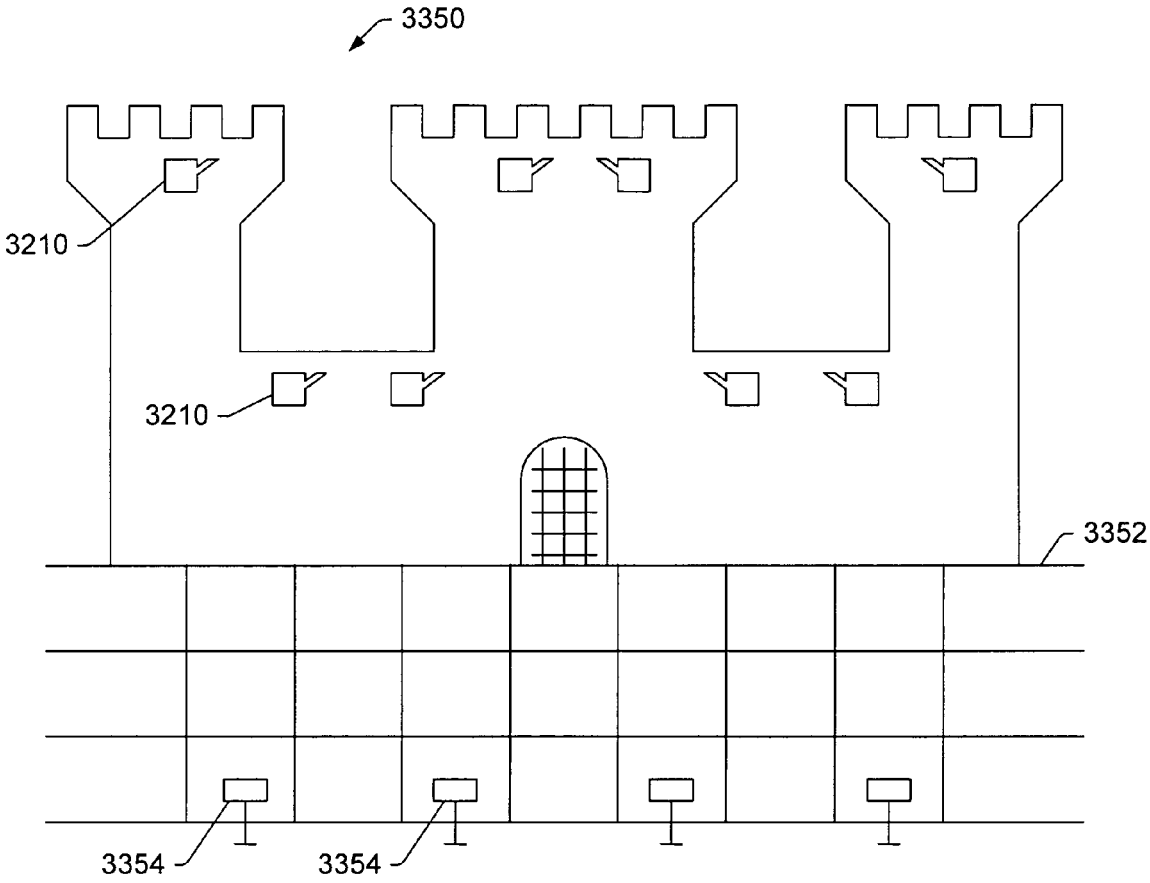
FIG. 92 is a front view of a water structure which includes a water cannon.

FIG. 92 depicts an embodiment of a play structure 3350 with a number of associated water cannons. Play structure 3350 may be a castle (as depicted in FIG. 92), a boat, a house, a fort, a space ship, or another form selected to conform to a desired theme. A number of water cannons 3210 may be placed about the structure. In some embodiments, participants may enter structure 3350 and activate water cannons 3210 to shoot water at targets outside the structure. A grid 3352 may be associated with play structure 3350. Grid 3352 may include markings which may allow the participants operating water cannons 3210 to aim the projectiles. For example, water cannons 3210 may include a guide for allowing the participants to aim at a specific region of the grid. When a person enters the specific region of the grid, the participant may activate the water cannon causing the cannon to project water onto the person. Alternatively, the structure may be inaccessible to participants. In such an embodiment, activation points 3354 may be remotely coupled to water cannons 3210. Activation points 3354 may be configured to send an activation signal to a control system, as previously described with reference to FIG. 1. The control system may cause one or more of water cannons 3210 to fire a projectile of water in response to the activation signal. Each activation point 3354 may activate one or more of water cannons 3210 causing a projectile of water to be sent onto grid 3352. Activation points 3354 may also allow water cannon 3210 to be remotely aimed at a specific grid. The participant may therefore "aim" the cannon at a specific region of the grid using activation points 3354, and subsequently, fire a projectile from the water cannon at the grid. In an embodiment, the control system may be configured to fire one or more of water cannons 3210 randomly, at predetermined intervals, or in response to a trigger event. For example, the control system may be configured to fire one or more water cannons if a participant detector coupled to the control system detects a participant.

Interactive Water Game

Figure 93:
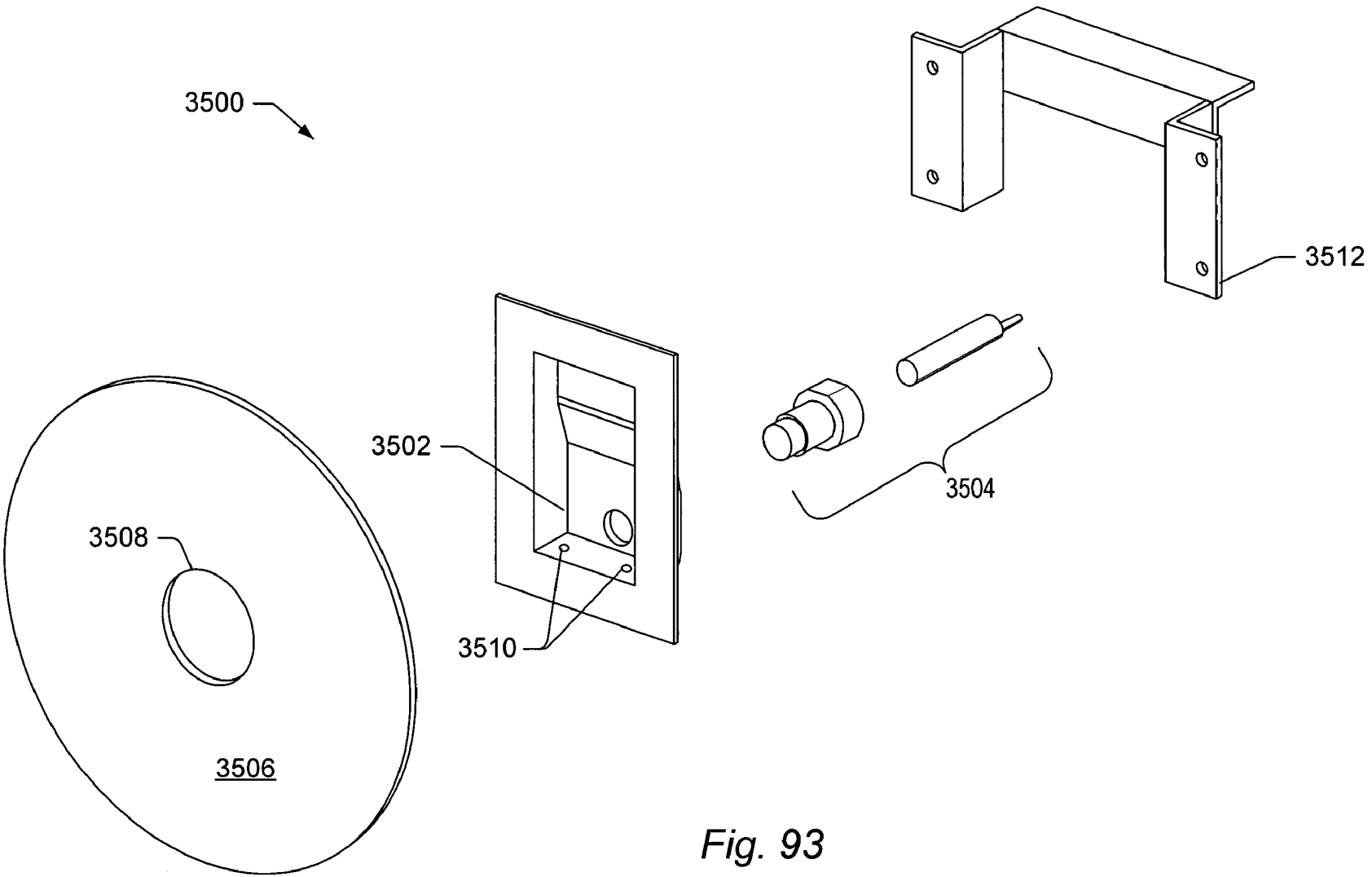
FIG. 93 is an exploded perspective view of an embodiment of a water target device having a liquid level sensor.

Turning to FIG. 93, an exploded perspective up view of an embodiment of a water target 3500 is shown. Water target 3500 may include a water retention area 3502 and an associated liquid sensor 3504, and a mounting bracket 3512. In an embodiment, water target 3500 may be incorporated into an interactive water game system. An interactive water game system may include at least one water system, and at least one control system. The interactive water game system may be arranged so that participants may interact with the game system in competition with one another, or to accomplish a task. For example, the participants may interact with the game system to trigger an event such as a water effect, sound effect, and/or light effect as previously described. An event triggered by a first participant may include a water effect wherein water may be directed toward a second participant. In such a case, the first and second participants may compete with one another to attempt to get each other wet via one or more triggered water effects.

In an embodiment, water target 3500 may include a target area 3506 with one or more water capture openings 3508. Water capture openings 3508 may provide a passage through target area 3506 into water retention area 3502. If water target 3500 is hit, water may pass through water capture opening 3508 into water retention area 3502. The water entering water retention area 3502 may cause a change in a monitored electrical property of liquid sensor 3504. For example, the water may cause a change in capacitance, or resistance of liquid sensor 3504. A suitable capacitive liquid sensor system may be purchased from the Balluff Inc. of Florence, Ky. The change in the monitored electrical property may be registered as an activation signal by the control system. One or more drains 3510 may be provided in water retention area 3502 to allow capture water to drain. By draining the water from water retention area 3502, the monitored electrical property may be returned to a "normal" state. Thus, water target 3500 may be reset, and prepared to register subsequent hits.

In an embodiment, one or more water targets 3500 may be coupled to a musical water fountain system. In such an embodiment, water target 3500 may act as an activation point. The musical water fountain system may include one or more water effect generators (e.g., nozzles, water cannons, etc.) moveably mounted for participant interaction. A participant may direct water from the one or more water effect generators toward water target 3500. If the participant hits water target 3500, an activation signal may be sent by the water target to a control system. The control system may then send one or more control signals to the musical water fountain system to trigger one or more water effects, sound effects, and/or light effects.

Figure 94:
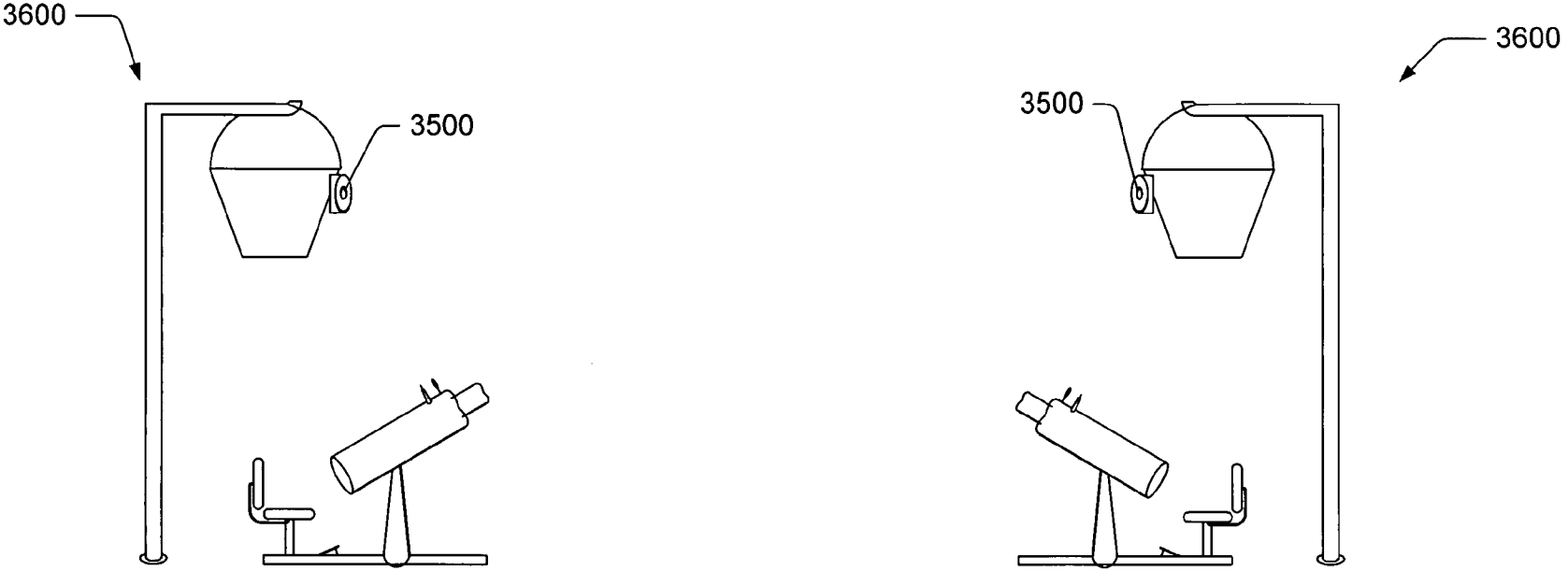
FIG. 94 is a side view of an embodiment of an interactive water game using water targets.

In other embodiments, one or more water targets 3500 may be associated with a play structure. Again, water targets 3500 may act as activation points. A participant may direct water from one or more water effect generators (e.g., nozzles, water cannons, etc.) toward one or more water targets 3500. If a participant hits one of water targets 3500, the water target may send an activation signal to a control system. The control system may be coupled to one or more water systems associated with the play structure. The control system may send one or more control signals to the water systems to generate one or more water effects. In a competitive arrangement of such a system, the one or more water effects generated may be directed toward another participant. For example, each participant may be seated at a water cannon system as described with reference to FIGS. 88-92. Each participant may fire water projectiles in an attempt to strike one or more water targets 3500 associated with the other participant's water cannon system. If a first participant is successful in striking a water target associated with a second participant's water cannon system, the control system may initiate a water effect directed toward the second participant. For example, the second participant's water cannon system may "back-fire." That is, some or all of the water in the reservoir of the second participant's water cannon system may be directed out of the back of the water cannon onto the second participant. In another embodiment, another water effect generator may be direct to the second participant. For example, a tipping bucket water feature 3600 (as depicted in FIG. 94) may tip onto the second participant. It is anticipated that any water effect that may be safely direct toward a participant may be associated with such a system.

In an embodiment, liquid sensor 3504 may include a capacitive liquid sensor, or other liquid sensor such as is known in the art. An advantage of a capacitive liquid sensor may be its relatively installation and operating low costs as compared with mechanical liquid sensing systems.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A system for conveying a participant from a first source of water to a second source of water comprising:

a belt; wherein the belt is coupled to the first source of water and to the second source of water, wherein a discharge end of the belt extends below a surface of the second source of water;

a belt movement system, configured to move the belt in a loop during use; and a deflector plate positioned below the first source of water wherein the deflector plate is positioned to inhibit the participant from moving to a position below the belt, and wherein the deflector plate is substantially angled to guide participants onto the belt.

2. The system of claim 1, further comprising a water flow sensor coupled to the first source of water, wherein the water flow sensor is configured to monitor the water flow rate of the first source of water proximate the belt.

3. The system of claim 1, further comprising:

a water flow sensor coupled to the first source of water, wherein the water flow sensor is configured to monitor the water flow rate of the first source of water proximate the belt; and a controller, wherein the controller is coupled to the belt movement system and the water flow sensor, and wherein the controller is configured to produce a control signal for the belt movement system, and wherein the belt movement system is configured to move the belt in response to the control signal.

4. The system of claim 1, wherein a portion of the belt extends below the surface of the first source of water.

5. The system of claim 1, wherein the belt comprises a series of interlocking plates.

6. The system of claim 1, wherein the first source of water is at a different elevation than the second source of water.

7. The system of claim 1, wherein the first source of water is at a lower elevation than the second source of water.

8. The system of claim 1, wherein the first source of water is a body of water.

9. The system of claim 1, wherein the first source of water is a pool.

10. The system of claim 1, wherein the second source of water is a body of water.

11. The system of claim 1, wherein the second source of water is a pool.

12. The system of claim 1, wherein the first source of water is a channel.

13. The system of claim 1, wherein the first source of water is coupled to a water slide.

14. The system of claim 1, wherein the belt comprises a material and design to inhibit the participant from moving in a direction opposite that of the direction the belt is moving.

15. The system of claim 1, wherein a protective device is positioned to cover the outer edges of the belt, wherein the participants are inhibited from accessing the belt movement system by the protective device.

16. The system of claim 1, further comprising a detection device positioned above the belt movement system, wherein the detection device is configured to detect when a participant is in a position above a predetermined height above the belt.

17. The system of claim 1, further comprising a plurality of detection devices positioned at a predefined height above the belt.

18. The system of claim 1, further comprising a detection device positioned above the belt movement system, wherein the detection device is configured to produce a detection signal when a participant is in a position above a predetermined height above the belt, and wherein the detection device is electronically coupled to the belt movement system such that the belt movement system is deactivated in response to a received detection signal.

19. The system of claim 1, wherein the deflector plate is permeable to water so as not to inhibit a current in the water directing a participant onto the belt.

20. The system of claim 1, further comprising a deflector plate positioned below the second source of water wherein the deflector plate is positioned to inhibit the participant from moving to a position below the belt, and wherein the deflector plate is substantially angled to guide participants off the belt.

21. The system of claim 1, further comprising a deflector plate positioned below the second source of water, wherein the deflector plate is positioned to inhibit the participant from moving to a position below the belt, and wherein the deflector plate is substantially angled to guide participants off the belt, and wherein the deflector plate is permeable to water.

22. The system of claim 1, wherein the belt is configured such that the belt reaches an apex at a position between the first source of water and the second source of water, wherein the belt is substantially angled in an upward direction from the first source of water toward the apex, and wherein the belt is substantially angled in a downward direction from the apex toward the second source of water.

23. The system of claim 1, wherein the belt is configured such that the belt does not extend past an apex at a position between the first source of water and the second source of water, and wherein the apex is coupled to the second source of water by a channel, and wherein the participant is transferred from the first source of water to the belt, from the belt to the channel, and from the channel to the second source of water during use.

24. The system of claim 1, wherein the belt is configured such that the belt does not extend past an apex at a position between the first source of water and the second source of water, and wherein the apex is coupled to the second source of water by a slide, and wherein the participant is transferred from the first source of water to the belt, from the belt to the slide, and from the slide to the second source of water during use.

25. The system of claim 1, wherein the belt is configured such that the belt does not extend past an apex at a position between the first source of water and the second source of water, and wherein the apex is coupled to the second source of water by a system of rollers, and wherein the participant is transferred from the first source of water to the belt, from the belt to the system of rollers, and from the system of rollers to the second source of water during use.

26. The system of claim 1, wherein the belt is configured such that the belt does not extend past an apex at a position between the first source of water and the second source of water, and wherein the apex is coupled to the second source of water by a second conveyor belt, and wherein the participant is transferred from the first source of water to the belt, from the belt to the second conveyor belt, and from the second conveyor belt to the second source of water during use.

27. The system of claim 1, wherein the belt is configured such that the belt reaches an apex at a position between the first source of water and the second source of water, wherein the belt is substantially angled in an upward direction from the first source of water toward the apex, and wherein the belt is substantially horizontal from the apex toward the second source of water, and wherein the system further comprises a carryover arm configured to facilitate movement of a rider from the upslope of the conveyor to the apex.

28. The system of claim 1, wherein the belt comprises a width such that only a single participant enters the system at the same time during use.

29. The system of claim 1, wherein the belt comprises a width such that at least two participants enter the system at the same time during use.

30. The system of claim 1, further comprising at least one floating queue line positioned within the first source of water upstream from the belt, wherein the floating queue line is configured to position the participants in a predetermined configuration prior to moving onto the belt during use.

31. The system of claim 1, wherein the conveyor belt speed is between about one foot per second and about five feet per second.

32. The system of claim 1, wherein the angle of ascent of the conveyor belt does not exceed 18%.

33. The system of claim 1, further comprising a tension unit coupled to the belt, wherein the tension unit is configured to vary the tension of the belt against a roller.

34. The system of claim 1, further comprising a barrier positioned on each side of the belt, wherein the barrier is configured to inhibit participants from leaving the belt as the participants are conveyed along the belt.

35. The system of claim 1, further comprising a plurality of barriers positioned along the belt, wherein the barriers are configured to define channels along the belt, and wherein participants move along the belt within the defined channels during use.

36. The system of claim 1, further comprising a lateral transfer system coupled to the belt, wherein the lateral transfer system is configured to move a floatation device from a position substantially adjacent to the belt onto the belt.

37. The system of claim 1, wherein the participant is riding on a floatation device.

38. The system of claim 1, wherein the belt movement system comprises:

at least two rollers, wherein the belt is coupled to the rollers such that rotation of the rollers causes the belt to move around the rollers during use; and a power supply coupled to at least one of the rollers, wherein the power supply is configured to supply a rotational force to at least one of the rollers during use.

39. The system of claim 1, wherein an infeed end of the belt extends below a surface of the first source of water.

40. The system of claim 1, wherein the first source of water comprises a discharge end of a first water amusement ride, and wherein the second source of water comprises an infeed end of a second water amusement ride.

41. The system of claim 1, further comprising a controllable obstruction configured to be moved from a lowered position to a raised position, and to positions in between the lowered and raised positions, wherein when the controllable obstruction is in the raised position the controllable obstruction is configured to substantially inhibit the flow of water and/or participants through at least a portion of the system.

42. A method of transporting a participant from a first source of water to a second source of water comprising:

moving a belt in a loop using a belt movement system, wherein the belt is coupled to a first source of water and to a second source of water, and wherein the belt and belt movement system form at least part of a conveyor belt system;

inhibiting the participant from moving to a position below the belt using a deflector plate positioned below the surface of the first source of water;

guiding participants onto the belt using the deflector plate, wherein the deflector plate is positioned at an angle;

transferring participants from the first source of water onto the belt; and conveying the participants with the belt from the first source of water to the second source of water, wherein a discharge end of the belt extends below a surface of the second source of water.

43. The method of claim 42, further comprising moving the belt at a speed such that the rate at which participants enter the system is substantially equal to the rate at which participants exit the system.

44. The method of claim 42, wherein the second source of water is coupled to a water ride.

45. The method of claim 42, wherein the belt comprises a series of interlocking plates.

46. The method of claim 42, wherein the second source of water is coupled to a water ride, and further comprising moving the belt at a speed such that the rate at which participants enter the system is substantially equal to the rate at which participants enter the water ride.

47. The method of claim 42, further comprising monitoring the water flow rate of the first source of water proximate the belt using a water flow sensor coupled to the first source of water.

48. The method of claim 42, further comprising:

monitoring the water flow rate of the first source of water proximate the belt using a water flow sensor coupled to the first source of water;

producing a control signal for the belt movement system using a controller coupled to the belt movement system and the water flow sensor; and moving the belt using the belt movement system in response to the control signal.

49. The method of claim 42, wherein a portion of the belt extends below the surface of the first source of water.

50. The method of claim 42, wherein the first source of water is at a different elevation than the second source of water.

51. The method of claim 42, wherein the first source of water is at a lower elevation than the second source of water.

52. The method of claim 42, wherein the first source of water is a body of water.

53. The method of claim 42, wherein the first source of water is a pool.

54. The method of claim 42, wherein the second source of water is a body of water.

55. The method of claim 42, wherein the second source of water is a pool.

56. The method of claim 42, wherein the first source of water is a channel.

57. The method of claim 42, wherein the first source of water is coupled to a water slide.

58. The method of claim 42, further comprising inhibiting the participant from moving in a direction opposite that of the direction the belt is moving using a material forming at least a portion of the belt.

59. The method of claim 42, further comprising covering a space around the outer edges of the belt such that the participants are inhibited from accessing the space using a protective device.

60. The method of claim 42, further comprising detecting when a participant is in a position above a predetermined height above the belt using one or more detection devices positioned above the belt movement system.

61. The method of claim 42, wherein the conveyor belt system further comprises a plurality of detection devices positioned at a predefined height above the belt.

62. The method of claim 42, further comprising producing a detection signal when a participant is in a position above a predetermined height above the belt using one or more detection devices positioned above the belt movement system, wherein the detection devices are electronically coupled to the belt movement system; and deactivating the belt movement system in response to a received detection signal.

63. The method of claim 42, further comprising:

allowing water to pass through the deflector plate.

64. The method of claim 42, further comprising:

inhibiting the participant from moving to a position below the belt using a deflector plate positioned below the surface of the second source of water; and guiding participants off the belt using the deflector plate, wherein the deflector plate is positioned at an angle.

65. The method of claim 42, further comprising:

inhibiting the participant from moving to a position below the belt using a deflector plate positioned below the surface of the second source of water;

guiding participants off the belt using the deflector plate, wherein the deflector plate is positioned at an angle; and allowing water to pass through the deflector plate.

66. The method of claim 42, wherein the belt reaches an apex at a position between the first source of water and the second source of water, wherein the belt is substantially angled in an upward direction from the first source of water toward the apex, and wherein the belt is substantially angled in a downward direction from the apex toward the second source of water.

67. The method of claim 42, wherein the belt does not extend past an apex at a position between the first source of water and the second source of water, and wherein the apex is coupled to the second source of water by a channel, and wherein the method further comprises transferring a participant from the first source of water to the belt, from the belt to the channel, and from the channel to the second source of water.

68. The method of claim 42, wherein the belt does not extend past an apex at a position between the first source of water and the second source of water, and wherein the apex is coupled to the second source of water by a slide, and wherein the method further comprises transferring a participant from the first source of water to the belt, from the belt to the slide, and from the slide to the second source of water.

69. The method of claim 42, wherein the belt does not extend past an apex at a position between the first source of water and the second source of water, and wherein the apex is coupled to the second source of water by a system of rollers, and wherein the method further comprises transferring a participant from the first source of water to the belt, from the belt to the system of rollers, and from the system of rollers to the second source of water.

70. The method of claim 42, wherein the belt does not extend past an apex at a position between the first source of water and the second source of water, and wherein the apex is coupled to the second source of water by a second conveyor belt, and wherein the method further comprises transferring a participant from the first source of water to the belt, from the belt to the second conveyor belt, and from the second conveyor belt to the second source of water.

71. The method of claim 42, wherein the belt reaches an apex at a position between the first source of water and the second source of water, wherein the belt is substantially angled in an upward direction from the first source of water toward the apex, and wherein the belt is substantially horizontal from the apex toward the second source of water, and further comprising facilitating movement of a rider from the upslope of the conveyor to the apex using a carryover arm.

72. The method of claim 42, wherein the belt comprises a width such that only a single participant enters the system at the same time.

73. The method of claim 42, wherein the belt comprises a width such that at least two participants enter the system at the same time.

74. The method of claim 42, further comprising positioning the participants in a predetermined configuration prior to moving onto the belt using at least one floating queue line positioned within the first source of water upstream from the belt.

75. The method of claim 42, wherein the conveyor belt speed is between about one foot per second and about five feet per second.

76. The method of claim 42, wherein the angle of ascent of the conveyor belt does not exceed 18%.

77. The method of claim 42, further comprising varying the tension of the belt against a roller using a tension unit coupled to the belt.

78. The method of claim 42, further comprising inhibiting participants from leaving the belt as the participants are conveyed along the belt using a barrier positioned on each side of the belt.

79. The method of claim 42, wherein the conveyor belt system further comprises a plurality of barrier position along the belt, wherein the barriers are configured to define channels along the belt, and wherein participants move along the belt within the defined channels.

80. The method of claim 42, further comprising moving a floatation device from a position substantially adjacent to the belt onto the belt using a lateral transfer system coupled to the belt.

81. The method of claim 42, wherein the participant is riding on a floatation device.

82. The method of claim 42, further comprising:

rotating at least two rollers coupled to the belt such that rotation of the rollers causes the belt to move around the rollers; and supplying a rotational force to at least one of the rollers using a power supply coupled to at least one of the rollers.

83. The method of claim 42, wherein an infeed end of the belt extends below a surface of the first source of water.

84. The method of claim 42, wherein the first source of water comprises a discharge end of a first water amusement ride, and wherein the second source of water comprises an infeed end of a second water amusement ride.

85. The method of claim 42, further comprising a controllable obstruction configured to be moved from a lowered position to a raised position, and to positions in between the lowered and raised positions, wherein when the controllable obstruction is in the raised position the controllable obstruction is configured to substantially inhibit the flow of water and/or participants through at least a portion of the system.

* * * * *